United States Patent [19]

Ostrowiecki

[11] Patent Number: 4,852,695

[45] Date of Patent: Aug. 1, 1989

[54] ELEVATOR CONTROL SYSTEM

[76] Inventor: Morris Ostrowiecki, 5-21-11 Jingumae, Shibuya-ku, Tokyo, Japan

[21] Appl. No.: 785,804

[22] Filed: Oct. 9, 1985

[51] Int. Cl.[4] ..... B66B 1/18

[52] U.S. Cl. ..... 187/121

[58] Field of Search ..... 187/121, 125, 126, 139; 379/104

[56] References Cited

U.S. PATENT DOCUMENTS 3,924,071 12/1975 Pirnie, III ..... 379/104

4,087,635 5/1978 Vasquez ..... 379/104 X 4,431,086 2/1984 Moser et al. ..... 187/121 X

*Primary Examiner*—William M. Shoop, Jr.

*Assistant Examiner*—W. E. Duncanson, Jr.

[57] ABSTRACT

The present invention relates to an elevator control system and more particularly, to a control system which allows the users thereof to enter a request for the elevator directly from their respective office rooms or their respective suites in a building. A first embodiment comprises a single car elevator control system, a second embodiment comprises a multi-car elevator control system and a third embodiment comprises a private elevator control system.

27 Claims, 61 Drawing Sheets

FIG. 4A
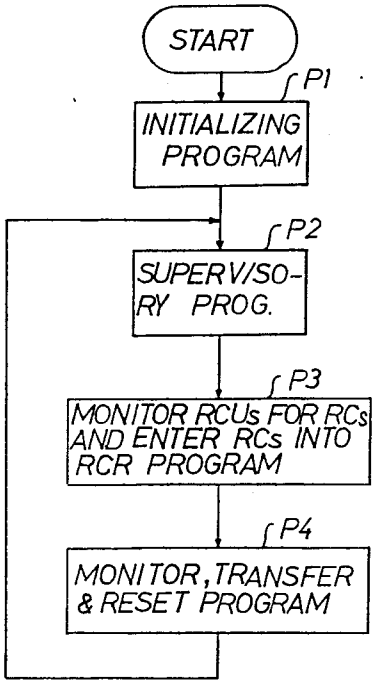
FIG. 4B
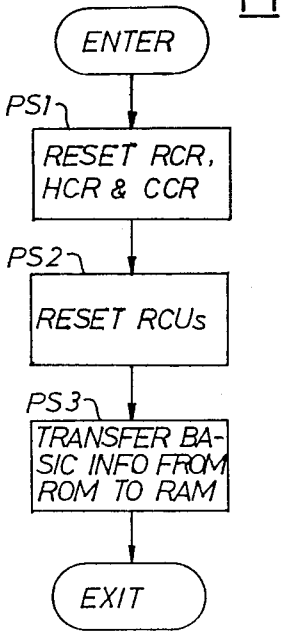
FIG. 4C
| |
|---|
| V = 0m/sec. |
| F1 = 0 m. |
| F2 = 3 m. |
| F3 = 6m. |
| F4 = 9m. |
| ---- |
| Fn= |
| Ts = 5sec. |
| ---- |

FIG. 7C P4A
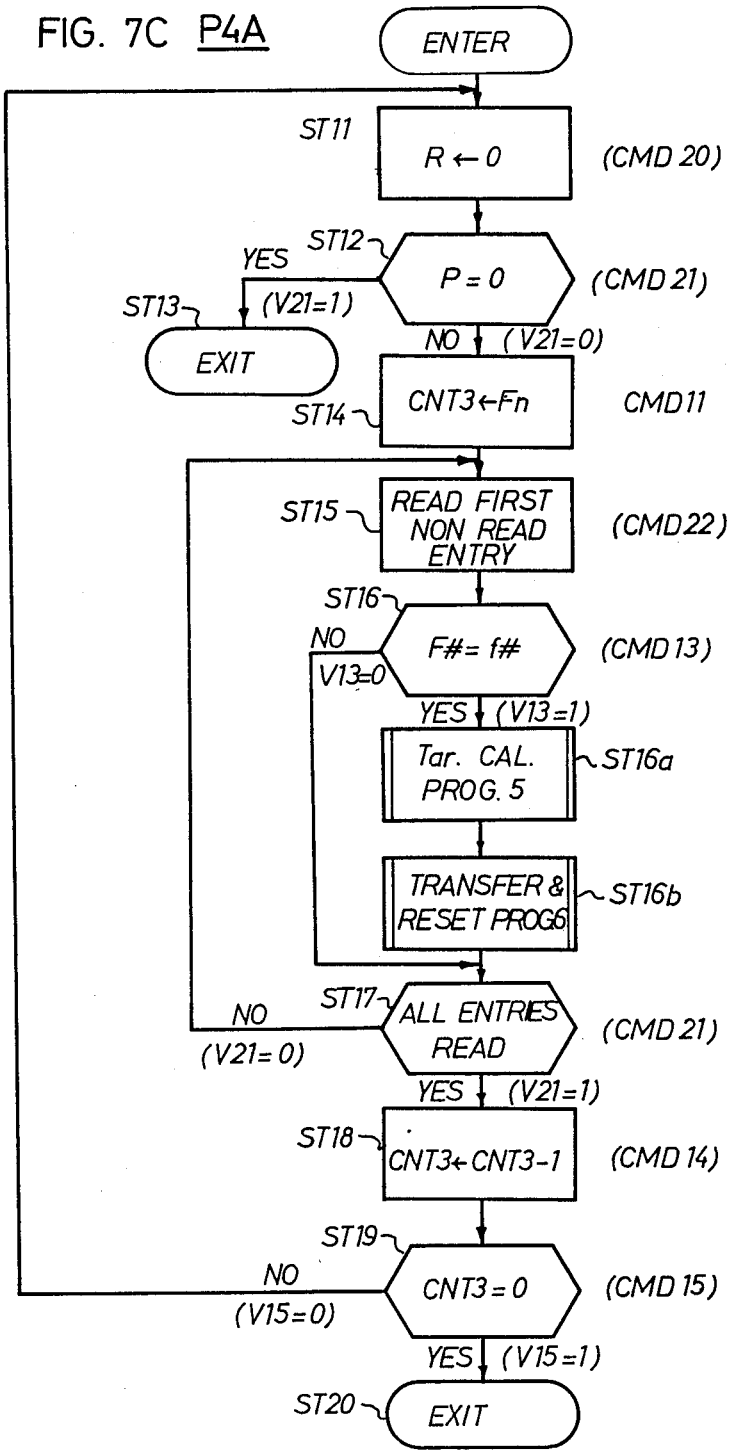

CMD
CMD 0
CMD7
CMD18
CMD19
CMD17
CMD16
CMD170
CMD14
CMD11
CMD12
CMD13
CMD10
CMD15
CLK
R
CNT3
MSB
Tr'
Td''
Td
Tp
Treq
(r1''-rm'')
(r1'-rm')
(f2''-fn'')
(f2'-fn')
(f2-fn)
f#
Q1
Q2
Qr
Q(r-1)
C11
C12
C1r
C84
V15
V13
V10
H53
H52
H55
H51
H62
H6r
H61
H32
H3r
H41
H42
H4r
H11
H12
H1r
H21
H22
H2r
D41
D42
D4r
D51
D52
D21
D22
D2r
E41
E42
E4r
E31
E32
E3r
E21
E22
E2r
E11
E12
E1r
F41
F42
F4r
F31
F32
F3r
F21
F22
F2r
I11
I12
I1r
I21
I22
I31
I32
I41
I42
I43
I44
I22
I21

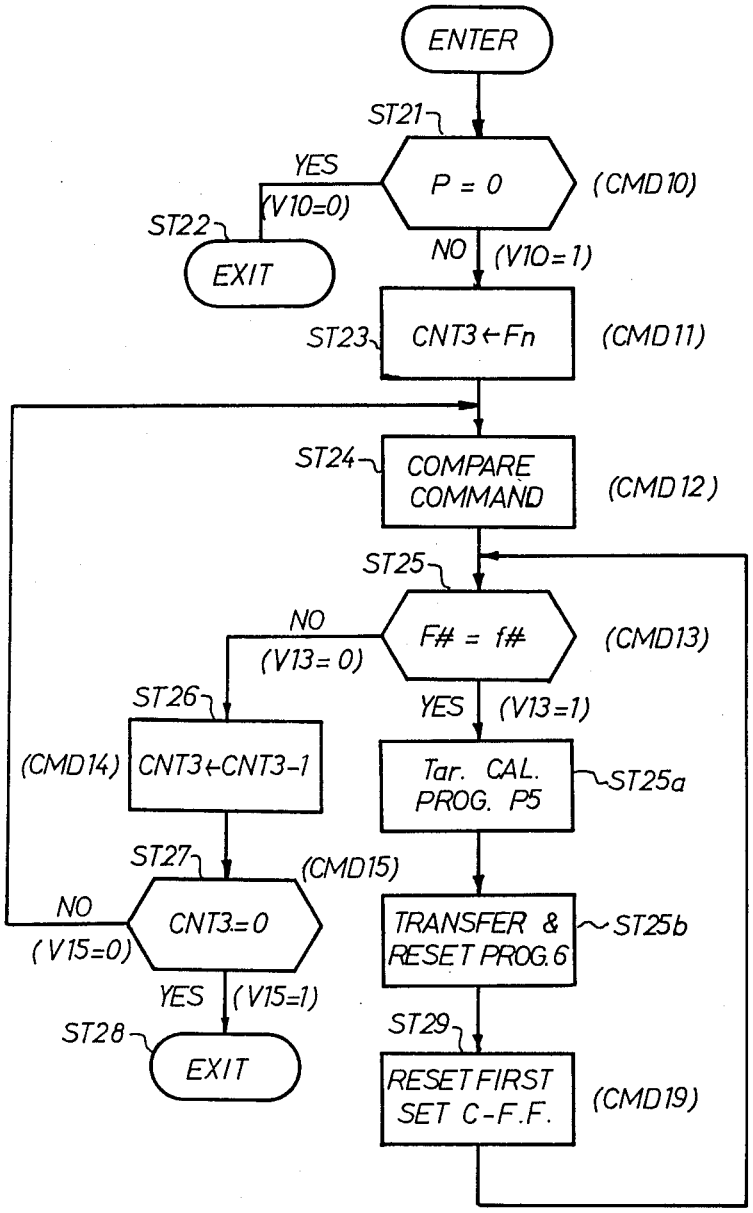
FIG. 8C P4B

P6B

FIG. 12 P6A
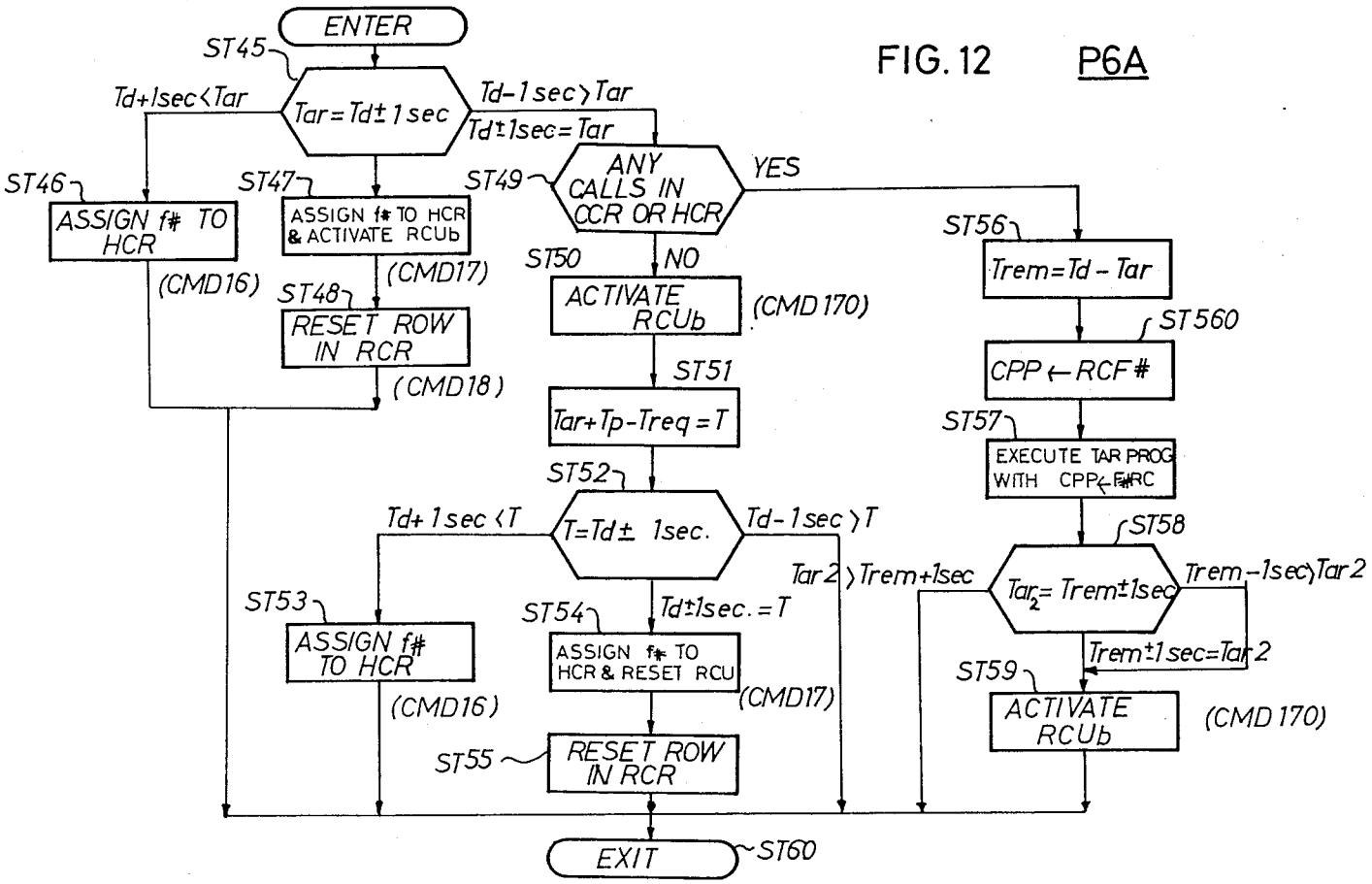

44

P2

390
CAR#
(C1-Cl)
CMD32
CMD0
CMD37
CMD40
CMD41
V40
V41
V37
CNT4
CMD34
CMD33
CMD35
CMD36
F/F3
CLK
HLFn
HLFn-1U
HLFn-1D
HLF2U
HLF2D
HLF1U
HLF1D
HnD
HnU
Hn-1D
H2U
H2D
H1U
Vcc
SHFnD
RHFnD
SHFn-1U
RHFn-1U
SHFn-1D
RHFn-1D
SHF2U
RHF2U
SHF2D
RHF2D
SHF1U
RHF1U
QHFn-1U
QHF2U
QHF1U
QHFnD
QHF3D
QHF2D

410a

372

372

371A
Vcc
d1C1
d1C2
d1C1
SSC1Fn
SSC1F3
SSC1F2
SSC2Fn
SSC2F3
SSC2F2
SSC1Fn
SSC1F3
SSC1F2
11n
11c
11b
13n
13c
13b
12n
12c
12b
F#(1)
F#(2)
F#(r)
F#
fn
f3
f2
21an
21bn
21ln
21ac
21bc
21lc
21ab
21a
21bb
21b
21lb
21l
CAR#
C(1)
C(2)
C(r)
C1
C2
31l
31b
31a
41a
RES1
22an
22bn
22ln
22ac
22bc
22lc
22ab
22a
22bb
22b
22lb
22l
32l
32b
32a
41b
RES2
2ran
2rbn
2rln
2rac
2rbc
2rlc
2rab
2ra
2rbb
2rb
2rlb
2rl
3rl
3rb
3ra
41r
RESr

371B

391

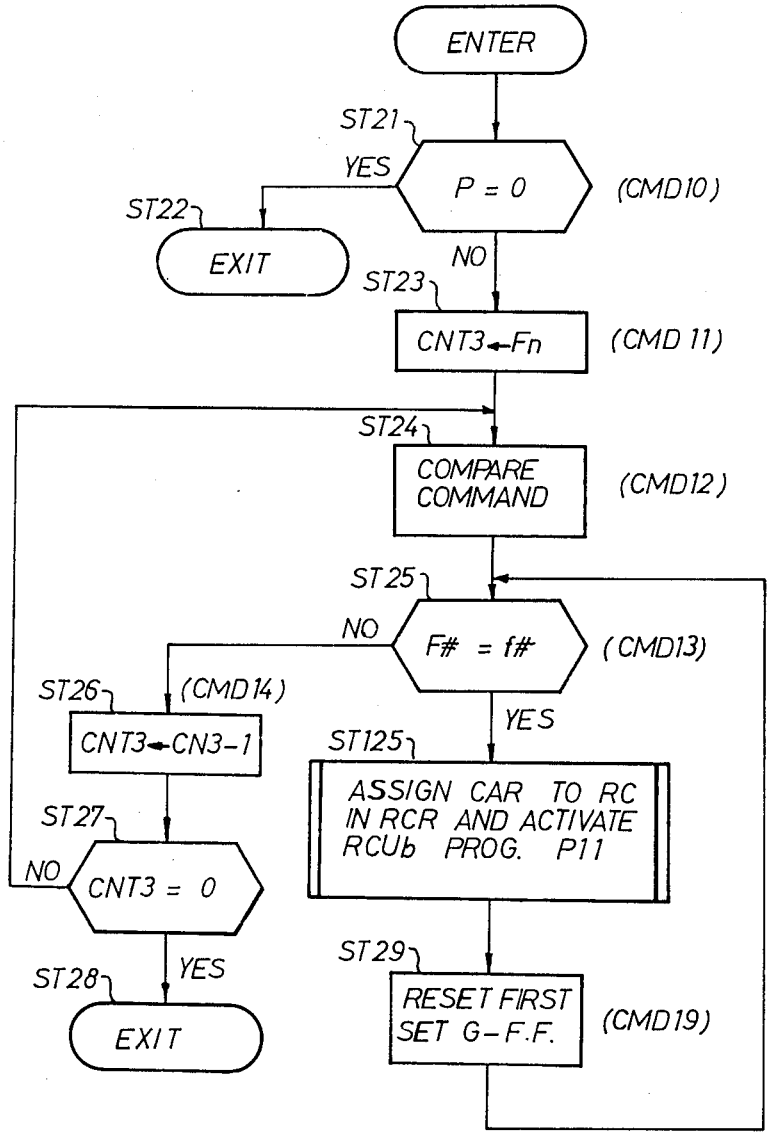
FIG. 23 P9

P11A

P11B

P11C

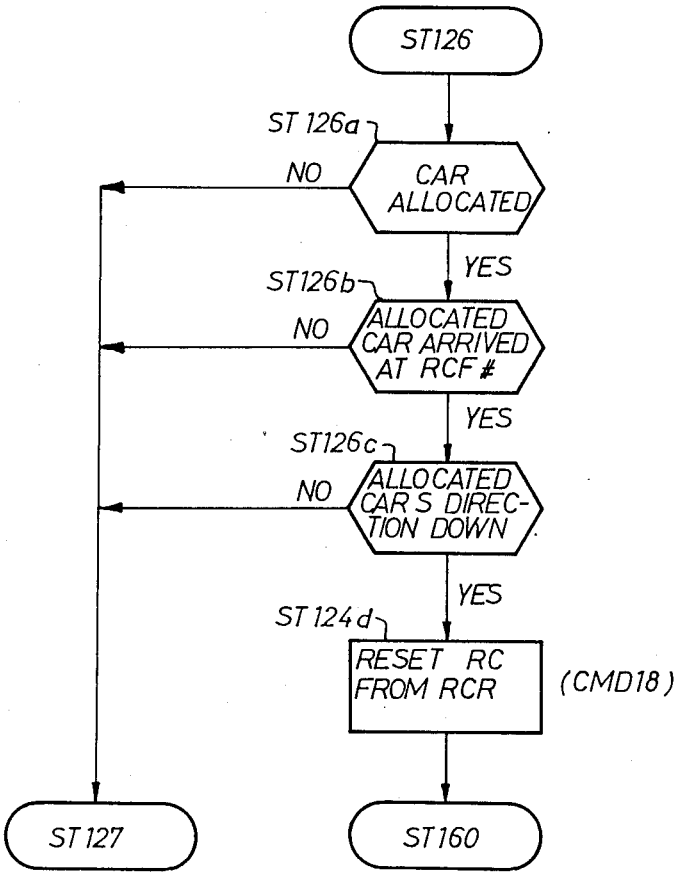
FIG. 24D P11D

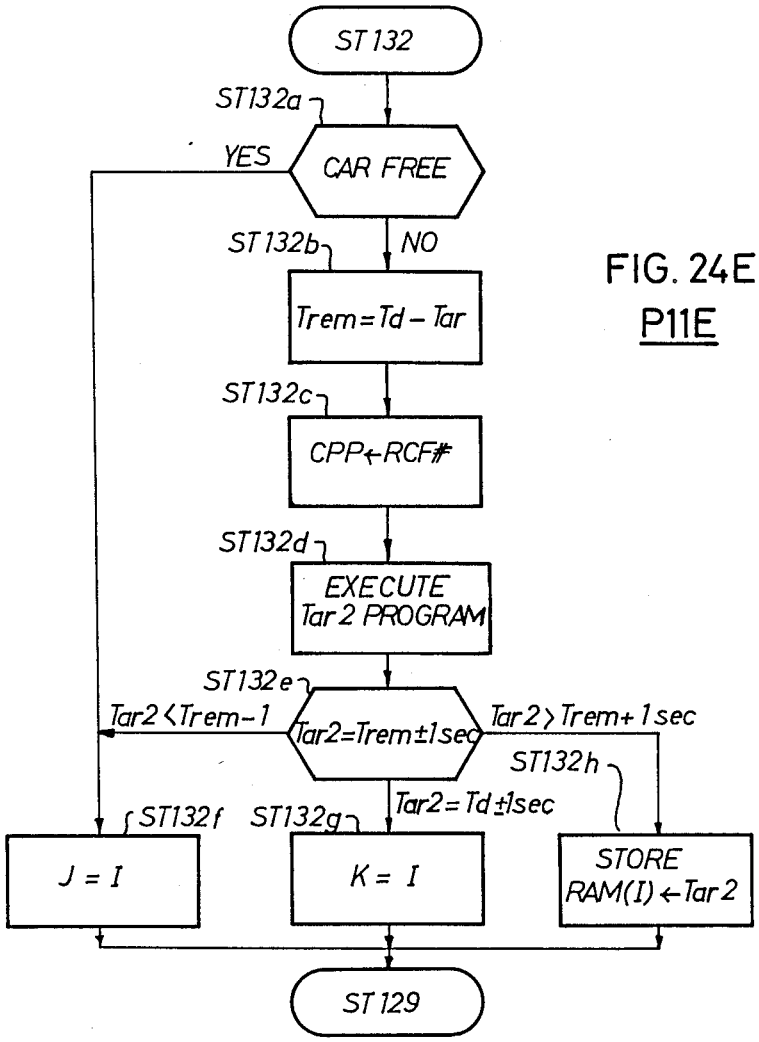
FIG. 24E
P11E
FIG. 24F
P11G
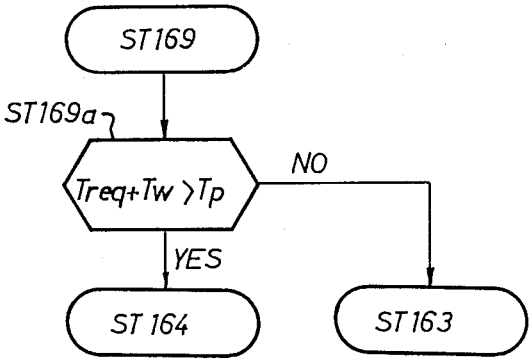

P8

P10

P7

FIG. 32
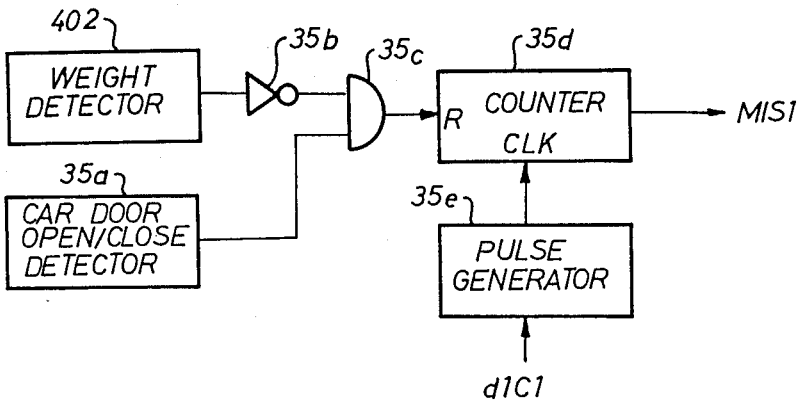
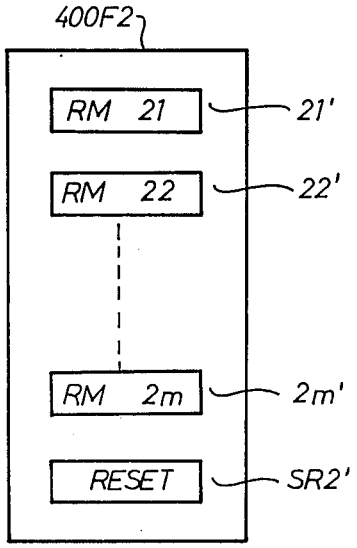
FIG. 31

401

4100

FIG. 36B P33
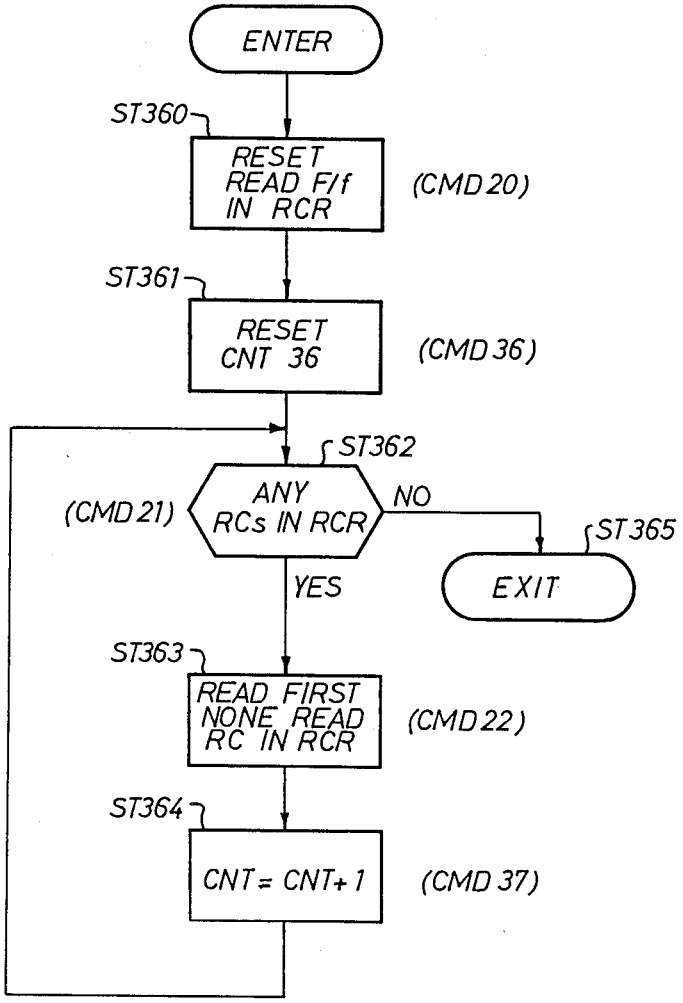

P30

P34

P31

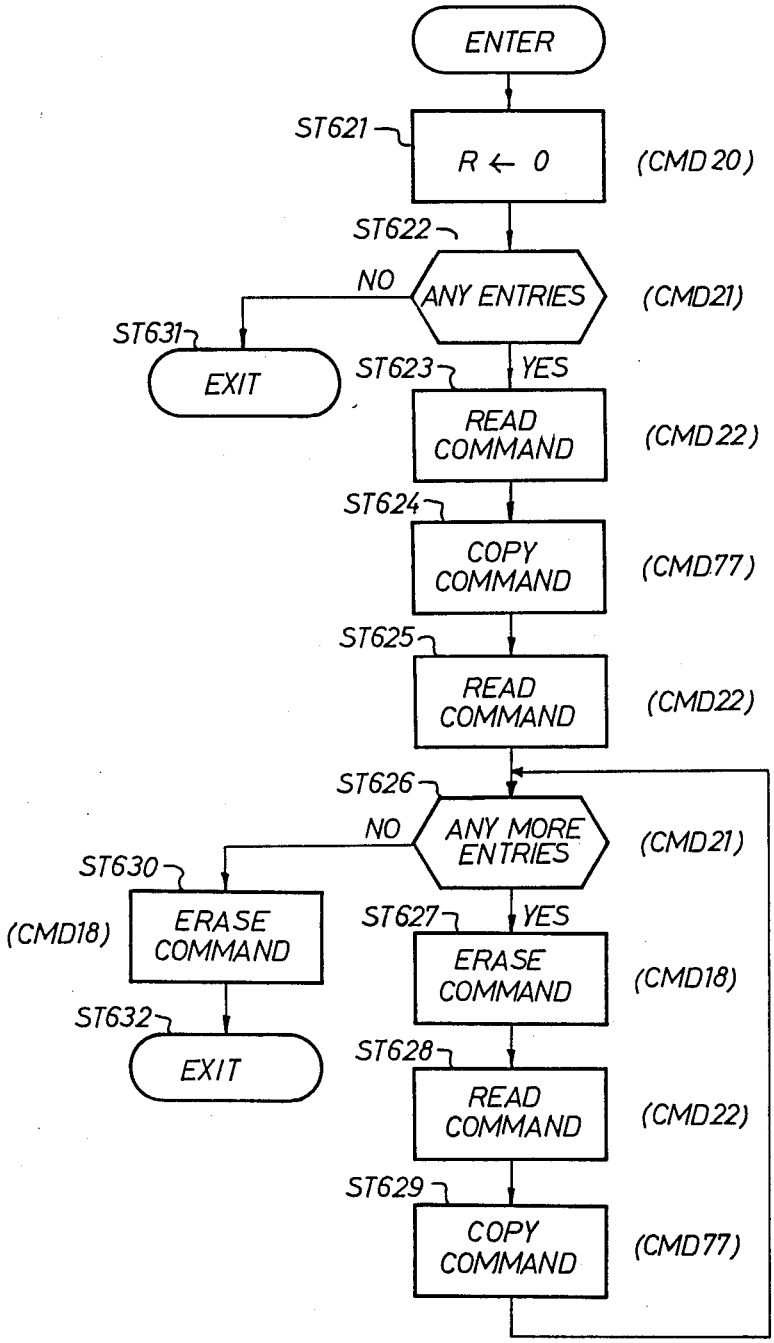
FIG. 39B P35

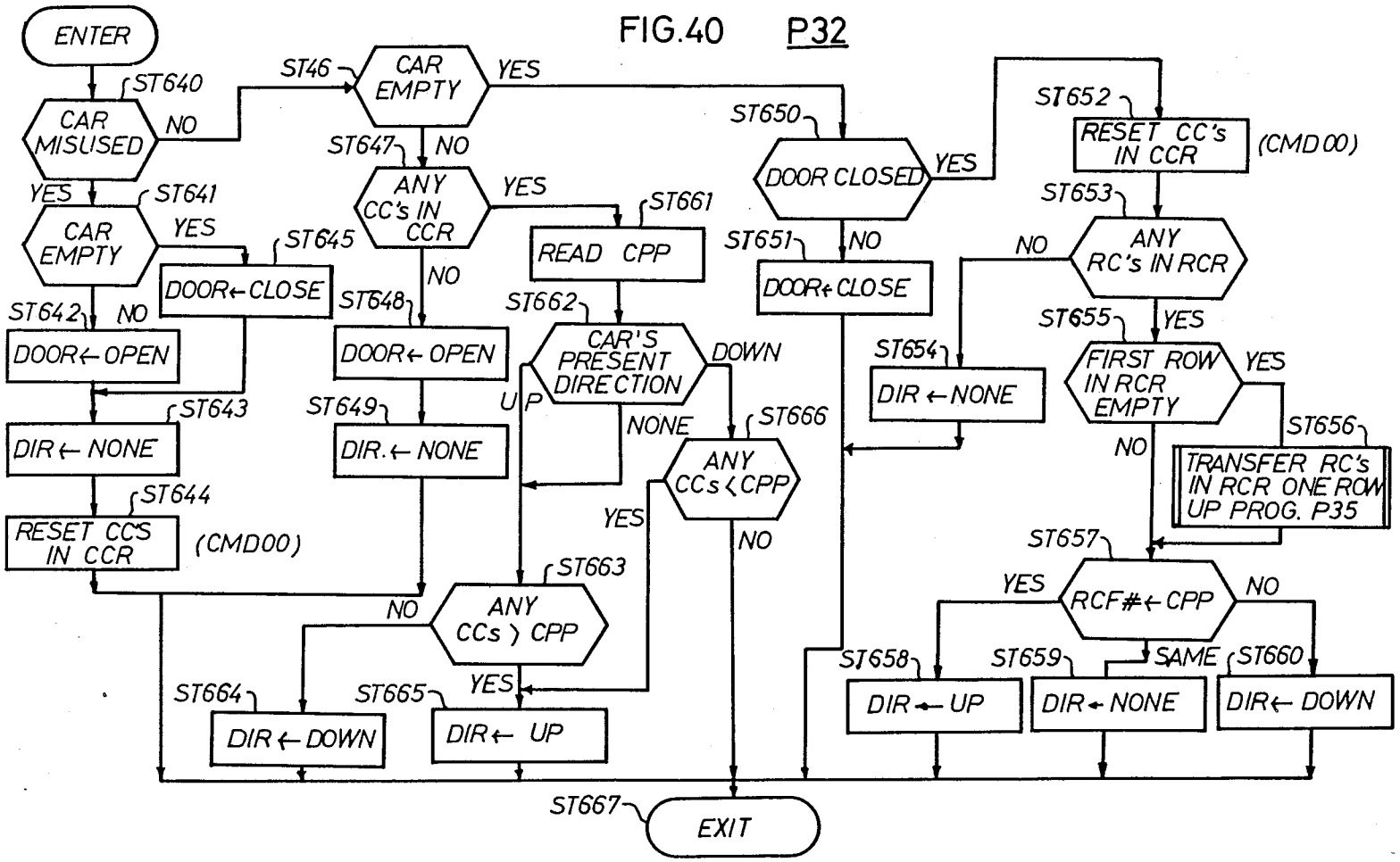
FIG.40 P32

ELEVATOR CONTROL SYSTEM

BACKGROUND OF THE INVENTION

The present invention relates to an elevator control system and more particularly to an elevator control system which enables users to enter calls directly from their suites or from their office rooms in a building.

Presently, in order to utilize an elevator car, a person must first enter a hall call from a respective activating device located in the hall. However, the in these conventional systems the operator has no way of indicating in advance to the elevator control system that he or she would like to utilize the elevator control system in advance of their arriving at the hall of the elevator car. Neither does the system have any way of knowing that an operator is planning to soon utilize the elevator car in advance of their registering a hall call at the time of their arrival at the hall of the elevator car, and, accordingly, not only must the operator spend more time in the hallways of the building, but the supervisory system of the elevator cannot utilize the information in advance so as to provide better supervision of the car or cars as well as to provide faster and better service. Further, the operator has no way of knowing when an elevator car is going to be available at the floor that he or she lives on.

SUMMARY OF THE INVENTION

A major object of the present invention is to overcome the drawbacks mentioned above.

Basically, three embodiments are shown in which a single elevator system, a multicar elevator system and a private car elevator control system are disclosed, all the systems having room call units for entering room calls directly from the rooms of a building for informing the system in advance of the arrival of the operators of the units at the elevator halls that the respective operators are planning to utilize the car.

These and other advantages will become apparent from the following description when thaken in conjunction with the following drawings:

BRIEF DESCRIPTION OF THE DRAWINGS

FIG. 4A shows programs utilized with the Single Car Elevator Control System;

FIGS. 4B and 4C show an initializing program P1 in more detail;

FIG. 7C shows a Monitor, Transfer and Reset Program P4A to be utilized with the RCR 37A;

FIG. 8C shows a Monitor, Transfer and Reset Program P4B to be utilized with the RCR 37B;

FIG. 12 shows a Transfer and Reset Program P6 according to the present invention;

FIG. 23 shows a monitor for RCs in the RCR, assign CAR# to RC in RCR and activate RCUb program P9 of the multiple car elevator control system;

FIG. 31 shows a misuse detector of the private elevator control system according to the present invention;

FIG. 32 shows a front view of a panel 400F2 located in the second floor hall of a building for entering CODE# of the private elevator control system according to the present invention;

FIG. 36B shows a determine RCs waiting number program P33 of the private elevator control system according to the present invention;

FIG. 39B shows a transfer RCs in RCR up one row program P35 of the private elevator control system according to the present invention; and FIG. 40 shows a supervisory program P32 of the private elevator control system according to the present invention;

In the drawings the same reference numerals designate the same or corresponding parts.

DETAILED DESCRIPTION OF THE PREFERRED EMBODIMENTS

Figure 1:
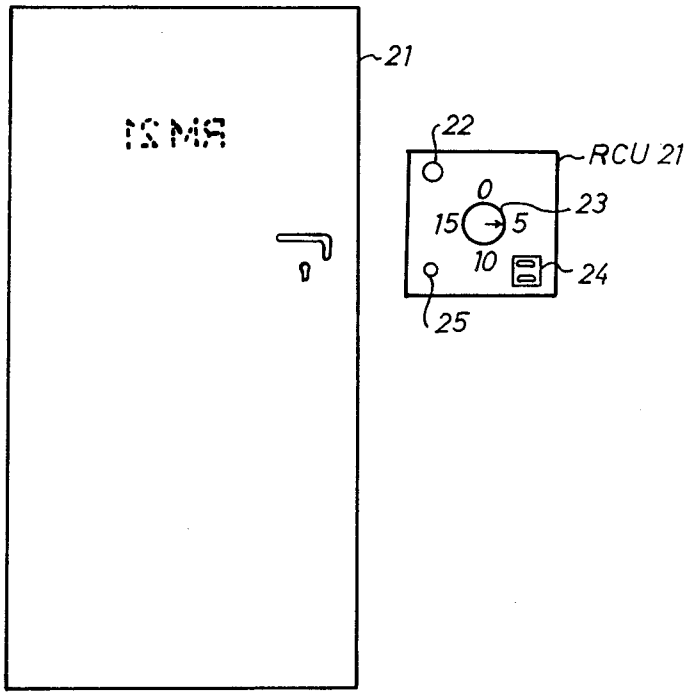
FIG. 1 shows a front view of a room control unit RCU according to the present invention.

FIG. 1 shows a room control unit RCU21 (hereinafter referred to as RCU RCU21) placed inside a suite RM21 next to the entrance door 21 of the suite. The RCU RCU21 comprises an actuation means 22 such as a push button, which, when pressed (hereinafter referred to as RC) by a person inside the suite (hereinafter referred to as an operator), informs the elevator control system that an elevator car is desired by the operator at the floor that the suite is on, a visual indicating means 25 which lights upon activation of the push button 22 for providing a visual indication to the operator that the unit is activated, a timer 23 having settings from 0 to 20 sec. for allowing the operator to inform the system the time Td from the time he presses the button that he desires to use an elevator car (hereinafter referred to as the desired time Td) and an audio indication means 24 such as a buzzer, which is automatically activated by the elevator control system, for informing the operator that an elevator car will arrive at his floor at a time:

$$Tar = Tb + Td$$

where:

Tar is the time that an elevator car will be available in the elevator hall at the floor of the suite that the RCU was activated;

Tb is the time that the buzzer sounds; and

Td is the desired time as set on the timer.

The reason the buzzer 24 is included is that, although the operator may desire to use an elevator car at a time Td from the time that he has pressed the push button 22, an elevator car may not be available by that time due to the car being to far to reach the operator's floor in time or due to the car being accupied during that time by other people or both. Accordingly, the inclusion of the buzzer 24 allows the elevator control system to inform the operator that an elevator car will be available at his floor at a time Td as set on the timer 24 from the time the buzzer 24 sounds Tb.

When using the RCU RCU21, the operator first determines the time Td that he desires an elevator car with respect to the present time Tp. In calculating the desired time Td, the operator may consider such variables as the time that he requires to put his shoes on, kiss his girl friend or wife or both good bye, lock the door and the time it takes him to walk to the elevator hall from his particular suite. Second, the operator than sets the timer 23 to the desired time Td. Third, the operator than depresses the push button 22, thereby indicating to the elevator control system that an elevator car is desired at a time Td from the present time Tp (i.e. the time that the operator depresses the button 22) as set on the timer 23. Fourth, the operator either waits for the buzzer 24 to sound, thereby indicating to the operator that an elevator car will be available at the elevator hall of his respective floor at the time Td as set on his timer from the time the buzzer sounds, or proceeds to the elevator hall without waiting. If the operator desides to wait for the buzzer 24 to sound, the operator knows exactly the amount of time he has before an elevator car will be available at his floor, thereby saving him the need to wait in the elevator hall. Further, since the operator may inform the system directly from his room that he desires to use the elevator, the operator can inform the elevator system in advance of his arrival at the elevator hall that he desires to use the elevator system, thereby possibly providing him with faster service as well as providing a group supervisory system of the elevator control system with the information that the operator wants to utilize the elevator in advance as compared with the time if the operator had gone to the elevator hall and pushed a respective hall button, thereby allowing the group supervisory system to process the information representative of passenger demand that much more in advance. For example, assuming the following situation occurred:

1. A first operator living on the fourth floor sets his RCU's timer at 20 sec. (i.e. Td1=20 sec.) and activates it at time T1;

2. A second operator living on the six floor sets his RCU's timer at 5 sec. (i.e. Td2=5 sec.) and activates it at time T2; and 3. Assuming that the car has no calls assigned to it, that it is waiting for calls to be assigned to it at the first floor F1, that it takes the car 4 and 6 sec. to go from the first floor to the fourth and six floors, respectively, that it takes the car 2 sec. to go from the six floor to the fourth floor and that it would require an average of 5 sec. to service any floor (i.e. it would take 5 sec. to open the car door, allow a waiting person to enter the car and close the door again) and that T2=T1+7 sec. (i.e. the second operator activated his RCU 7 sec. later that the first operator activated his RCU, respectively).

According to the above conditions, the elevator control system of the present invention can be programmed to service the above calls as follows:

1. At time T1, since it only takes the elevator car 5 sec. to arrive at the forth floor and since the first operator has set his timer to 20 sec., the elevator control system can:

(a) activate the buzzer of the RCU of the first operator at time T1, thereby informing the first operator that the car will be available at his floor in 20 seconds; and (b) instruct the car to wait at the first floor F1 for the time being before proceeding to service the fourth floor, since it only takes 4 sec. to arrive at the 4'th floor and since the first operator wants to utilize the car in 20 sec.;

2. At time T2, when the second operator activates his RCU the elevator control system can:

(c) Instruct the elevator car to start traveling towards the six floor at time T2, since the second operator set his timer to 5 sec. and it takes 6 sec. to arrive from F1–F6;

(d) When the car travels to a point in the elevator shaft which is only 5 sec. away from reaching the six floor, the elevator control system activates the buzzer of the RCU of the second operator;

3. Upon arrival of the car at the six floor, instruct the car to service the six floor F6 (the second operator by this time should be waiting in the hall way ready to be serviced);

4. If the second operator enters the car during the service time, except any car call in the down direction, and instruct the car to service the first operator on the fourth floor on the down;

5. If the second operator does not enter the car within the service time, instruct the elevator to proceed to service the fourth floor;

6. Upon arrival at the fourth floor, instruct the car to service the first operator.

Accordingly, the second operator is serviced by the car at time T2+Td2+1 sec. (since it took 6 sec. to go from F1–F6). Further, the first operator is serviced at Ts=T1+7+6+5+2 (namely, the time T1+the time T2 from the time T1 that the second operator activates his RCU+the time it takes the car to travel from the first floor to the six floor+the time it takes to service the six floor+the time it takes the car to travel from the six floor to the fourth floor)=T1+20 sec.=T1+Td1, which is exactly the desired time Td1 that the first operator has set his timer to.

However, had the control system of the present invention not been available and assuming the same conditions as stated above, namely that the first and second operators activated the fourth and the six hall buttons at time T1 and T2, respectively, the car would have been instructed to service the first person on the fourth floor immediately and would service the fourth floor at time T1+4 sec. which is earlier than T2, and assuming that the first operator activates the car in the down direction, the second operator would have to wait for the next time the car is available in the up direction before being able to utilize the car, thereby requiring two runs to service the calls, whereby electricity and the operators time is waisted as well as putting more milage on the elevator system, thereby increasing the wear thereof.

Still further, since the operator may not want to be seen in the hall by others or, in the case of women especially, may want to spend as little time in the hall way as possible due to potential rapists, etc., the control unit of the present invention informs the operator of the exact time that an elevator car will be available.

It should be noted here that, depending on the software programming included, will determine whether operators will be serviced at the exact time Td after their respective buzzers sound or may in some cases be serviced at a delayed time. For example, in the above embodiment, had the second operator registered a down call for floor F5, the car would have had to stop at the fifth floor and accordingly, the first operator on the fourth floor would be inconvienced in that he would have to wait a little longer. This situation of course is no different then the type of service one can expect from presently available systems. This drawback can however be alleviated by assigning to the car only one room call (i.e. a call entered through a RCU hereinafter reffered to as RC) at any given time and only after that RC is serviced (i.e. only after the system detects that there are no RCs, hall calls (i.e. calls entered from the hallway activation means hereinafter referred to as HCs) or car calls (i.e. calls entered through the activation means inside a car, hereinafter referred to as CCs)), does the system allow the next chronologically registered RC to be assigned to the car. In this way, each operator is guaranteed of getting serviced at the exact time specified by him as set on the timer of his control unit. This would of course result in a general slower service during large demand times (i.e. 8 am or 6 pm). Accordingly, such a system can be programmed to operate only during night hours wherein the elevator car is controled to operate as in a presently available elevator system during the day time and the RCUs are functional (i.e. can be activated) only during the night time. It should be further noted that when a multi-car elevator system is availabe, the delayed service mentioned above can be minimized by continuously monitoring the present position of each car and continuously assigning and reassigning each RC to different car numbers such that each RC is continuously assigned to the car which, at the time of assigning (i.e. the time the CPU executes the respective program which examines and re-assigns car numbers to RCs) is closest to and which cannot arrive at a time less than the desired time Td specified by that RC.

Figure 2:
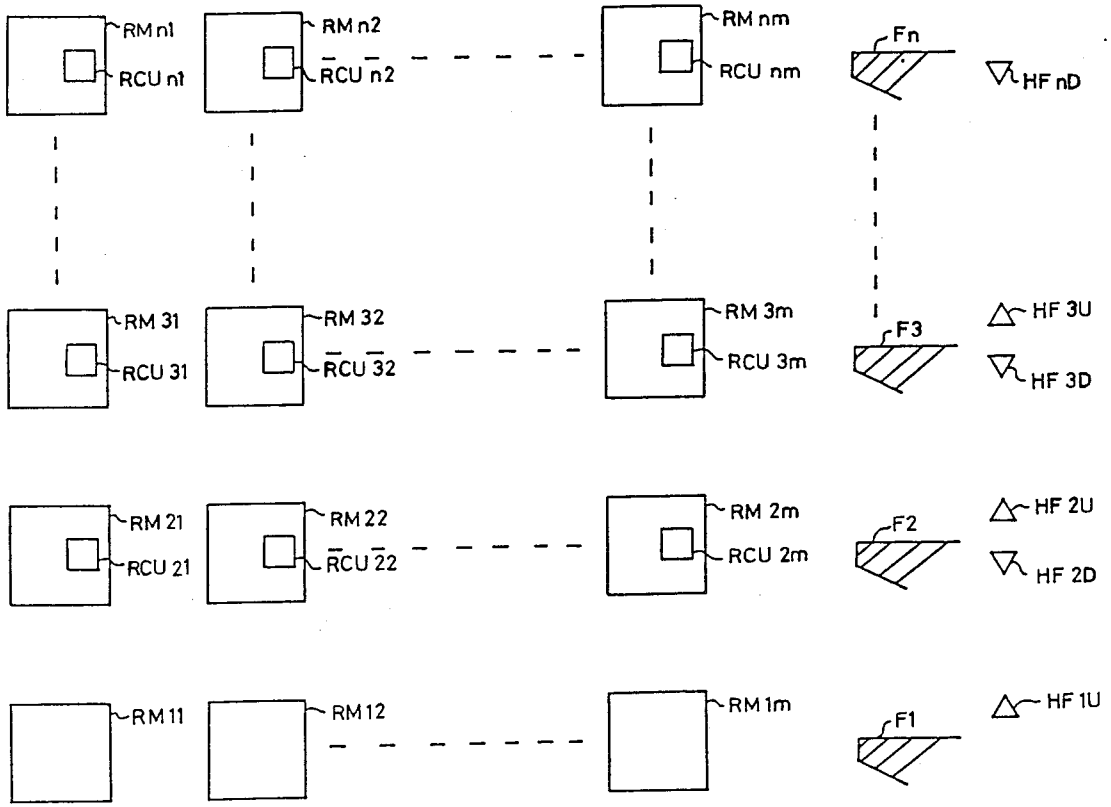
FIG. 2 shows a distribution layout of the RCUs in a building.

FIG. 2 shows a diagram of the RCUs in the respective suites on the respective floors of a building. The building is assumed to have m rooms per floor and n floors.

RCUs RCU21–RCU2m are located in respective suites R21–R2m on floor F2, RCUs RCU31–RCU3m are located in rooms R−14 R3m on the third floor, . . . , and RCUs RCUn1–RCUnm are located in suites Rn1–Rnm on the n'th floor, respectively. No RCUs are available on the first floor because the push buttons 22 of the RCUs are only for informing the elevator control system that an operator desired to utilize an elevator car in the down direction. Also shown in the Fig., are up and down hall push buttons HF1U, HF2D and HF2D, HF3D and HF3U, and HFnD located in the elevator halls F1, F2, F3, . . . and Fn, respectively.

FIG. 3 shows a block diagram of a single car elevator control system according to the present invention. In the Fig., numerals RCU21–RCUmn designate the room control units (hereinafter referred to as RCUs) which are located in the respective rooms R21–Rmn, respectively, numeral 30 designates a multiplexer, numeral 31 a central processing unit (hereinafter referred to as a CPU), numeral 32 a read only memory (hereinafter referred to as a ROM), numeral 33 a random excess memory (hereinafter referred to as a RAM), numeral 34 an arithmetic unit, numeral 35 car position detecting means for detecting the present postion of the car (hereinafter referred to as the CPP), numeral 37 a RC register (hereinafter referred to as a RCR), numeral 36 a clock for supplying the present time Tp to the CPU 31 and to the RCR 37, numeral 38 a group supervisory system (hereinafter referred to as GSS), numeral 39 a hall call register (hereinafter referred to as a HCR), numeral 40 a hall activating means such as the up and down buttons found in the hall of an elevator as designated by numerals HF1U–HFnD in FIG. 2, numeral 41 a car call register (hereinafter referred to as a CCR), numeral 42 a car activating means such as the control buttons found in the car of an elevator car, numeral 43 car position detecting micro switches located in the shaft of the elevator car at respective floors of the building, numeral 44 a logic control unit, numeral 45 a drive and control unit and numeral 46 an electric motor for driving the car of the elevator control system.

FIG. 4A shows a general flow chart of programs stored in the ROM 32 which are executed by the CPU31 to control the operation of the single car evevator control system shown in FIG. 3 according to the present invention. Referring to the Fig., numeral P1 designates an initializing program having pre-stored therein given variables pertaining to the elevator characteristics as well as to the particular characteristics of the building that the elevator system is installed, numeral P2 designates a supervisory program, numeral P3 designats a monitor RCUs for RCs and enter RCs into RCR program and numeral P4 designates a transfer and reset program. Programs P2–P4 will be described more fully later. The program P1 is only executed when the control system is first installed and the power turned on, while the programs P1–P4 are continuously sequencially executed by the CPU 31.

FIG. 4B shows in greater detail the contents of the initializing program P1. Referring to the Fig., after entering the program, at step PS1 a command CMD0 is issued by the CPU whioch causes the entries in the RCR, HCR and CCR to be reset. At step PS2 another CMD is issued by the CPU 31 which causes all the RCUs RCU21–RCUnm to be reset. (This is done by supplying a short pulse to reset lines FR21″–FRnm″ of the RCUs RCU21–RCUnm, respectively, as can be seen from FIG. 5A for RCU RCU21.) Next, a transfer basic information from ROM to RAM program PS3 is executed after which the initializing program P1 is exited.

Figure 5A:
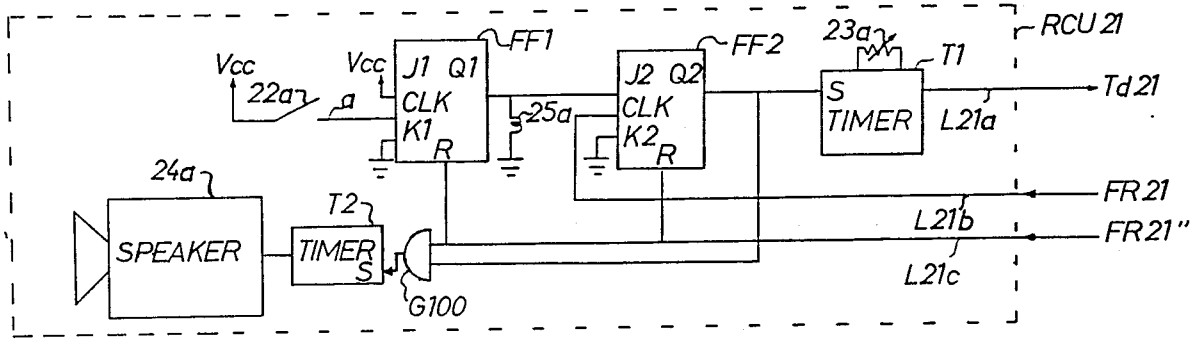
FIG. 5A shows a schematic diagram of a first embodiment of the room call unit according to the present invention.
Figure 5B:
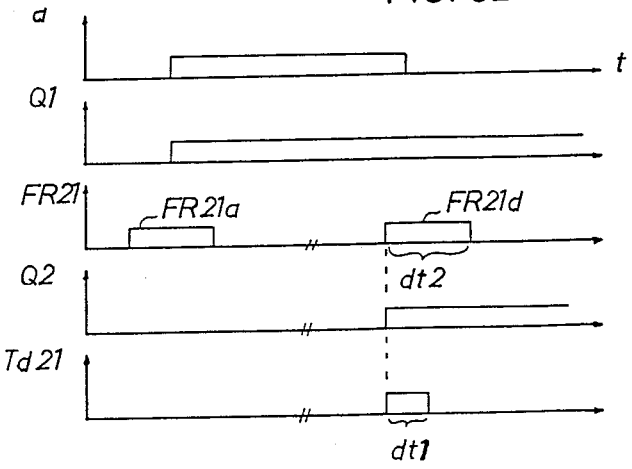
FIG. 5B shows a waveform diagram of waveforms provideed to and generated in the RCU21 shown in FIG. 5A.

FIG. 4C shows some of the basic information of the program PS3 stored in the ROM 32 which is transferred by the CPU to the RAM33. Referring to the Fig., it can be seen that the table of information consists of the velocity of the car is V=1 meter/sec., that the first, second, . . . , and top floors F1, F2 . . . , Fn are located at 0,3, . . . , and 3n meters, respectively. FIG. 5A shows a schematic diagram of the RCU RCU21 according to the present invention and FIG. 5*b* waveform diagrams thereof. In the Fig. numeral 22*a* designates a normally open switch which closes upon the depresion of the push button 22, numeral FF1 and FF2 designate positive edge triggered J–K flip flops, numeral T1 and T2 designate timers, numeral 23*a* designates a variable resistor corresponding to the timer 23, numeral 24*a* a speaker corresponding to the buzzer 24, numeral 25*a* a light bulb corresponding to the light indicating means 25 and numeral G100 and AND gate. Numerals Td21, FR21 and FR21″ are signals appearing on lines L21*a*–L21*c* of a line L21, respectively, which connect the RCU RCU21 to the multiplexer 30. FIG. 5B is a waveform diagram illustrating electrical waveforms at different points of the RCU RCU21. In operation, when an operator depresses the push button 22, the switch 22*a* momentarily closes causing a voltage Vcc to appear at the clock input CLK of the J–K flip flop FF1. Since the J1 and K1 inputs of the flip flop FF1 are connected to Vcc and ground, respectively, the output Q1 of the flip flop FF1 goes high and stays high, thereby causing bulb 25*a* to light and the J2 input of the flip flop FF2 to go high. However, even though the J and K inputs of the flip flop F2 are high and low, respectively, when the output Q1 goes high, the output Q2 of the flip flop FF2 stays low until the FR21 signal on line L21*b*, which is connected to the CLK input of the flip flop FF2, goes high. The FR21 signal is a sampling signal provided periodically by the multiplexer 30 to check if activation means 22 of the RCU RCU21 has been depressed. Similar signals are sequencially provided by the multiplexer 30 to the other RCUs RCU22–RCUmn to similarly check if their respective push buttons 22 have been activated. The output Q2 going high causes the set input of the timer T1 to go high which triggers the timer T1 causing its output to go high for a period of time dt1 determined by the setting of the variable resistor 23*a*.

It should be noted that the longest period of time that the output of the timer T1 is high, as set by the resistor 23*a* is designed to be less than the sampling time dt2 of the sampling signal FR21, as designated in the wave-from diagrams by dt1 and dt2, respectively. This ensures that the entire duration during which the signal Td21 from the timer T1 is high is sampled and is inputted into the multiplexer 30 during the time that the sampling signal FR21 is present, regardless of the setting on the resistor 23*a*. Further, as can be seen from the waveform diagrams in FIG. 5*b*, should the switch 22*a* be pressed exactly at a time during which the sampling signal FR21 is already high, as in the case of waveform FR21*a*, since the flip flop FF2 is a positive edge trigger type flip flop, the output of the flip flop FF2 stays low until the next sample signal, as indicated by FR21*b*, appears, thereby ensuring that the signal Td21 of the timer T1 goes high exactly at the start of the sampling signal FR21 so as to ensure that the entire period during which the signal Td21 is high is sampled during one sampling of the sample signal FR21, namely that the output signal Td21 is synchronized with the sample signal FR21. This synchronization is necessary because of the fact that the time that the operator decides to press the push button 22 is indefinite.

The signal FR21" is a reset signal supplied by the multiplexer 30 for resetting the flip flops FF1 and FF2 as well as to activate the timer T2 which causes the speaker 24a to emit an audio sound for a short period i.e. 0.2 sec. Timers T1 and T2 are conventional monostables well known in the art.

Accordingly, as can be seen from the waveform diagrams in FIG. 5, activation of the switch 22a causes the output Q1 to go high simultaneously. The output Q2, however, goes high only when the sampling signal FR21 goes high while the output Q1 is high. The output signal Td21 from the timer T2 goes high simultaneously with the signal on the output Q2 going high and stays high for a duration as determined by the setting of the resistor 23a. The begining of the Td21 signal is thereby synchronized with the begining of the sampling signal FR21, thereby ensuring that the entire signal Td21 is inputed to the multiplexer 30 during one period dt2 of the sampling signal FR21.

It should be noted that the operator, once activating his RCU, should he decide to cancel his call, change the desired time Td he desires a car or to enter another call, in the above described embodiment, the RCU allows the operator to input another RC only after the RCU has been reset. The fact that the operator is not able to input another call till the unit is reset is advantages in that it prevents the operator from entering a large number of calls at the same time, thereby possibly incoveniencing other users. Another embodiment may further limit the number of calls the same user inputs by allowing the operator to input a succesive call only after the elevator car actually arrives at the respective floor.

However, other embodiments may further comprise means provided on the respective RCUs for manually resetting a previously entered call, should the operator decide not to use the car, or to modify the time that the evevator car is desired should be operator decide that he desires to utilize the car at an earlier or later time than he originally entered.

Figure 6A:
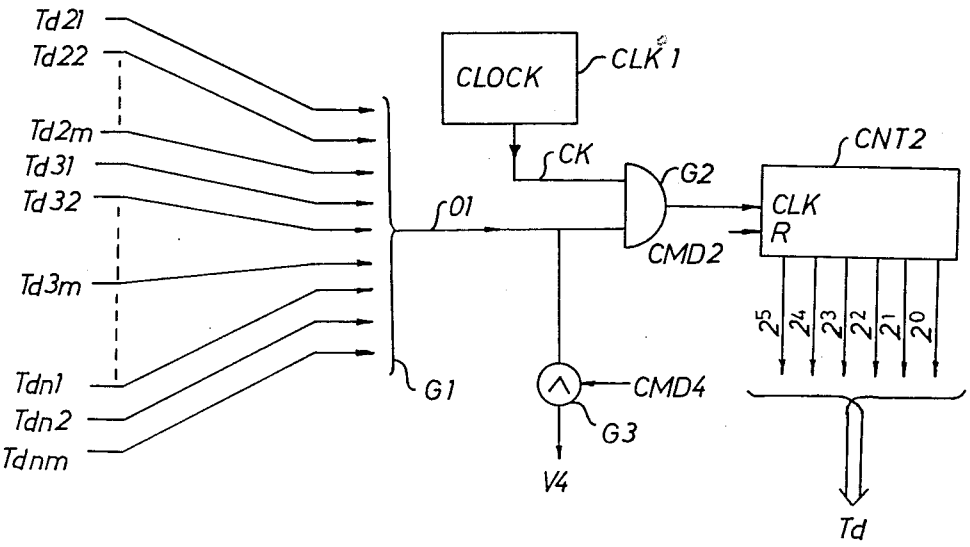
FIGS. 6A–6E show a schematic block diagram of a Multiplexer 30 utilized for generating sampling signals for the RCUs in the elevator control systems according to the present invention.

FIG. 6A shows a schematic block diagram of a first part of the multiplexer 30 according to the present invention. In the Fig., numerals Td21–Tdnm designate output signals from the RCUs RCU21–RCUnm, respectively, which are inputed into an OR gate G1. The output of the OR gate G1 is connected to the first input of an AND gate G2, the second input of which is connected to the output CK of a clock CLK1, which generates clock pulses. The output of the AND gate G2 connects to the input of a counter CNT2. The output of OR gate G1 also connects to one input of an AND gate G3, the other input of which receives a command signal CMD4 from the CPU. The output of the AND gate G3 is fed into the CPU for determining, when the command signal CMD4 goes high, whether or not the output signal of the RCU being sampled at that time is high. The counter CNT2 is a conventional binary counter well known in the art which counts in the sequence of 000000, 000001, 000010, 000011, etc.

Figure 6B:
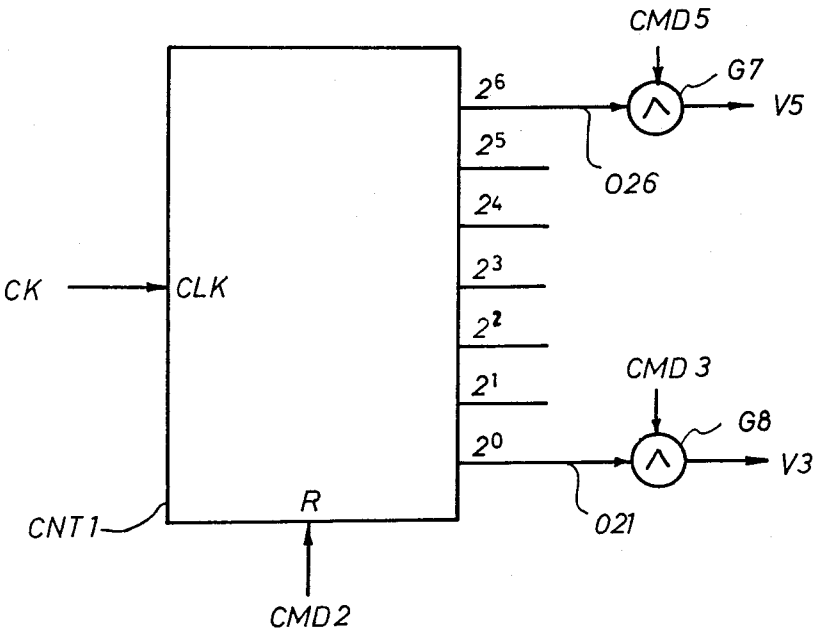
Figure 6C:
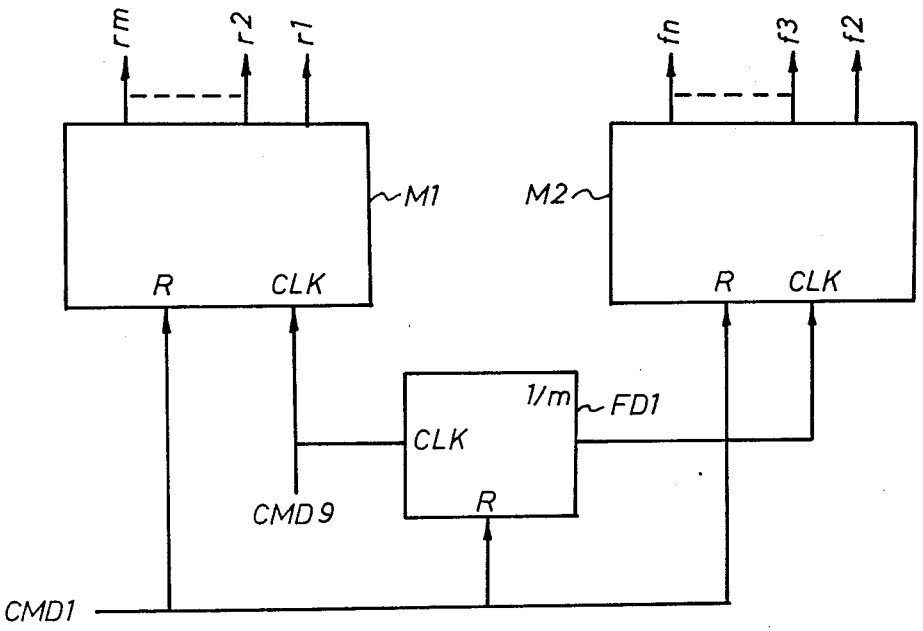

FIG. 6B and 6C show a schematic block diagram of a second part of the multiplexer 30 which is utilized to generate the sampling signals FR21–FRnm for the RCUs RCU21–RCUnm, respectively, according to the present invention. Referring to the Figs., numeral CNT1 designates a binary counter having seven outputs which, similar to counter CNT2, counts in the sequence of 00 . . . 0000, 00 . . . 0001, 00 . . . 0010, 00 . . . 0011, 00 . . . 0100, etc., as a function of input clock pulses and is well known in the art, numeral G7–G8 designate AND gates, numeral M1 and M2 designate counters (actually left shift registers) which count in the sequence of 00000000, 00000001, 00000010, 00000100, 00001000, etc., as a function of input clock pulses, and are well known in the art. The outputs f2, f3 . . . , and fn of the counter M2 are representative of the floors F2, F3, . . . , and Fn in the building and the outputs r1, r2, . . . , and rm of the counter M1 are representative of the suites on each floor, ie. RM21, RM22, . . . , and RM2m for the second floor F2, RM31, RM32, . . . , and RM3m for the third floor F3, and so on. Accordingly, the number of output lines the counter M2 has is equall to the number of floors in the building less one, i.e. Fn−1, and the number of output lines the counter M1 has is equall to the number of rooms on each floor m. Should the number of rooms on the floors vary, then the number of output lines of the counter M1 should be made equall to the number of rooms on the floor having the maximum number of rooms. Numeral FD1 designates a 1/m frequency divider the output of which goes high every m pulses at its CLK input, where m is defined by the number of rooms on each floor. The output of the frequency divider FD1 connects to the CLK input of the counter M2. The frequency divider FD1 may be a conventional counter such as the counter CNT1 where the most significant bit MSB output thereof is set to go high every m input pulses.

The counter CNT2 should count at least to 32 so that 0 pulses may be representitive of a 0 sec setting and 32 pulses representitve of a 20 sec. setting on the timer 23.

Figure 6D:
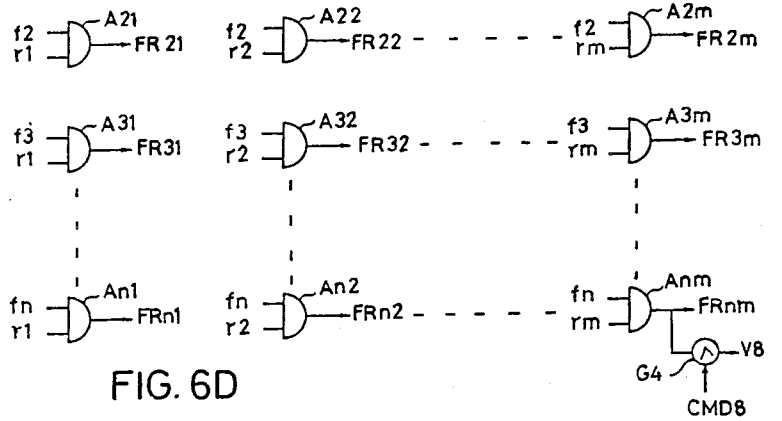

FIG. 6D shows a circuit diagram of a third part of the multiplexer 30 which is basically a matrix of AND gates for combining the signals from the counters (left shift registers) M1 and M2 so as to produce the sequencial sampling signals FR21, FR22 . . . and FRnm for each of the RCUs RCU21, RCU22, . . . and RCUnm in the suites of the building RM21, RM22 . . . and RMnm, respectively. Referring to the FIG., numerals A21, A22, . . . and Anm designate AND gates which have respective first and second inputs connected to the outputs r1 and f2, r2 and f2, . . . and rm and fn of the counters M1 and M2, respectively, the outputs of which are connected to respective of the RCUs RCU21, RCU22, . . . and RCUnm and which provide the sampling signals FR21, FR22, . . . and FRnm thereto. Accordingly, the output of AND gate A21 connects to the line L21*b* of the RCU RCU21.

Figure 6E:
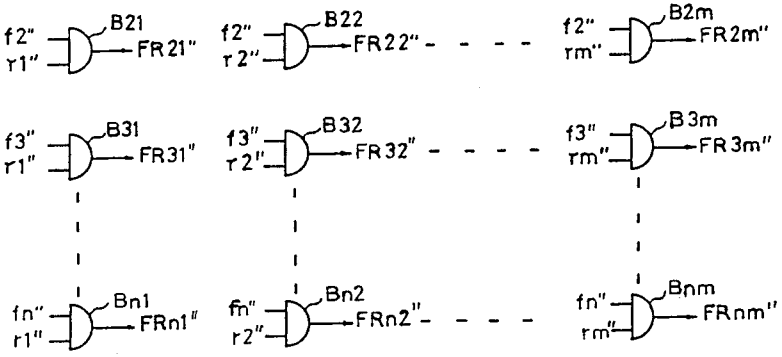

FIG. 6E shows a circuit diagram of a fourth part of the multiplexer 30 which basically comprises a matrix of AND gates utilized for generating the reset signals FR21"–FRnm" of the RCUs RCU21–RCUnm, respectively. Referring to the FIG., numerals B21–Bnm designated AND gates, the inputs of which are connected to respective outputs from the RCR 37 (which will be described more fully later), and the outputs of which connect to respective reset lines FR21"–FRnm" of the RCUs RCU21–RCUnm, respectively. Accordingly, the output of the gate B21 connects to the reset line L21*c* of the RCU RCU21. Similarly, the remaining outputs of the gates B22, B23, . . . and Bnm connect to the respective reset lines of the RCUs RCU22, RCU23, . . . and RCUnm, respectively.

Figure 6F:
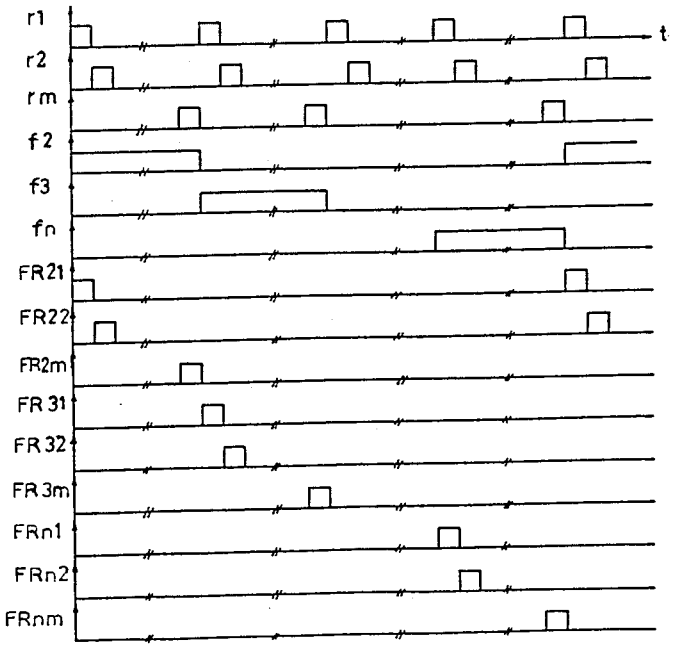
FIG. 6F shows waveform diagrams of the sampling signals generated by the multiplexer 30.
Figure 6G:
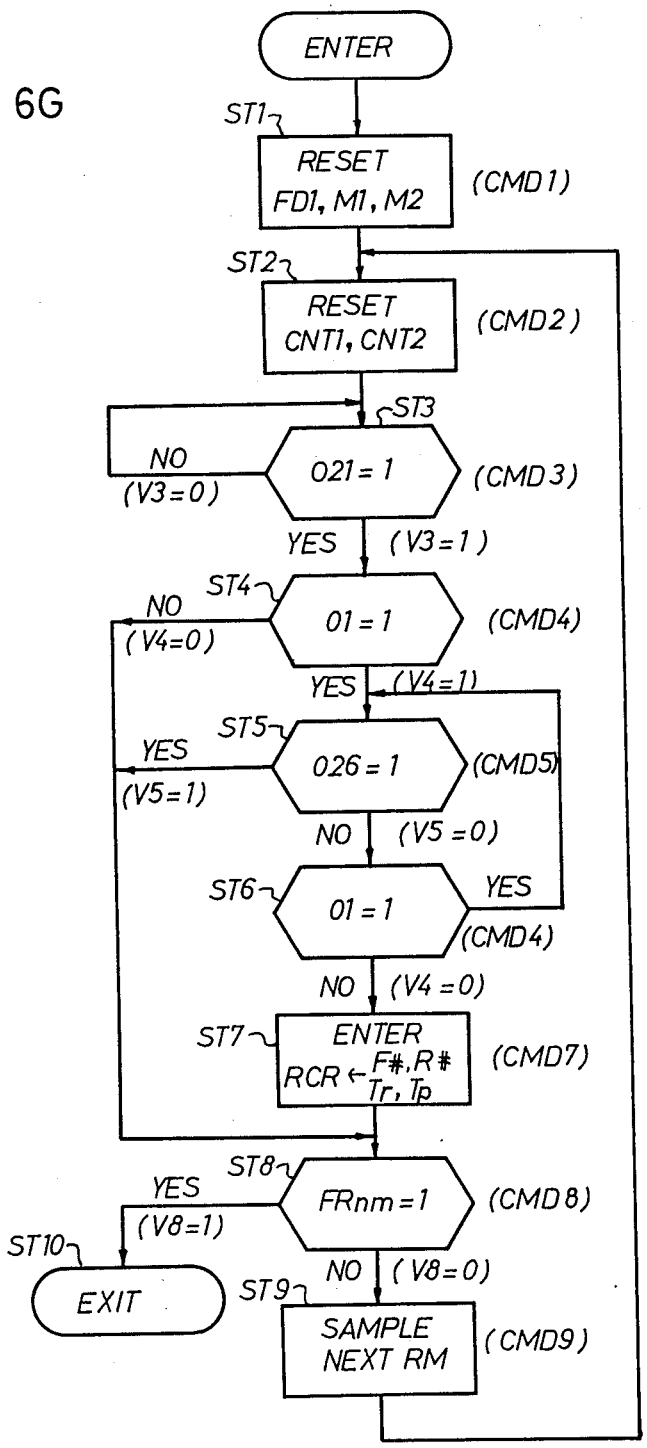
FIG. 6G shows a flow chart of a Monitor RCUs for RCs and Enter RCs into the RCR Program P3 utilized in combination with the multiplexer 30 according to the present invention.

FIG. 6G shows a flow chmonitored has not been activated, immidiately;

terminating the monitoring of that RCU;

generating the sample signal for the next RCU; and applying the next generated sample signal to the next RCU;

5. If at step 3 it is determined that the RCU being monitored has been activated;

monitoring that RCU for the time that the timer therein is set for by monitoring the output signal thereof;

6. Generating pulses and storing the generated pulses in a register during the time that the output from the RCU being monitored is high, the number of pulses being stored being directly proportional to the time that the output signal from the RCU being monitored is high;

7. If during step 6 it is determined that the output signal from the RCU being monitored is high for a period of time longer than a second period of time;

determining that the room control being monitored is faulty;

skipping that RCU;

generating a sampling signal for the next RCU; and applying the next sampling signal to the next RCU;

8. If at step 6 the output signal of the RCU being monitored goes low before said second period of time;

entering binary information representative of the room number R#, the floor number F# and the number of pulses registered in step 6 for the RCU being monitored into a row of registers in the RCR 37, as well as the actual time Tp that the entry was registered (hereinafter referred to as Treg).

Figures 7A, 7B:
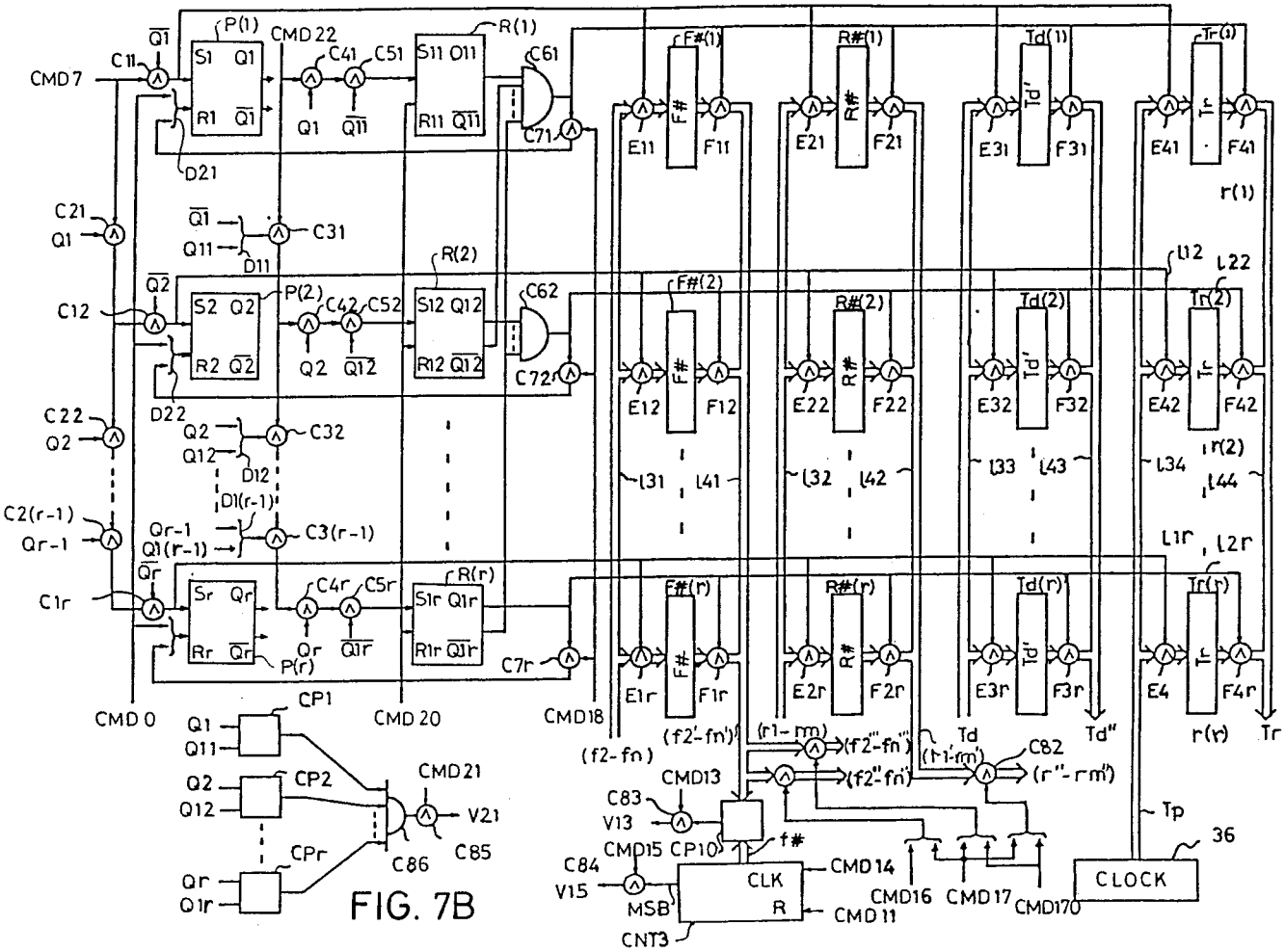
FIG. 7A,B shows a first embodiment 37A of a Room Call Register RCR 37 according to the present invention.
Figures 8A, 8B:
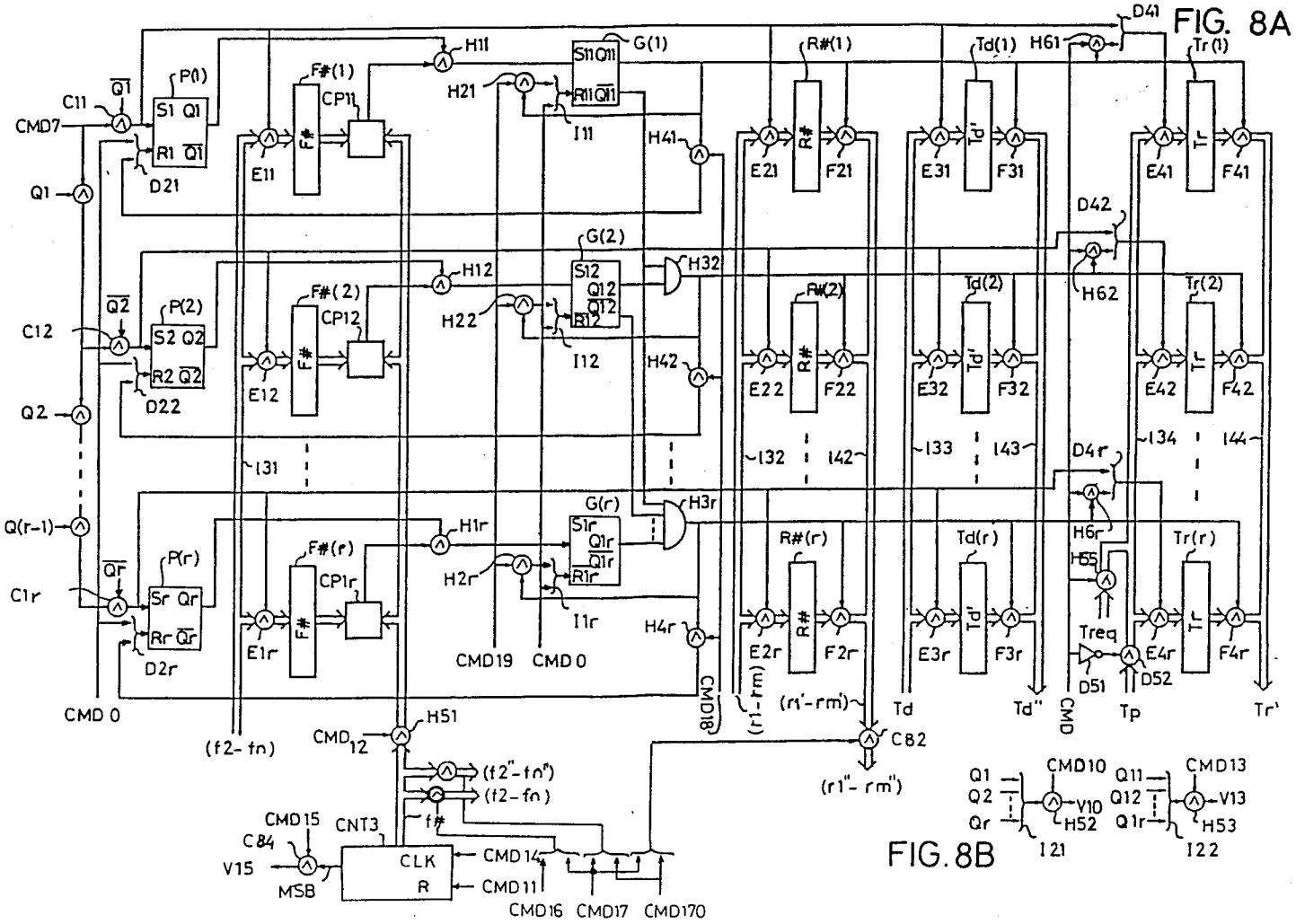
FIG. 8A,B show a second embodiment 37B of a Room Call Register RCR 37 according to the present invention.

The program P3 is utilized with the multiplexer 30 to inputs RCs into the RCR shown in FIGS. 7A, B or the RCR shown in FIGS. 8A, B.

In the FIGS., the commands issued by the CPU for each step are designated in parenthesis, i.e. (CMD1), (CMD2), etc., to the right of each respective step to facilitate easier understanding. The commands CMD1, CMD2, etc., are in the form of short pulses supplied by the CPU 31 which are inputted to i.e. respective first inputs of AND gates, counter set and reset inputs, etc., which are connected at respective points of the hardware as shown in the drawings, and having respective outputs V1, V2, etc., which are inputted to the CPU. Depending on whether or not the output signal V1, V2, etc., of the respective AND gate goes high at the time the respective command CMD1, CMD2, etc., is issued by the CPU, the CPU is informed as to the state of the system.

The generated sampling signals FR21-FRnm as a function of the output signals r1–rm and f1–fn of the counters M1 and M2, respectively, are shown in FIG. 6F.

Referring to the FIG. 6G, after entering the program, at step ST1, and CPU 31 issues a first command CMD1, which is applied to the reset terminals R and which resets the counters M1 and M2 as well as the frequency divider FD1 to their initial states, namely their 0 states. Next, at step ST2, the CPU issues a second command CMD2 which is applied to the reset terminals R and which resets the counters CNT1 and CNT2 to their initial states, namely their respective 0 states. At step ST3, the CPU repeatedly issues a command CMD3 which is applied to a first input of the enabling AND gate G8 whereby, by continuously monitoring the output V3 (i.e. step ST3) of the gate G8, the time that the output O21 from the counter CNT1 goes high can be detected. The output O21 is contiuously monitored until, after a first short period of time (i.e. approximately 3 clock pulses) the counter CNT1 reaches a 0000010 count at which time the output O21 goes high (i.e. answer YES at step ST3), at which time the program proceeds to step ST4. At step ST4, the CPU issues a command CMD4 whereby the output O1 of OR gate G1 is monitored (via gate G3) to determined whether or not the RCU presently being monitored has been activated.

It should be noted that, in the illustrated embodiment, the number of output lines from the counter CNT1 is seven, namely, 2 to the 0 to 2 to the 6 and the number of output lines from the counter CNT2 is six, namely 2 to the 0 to 2 to the 5. Further, that the value of the variable resistor 23*a* in each RCU is chosen so that when it is set to its maximum position, the longest time dt1 that the output signal of the timer T1 in each respective RCU stays high is equal to or less than the time it takes for the counter CNT2 to count from 000000 up to 111111. Accordingly, depending on the setting of the respective resistors 23*a* in the respective RCUs will determine the binary number generated and stored in the counter CNT2. For example, a 1 sec. setting on the timer 23 may be represented by a 000001 binary signal, 2 sec. by a 000010 signal, 4 sec. by a 000100 signal, 8 sec. by a 001000 signal, 16 sec. by a 010000 signal and 32 sec. by a 100000 binary signal. Further, since the counting rates of couters CNT1 and CNT2 are determined by the pulse frequency CK of the pulse generator CLK1, and since the counter CNT1 and CNT2 comprise 7 and 6 bits, respectively, the time dt2 is automatically made longer than the time dt1.

It should be further noted that, although the system will work for the counters M2 and M1 being reset to their 0 states, for the sake of simplifying and shortening the explanation, the outputs f2–fn, and r1–rm of the counters M2 and M1 are assumed to be reset to 00001 and 0001 (i.e. assuming that the building has 6 floors and 4 suites per floor, respectively, i.e. n=6 m=4).

Accordingly, at step ST1, the outputs r1 and f2 of counters M1 and M2 are high which implies that both inputs to AND gate A21 are high. Accordingly, the first time the program P3 is executed, the sampling signal FR21 is generated and provided to the RCU RCU21 and, depending on whether or not the activation means 22 thereof has been activated, will determine whether or not the output signal Td21 therefrom will be high. The output signal Td21 is inputted to the OR gate G1, and, accordingly, when the step ST4 is executed while the RCU RCU21 is being monitored (i.e. signal FR21=1), since the output of OR gate G1 is monitored by the CPU by observing the signal V4 of AND gate G3, it can be determined whether or not the RCU RCU21 has been activated. Assuming that the activation means 22 of the RCU RCU21 has not been activated, the output signal Td21 therefrom will be low and, accordingly, when the command CMD4 is issued, the signal V4 will be low. Accordingly, the program proceeds from step ST4 to step ST8 where it is checked whether or not the last RCU RCUnm has been monitored (by monitoring the output V8 of AND gate G4 shown in FIG. 6D). If the last RCU RCUnm has not been monitored (answer NO at step ST8), the program proceeds to step ST9 where the next sample signal is generated. The next sample signal is generated by the issuance of a command CMD9, which causes a pulse to be inputted to the clock CLK inputs of the counter M1 and frequency divider FD1, which causes the outputs of counters M1 and M2 to change respectively. The program then returns to step ST2, and the process described above is repeated for RCU RCU22. Steps ST2, ST3, ST4, ST8 and ST9 are repeated in that order until it is detected that either one of the RCUs being monitored is activated (i.e. V4=1) or that the last RCU RCUnm in the last suite RMnm on the top floor Fn has been monitored (i.e., V8=1). Only after command CMD9 goes high m times, causing r1 to rm to go high, respectively, does f3 go high and f2 go low. Accordingly, the RCUs are monitored by sequencially monitoring the RCUs on the second floor, third floor, and so on.

It should be noted that if a building has 21F and 30 suites per floor (i.e. requiring 600 RCU), the time that it would take to scan (i.e. monitor) all the RCUs in the building can be calculated as follows:

Assuming a clock freq of 1 MHz and that no RCUs are activated at the time of the scan, since the program P3 can detect that a RCU being monitored is not activated after a first short period of time (i.e. 10 clock pulses), then the time to monitor each RCU=10 pulses/1,000,000 pulses/sec=0.00001 sec/RCU. Therefore, the time to scan the entire building=600-RCU×0.00001 sec/RCU=0.006 sec. Further, since the scans occur regularly, the posibility of there being more then 5 RC present during any one scan is very small and since the max time Td setting of any RCU is less then the time it takes the counter CNT1 to count to 1000000 (i.e. the time it takes to count 64 pulses), the scanning time even when RCs are present would not change appreciably. Accordingly, a quick and functional system can be realized.

After the first RCU RCU21 is monitored as indicated above, the issuance of command CMD9 causes the output of counter M1 to become 0010 while the output of counter M2 remains 00001. Accordingly, both the inputs of AND gate A22 are high which causes the sampling signal FR22 to be applied to the RCU RCU22. Assuming that the the activation means of the RCU RCU22 has been activated the program will proceed as follows:

At step ST4, it is determined that the RCU being monitored (in this case RCU22) is activated (i.e. V4=1), and, accordingly, the program proceeds to step ST5. At step ST5 it is determined whether or not output O26 of counter CNT1 has gone high. If output O26 is not high, the program proceeds to step ST6. At step ST6, a command CMD6 is issued whereby it is determined whether or not the output O1 is still high. If at step ST6 it is determined that the output O1 is still high, the program returns to step ST5 where it is again determined whether or not the output O26 is high. Steps ST5 and ST6 are repeated till either output O26 goes high or O1 goes low. If all is well, output O1 should go low before output O26 goes high (i.e. since dt1<dt2) and, accordingly, the program should proceed from step ST6 to step ST7. At step ST7, a command CMD7 is issued, whereby, as will be described in more detail later, information representative of the floor number F#, room number R#, desired time Td, and present time Tp (i.e. the actual time that this step ST7 is executed) corresponding to the RCU being monitored is entered into a row in the RCR 37. Next, the program proceeds to step ST8 where, as previously described, it is determined whether or not the RCU presently being monitored is RCUnm. Accordingly, the steps ST1–ST9 are executed each time it is determined that a RCU being monitored has been activated.

If at step ST5 it is determined that the output O26 is high (i.e. V5=1), the program proceeds directly to step ST8. In other words, it is determined that the RCU being monitored is faulty and, accordingly, the information pertaining thereto is not entered into the RCR 37.

It should be noted that, although in the about described embodiment the rooms in the building where monitored by the sampling signals starting from the second floor F2 up, the rooms could have just as easily been monitored from the top floor Fn down, and that in actual fact, as will be more fully described later, it would be advatages to monitor the rooms in the building from the top floor Fn down.

It should also be noted that if it is desirable to reset the RCUs immidiately after each RC is monitored and the information pertaining thereto entered into the RCR 37, (i.e. after the R#, F#, Td and Tp are entered into the RCR 37 for each RC as in step ST7), an additional step (not shown) can be added immediately after step ST7, the additional step comprising a command CMDreset (not shown), which would be applied to respective first inputs of an array of AND gates the second respective inputs of which are connected to the respective outputs of the AND gates A21–Anm, and the respective outputs of which would connect to the respective reset inputs R of the respective flip flops FF1 and FF2 of the RCU RCU21–RCUnm, respectively. The outputs FR21–FRnm of the AND gates A21–Anm in that case would be connected only to the respective inputs of the respective AND gates G100 in the respective RCUs RCU21–RCUnm, respectively. FIG. 6D shows such a setup for the RCU RCU21 only, wherein numeral A21′ (not shown) designates an AND gate one input of which is connected to the output of the AND gate A21 and the other input of which is connected to the command CMDreset supplied by the CPU 31. The output of the gate A21′ connects to the reset terminals R of the flip flops FF1 and FF2, while the output of the AND gate A21 connects to the input of the AND gate G100 of the RCU RCU21. Accordingly, an extra line must be connected to each RCU. In operation, since at step ST7 the sampling signal of the RCU being monitored is still high, the high sampling signal and the command CMDreset would cause the respective output of the respective AND gate A21′–Anm′ (not shown) to go high when the command CMDreset is issued, which will cause the RCU being monitored to reset. Since the respective buzzers in each RCU is seperately connected from the reset line R of the respective flip flops FF1 and FF2, the reseting of the RCUs does not cause their respective buzzers to be activated. Since in this case the operators of the respective RCUs can continuously enter as many calls as they like (i.e. during a short period of time), it may be desirable to include a program which checks if more then one RC is present in the RCR for each RCU and, if so, erase all the RCs except the last chronologically entered RC appearing in the RCU for the same RCU (i.e. only the call for a given RCU having the lastest Treg. is not erased for each RCU). In this way, should the operator of a RCU decide that the desired time Td he originally entered is not the time he actually desires, he can always change the setting on his timer and press the button 22 again, whereby the system would automatically erase the first call he enterred and only keep the last.

FIG. 7A shows a first embodiment 37A of the RCR 37 according to the present invention. Referring to the FIG., numerals F#(1)–F#(r), R#(1)–R#(r), Td(1)–Td(r), Tr(1)–Tr(r) designate registers in rows r(1)–r(r), respectively, utilized for storing, in binary code, information representative of respective RCs, namely, the floor number F#, room number R#, desired time Td, and registered time Treg pertaining to each RC, the information in each row being inputted each time a write command CMD7 is issued, numerals P(1)–P(r) designated presence S-R flip flops utilized for indicating whether or not any information is present in the respective registers of each respective row r(1)–r(r) of the RCR 37 (Although the information in the respective registers is not actually erased, if the respective presence register is not set, the information contained in the respective registers cannot be read out due to enabling AND gates as will be explained later, which is equivalent to no information being present in the register or, in other words, the register being empty), numerals R(1)–R(r) designate read S-R registers utilized for indicating whether or not the respective registers in the respective rows r(1)–r(r) have been read. Numerals, C11–C1r and C21–C2(r−1) designated AND gates which, in combination with the presence flip flops P(1)–P(r), guide (channel) each new set of information pertaining to a RC (i.e. room number R#, floor number F#, time desired Td, and time registered Treg) being written, due to a write command CMD7, into the first empty row available. Specifically, the command CMD7 causes the information (signals) on the outputs of the counters M2, M1, CNT2 and clock 35, which is repressentative of a RCs'F#, R#, Td and Tp, to be inputted via respective lines 131, 132, 133 and 134 to the first empty row of registers, namely, respectively F#, R#, Td and Tr registers in the RCR 37A. Numerals D11–D1(r−1) designate OR gates and numerals C31–C3(r−1), C41–C4r, C51–C5r and C61, C62 designate AND gates, which, in combination with the presence flip flops P(1)–P(r) and the read flip flops R(1)–R(r), are utilized for automatically reading the first non read row of information each time a read command CMD22 is issued, numerals C71–C7r and D21–D2r designate AND gates and OR gates, respectively, utilized, when an erase command CMD18 is issued, to erase the last read row of information. Numerals C11–E1r, F11–F1r, E21–E2r, F21–F2r, E31–E3r, F31–F3r, E41–E4r, and F41–F4r designate enabling AND gates which, in response to their respective enabling inputs (their respective single input lines as shown in the FIG.) allow the information to be inputted or outputted to or from the respective registers, respectively. Numerals C81–C86 designate AND gates, numeral D31 an OR gate, numeral 36 a clock, numeral CNT3 a counter (actually a left shift register) which counts in the sequence 100 . . . 00, 010 . . . 00, 001 . . . 00, etc., and numeral CP10 a comparator.

It should be noted that the number of bits in each of the R# and F# register R#(1)–R#(r) and F#(1)–F#(r) is equal to the number of rooms m on each floor and the number of floors less one n, respectively, in the building. Further, that only one digit of information stored in each of these registers can be high at any given time, the unit being high being representative of a F# or R#, respectively. For example, a 0010000 stored in a F# register may indicate that the respective RC is from the third floor of a building having 8 floors. Further, the number of bits in each of the desired time registers Td(1)–Td(r) is equal to the number of bits in the counter CNT2 and the number of bits in each of the Tr registers is equal to the minimum number required to store the present time Tp. However, should it be desirable to save bits (i.e. minimize the required bits) in the F# and R# registers, an encoder can be placed in series with each of the input lines 131 and 132, and a decoder can be placed in series with each of the output lines 141 and 142, respectively, the encoders changing each respective incomming signal from a signal having only one digit high to a regular binary signal and the decoders, vise versa.

In operation, when writing information in, initially, the presence flip flops P(1)–P(r) (which will also be referred to as write flip flops) are reset by a command CMD0 (i.e. which is issued during the execution of the initializing program P1) inputted through respective first inputs of OR gates D21–D2r. Accordingly, Q1=Q2=Qr=0. Then a write command CMD7 causes the first presence flip flop P(1) to set, and also allows, due to an enabling input line l11 also momentarily going high, information to be inputted to the first rows of registers, since the line l11 connects the output of AND gate C11 to enabling inputs of AND gates E11, E21, E31 and E41 which intern are respectively connected at the inputs of the respective first row r(1) registers. Accordingly, information being inputted to the RCR 37A namely, information representative of the floor number F# (i.e. the outputs f2–fn of the counter M2), room number R# (i.e. the outputs r1–rm of the counter M1), desired times Td (i.e. the output of the counter CNT2) and the time registered Treg (i.e. the output Tp, representative of the present time, of the clock 36), namely, information representative of a given RC, is entered into the first row registers F#(1), R#(1), Td(1) and Tr(1), respectively. When writing information into the RCR 37A once the first row already contains information, since the presence flip flop P(1) is set i.e., Q1=1, the information is automatically channelled into the respective registers in row r(2) by the AND gates C21, C12, E12, E22, E32 and E42, which also causes presence flip flop P(2) to set. Similarly, information read in thereafter is channelled to the remaining registers in rows r(3)–r(r).

Should information in a given row be erased by an erase command CMD18 (after the group supervisory system 38 assigns that RC, i.e. as defined by the information in said given row, to the HCR 39), even though rows before and after that row have information stored therein, the next time a write command CMD7 is issued, the information will automatically be written into the first row having no information in it, regardless of whether or not any of the following rows has any information stored therein as indicated by the respective presence flip flops P(1)–P(r) being set or not.

When reading information out, first a clear command CMD20 is issued which resets the read flip flops R(1)–R(r). Next, a read command CMD22 is issued which causes a read flip flop in the same row as the first set presence flip flop to set, namely, the first read command CMD22 automatically causes the first set of information in the RCR 37 to be read out, regardless of whether the information is in the first row or not. Similarly, the second read command CMD22 automatically causes the next set of information in the RCR 37, regardless of the row it is in, to be read out, and so on. For example, assuming that the first and third rows r(1) and r(3) have information stored therein, i.e. Q1=Q3=1. The first read command CMD22 (asuming a clear command CMD20 was previously issued) will cause read flip flop R(1) to set, since outputs Q1 and Q11 of flip flops P(1) and R(1) are 1 and 0, respectively, thereby allowing the read command to pass through the AND gates C41 and C51. Since, the first read command caDFAEhe output Q11 of read flip flop R(1) to go high, EEDEDEE@D outputs Q12–Q1r of read flip flops R(2)–R(r) are all low, all the inputs to AND gate C61 are high which causes the output thereof to go high, which causes the enabling inputs to the respective AND gates F11, F21, F31 and F41 to go high, thereby allowing the information in the first row registers to be read out. The second read command issued sets read flip flop R(3) (not shown), since only Q1=Q3=Q11=1 at that time, which would allow the read command CMD22 to pass only through AND gates C31, C32, C43 (not shown) and C53 (not shown) to set read flop R(3) (not shown). Accordingly, output Q33 (not shown) of the read flip flop R(3) (not shown) goes high which causes the output of AND gates C61, C62 and C63 (not shown) to go low, low and high, respectively, which causes the enabling inputs to AND gates F11, F21, F32, F41 and F13, F23, F33, F43 (not shown) to go low and high, respectively, which causes the information being read out via lines 141–144 to change from the information in the respective first row r(1) registers to the information in the third row r(3) registers.

It should be noted that although the AND gates C61, C62, etc., have respective inputs connected to respective outputs of the read flip flops as shown in the FIG., another embodiment may reduce the number of inputs to the respective AND gates C61, C62, etc., to only two, respectively, by connecting the first input of AND gate C61 to output Q11 and the second input thereof to the output of AND gate C62, the first input of AND gate C62 to output Q12 and the second input thereof to the output of AND gate C63 (not shown), and so on for AND gates C63–C6(r−1) (not shown).

When erasing information in the RCR 37, i.e. due to the CPU 31 and group supervisory system 38 determining that an elevator car can meet the conditions defined by the information in the registers, an earase command CMD18 is issued by the CPU which causes the presence flip flop of the same row as the last set read flip flop to reset. For example if the first and third presence and read flip flops are set, i.e., Q1=Q3=Q11=Q33=1, then the outputs of AND gates C61 and C63 are low and high, respectively, and, accordingly, an earase command CMD18 causes inputs of AND and OR gates C73 (not shown) and D23 (not shown), respectively, to go high which causes the presence flip flop P(3) (not shown) to reset. Accordingly, the presence flip flop P(3) is reset. However, since the third read flip flop R(3) is not reset by the erase command CMD18, the next time a read command is issued, the next row after row r(3) which has any information in it will automatically be read out.

A transfer command CMD16 when issued by the CPU 31 causes the floor number F# presently being read out on output line 141 to be read out from RCR 37 and to be registered in the HCR 39.

A transfer reset command CMD17 causes the floor number F# (designated by numerals (f2'–fn')) and the room number R# (designated by (r1'–rm')) presently appearing on the output lines 141 and 142, respectively, to be read out of the RCR 37, whereby the floor number F# (designated by (f2''–fn'')) is registered (assigned) in the HCR 39 and the R# (designated by (r1''–rm'')), is inputted to respective gates in the multiplexer 30, namely, said fourth part of the multiplexer shown in FIG. 6E to reset the respective RCU as defined by the information in the entry being read out. Specifically, since only one piece of information stored in the respective F# and R# registers presently being read out is high at any given time, only one set of inputs to the AND gates B21–Bnm is high causing the respective output thereof to go high, which causes the respective RCU RCU21–RCUnm, as defined by the combination of high signals, to reset and the buzzer thereof to sound.

FIG. 7B shows another part of the RCR 37A in which numerals CP1–CPr designate comparators the respective first inputs of which are connected to the outputs Q1, Q11–Qr, Q1r of presene and read flip flops P(1), R(1)–P(r), R(r), respectively, and numerals C85 and C86 designate AND gates.

FIG. 7C shows a Monitor, Transfer and Reset program P4A (i.e. representative of a first embodiment of the program P4 shown in FIG. 4A), stored in the ROM 32, to be utilized with the room control register 37A shown in FIGS. 7A and 7B.

The program P4A is utilized for:

1. Reading the entries (i.e. RCs) in the RCR 37A; and
2. Determining whether or not to assign the entry presently being read out of the RCR 37A to the HCR 39 and/or to reset the respective RCU defined by the information in the entry presently being read out, as well as whether or not to reset the entry presently being read from the RCR 37A.

Referring to FIGS. 7A–C, after entering the program P4A, at step ST11, a command CMD20 is issued which resets the read flip flops R(1)–R(r). Next, at step ST12, a command CMD21 is issued, whereby it is determined whether or not there are any entries in the RCR 37A. More specifically, since the comparators CP1–CPr continuously compare whether or not the respective outputs of the presence flip flops P(1)–P(r) and read flip flops R(1)–R(r) are at the same level, respectively, and since all the read flip flops R(1)–R(r) were reset at step ST11, unless all the outputs of the presence flip flops P(1)–P(r) are also all at the level 0, the signal V21 will be low (level 0) when the command CMD21 is issued, thereby informing the CPU 31 that there is at least one entry in the RCR 37. Similarly, if the first row r(1) read register R(1) is set i.e. R(1)=1 due to a first entry in the row r(1) having previously been read, then the hardware shown in FIG. 7B informs the CPU 31 whether or not any more entries (RCs) are present in rows r(2)–r(r) in the RCR 37A, namely, if any of the presence flip flops P(2)–P(r) is or are set.

If at step ST12 it is determined that there are no entries in the RCR 37A (answer YES at step ST12), the program is exited at step ST13. If at step ST12 it is determined that there are entries in the RCR 37, the program proceeds to step ST14. At step ST14, the counter CNT3 (which is actually a left shift register) is reset to its initial state which is representative of the top floor, namely Fn. The counter CNT3 has the same counting sequence as the counter M2 and has one more output than the counter M2, wherein the most significant bit MSB output is utilized to determine whether or not the floor F2 has been monitored, and the list significant bit LSB to the second MSB outputs are inputted to the comparator CP10 and are designated as f#, the signals on the LSB and the second MSB outputs being representative of the floor numbers F2 and Fn, respectively. (i.e. 00000001, 00000010, 00000100, etc., when the number of floors n=8 including the signal of the MSB output.)

Next, at step ST15, a read command CMD22 is issued, which causes the first entry in the RCR 37A, regardless of the row it is in, to be read out of the RCR 37A and into the CPU 31, namely, the floor number (f2'-fn'), the time desired Td'' and the time registered Treg', appearing on output lines 141, 143 and 144, respectively, are read out of the RCR 37A and into the CPU 31. It should be noted that the room number (r1'-rm') on output line 142 is not read into the CPU 31 because it is only necessary for the CPU to know which floor number (f2'-fn') the RC is from.

Next, at step ST16, a command CMD13 is issued, whereby it is determined whether or not the floor number (f2'-fn') of the entry presently being read out is equal to the floor number f# that the output of the counter CNT4 is presently set to (which presently is at Fn). If at step ST16 the answer is NO, the program proceeds to step ST17. At step ST17, a command CMD21 is issued whereby, similar to step ST12, it is determined whether or not all the entries in the RCR 37A have been read. If at step ST17 the answer is NO, the program returns to step ST15. If at step ST17 the answer is YES, i.e. all entries have been read, the program proceeds to step ST18. At step ST18, a command CMD14 is issued, whereby a pulse is entered into the clock CLK input of the counter CNT3, causing the output of the counter CNT3 to change from Fn to Fn−1 (i.e. f#=f#−1). By counting up or down it implies that the single high level on an output of the counter CNT3 moves to the more significant bit output or to the less significant bit output, respectively.

Next, at step ST19, it is determined whether or not the second floor F2 has already been checked (i.e. whether or not the most significant bit MSB of the counter CNT3 has gone high causing V15=1). If at step ST19 the answer is NO, it implies that not all the floors Fn-f2 have been checked for respective entries in the RCR 37A and, accordingly, the program returns to step ST15. If at step ST19 the answer is YES, the program is exited at step ST20.

If at step ST16 the answer is YES, the program P4A proceeds to an Arrival Time Calculating Program P5, wherein the arrival time Tar of the elevator car from its present position to the F# (f2'-fn') of the entry presently being read out of the room control register 37A is determined. After executing the program P5, namely, calculating the time Tar, the CPU 31 proceeds to a Transfer and Reset Program, where it is determined whether or not:

1. To only activate the buzzer of the RCU corresponding to the information (f2''-fn'') and (r1''-rm'') of the entry presently being read out of the RCR i.e. reset that RCU (due to the CPU determining while exectuting the program P6 that the time desired Td''−1 sec.->Tar.);

2. To only assign the (f2''-fn'') of the entry presently being read out of the RCR 37A to the HCR 39 (due to the CPU determining that Td''+1 sec.<Tar); or 3. To assign the F# (f2''-fn'') of the entry (RC) presently being read out of the RCR 37A to the HCR 39, to reset the RCU corresponding to the information (f2''-fn'') and (r1''-rm'') of the entry presently being read out (since the signals (f2''-fn'') and (r1''-rm'') are applied to said fourth part of said multiplexer 30) and to delete the entry presently being read out of the RCR 37A from the RCR 37A (due to the CPu determining while executing the program P6 that Td''±1 sec.=-Tar.)

After executing the Transfer and Reset Program P6, the CPU returns to executing step ST17 of the program P4A.

FIGS. 8A and 8B show a second embodiment 37B of a RCR 37 according to the present invention. In the Fig., the same or corresponding parts to those of the RCR disclosed in FIGS. 7A and 7B are designated by the same reference numerals. Further, the commands that produce the same desired effect in both embodiments are designated by the same command numbers. The advantage that the second embodiment has over the first is that it is faster to execute, i.e. requires less steps to determine the same amount of information. More specifically, in the first embodiment, the floor numbers F# of each entry was compared with the output f# of the counter CNT3 separately, while in the second embodiment, the F# of all the entries are compared with the output f# at the same time. Further, the elements in the second embodiment 37B which basically function the same as the respective elements of the first embodiment **37*a* have been designated with the same reference numerals and the description therefor will not be repeated. Further, that either the RCR 37A and its corresponding program P4A or the second embodiment of the RCR 37B and its corresponding program P4B are used for the RCR 37 shown in FIG. 3 and the program P4 shown in FIG. 4A**, respectively.

Referring to FIGS. 8A and 8B, numerals CP11-CP1r designate comparators for consecutively comparing the respective floor numbers F# in the registers F#(1)-F#(r) with the output f# of the counter CNT3, respectively, numerals G(1)-G(r) designate comparing S-R flip flops for remebering and indicating which rows r(1) to r(r) have entries having the same floor number F# as the output f# of the counter CNT3 after a compare command CMD12 is issued, numerals H11-H1r designate AND gates for allowing the respective compare flip flops G(1)-G(r) to be set in response to whether or not:

the respective presence flip flops P(1)-P(r) are set (implying that the information stored in the respective rows is to be considered); and the respective outputs of the comparators CP11-CP1r go high due to the respective F# entry portions and the f# output being the same when the command CMD12 is issued;

Numerals H32-H3r designate AND gates which allow only one of the entries to be read out of the RCR 37B when two or more entries have the same F# portion as the present setting f# of the counter CNT3 when a compare command CMD12 is issued. More specifically, when a compare command CMD12 is issued, should two or more entries have the same F# portion, two or more respective compare flip flops are set. However, the AND gates H32-H3r ensure that only the entry in the first row in which the compare flip flop is set, is read out. Only after the respective compare flip flop is reset by a command CMD19 does the next entry in which the respective compare flip flop is set allowed to be read out. Numerals I11-I1r designate OR gates and numerals H21-H2r designate AND gates, which in combination with AND gates H32-H3r, allow only the first set compare flip flop to be reset when a command CMD19 is issued. Numerals H41-H4r designate AND gates which in combination with AND gates H32-H3r allow only the presence flip flop in the first row that has both the presence and compare flip flops set to be reset when a command CMD18 is issued. Numerals H51-H53 designate AND gates and numerals I21 and I22 designate OR gates.

FIG. 8C shows a program P4B utilized, in combination with the RCR 37B.

Referring to FIGS. 8A–C, after entering the program P4B, at step ST21, a command CMD10 is issued, whereby it is determined whether or not there are any entries in the RCR 37B (i.e. whether or not all the outputs Q1–Qr of the respective presence flip flops P(1)–P(r) are all at level 0). If at step ST21 the answer is YES, i.e. there are no entries in the RCR, the program is exited at step ST22. If at step ST21 the answer is NO, i.e. there are entries in the RCR 37B, the program proceeds to step ST23. At step ST23, a command CMD11 is issued, whereby the counter CNT3 is reset, thereby causing the output f# thereof to be set to Fn. Next, at step ST24, a compare command CMD12 is issued, whereby the contents F# of the floor number registers F#(1)–F#(r) are simultaneously compared with the output f# of the counter CNT3 by the comparators CP11–CP1r, respectively. Since the compare command CMD12 is only present momentarily, i.e. for one clock pulse, the respective outputs of the passive comparators CP11–CP1r can only stay high for the time that the command CMD12 is present. The outputs of the comparators CP11–CP1r going high cause respective first inputs to AND gates H11–H1r to go high, and, since the respective second inputs of the AND gates H11–H1r are connected to the respective outputs Q1–Qr of presence flip flops P(1)–P(r), depending on whether or not the respective presence flip flops P(1)–P(r) are set and whether or not the respective outputs of the comparators CP11–CP1r go high (due to their comparing their respective inputs) when the command CMD12 is issued, will determine whether or not respective outputs of AND gates H11–H1r will go high, which will determine whether the respective compare R-S flip flops G(1)–G(r) are set or not (since the outputs of AND gates H11–H1r connect to the respective set inputs S11–S1r of the compare R-S flip flops G(1)–G(r)).

For example, assuming that only RCs present in the first and third rows r(1) and r(3) have a floor number portion F# equall to the output f# of the counter CNT3 and that P(1)=P(3)=1, only the flip flops G(1) and G(3) (not shown) will set when the command CMD12 is issued. Accordingly, since the output Q11 of flip flop G(1) connects to the enabling inputs of AND gates F21, F31, and F41, the information in registers R#(1), Td(1) and Tr(1) will be read out on lines 142, 143 and 144, respectively. Further, since the outputs Q11BAR, Q12BAR and Q13 (not shown) are connected to the inputs of AND gate H33 (not shown), and since the output Q11BAR is low, even though the outputs Q12BAR and Q13 are high, the output of AND gate H33 stays low, thereby preventing the information in the third row from appearing on the output lines 142, 143 and 144. Only when the flip flop G(1) is reset (i.e. when a command CMD19 is issued) are all the inputs to AND gate H33 high, thereby allowing the information in the third row registers to be read out. Further, since the output Q11 has gone low, the information in the first row is prevented from being read out. Accordingly, the compare command CMD12 serves to identify in one step all the entries which have a floor number F# portion the same as the present setting of the output signal f# of the counter CNT3. Since at this stage the output f# of the counter CNT3 is set to Fn, all the entries from the n'th floor Fn in the RCR 37B are identified. At step ST25, a command CMD13 is issued, which serves to inform the CPU whether or not any of the entries in the RCR 37B have the same floor number F# portion as the present output f# of the counter CNT3. More specifically, the command CMD13 checks whether or not any of the outputs Q11–Q1r have been set in response to the command CMD12, thereby indicating whether or not one or more of the entries in the RCR 37B is from a floor number F# equall to the present setting f# of the counter CNT3. If at step ST25 the answer is YES (i.e. V13=1), the program proceeds to step ST251 where the Arrival Time Calculating Program P5 is executed, whereby the arrival time Tar of the elevator car from its present position to the floor number (f2'–fn') designated in the entry presently being read out is determined. Next at step ST252, the Transfer and reset program P6 is executed where the RC presently being read out of the RCR 37B is operated on.

By operated on is meant:

1. whether or not the F# of the entry presently being read out of the RCR 37B is to be assigned to the HCR;
2. whether or not the RCU corresponding to the entry presently being read out of the RCR 37B is to be reset and the buzzer therein activated; or
3. whether or not to assign the F# of the entry presently being read out of the RCR 37B to the HCR 39, to reset the corresponding RCU and to erase the RC entry from the RCR 37B.

Next, at step ST29, a command CMD19 is issued, whereby the first set compare flip flop is reset.

It should be noted that, similar to the command CMD19, a command CMD18 causes only the first set presence flip flop, the respective compare flip flop of which is set, to reset (since the command CMD18 is inputted to the first inputs of AND gates H41–H4r, the respective second inputs of which are connected to the respective outputs of flip flop G(1) and AND gates H32–H3r, which allow only one output of AND gates H32–H3r to be high at any given time, (namely, from the first entry the floor number F# of which is equal to the present output f# of the counter CNT3, to the next entry the floor number F# of which is equall to the present output f# of the counter CNT3, and so on.) and since the outputs of the AND gates H41–H4r are connected to the respective reset inputs of the presence registers P(1)–P(r) through the OR gates D21–D2r, respectively).

After step ST29, the program returns to step ST25 where again it is checked if any more entries have the same F# as the present setting f# of the counter CNT3. Steps ST25–ST29 are repeatedly executed until all the entries having a F# corresponding to the present setting f# of the counter CNT3 have been monitored and operated on (i.e. as described above) by the CPU.

If at step ST25 the answer is NO, due to either non of the entries having a F# portion equal to the present setting f# of the counter CNT3, or due to all the entries, having the same floor number F# as the present setting f# of the counter CNT3, having been monitored and operated on by the CPU in steps ST25–ST29, the program proceeds to step ST26. At step ST26, the output signal f# of the counter CNT3 is reduced by one (f#−1), which is equivalent of the next floor down. Next, at step ST27, it is determined whether or not the output f# of the counter CNT3 is less than F2 (i.e. by monitoring the output V15). If at step ST27 the answer is NO, the program returns to step ST24 where, again, a compare command is issued, whereby the compare registers G(1)–G(r) in the rows having an entry having a F# portion equall to the present output of the counter CNT3 are set. If at step ST27 the answer is YES, the program is exited at step ST28.

Figure 10:
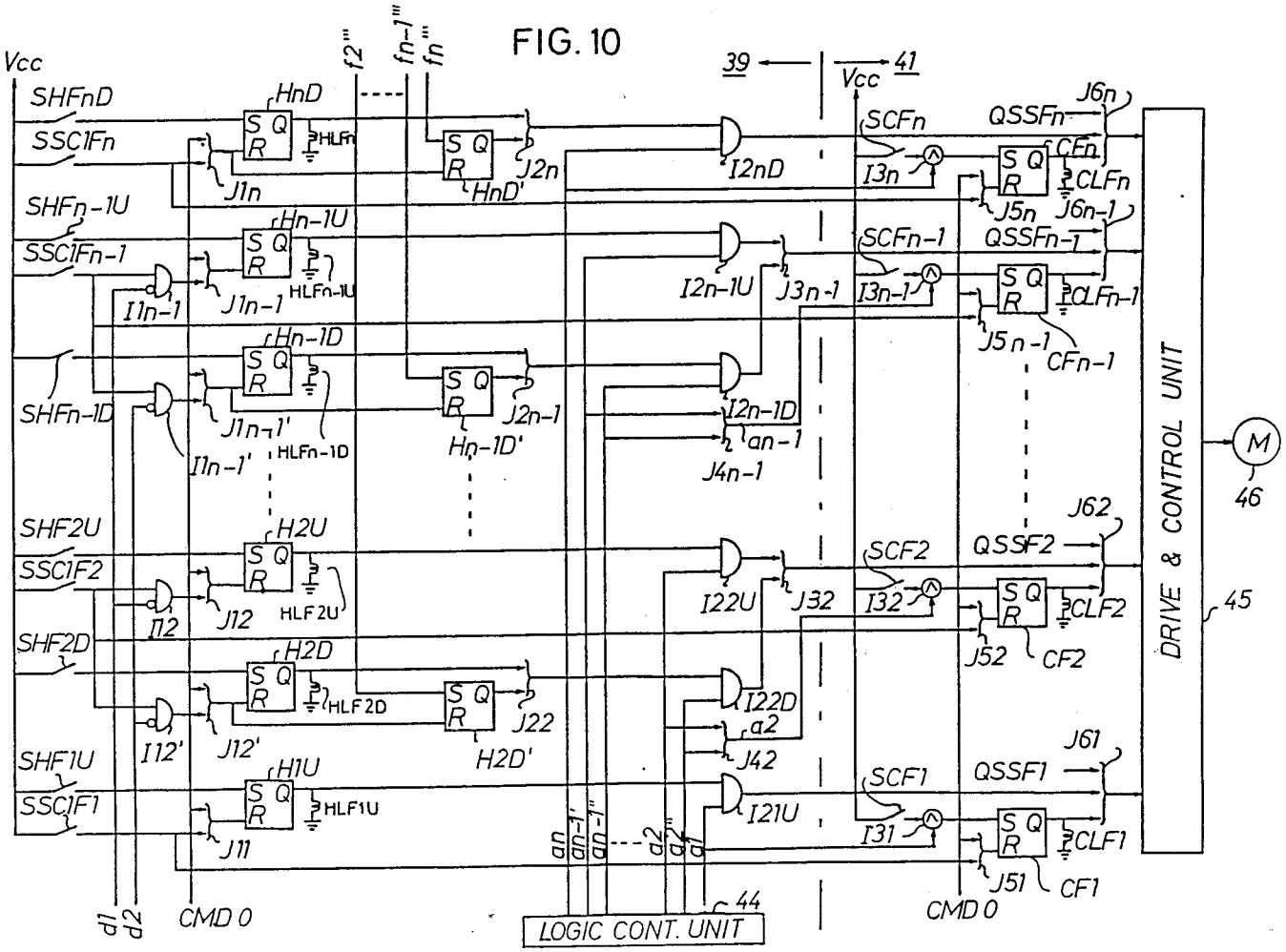
FIG. 10 shows an Arrival Time Calculating Program P5 according to the present invention.

FIG. 10 shows the Arrival Time Calculating Program P5 according to the present invention which is stored in the ROM 32 and which is executed intern by the CPU 31. In the Fig., the following symbols indicate the following:

CPP: the car's present position;

RCFP: the RC's floor position, as indicated by the floor number output portion (f2'-fn') of the entry presently being read out of the RCR 37;

HFCP: the position of the highest floor call presently in the HCR 39 or CCR 41;

LFCP: the lowest floor call position presently in the HCR 39 or CCR 41;

Ts: the average time required to service a given floor (i.e. 1 sec. for the car doors to open, 3 sec. for allowing people to get into the car and 1 sec. for the car doors close provides for a 5 sec. service time Ts);

V: the car's average velocity

A: the distance between the CPP and the RCFP;

A': the number of calls between the CPP and the RCFP in the up direction;

A'': the number of calls between the CPP and the RCFP in the down direction;

B: the distance between the CPP and the HFCP;

B': the number of calls between the CPP and the HFCP in the up direction;

C: the distance between the CPP and the LFCP;

C'': the number of calls between the CPP and the LFCP in the down direction;

D: the distance between the HFCP and RCFP

D'': the number of calls between the HFCP and the RCFP in the down direction;

E: the distance between the LFCP and the RCFP;

E': the number of calls between the LFCP and the RCFP in the up direction;

F: the distance between the LFCP and the HFCP; and

F': the number of calls between the LFCP and the HFCP in the up direction. .

In the above definitions for A', A'', B', C'', D'', E' and F', by number of calls is meant the number of calls presently in the CCR 41 and HCR 39 in the directions specified in the respective definitions. Accordingly, outputs of respective flip flops in the HCR 39 and CCR 41 which indicate this information are inputted to the CPU 31. Further, in the Fig., the car's presently assigned direction is indicated by an arrow in a square box, the RCFP and HFCP are indicated by the symbols R and H in respective circles, respectively, the circled R and the circled H also being shown in their relative positions to the CPP to fascilitate easier understanding.

Referring to FIG. 10, after entering the program, at step ST31, the CPP is read out of the car position detecting means 35. Next, at step ST32, it is determined whether or not there are any calls in the CCR 41. If the answer at step ST32 is NO (implying that there are also no HCs in the HCR 39, since, if there where calls, they would have been transfered to the CCR 41 by the Supervisory Program P2, as will be described later), the program proceeds to step ST37 where the arrival time of the elevator car to the RCFP from its present position is given by Tar=A/V, namely the distance between the car's present position CPP and the RC's floor position RCFP divided by the average velocity v of the elevator car. If at step ST32 the answer is YES, the program proceeds to step ST33. At step ST33, the cars presently assigned direction is determined (i.e. by monitoring the outputs of respective flip flops SSd1, SSd2 in a Supervisory System Register, as will be explained later). If at step ST33 the car's presently assigned direction is determined to be UP, the program proceeds to step ST34, where it is determined whether or not the RCFP>HFCP (i.e. whether or not the RCFP is higher up then the CPP). If at step ST34 the answer is SAME (i.e. RCFP=HFCP) or YES, the program proceeds to step ST43, and the car arrival time is calculated to be Tar=A/V+A'Ts. If at step ST34 the answer is NO, the program proceeds to step ST42 and the car arrival time Tar=B/V+B'Ts+D/V+D''Ts. If at step ST33 the car's presently assigned direction is determined to the DOWN, the program proceeds to step ST35. At step ST35 it is determined whether or not the RCFP>CPP. If the answer at step ST35 is SAME (i.e. RCFP=CPP), the program proceeds to step ST39 where the Tar=0. If at step ST35 the answer is NO, the program proceeds to step ST38 and the arrival time is set as Tar=A/V+A''Ts. If at step ST35 the answer is YES, the program proceeds to step ST36, where it is determined whether or not the RCFP>HFCP. If at step ST36 the answer is YES or SAME, the program proceeds to step ST41 where the arrival time is calculated to be Tar=C/V+C''Ts+E/V+E'Ts.

If at step ST36 the answer is NO, the program proceeds to step ST40, where the arrival time is set at Tar=C/V+C''Ts+F/V+F'Ts+D/V+D''Ts. That is, since the car's presently assigned direction is DOWN, since the CPP is below the RCFP, and since the HFCP present in either the HCR or the CCR is higher than the RCFP; first, the car must go down from its present position CPP to service the lowest call LFCP presently in the RCR or the HCR as well as all the calls therebetween in the down direction, second, the car must go up from the LFCP to service the HFCP in the CCR or the HCR as well as all the calls therebetween in the up direction, third, the car must go back down again from the HFCP to service the RC, at the RCFP, presently being read out of the RCR as well as all the calls therebetween in the down direction.

It should be noted that the Arrival Time Calculating Program P5 is a rather simple program for calculating the arrival time Tar, and will not always produce the best estimates. For example, should the HFCP be for an up direction (i.e. the HFCP is a HC which is for the up direction), since it is impossible to determine in advance to what higher floor than the presently entered HFCP (unless the call is from the second highest floor) the person who entered that HFCP call actually wants to go to, and considering the fact that that information is only made available when that person actually gets into the car and enters the F# to which he wants to go to by pressing a corresponding button inside the car (i.e. enters a CC corresponding to the floor to which he wants to go to), the actuall final HFCP will not be available at the time the Tar program P5 is executed. Similarly, should the LFCP be for the down direction (i.e. the LFCP is a HC for the down direction, or a RC which has been transferred to the HCR (hereinafter referred to as transferred RC), since it is impossible to determine in advance to what lower floor than the presently entered LFCP (unless the call is from the second lowest floor) the person who entered that LFCP actually wants to go to, and considering the fact that that information will only be made available when that person actually gets into the car and enters the F# of the floor to which he wants to go to, the actuall final LFCP is not available at the time the Tar program P5 is executed for the RC presently being considered.

However, by considering the floor number that the HFCP was registered, the time that that call was made (i.e. at midnight there are few calls entered) and any number of other variables which may be considered by the Group Supervisory System 38, a more exact arrival time Tar can be estimated. Further, if a multiple elevator car is utilized, should a car be held up by an operator for a period of time longer than the estimated serivce time Ts, the calls assigned to that car may be transfered to another car to provide a better and more accurate service.

However, it should also be noted that for a 10 sec. desired time Td setting (which is the most probable setting that most operators would set their RCUs to), since the service time Ts is approximately 5 sec., the probability that the arrival time Tar, when calculated in steps ST40, ST41 and ST42 or ST43, can satisfy the condition $Tar<Td-1$ sec or $Tar=Td\pm1$ sec is much less than the probability that the above mentioned condition will be satisfied when calculated in steps ST37, ST38 or ST39. Accordingly, since the LFCP and the HFCP are not considered in steps ST37–ST39, generally, no discrepancy will arise in the calculation of Tar. Further, since the RCU's buzzers are activated only when one of these conditions are met, no erroneously early activation of the buzzers (i.o consider the possible higher or lower floors that an operator may desire to go to once entering the car from a HFCP or a LFCP, respectively, to be the highest floor Fn or the lowest floor F1, or, at the very least, the floors just above and just below the HFCP and LFCP, respectively. Another possibility is to pre-determine that all the registered down direction HCs and transferred RCs (i.e. RCs which have been transferred to the HCR 39 due to commands CMD16 or CMD17) are for the first floor F1 and accordingly to automatically set the LFCP to F1 each time a HC or a transferred RC is present in the HCR 39.

Figure 11A:
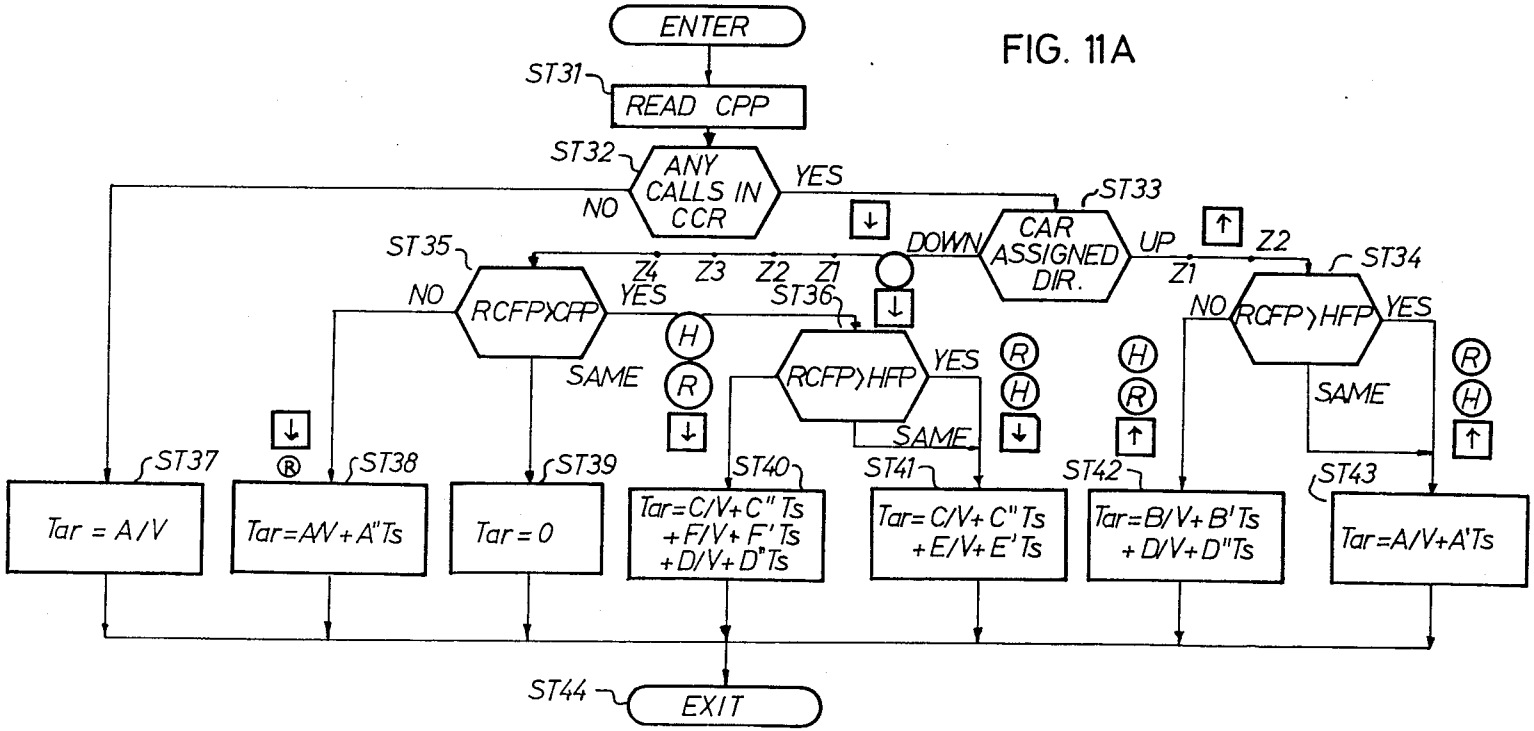
FIG. 11A shows a flow chart of an elevator car arrival time calculation program according to the present invention.
Figure 11C:
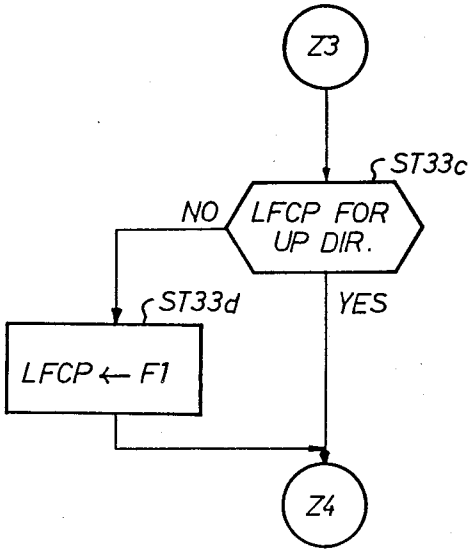
FIG. 11B,C show modifications to the flow chart shown in FIG. 11A.
Figure 11B:
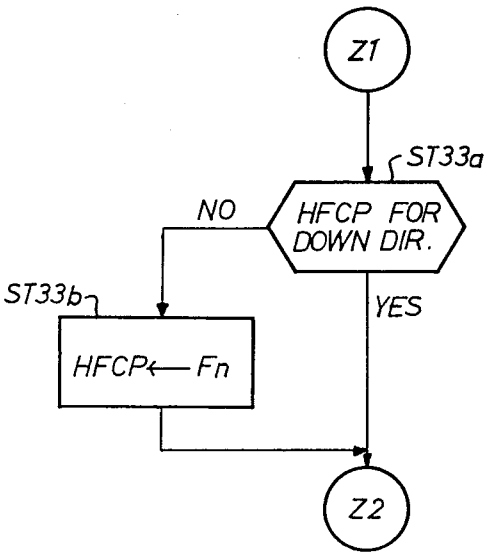

FIG. 11B shows one such modification to the Arrival Time Tar Calculating Program P5 shown in FIG. 11A. Specifically, steps ST33*a* and ST33*b* are inserted between points Z1 and Z2 and steps ST33*c* and ST33*d* between points Z3 and Z4 shown in FIG. 11A. At step ST33*a* it is determined whether or not the HFCP registered in the HCR 39 is for the DOWN direction. If at step ST33*a* the answer is YES, the program proceeds to the next step shown in FIG. 11A (i.e. the step to which point Z2 is connected to). If the answer is NO, the program proceeds to step ST33*b*, where the HFCP is made equal to Fn after which the program proceeds to the next step. Similarly, at step ST33*b* it is determined whether or not the LFCP registered in the HCR 39 is for the down direction. If at step ST33*b* the answer is YES, the program proceeds to the next step shown in FIG. 11A (i.e. the step to which point Z4 is connected to). If the answer is NO, the program proceeds to step ST33*d*, where the LFCP is made equall to F1, after which the program proceeds to the next step shown in FIG. 11A, namely step ST35. Another embodiment may have the steps ST33*b* and ST33*d* read the $HPCP=HFCP+1$ and the $LFCP=LFCP-1$, respectively, thereby providing the minimum extra distance as well as the extra service times for those floors.

FIG. 11B shows another modification to the Tar Program P5 according to the present invention, which is connected between points Z5 and Z6 in FIG. 10. Referring to the Fig., at step ST305 it is determined whether or not there are any HCs or transferred RCs for the DOWN direction registered in the HCR 39. If the answer is NO, the program proceeds to step ST33, shown in FIG. 10. If the answer is YES, the program proceeds to step ST306, where the LFCP is set to F1, after which the program proceeds to step ST33. The reason for steps ST305 and ST306 being included is because, generally speaking most down direction HC will be for F1. Similarly, most RCs, since these are only for the down direction, will also be for F1.

It should be noted that in the embodiment disclosed in FIG. 11A, since the LFCP and the HFCP are assigned floor F1 and Fn, respectively, if an actuallity this does not occur, the car may arrive at the F# of a RC before the designated desired time (i.e. earlier than the time Td from the time the respective buzzer was activated) which is highly undesirable, since the car arriving later than specified is acceptable but if it arrives earlier then specified by a RCU it may really inconvinience the operator. Accordingly, to avoid the later case, the instructions in steps ST302 and ST304 can be changed to read $HFCP=HFP+1$ and $LFCP=LFCP-1$, respectively. Namely, the HFCP is made equall to one floor higher than the presently registered HFCP and the LFCP is made equall to one floor lower than the presently registered LFCP. This problem, however, does not arrise when changing the information stored in the Tr registers Tr(1)–Tr(r) from Treg to Treq as will be described more fully later.

It should be mentioned, however, that by assumming that all down direction HCs and transferred RCs are for F1, if not the case:

1. may delay the time that the RCUb is activated and accordingly, may also delay the service time; and
2. ensures that the operator of the RCU gets the best service with respect to the accuracy of the RCUb being activated with respect to the actual arrival of the elevator car, whereby the operator spends less tim in the hall due to delays.

However, this should cause no problem since, if the operator is in a real rush, he can always activate his RCU and immediately proceed (buzzer or no buzzer) to the hall and, if the car has not arrived yet, activate the hall button, thereby being ensured of getting the best service. Moreover, the above problem of deciding the LFCP and HFCP would not apply to such a person since, such a person would more then likely set his timer to a short desired time Td, and, accordingly, the RCUb would not be activated till the car was really near, where the HFCP and LFCP make little difference, unless you are living at Fn or F2 in which case you would be it.

Another embodiment may overcome the above mentioned problem completely, by having the Hall activation means include not only the up and down direction buttons HF1U–HFnD, but include hall destination buttons for designating not only the direction but also the exact destination floor to which the person in the hall wants to go too. In this case, the originating floors (i.e. the floors from which the HCs originate) can be placed in the HCR 39 while the destination floors can be placed in another register similar to that of the CCR 41.

After the calculation of the arrival time Tar by the Arrival Time Calculating Program P5, the CPU proceeds to the Transfer and Reset Program P6.

Since two types of RCUs where disclosed namely, a first embodiment in which the RCU and the RCU's buzzer (hereafter referred to as RCUb) where reset together and a second embodiment where they where reset separately, although the following discription will infer to the latter, it applies to the first embodiment as well.

FIG. 12 shows the Transfer and Reset Program P6 according to the present invention. This program is utilized with the RCR 37A or 37B. Referring to the Fig., after entering the program, at step ST45, it is determined whether or not Tar=Td±1 sec. This calculation is done in the arithmetic unit 34 and depending on the result of this calculation will determine which of three possible routes RT1, RT2 or RT3 the program will proceed to.

It should be noted here that although a given entry when considered in this program the first time around may not be reset from the RCR 37, i.e. if the entry is considered in the first route RT1, that that entry, if not reset, will be considered again at a later time in this program via the same route or another as determined at step ST45.

Generally, the three routes represent three possibilities, namely:

1. route RT1 which represents the case where the car can not arrive at the RC's floor number (hereinafter referred to as RCF#) by the desired time Td;

2. route RT2 which represents the case where the car can arrive at the RCF# exactly at the desired time Td; and 3. route RT3 which represents the case where the car can arrive at the RCF# before the desired time Td.

The third case (i.e., the car can arrive at the RCF# before the desired time Td) brings forth the following other possibilities which must be considered, namely:

3A. The car is not moving (i.e. there are no calls in the HCR 39 or CCR 41); and 3B. The car is moving (i.e. there are calls in the HCR 39 or CCR 41).

The above mentioned possibility 3A again raises the following possibilities:

3A1. The car is not moving and there is still time before it must start moving towards the RCF#; and 3A2. The car has not been moving for some time now (i.e. with respect to the time that the RC presently being considered was registered) and the time to start moving towards the RCF# has arrived.

The above mentioned possibility 3B again raises the following possibilities:

3B1. The car is moving and can reach the RCF# on a second run (i.e. the car after passing by the RCF# can arrive at the RCF# again by the time desired, or can simply arrive in time after serving a last call in the HCR 39 or CCR 41; and 3B2. The car is moving and can not reach the RCF# on a second run, or after serving a last call in the HCR 39 CCR 41.

It should be noted however that, generally, when a RC is being considered a first time in the program P6 (i.e. since being registered in the RCR 37), the elevator car can either:

1. arrive at the RCF# earlier then the desired time Td;
2. arrive at the RCF# exactly at the desired time Td; or
3. arrive at the RCF# later then the desired time Td;

And since there is only one car, the state of the car with respect to the arrival time thereof at a RCF# should normally change from case 1 to case 2 or from case 3 to case 2 which sould provide good service times with respect to the time the RCUs' buzzers are activated. However, should the state of the car change from the case 1 or 2 to the case 3, it will only result in a delayed service with respect to the time that the RCUb was activated.

If at step ST45 it is determined that Td+1 sec.<Tar, the program proceeds to step ST46. At step ST46 the CPU issues a command CMD16 whereby the RCF# (f2'''∝fn''') which is presently being read out of the RCR 37 (i.e. corresponding to the signal (f2'-fn')) is transfered to the HCR 39, after which the program is exited at step ST60. That is, since the arrival time Tar is determined to be greater than the desired time Td+1 sec. (i.e. the car can not arrive at the RCF# by the desired time Td), only the RCF# (f2'''-fn''') is assigned to the HCR 39, so that the elevator car, when it is available or instructed by the Supervisory System 36 to do so, will start to proceed towards that floor number (f2'''-fn'''), so that, when the car arrives at a point where the condition of Td±1 sec=Tar holds, the program P6, when it is executed again by the CPU and when that same entry is considered again, will proceed through the second route RT2, wherein the CPU will issue a command CMD17, whereby the respective RCUb activated, and a command CMD18, whereby the respective entry is erased from the RCR 37, as will be explained hereafter.

It should be noted that the signal (f2''-fn'') has the same value as the signal (f2'-fn') and that the only difference is that the signal (f2''-fn'') is only present while the command CMD17 or CMD170 is issued. Similarly the same relationship exists between the signals (f2'-fn') and (f2'''-fn''') but with respect to the command CMD16 or CMD17. Further, the same relationship exists for the signals (r1''-rm'') and (r1'-rm') but with respect to the command CMD17 or CMD170.

It should also be noted that one reason for ±1 sec is included in the calculation in step ST45 is due to the fact that, similar to a residual magnetism curve in magnets, since each step in the flow charts requires a finite time (albeit, very small) to be executed, that a given RC in the RCR 37 may be erased therefrom the first and/or subsequent time(s) it is considered, and that the next time that that given RC will be considered with respect to the previous time is directly proportional to the clock frequency, the total number of steps in the respective programs to be executed by the CPU, and the number of RCs, HCs and CCs registered in the respective registers at that time, a certain tolerance in the times specified must be provided with respect to the times Tar, Td (as well as with respect to a time Treq as will be described later), since the system is operating in an on line, real time basis. Although ±1 sec. was chosen, it is not intended to limit the invention thereto and in actual fact the best choice would be a value equal to the time required to run the programs P2–P4 once while approximately 5 RCs are registered in the RCR 37. Should the cycle time be faster than one second, ±1 sec. variable can be decreased accordingly.

It should be further noted that a second reason that the ±1 sec time variable considered in steps ST45 and ST51 is included, apart from compensating for the cycle time that the CPU requires to execute the progarams P1–P6 mentioned above, is that it is also desirable to provide a certain tolerance in the decisions made (i.e. provide a certain overlap in the times of the decisions) at step ST45 and ST51. This provides a certain tolerance i.e. 0.5 sec, so that if the car is, for example, only 0.5 sec away from satisfying the conditions of Ta=Td, that condition can be satisfied if a 0.5 sec tolerance is included. Accordingly, even if the car is half a second early or late, it will still be considered as satisfying the corresponding condition, and since half a second will not inconvinience the users, this tolerance is highly desirable.

At step ST45, if it is determined that Td±1 sec=Tar, the program proceeds to step ST47. At step ST47, as briefly mentioned above, the CPU issues a command CMD17, allowing the RCF# (f2'''-fn''') presently being read out of the RCR 37 to be assigned to the HCR 39 (i.e. assigning the RCF# to the HCR 39), as well as allowing the RC's F# (f2''-fn'') and R# (r1''-rm'') to activate the RCUb corresponding to the RC presently being considered in the RCR 37. The reason that the buzzer in the respective RCU is activated by the command CMD17 is due to the respective signals (f2''-fn'') and (r1''-rm'') causing the inputs to a respective AND gate in the multiplexer 30 (i.e. the part shown in FIG. 6E) to go high, which causes the output thereof to go high, which causes the respective RCUb to be activated.

It is assumed that the hardware shown in FIG. 6H is utilized for reseting the RCU's flip flops FF1 and FF2 and that the hardware shown in FIG. 6E is utlized for reseting the RCUs' buzzers. However, the flow charts disclosed will work just the same for the case where only the hardware shown in FIG. 6E is used to cause both the respective RCU to reset and the buzzer therein to be activated, as was previously described.

Since the programs P2-P4 are repeatedly executed any number of times in one second, the fact that the same entry may have been previously examined by this program P6 and that the RCF# (f'''-fn''') may have been previously assigned to the HCR 39 at step ST46, the fact that this time through the program the RCF# (f2'''-fn''') is again assigned to the CCR 41 at step ST46 or ST47, this only serves to set the same corresponding register in the HCR 39.

Next, at step ST48, the CPU issues a command CMD 18, whereby the entry presently being read out of the RCR 37 is reset therefrom, after which the program is exited at step ST60. Namely, since the RCF# has been registered in the HCR 39 and the buzzer of the RCU corresponding to the RC presently being considered in the RCR 37 has been activated (i.e. implying that the RCU has also been reset) at step ST47, the information pertaining to the RC in the RCR is not required any longer and can be erased.

At step ST45, if it is determined that Td−1 sec>Tar, the program proceeds to step ST49, implying that the car can arrive before the time desired Td−1 sec., i.e. to route RT3.

At step ST49, it is determined whether or not there are any calls presents in the HCR 39 (i.e. by monitoring the Q outputs of S-R flip flops H1U-HnD and H2D'-HnD' in the HCR 39) or CCR 41 (i.e. by monitoring the Q outputs of S-R flip flops CF1-CFn in the CCR 41, as will be explained later). If at step ST49 the answer is NO, the program proceeds to step ST50, where a command CMD170 is issued whereby the respective RCUb is activated (i.e. due to the signals (f2''-fn'') and (r1''-rm'') being supplied to the fourth part of multiplexer 30). Next at step ST50, the arrival time Tar is re-adjusted to be equall to Tar'=Tar+Tp−Treg. This step is necessitated because, once the RCUb is activated, the arrival time Tar' takes on a whole new meaning, namely, the time from the time that the RCUb was activate must be taken into consideration. In other words the time the RC was registered Treg with respect to the present time Tp must be considered as will be explained more fully later. Next, at step ST52, similar to step ST45, the relationship between Tar' and Td is determined. If at step ST52 it is determined that Td−1 sec>Tar', implying that the car can arrive before the desired time Td (i.e. with respect to the time the respective RCUb was activated), the program is exited at step ST60. If at step ST52 it is determined that Td+1 sec<Tar', implying that the car can not arrive by the desired time Td (i.e. with respect to the time the respective RCUb was activated), the program proceeds to step ST53 where the RCF# is assigned to the HCR 38. If at step ST52 it is determined that Td+/−1 sec=Tar', implying that the car can arrive at the desired time Td (i.e. with respect to the time the respective RCUb was activated), the program proceeds to step ST54, where the CPU issues a command CMD17, whereby the RCF# is assigned to the HCR 39 and the RCUb is activated, after which the program proceeds to step ST55, where the CPU issues a command CMD18, whereby the respective RC is reset from the RCR 37, after which the program is exited at step ST60.

For example, assuming the following situation:

1. A RCU is activated with a desired time setting of 10 sec. i.e. Td=10 sec;

2. The car is only 5 sec away from the RCF# i.e. Tar=5 sec.; and

3. That there are no other calls in the HCR 39 and CCR 41 at that time, i.e. the car is standing still.

Accordingly, the first time the program P6 is executed for this RC, since the car can arrive to the RCF# before the desired time Td, i.e. Td−1 sec>Tar, the program would proceed from step ST45-ST49. Since there are no calls in the HCR 39 and the CCR 41, i.e. the car is not moving, the program proceeds from step ST49-ST50-ST51-ST52. At step ST51 Tar' is calculated, and since this RC has just been registered, this is the first time the step ST51 is carried out for this RC and, accordingly, Tp (i.e. the time that the step ST51 is carried out) is almost the same as Treg which means that Tar'=Tar. Accordingly, at step ST52 again it will be determined that Td−1 sec>Tar', i.e 10−1>5, and the program goes from step ST52 to step ST60 (i.e the program is exited) without having assigned the RCF# to the HCR 39. Accordingly, only the RCUb was activated at step ST50 and the car was not instructed to go anywhere. Since the car is standing still, since there are no other calls, exactly the same thing will happen the next time this program is executed (i.e. go through steps ST45-ST49-ST50-ST51-ST52-ST60), with the only difference being that the value of Tp has increased a little and accordingly the value of Tar' will be a little larger then it was the time before. This is repeated for about 4 seconds when finally Tar'=Td±1 sec, at which time the program proceeds from step ST52-ST54-ST55-ST60, whereby the RCF# is assigned to the HCR 39 and the RC is reset from the RCR 37.

Accordingly, unless some record of the passage of time since the activation of the RCUb was activate is made (i.e. as by Tar' in step ST51), the car will never be instructed to service that RC. The reason the car is not instructed to service the car immidiately and only instructed to service the RC when Td±1 sec=Tar' is to save electricity, i.e. should other calls be registered during that interval, the car can be instructed accordingly.

In other words, if no calls are assigned to the elevator car, and if the elevator car is at the top floor Fn, since the RC is not assigned to the HCR 39 till the last possible second, should another RC or a HC be entered during the time the time that the RC is not assigned, the CPU and Supervisory system may decide to service the later entered call first, at the possible expense of the operator of the first call. By expense is meant that the operator of the RCU of the first entry may be serviced by the elevator car at a later time than he was informed (by the activation of the buzzer of his RCU). That means that, although the system informs the operator that an elevator will be available at a time Td from the time his buzzer sounds and not before, the elevator car may actually arrive later then that. This serves to reduce the number of runs the car makes, thereby reducing the wear thereof as well as saving electricity, while still providing a service to the user.

It should be noted, however that, if the car has been instructed by the Supervisory System to proceed to a waiting floor i.e. F1, to wait for calls to come in, should a RC be registered while the car is proceeding to the waiting floor, the car may be instructed to stop on its way at the F# of the RC.

If at step ST49 it is the answer is YES (i.e. implying that there is at least one call in the HCR 39 or CCR 41), the program proceeds to step ST56. This case is representative of, for example, an operator activating his RCU with a desired time Td setting of 10 sec exactly as the car, full of people, is just about to pass by his floor on the way down to the first floor. Even though the car is only one second away from arriving at the RCF# of that operator at the time he activated his RCU, you don't want to stop the car at his floor and let all the people inside the car wait for 9 sec for him to arrive. Accordingly, in the remaining steps of this program, the above mentioned posibilities 3B1 and 3B2 will be described.

At step ST56 the calculation Trem=Td−Tar is made, where Trem represents the time that would still remain after the car arrived at the RCF# of the RC being considered with respect to the desired time Td specified by the setting of the timer therein. Next, at step ST57, the Arrival Time Calculation Program is executed again with the cars present position CPP set at the RCF# and the calls that will be serviced on the car's way from it present actual position to the RCF# being neglected (i.e. assumed as having been serviced. Namely, the calls on the way from the car's present position to the RCF# are assumed to have been serviced, and only the calls remaining after that, if any, are considered in determining the arrival time Tar of the car. Next, at step ST58, it is determined whether or not the arrival time Tar2=Trem±1 sec, where Tar2 represents the arrival time calculated at step ST57. If at step ST58 it is determined that Trem+1 sec<Tar2, implying that the car can not arrive at the RCF# by time Td a second time, the program is exited without activating the RCUb or assigning the RCF# to the HCR 39, since, if the RCF# where assigned now, the car would automatically stop at the RCF# on its first run. If it is determined that Trem−1 sec>Tar2 or that Trem±1 sec=Tar2, implying that the car can arrive on or before the time Trem at the RCF# (i.e. on a first run after having serviced the last call in the HCR 39 or CCR41, or on a second run while serving calls or after having serviced the last call in the HCR 39 or CCR41), the program proceeds to step ST59, where the RCUb is activated. In this case, also, the RCF# is not assigned, since, that would limit the car to service that RC on a first run which may not be the case.

It should be noted that, when the program is exited via route RT3A1, the RCF# (f2'''-fn''') is not assigned to the HCR 39. This is to try and save electricity. More specifically, since the elevator can arrive at the floor of the RC being considered faster than the time that the car is desired Td (i.e. with respect to the time the RCUb was activated), the RCF# is not assigned to the HCR 39 until a time t=Treg+Td−Tar.

FIG. 9 shows schematic diagrams of the HCR 39 and the CCR 41, wherein the circuit to the left of the broken line represents the HCR 39 and the circuit to the right of the broken line represets the CCR 41. Refering to the Fig., numerals SSC1F1-SSC1Fn designate micro switches (normally open) of the floor arrival detecting means 43 located along the shaft of the elevator car at positions F1-Fn, respectively. The switches SSC1F1-SSC1Fn are activated (closed) by a lever attached to the side of the car when the car arrives at the respective floors F1-Fn. Numerals SHF1U-SHFnD designate normally open switches which are activated when the hall call push buttons HF1U-HFnD (shown in FIG. 2) are pressed, respectively. (Also designated as the hall call activating means 40 in FIG. 3). The U and D suffixes designate up and down directions, respectively. Numerals H1U-HnD designate R-S flip flops for storing HCs entered through the hall call push buttons HF1U-HFnD, which correspond to the switches SHF1U-SHFnD, respectively. Numerals HLF1U-HLFnD designate hall light indicating means, located in the halls F1-Fn, respectively, for indicating which of the hall push buttons HF1U-HFnD, respectively, has been activated. Numerals H2D'-HnD' designate R-S flip flops for storing RCs transferred from the RCR 37 to the HCR 39 when the CPU issues the command CMD16 or a command CMD17 as indicated by the signals (f2'''-fn'''), wherein the signal f2''' serves to set flip flop H2D', signal f3''' serves to set the flip flop H3D' (not shown), and so on. Numerals SCF1-SCFn designate car call push buttons (normally open) of the car call activation means 42 located in the car of the elevator for registering CCs for floors F1-Fn, respectively. Numerals CF1-CFn designate R-S flip flops which are set in response to the activation of the car call push buttons SCF1-SCFn, respectively, and which are utilized for storing CCs. Numerals CLF1-CLFn designate light indicating means located in the car of the elevator for indicating the CCs entered through the car call push buttons SCF1-SCFn, respectively, which the car will stop at. Numeral 44 designates a logic control unit which:

1. Only allows HCs which are higher than the present position of the elevator car, when the car is assigned in the up direction, to be transfered from the HCR 39 to the CCR 41;

2. Only allows HCs which are lower than the present position of the elevator car, when the car is assigned in the down direction, to be transfered from the HCR 39 to the CCR 41;

3. Only allows CCs, entered through the car activation means SCF1-SCFn, which are for a floor number higher than the present position of the elevator car, when the assigned direction of the car is in the up direction, to be entered into the CCR 41; and 4. Only allows CCs, entered through the car call activation means SCF1–SCFn, which are for a floor number lower than the present position of the car, when the assigned direction of the car is in the down direction, to be entered into the CCR 41.

The signals d1,d2 are supplied by the Supervisory System 38 and designate the assigned direction of the car, namely:

d1,d2=0,0 is a don't care state;

d1,d2=0,1 signifies that the car's assigned direction is d1,d2=1,0 signifies that the car's assigned direction is down; and d1,d2=1,1 signifies that no direction is assigned to the car and that the elevator car may be transfered from its present posie car is presently at floor F3.

Accordingly, since d2=0, the inverted input to AND gate I12' is high and when the car arrives at floor F2, the switch SSC1F2 is activated which causes the non inverted input of AND gate I12' to go high, which causes the output thereof to go high, which, through OR gate J12', causes the flip flop H2D to reset. However, assuming that the car's assigned direction is up, that the car is presently at the first floor F1, and the second floor hall down button HF2D is activated (i.e. the flip flop H2D is set), since d2=1, the inverted input to AND gate I12' is low which prevents the flip flop H2D from being reset when the switch SSC1F2 is activated by the car passing by the floor F2 in the up direction. Accordingly, the AND gates I12,I12'–I1n—-1,I1n−1' allow the flip flops H2U,H2D–Hn−1,Hn−1, to be reset when the car passes by the floors F2–Fn−1 and wise versa, respectively, when the assigned direction is the same as the car's present direction, as well as allow the flip flops H2D'–Hn−1D' to be reset when the car passes by the floors F2–Fn−1 in the down direction while the car's assigned direction is down. The first and last floors F1 and Fn do not require the AND gates because the elevator car must obviously change direction at those floors. The flip flops H2D'–HnD' (which are set in response to the floor number signals f2'''–fn''', respectively, from the RCR 37) are reset the same way the flip flops H2D–HnD, respectively.

It should be noted that when the supervisory system causes the outputs signals d1,d2=1,1, the inverting inputs to all the AND gates I12,I12'–I1n−1,I1n−1' are all low, which means that non of the flip flops H2U,H-2D–Hn−1U,Hn−1D, would reset when the elevator car passes through the respective floors F2–Fn−1 in the up direction or the down direction. This means that the car can be instructed to go to a given floor without reseting any of the HCs or RCs which where transfered to the HCR 39 (hereinafter referred to as transferred RCs) between its present position and said given floor. This is especially usefull in a multiple car elevator control system as will be discribed later.

Numerals J22–J2n designate OR gates which surve to combine the down HCs, as designated by the flip flops H2D–HnD being set, with the transferred RCs as designated by the flip flops H2D'–HnD' being set, respectively. Numerals I21U–I2nD designate AND gates, the respective first inputs of which are connected to respective outputs (a1–an) from the Logic Control Unit 44 and the second inputs of which are connected to either the outputs of flip flops H1U–HnD or to the outputs of the OR gates J22–J2n, for allowing only the calls in the HCR 39 which are above or below the present position of the elevator car to be transferred to the CCR 41 when the assigned direction of the car is up or down, respectively, as determined by the signals on the outputs of the Logic control unit 44. Numerals J32–J3n−1 designate OR gates utilized for combining the up and down calls of each respective floor F2–Fn in the HCR 39, numerals J42–J4n−1 designate OR gates and numerals I31–I3n designate AND gates which allow only CCs, entered through the car swiches SCF1–SCFn, which are for floor numbers above or below the present position of the car when the assigned direction is up or down, to be registered in the flip flops CF1–CFn, respectively. Numerals J51–J5n designate OR gates, numerals CLF1–CLFn designate car light indicating means which are located in the car for visually indicating which floors the car will stop at. Numerals J61–J6n designate OR gates utilized for combining the calls in the HCR 39, CCs in the CCR 41 and calls from the Supervisory System 38 (i.e. outputs of flip flops SSF1–SSFn) to be entered into the Drive Control Unit 45. The Drive Control Unit 45 is well known in the art.

Figure 13:
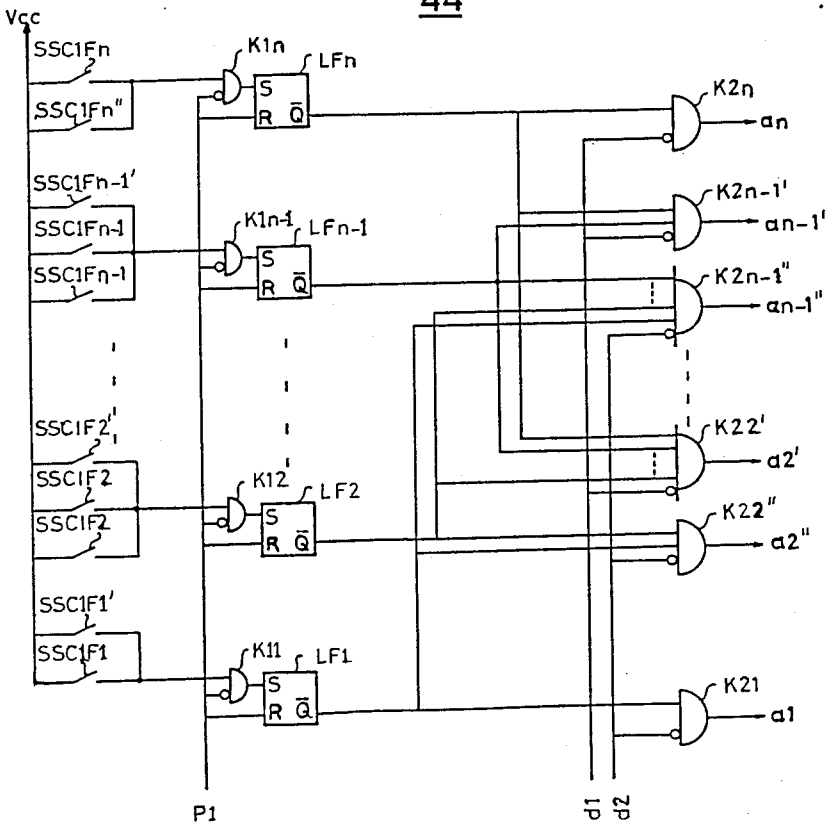
FIG. 13 shows a circuit diagram of a logic control unit according to the present invention.

FIG. 13 shows the logic control unit 44 according to the present invention. Referring to the Fig., numeral SSC1F1–SSC1Fn (which correspond to the car's floor arrival detecting means 43 shown in FIG. 3) designate micro switches placed in the shaft of the elevator car at the floors F1–Fn, respectively, numeral LF1–LFn designate R-S flip flops which are set in response to the closing of the switches SC1F1–SC1Fn, respectively, numeral P1 designates a reverse direction signal provided by the Supervisory System 38 each time the direction of the car is reversed for causing the flip flops LF1–LFn to reset, numerals K11–K1n designate AND gates which surve to prevent both inputs to any of the flip flops LF1–LFn from going high when the reverse direction signal P1 is issued by the Supervisory System, and numerals K21–K2n designate AND gates which surve to generate the signals (a1–an) as a function of the output levels of the flip flops LF1–LFn, respectively. Accordingly, signal a1 is high only when the car's assigned direction is down (i.e. d1,d2=1,0) and the output QBAR of flip flop LF1 is high (i.e. the car is above the first floor F1). The signal a2'' is high only when the assigned direction is down and the outputs QBAR of flip flops LF1 and LF2 are high indicating that the car is above the second floor F2. Similarly the signal (an−1'') is high only if the assigned direction is down and the outputs QBAR of flip flops LF1–LFn−1 are all high indicating that the car is above the floor Fn−1. The signal (an) is high only when the assigned direction is up (i.e. d1,d2=0,1) and the output QBAR of flip flop LFn is high indicating that the car is below the highest floor Fn. The signal (an−1') is high only when the assigned irection is up ad the outputs QBAR of flip flops LFn−1 and LFn are high indicating that the car is below the floor Fn−1. Similarly, the signal (a2') is high only when the assigned direction is up and the outputs QBAR of flip flops LF2–LFn are all high indicating that the car is below the second floor F2.

It should be noted that additional switches SSC1F1'–SSC1Fn−1' and SSC1F2''–SSC1Fn'' are physically positioned below and above the switches SC1F1–SC1Fn, respectively, for providing advance warning that the car is arriving at the respective floors, and accordingly, when the car is within a given distance from a floor platform, a CC, HC or transferred RC for that floor number should not be allowed to entered into the CCR 41.

Figure 14:
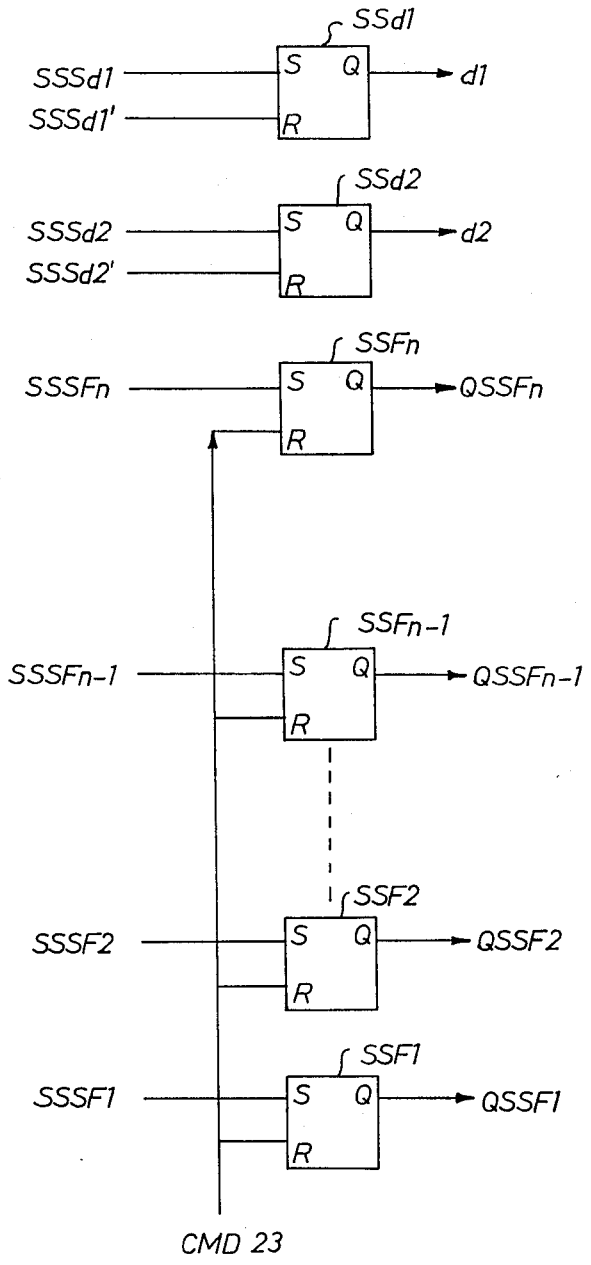
FIG. 14A shows a Supervisory System Register SSR 38A utilized with the Supervisory Systems 38, 380 and 3800 according to the present invention.
FIG. 14B shows a System Supervisory program P2 according to the present invention.

FIG. 14A shows a Supervisory System Register (hereinafter referred to as SSR 38A utilized in the Supervisory System 38. Referring to the Fig., numerals SSF1–SSFn designate R-S flip flops which are set in response to signals SSSF1–SSSFn, respectively, provided by the Supervisory System 38. Numerals SSd1 and SSd2 designate S-R flip flops utilized for storing the car's assigned direction signals d1,d2 generated in response to signals SSSd1, SSSd1', SSSd2 and SSSd2' provided by the Supervisory System 38. The S-R flip flops SSF1–SSFn are utilized by the Supervisory System 38 for storing therein a highest hall call for the down direction HHCD and a lowest hall call for the up direction LHCU as well as for storing a command for the car to procceed to floor F1 when flip flop SSF1 is set, as will be described in conjunction with the System Supervisory Program P2 herebelow.

Figure 14B:
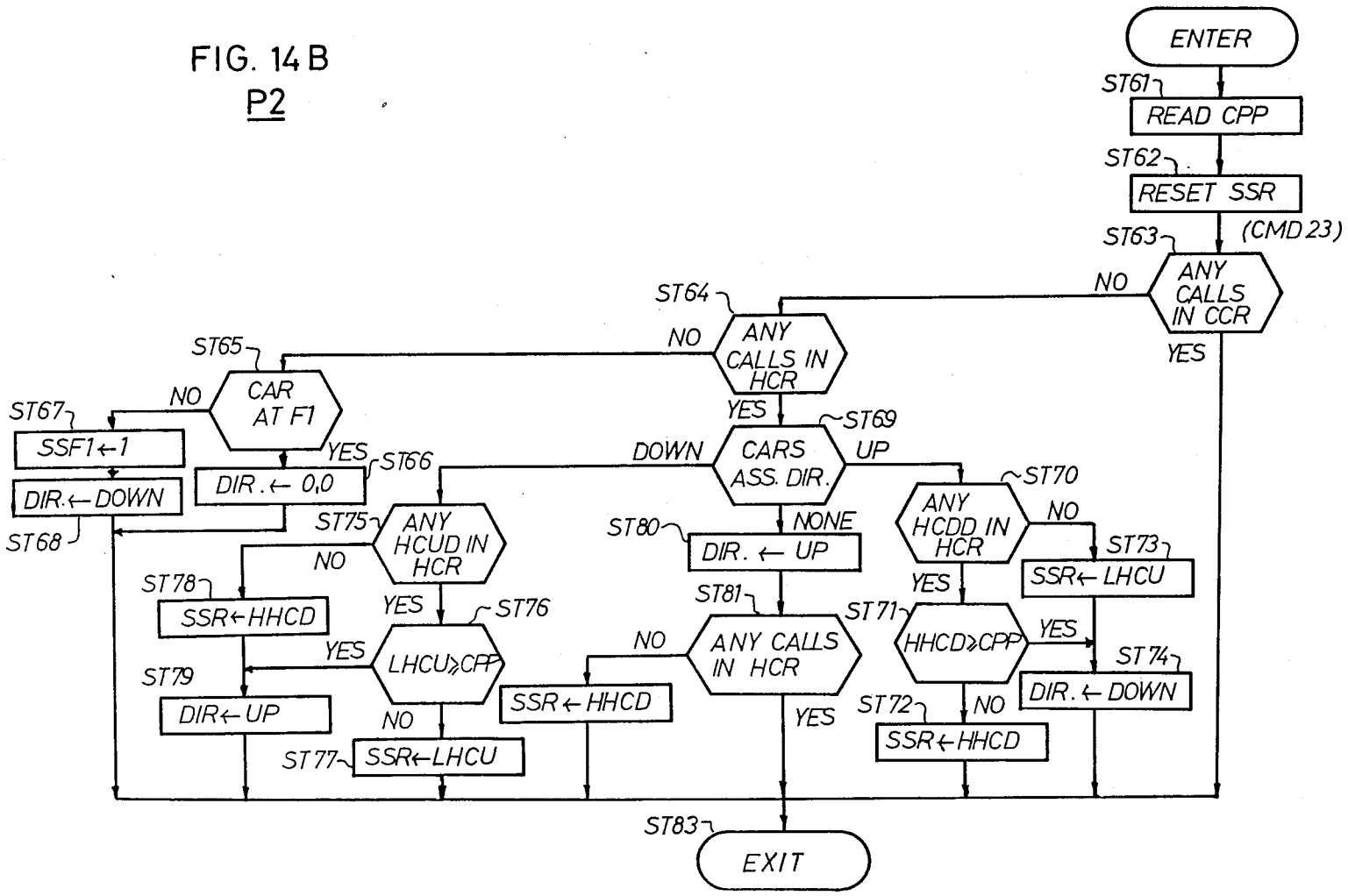

FIG. 14B shows the System Supervisory Program P2 according to the present invention. Although a rather simple program to be executed by the Supervisory System is disclosed, in actuall use it may include many other variables such as the demand conditions during different times of the day, etc.

Referring to FIG. 14B, after entering the program, at step ST61, the present position of the car CPP is read (i.e. by monitoring the otput of the Car Position Detecting Means 35). Next, at step ST62, a command CMD3 is issued, whereby the rigisters SSF1–SSFn in the Supervisory System Register SSR are reset. Next, at step ST63, it is determined whether or not there are any calls (i.e. CCs, HCs and/or transferred RCs) in the CCR 41. This is done by monitoring the outputs of the OR gates J61–J6n of the CCR 41. If at step ST63 the answer is YES, the program is exited at step ST83 without doing anything, since, the fact that there are still calls in the CCR 41 implies that not all the calls in the CCR 41 for the presently assigned direction have been serviced as yet, regardless of the assigned direction of the elevator. If at step ST64 the answer is NO, (i.e. all the outputs of OR gates J61–J6n are low) the program proceeds to step ST64 where it is determined whether or not there are any calls (i.e. HCs and/or transferred RCs) in the HCR 39. This is done by monitoring the outputs § the flip flops H1U–HnD and H2D'–HnD' (i.e. if all the outputs of these flip flops in the HCR 39 are low, it implies that there are no calls in the then there are no calls in the HCR 39). If at step ST64 the answer is NO (i.e. no calls in the HCR 39), the program proceeds to step ST65, where it is determined whether or not the car is at floor F1. If at step ST65 the answer is NO, the program proceeds to step ST67 where the Supervisory System 38 instructs the car to proceed to F1, i.e. the flip flop SSF1 in the SSR 38A is set, and, thereafter, at step ST68, the car's direction is set to DOWN (i.e. d1,d2=1,0). If at step ST65 the answer is YES, the car is left waiting at floor F1 and the car direction is assigned to be NONE (i.e. d1,d2=1,1), which prevents any calls from being inputed to the car call register (until the direction status is changed) and prevents any calls from the hall call register 39 from being transfered to the car call register 41. Accordingly, during the night when very few calls are entered the car is instructed to wait as floor F1 and the program, when executed, proceeds through steps ST61–ST66 while waiting for calls. If at step ST64 the answer is YES (implying that there is or are calls in the HCR 39 and that those calls have not been transfered to the CCR 41 because they are either:

1. for the opposite direction than the car's presently assigned direction;

2. above or below the present position of the car when the assigned direction of the car is DOWN or UP, respectively; or 3. that the car is at floor F1 with the NONE (i.e. d1,d2=1,1) direction assigned to the car)), the program proceeds to step ST69 where the car's presently assigned direction is monitored. If the presently assigned direction of the elevator car is DOWN (i.e. d1,d2=1,0), the program proceeds to step ST75 where it is determined whether or not there are any calls in the HCR 39 for the UP direction (hereinafter referred to as HCUD). This is done by monitoring the outputs of the flip flops H1U, H2U, H3U, . . . and Hn−1 only in the HCR 39. If the answer at step ST75 is NO, implying that none of the calls present in the HCR 39 are for the UP direction and that the calls for the DOWN direction are higher than the car's present position CPP (since if they were below the CPP, they would have automatically been transfered from the HCR 39 to the CCR 41 which would have caused the answer at step ST63 to be YES), the program proceeds to step ST78. At step ST78, a respective flip flop SSF1–SSFn of Supervisory System Register SSR 38A corresponding to the highest call for the down direction (hereinafter referred to as HHCD) present in the HCR 39 is set (i.e. corresponding to the highest HC for the DOWN direction, or transferred RC present in the HCR 39, as indicated by the respective highest set flip flop H2D–HnD and/or H2D'–HnD' being set). Next, at step ST79, the direction of the car is changed to UP. If at step ST75 the answer is YES, the program proceeds to step ST76 where it is determined whether or not the lowest HC for the UP direction (hereinafter referred to as LHCU) presently registered in the HCR 39 is from a floor higher than or equal to the CPP. If at step ST77 the answer is NO, the program proceeds to step ST77, where the SSR 38A is set to the LHCU (i.e. a respective flip flop SSF1–SSFn of the Supervisory System Register SSR 38A, corresponding to the LHCU present in the HCR 39 as indicated by the lowest set flip flop H1U–Hn−1U being set, is set), after which the program is exited at step ST83. If at step ST76 the answer is YES the program proceeds to step ST79 where, as mentioned before, the car's direction is changed to UP.

If at step ST69 it is determined that the car's presently assigned direction is UP, the program proceeds to step ST70 where it is determined whether or not there are any calls in the HCR 39 for the down direction (hereinafter referred to as HCDD). This is done by monitoring the outputs of the OR gates J22–J2n of the HCR 39. If at step ST70 the answer is NO, the program proceeds to step ST73, where the LHCU direction presently registerred in the HCR 39 is assigned to the SSR 38A (i.e. a respective flip flop is set in the SSR 38A). Next, at step ST74, the car's direction is changed to DOWN. If at step ST70 the answer is YES, the program proceeds to step ST71 where it is determined whether or not HHCD direction is lower than or at the same level as the CPP. If at step ST71 the answer is NO, the program proceeds to step ST72 where the floor number of the HHCD is assigned to the SSR 38A, after which the program is exited at step ST83. If at step ST71 the answer is YES, the program proceeds to step ST74 where the car's assigned direction is changed to DOWN, after which the program is exited at step ST83. Steps ST70–ST74 are complementary of the steps ST75–ST79, respectively, for the respective directions.

If at step ST69 it is determined that the car's presently assigned direction is NONE, implying that the car is at floor F1, the program proceeds to step ST80, where the car's assigned direction is changed to UP (i.e. d1,d2=0,1). Next, at step ST81, it is determined whether or not there are any calls present in the CCR 41 (i.e., since the direction was changed from NONE to UP at step ST80, at step ST81 it is determined if any HCUD where present in the HCR 39 which would have been automatically transfered to the CCR 41 when the car's direction was changed to UP.). If at step ST81 the answer is YES, the program is exited at step ST83. If at step ST81 the answer is NO, the program proceeds to step ST82 where the HHCD direction presently in the HCR 39 is assigned to the SSR 38A, after which the program is exited at step ST83.

For example, if the car's assigned direction is DOWN, a car call exists in the CCR 41 for the first floor F1, and a down direction hall call exists in the HCR 39 for the floor Fn, when the service of the first floor call is complete, the Supervisory System will proceed as follows:

1. The first time the Supervisory System program is exectuted, the program goes through steps ST61, ST62, ST63, ST64, ST69, ST75, ST78 and ST79, whereby the assigned direction is changed to UP and the HHCD in the HCR 39, namely, HFnD is assigned to the SSR 38A, namely SSFn is set;

2. The next and consecutive times the Supervisory program is run, the program proceeds to steps ST61, ST62, ST63, ST64, ST69, ST70, ST71 and ST72, whereby the HHCD is repeatedly assigned to the SSR and the assigned direction is not changed; and 3. When the car finally reaches the HHCD (in this case Fn), the next time the program is run, the program proceeds through steps ST61, ST62, ST63, ST64, ST69, ST70, ST71 and ST74, whereby the car's assigned direction is changed to DOWN again, so that the floor Fn is serviced.

It should be noted that it is not necessary to re-assign the floor Fn to the SSR 38A because as soon as the car's assigned direction is changed from UP to DOWN at the floor Fn, the respective hall call HnD will be automatically transferred from the HCR 39 to the CCR 41.

Figures 9A, 9B:
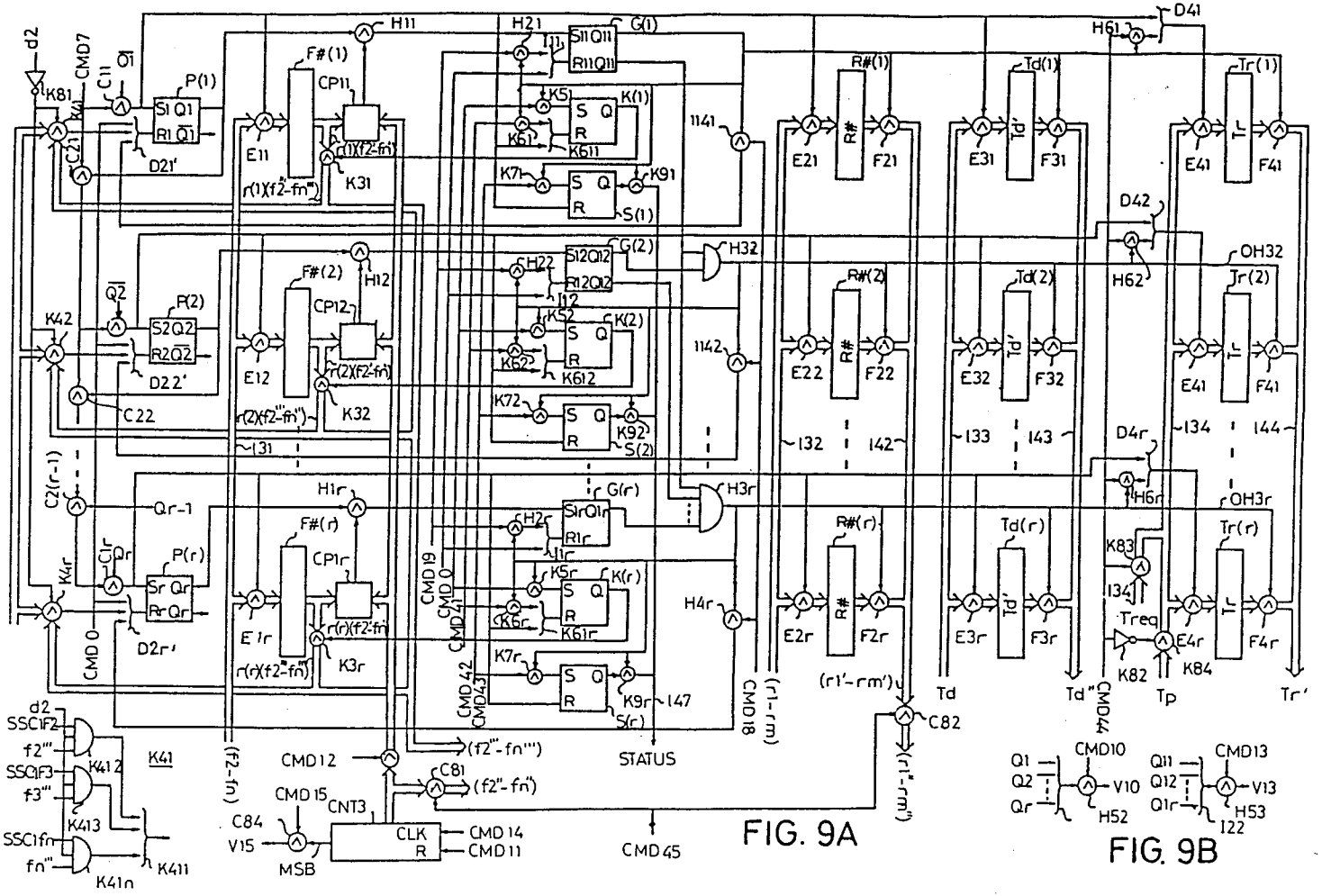
FIG. 9A,B show a third embodiment of the room call register RCR 37C for the single car elevator control system according to the present invention.

FIGS. 9A, B and C show a third embodiment of the RCR 37C for a single car elevator system according to the present invention. In the Fig., the same portions as those shown in the corresponding first and second embodiments RCR 37A and RCR 37B shown in FIGS. 7A ,B and 8A, B are designated by the same reference numerals, and the description thereof will not be repeated herebelow.

The advantages the RCR 37C has over the RCR 37A and 37B are that:

1. The information stored in the Tr registers is changed from a value representative of the Treg to Treq, where Treq=Treg+Tb where Tb is the time Tp that the RCUb was activated. This leads to the advantage that the exact time Treq that the car is expected to service the respective RCs in the RCR 37C is specified, thereby providing more accurate results as well as simplifying the associated software;

2. Even though the RCF# of the RCs stored in the respective rows of the RCR 37C have been assigned to the HCR 39, they may subsequently be erased therefrom. This leads to the advantage that, should it be determined that the car can arrive sooner then originally was expected (i.e. due to the HFCP's or LFCP's destination floors not actually being the pre-determined Fn or F1, respectively, as described with respect to the arrival time Tar Program P5), the RCF# can be subsequently from the HCR 39.

3. a STATUS value has been assined to the car which allows to determine whether or not:

(a) the value is the Tr register is Treg or Treq;

(b) the RCUb has been previously activated;

4. The RCs in the RCR 37C are self resetting when it is detected that the car has arrived at the respective RCF#, that the car direction is down and that the car is assigned to service that call as indicated by the respective K# register being set;

5. The software program associated with the RCR 37C provides for the added possibility of reseting a RC from the RCR 37C, and, accordingly, the corresponding RCF# of the transferred RC from the HCR 37 (as will be described later), if it is determined that no HC corresponding to that RC exists in the HCR by the time that:

(a) the car is 1 sec from arriving at the RCF#; and (b) that the present time is less than 1 sec from the time Treq that the car is expected to service that RCF#.

This is made possible because the exact time Treq that the car is supposed to service the RCF# is stored in the Tr registers. Accordingly, unless a HC is registered in the hall corresponding the RCF# in the RCR 37C by the above specified time, the RC is erased from the RCR 37C and the car does not stop at that F# (for that RC anyway). This requires the operator of each RCU not only to activate his RCU but to also press the corresponding hall button at some time before the elevator car is expected to service that hall (i.e. 1 sec before it is expected to service that hall). For example, if the operator set his timer for 10 sec (i.e. Td=10 sec) and activates his RCU (i.e. presses the button 22), once the buzzer of his RCU is activated by the elevator control system (i.e. informing the operator that a car will be available at his floor in 10 sec), the operator must get to the elevator hall and press the corresponding hall button for the down direction within 9 seconds of the activation of his buzzer or the car will not service that call. This makes sure that the person responsible for a RC actually does show up in the hall and has registered a corresponding HC, thereby not inconviniencing riders in the car by having the car respond to a RC and have no one enter the car. Of course, the pressing of the hall button can be eliminated if hall detecting means for detecting the presence or obsence of a passenger are provided.

Referring to FIGS. 9A, B and C, numerals K(1)–K(r) designate CAR S-R flip flops utilized for storing information representative of whether or not the RCF# of the RC stored in the respective row r(1)–r(r) is to be assigned to the HCR 39, as well as whether or not to allow the respective presence flip flop P(1) to P(r) to be automatically reset when the car arrives at the RCF# specified in the respecitive F# register while moving in the down direction. The outputs Q of the CAR flip flops K(1)–K(r) connect to the enabling (i.e. single) inputs of AND gates K31–K3r, the other inputs of which are connected to the respective outputs of the F# registers F#(1)–F#(r), and the outputs of which are connected to the respective first inputs of AND gates K41–K4r. The respective outputs (f2'–fn') of the F# registers F#(1)–F#(r) are also connected to the respective inputs of the respective comparators CP11–CP1r. The respective outputs f2'''–fn''' of the AND gates K31–K3r are also connected to the inputs of the OR gates J22–J2n of the HCR 39 shown in FIG. 9. Accordingly, the output f2''' connects to the input of OR gate J22, f3''' connects to the input of the OR gate J23 (not shown), etc. Consequently, the S-R flip flops H2D'–HnD' in the HCR 39 are not utilized when the RCR 37C is used, and the signals f2'''–fn''' shown in HCR 39 connect directly to the OR gates J22–J2n. Otherwise the HCR 39 is exactly the same.

It should be noted that the ouputs of the AND gate K31–K3r are physically ORed together, so that the output signal f2''' of gate K31 in row r(1) is connected to the output signal f2''' of gate K32 in row r(2) and so on for the rest of the rows. Accordingly, the signal fn''' (which is applied to the input OR gate J2n the other input of which is connected to the output Q of flip flop HnD of the HCR) is high whenever any of the output signals fn''' in the rows r(1), r(2) . . . r(r-1), or r(r) appearing on the respective outputs of the AND gates K31–K3r is or are high. The input and output lines 131–134 and 142–144 are similarly connected.

Numerals S(1)–S(r) designate STATUS S-R flip flops in rows r(1)–r(r), which are utilized to indicate whether the value stored in the respective Tr registers Tr(1)–Tr(r) is a value representative of the time that the resective RC was registered Treg or the time that the elevator car is expected to service that RC Treq. Numerals K51, K61–K5r, K6r designate AND gates, for allowing commands CMD41 and CMD42 set or reset the respective CAR flip flop K(1)–K(r) of the RC in the row presently being monitored (i.e. as indicated by either the output Q of flip flop G(1), or a respective output of AND gates H32–H3r being high, since only one of these outputs can be high at any given time, the high output representing the row the RC of which is being monitored). Numerals K71–K7r designate AND gates, for allowing a command CMD43 to set the STATUS flip flop S(1)–S(r) of the row presently being monitored (i.e. as indicated by either the output Q of flip flop G(1), or a respective output of AND gates H32–H3r being high, since only one of these outputs can be high at any given time, the high output representing the row being monitored). Numerals K91–K9r designate AND gates, for allowing the respective STATUS value stored in flip flop S(1)–S(r) of the row presently being monitored (i.e. as indicated by either the output Q of flip flop G(1), or a respective output of AND gates H32–H3r being high, since only one of these outputs can be high at any given time, the high output representing the row being monitored) to be read out on output line 147. The reset inputs R of the STATUS registers S(1)–S(r) are connected to the outputs of the AND gates C11–C1r, respectively, so that each STATUS flip flop is automatically reset each time a new RC is entered into the corresponding row in the RCR 37C. Similarly, the reset inputs R of the CAR registers K(1)–K(r) are connected to the outputs of the AND gates C11–C1r through OR gates K611–K61r, respectively, so that each CAR flip flop is automatically reset each time a new RC is entered into the corresponding row in the RCR 37C.

Numeral K81 designates an invertor the input of which is connected to the direction signal d2 of the direction signals d1, d2 from the SSR 38A, and the output of which is inputted to the AND gates K41–K4r. The outputs of the AND gates K41–K4r are connected to respective third inputs of the OR gates D21'–D2r', respectively, for causing the respective presence flip flops to automatically reset when the respective CAR flip flop is set and the elevator car arrives at the F# specified in the respective RC while travelling in the down direction.

Numerals K82 designates an inverter, numerals H61–H6r AND gates, D41–D4r OR gates, numerals K83 and K84 AND gates. The AND gates K83, K84 and the INVERTING gate K82 are utilized to switch the signal appearing on the line 134 from the signal Tp (represetative of the present time) to a signal Treq (representative of the required time that the car is expected to service that RC), when a command CMD44 is issued by the CPU. The AND gates H61–H6r and the OR gates D41–D4r are utilized for allowing (enalbling), when the command CMD44 is issued, the information stored in the Tr registers Tr(1)–Tr(r) to be changed from the information representative of the present time Tp to information representative of the required time Treq, respectively. Since a first input of the AND gates H61–H6r is connected to the CMD44 line and the second respective inputs are connected to the output Q11 of the G(1) register and to the outputs of the AND gates H32–H3r, respectively, the time Treq appearing on input line 134' is automatically entered into the Tr register of the row presently being monitored. An activate RCUb command CMD45 is connected to the enabling inputs of AND gates C81 and C82 for allowing the buzzer of the RCU defined by the information (r1''–rm'') and (f2''–fn'') presently being read out of the RCR 37C to be activated.

Figure 9C:
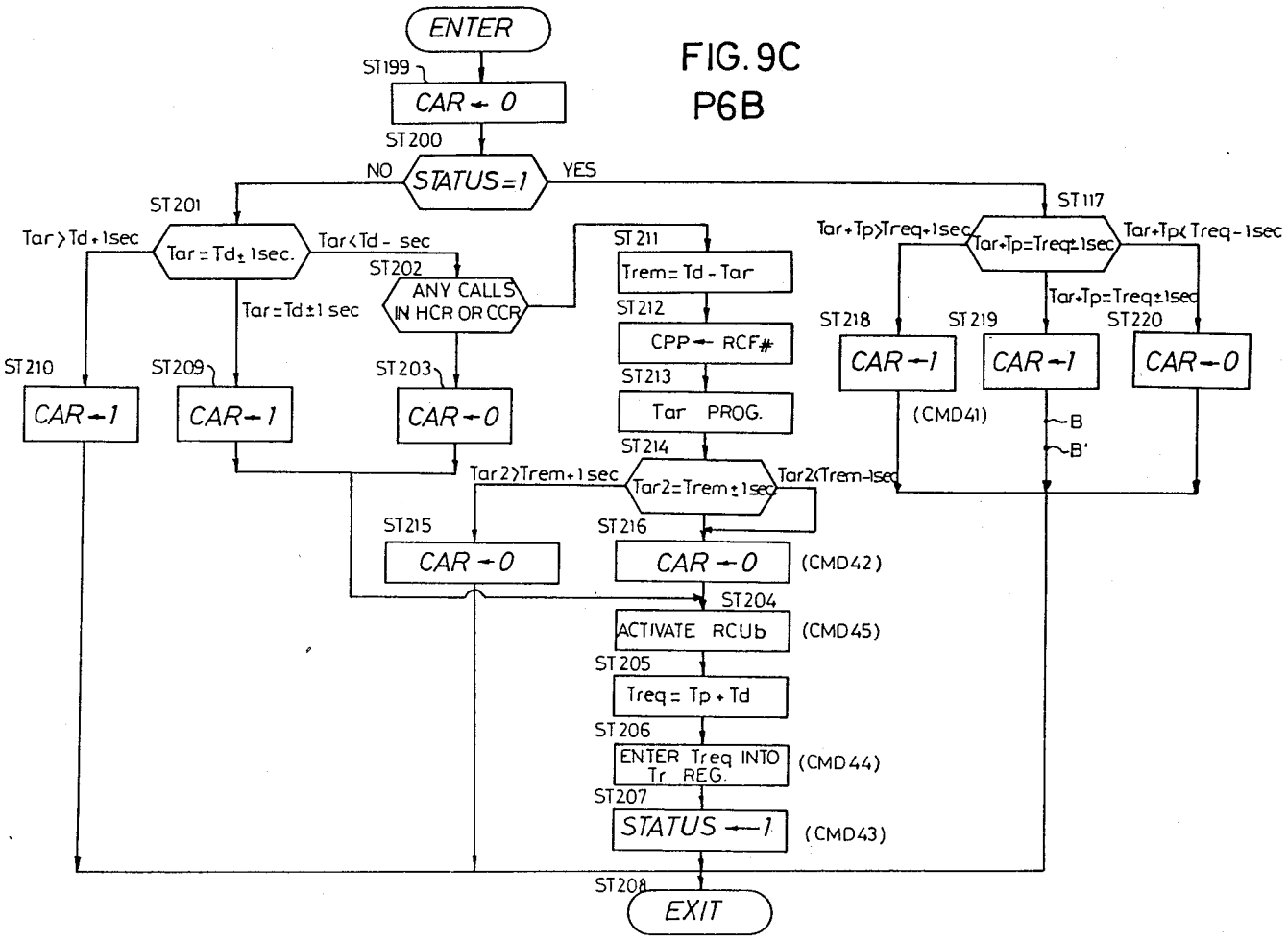
FIG. 9C shows a second embodiment P6B of the Transfer and Reset Program P6 which is utilized with the room call register RCR 37C.

FIG. 9C shows the structure of the AND gate K41. Refering to the FIGURE, numerals K412–K41n designate AND gates and numeral K411 designates an OR gate. The outputs f2'''–fn''' of the F# register F#(1) are connected to first inputs of the AND gates K412–K41n, respectively. The switches SSC1F2–SSC1Fn are connected to the respective second inputs of the AND gates K412–K41n and the output of the invertor K81 to the third inputs of the AND gates K412–K41n. The outputs of the AND gates K412–K41n are connected to the inputs of the OR gate K411, the output of which is connected to a third input of the OR gate D21'. Accordingly, if the direction of the car is down (implying that d2BAR=1), if the CAR flip flop K(1) in row r(1) is set (i.e. the output Q of the CAR flip flop K(1) is high which enables the AND gate K31, which allows the RCF# (f2'–fn') stored in the F# register F#(1) to pass through the AND gate K31, which allows the RCF# (f2'''–fn''') to cause a respective input to one of the STATUS flip flops are automatically reset whenever a RC is entered into the respective row. This is due to one of the outputs of the AND gates C11–C1r momentarily going high whenever a write command CMD7 is issued (i.e. implying that a RC is being entered into the first empty row in the RCR 37C), which causes the respective reset inputs of the CAR and STATUS flip flops in that row to go high casing said flip flops to reset.

FIG. 9C shows a second embodiment of the transfer and reset program P6B to be utilized with the RCR 37C, which is utilized insted of the P6A which is utilized with the RCR 37A or RCR 37B.

Referring to FIG. 9C, after entering the program, at step ST199 the respective CAR flip flop in the row of the RC presently being considered is reset. This is done in order to be able to determine whether or not there presently exists another transfered RC from the same F# as the presently being considered RC, since, if the respective F# signal (f2'''–fn''') remains high even after the CAR flip flop of the presently being consedered RC is reset, it implies that there is another RC from the same F# presently being transfered to the HCR 39, and accordingly, this RC should be considered with respect to how to deal with the presently being considered RC. Next, at step ST200 it is determined whether or not the STATUS flip flop of the RC presently being considered is high (i.e. STATUS=1). Specifically, since only one output amoung the outputs Q11 or the outputs of the AND gates H32–H3r can be high at any given time, the row in which the high output is present, which represents the row, and accordingly, the RC being monitored (considered), only one of the AND gates K91–K9r which is in that row will be enabled, thereby allowing the Q output of the respective STATUS flip flop be outputed from the RCR 37C and appear on line 147.

If at step ST200 the STATUS is determined to be 0 (i.e.the signal on line 147=0), the program proceeds to step ST201. This will always be the case the first time a RC is being considered in this porgram. At step ST201 it is determined whether or not Tar=Td±1 sec. If at step ST201 it is determined that Tar>Td+1 sec. (i.e. the car is too far to reach the RCF# by the desired time Td), the program proceeds to step ST210, where the CPU issues a command CMD200, whereby the CAR flip flop in the row of the RC being considered is set, after which the program is exited. In other words, the RCF# of the RC being considered is assigned to the HCR 39, so that the car may start proceeding to that floor when it is available to do so.

If at step ST201 it is determined that Tar=Td±1 sec, the program proceeds to step ST209 where the CAR flip flop in the same row as the RC being considered is set. Next, at step ST204, the respective RCUb is activated. Next, at step ST205, the calculation Treq=Tp+Td, where Tp is the time that this step is being performed as available from the clock 36 and Td is the desired time stored in the respective Td register, is performed in the arithmetic unit 34. Next, the CPU issues a command CMD44 whereby the Treq calculated at step ST206 is transfered into the Tr register of the row in which the RC presently being considered is in. Specifically, the command CMD44 disables and enables the AND gates K84 and K83, whereby the signals Tp and Treq are prevented and allowed to appear on the line 134, respectively. Further, since the respective AND gate H61–H6r of the row being considered is enabled at this time, the respective output of OR gate D41–D4r is high which causes the respective enabling input to one of the AND gates E41–E4r to be high, which allows the Treq signal to be entered into the respective Tr register Tr(1)–Tr(r), respectively. Next, at step ST207 the CPU issues a command CMD43 whereby the status value of the respective STATUS flip flop is changed to one, after which the program is exited at step ST208.

If at step ST201 it is determined that Tar<Td−1 sec (implying that the car can arrive at the RCF# of the RC being considered before the desired time Td specified therein), the program proceeds to step ST202. At step ST202 it is determined whether or not there are any calls present in the HCR 39 or RCR 41 (including tranferred RC in the HCR 39). This is done by monitoring the outputs of the OR gates J22–J2r of the HCR 39 and the outputs Q of the S-R flip flops CF1–CFr. If at step ST202 the answer is NO (i.e. there are no calls in the HCR 39 or CCR 41), the program proceeds to step ST203, where the respective CAR flip flop is reset, after which the program proceeds through the steps ST204, ST205, ST206, ST207 and is exited at ST208. Specifically, since the car can arrive before the desired time Td and since there are no calls in the HCR 39 or CCR 41 (implying that the car is completely free), the respective RCUb is immediately activated (at step ST204) and the car, however, is not called to service the respective RCF# since there is still time to do so. The reason the car is not summoned to survice the RCF# immediately is that other calls may come in in the meantime and the car may be instructed to go to another F# in the meantime, at the possible expense (i.e. delayed service) of that operator, of course. This may in some cases may provide faster service while, at the same time, reducing the number of runs the car otherwise would have had to make, not to mention the electricity saved.

For example, assuming the following case:

1. an operator living on the 10'th floor activates his RCU at time T1 with a desired time setting of 20 sec;
2. the car is at F1 waiting for calls to come in;
3. that it takes the car 10 sec to go from F1–F10
4. that at time T2 a HC is registered at F1, where T2=T1+5 sec;

Accordingly, when the RC is registered at time T1, since it only takes 10 seconds for the car to go from F1–F10, the program will proceed through steps ST200–ST207 and exited at step ST208 the first time it is executed, whereby the RCUb is activated (at step ST204), and through steps ST200, ST217, ST220 and ST208 the subsequent times it is executed while waiting for Tar+Tp to become equall to Treq±1 sec. (as will become more clear from the following description)

When the HC is registered at time T1+5 sec, since the car is still at F1 at that time, the elevator system can decide to service the person waiting in the hall, hoping that he does not delay the service of the car too much, so that the RCU's operator can be service in time. Accordingly, assuming that the person who registered the HC at F1 after entering the car:

5. enters a CC for F10.

Accordingly, since to service the first floor HC requires about 5 sec (i.e. Ts=5 sec. to open the car door, let the person waiting in the hall into the car and to close the car door), the time that the car will arrive at the F10 will be $$T = T2 + Ts + Tar = T1 + 5\text{ sec} + 5\text{ sec} + 10\text{ sec} = T1 + 20\text{ sec}$$

where:

Ts=service time of F1 HC;

Tar=arrival time of car from F1–F10.

Accordingly, by having allowed the car to stay at F1 untill the last possible second, the person who entered the car at F1 was provided immediate service and the RCU's operator is provided service at the exact time he desired. In this way not only are the two persons provided with good service, but also the number of runs the car has to make as well as the electricity therefor have been reduced.

If at step ST202 the answer is YES, implying that there are calls present in the HCR 39 or CCR 41, the program proceeds to step ST211 where the calculation Trem=Td−Tar is made in the arithmetic unit 34. Specifically, in this part of the program it will be determined whether or not the car can arrive again at the RCF#, or after servicing the last call in the HCR 39 and CCR 41. This is done by determining the time remaining Trem, with respect to the desired time Td specified in the RC, the car has after servicing the calls registered on a first run on the way to the RCF#, and determining whether or not the time Trem to arrive is sufficient, with respect to the desired time Td specified in the RC, to either arrive at the RCF# again (i.e. on a second run) or on a first run after servicing the last registered call in the HCR 39 or CCR 41.

Next, at step ST212, the CPP is assumed to be the RCF#. Next, at step ST213, the Tar program P6 is executed while assuming that the car's present position is the RCF# and that the calls it would have serviced on its way from its actual present position to the RCF# (i.e. on a first run) have already been service and that the cars direction is down. Next, at step ST214, it is determined whether or not Tar2=Trem±1 sec. If at step ST214 it is determined that Tar2>Trem+1 sec, implying that the car can not arrive by the desired time Td on a second run, the program proceeds to step ST215, where the respective CAR flip flop is reset, after which the program is exited at step ST208. The reason the RCF# is not assigned to the HCR 39 at this time is because, if it where assigned now, the car would automatically service the RCF# on this (i.e. the first) run. Further, since the car can not arrive a second time at the RCF# by the desired time Td, the RCUb is not activated. If at step ST214 it is determined that Tar2<-Trem−1 sec or that Tar2=Trem±1 sec, the program proceeds to step ST216 where the respective CAR flip flop is reset, after which the program proceeds through steps ST204, ST205, ST206, ST207 and is exited at step ST208. Namely, since the car can arrive on a second run or after servicing the last call in the HCR 39 or the CCR 41 by the time Td, the RCUb is activated. However, the RCF# is not assigned to the HCR 39, since, as explained for the case above, if the RCF# was assigned now the posibility exists that the car would service the RCF# on the first run.

If at step ST200 it is determined that the status of the respective STATUS flip flop is 1, implying that the RCUb was previously activated and that the value in the respective Tr register has been changed from a value representative of Treg to a value representative of Treq during a previous execution of this program, the program proceeds to step ST217 where it is determined whether or not Tar+Tp=Treq±1 sec, where Tp is the present time that this step ST217 is being executed. If at step ST217 it is determined that Tar+Tp>Treq+1 sec, implying that the car can not arrive by the required time Treq with respect to the time that the RCUb was activated, the program proceeds to step ST218, where the respective CAR register is set, after which the program is exited at step ST208. This step should hopefully not take place, since it implies that the car will be late with respect to the time that the respective RCUb was activated. However, since the car is still expected to service that RC, the RCF# is assigned to the HCF 39 (i.e. CAR=1). If at step ST217 it is determined that Tar+Tp=Treq±1 sec, implying that the car can arrive at the required time Treq with respect to the time that the RCUb was activated, the program proceeds to step ST219 where the respective CAR register is set, after which the program is exited. It should be noted that here it is not required to activate the respective RCUb since STATUS=1 implies that it was already activated. If at step ST217 it is determined that Tar+Tp<-Treq−1 sec, implying that the car can arrive at the RCF# before the required time Treq with respect to the time that the RCUb was activated, the program proceeds to step ST2220 where the respective CAR register is reset, after which the program is exited. It should be noted that here it is not required to activate the respective RCUb since STATUS=1 implies that it has already been activated. Further, that since the car can arrive before it is expected to do so, even though it may have originally been determined at step ST209 that the car can arrive on a first run, or at step ST214 that the car can arrive on a second run at the desired time, the RCF# is not assigned to the car since there is still time, even though it may have been previously assigned.

Figure 9E:
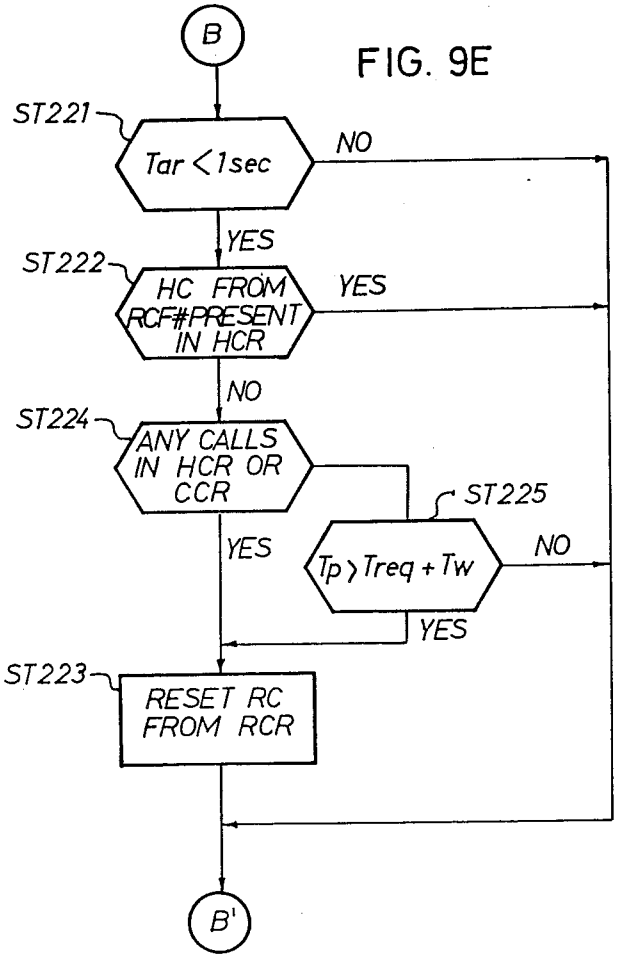
FIGS. 9D,E show modifications to the flow chart shown in FIG. 9C.
Figure 9D:
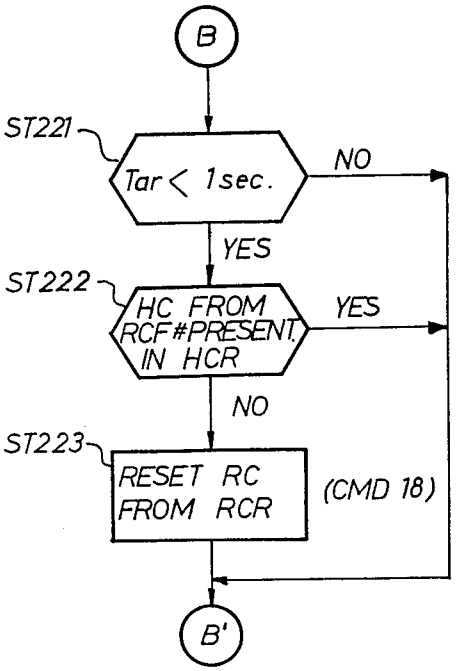

FIG. 9D shows a modification to the program P6B according to the present invention. Specifically, steps ST221, ST222 and ST223 are inserted between points B—B in the program P6B. These additional steps, as briefly mentioned above, are utilized to determine:

1. whether or not the time Treq that the car is supposed to service the RCF# is less then i.e. one second Treq<1 sec;
2. if the answer to 1 is YES, whether or not the car is within i.e. one second of arriving at the RCF#; and
3. if the answer to 2 is YES, whether or not there is a corresponding HC present from the respective F#.

If the answer to 3 is YES, that RCF# is serviced by the elevator. If the asnwer to 3 is NO, the respective RC is erased from the RCR 37. In this way, if the operator does not show up in the hallway and register a respective HC by the time that the car is 1 sec away from servicing that F# at the latest, the car does not stop there, thereby not inconviniencing other users. Referring to FIG. 9D, at step ST221 it is determined whether or not Tar<1 sec. If the answer is NO, implying that the car is still to far, the program is exited at step ST208. If the answer is YES, the program proceeds to step ST222 where it is determined whether or not there is a corresponding HC registerred in the HCR 39 (i.e. a HC from the same F# as the RCF#). If the answer is YES, the program is exited at step ST208, implying that the RC is not erased from the RCR 37 and that the car will be instructed to service that floor. On the other hand, if as step ST222 the answer is NO, the program proceeds to step ST223 where the CPU issues a command CMD18, whereby the respective RC is erased from the RCR 37, after which the program is exited at step ST208.

It should be noted that the reason no step was included to check the above mentioned item 1 (i.e. whether or not the time Treq that the car is supposed to service the RCF# is less then i.e. one second Treq<1 sec) is because this has already been done atstep ST117. Accordingly, the ±1 sec variable in step ST117 does not only include the time required to execute all the programs once, but also includes the time mentioned in the above item 1. Further, it is not intended to limit this invention to this variable ±1 sec. and other variables may be used, such as +0.2 sec/−0.5 sec can be used, where, for example, if the condition Tar>Td+0.2 sec exists, the program proceeds to step ST210, if the condition Tar<Td−0.5 sec exists, the program proceeds to step ST202 and if the condition Tar<Td+0.2 sec and Tar>Td+0.5 sec exists, the program proceeds to step ST209 from the step ST201, respectively.

FIG. 9E discloses a further modification to the flow charts disclosed in FIGS. 9C and 9D, which further provides for the cancellation of the RC if no corresponding HC is present one second in advance of the arrival of the car only if the car is otherwise not free, (i.e. if there are no other calls registered in the HCR 39 or CCR41), whereby is allowed to wait for a HC at the corresponding F# for a given period of time Tw (i.e. 10 sec), as long as no other calls are registered in the meantime, and if no corresponding HC is registered by the time Tw, the respective RC is erased from the RCR 39 thereby allowing the Supervisory Program instruct the car to go to a waiting F# i.e. F1.

Referring to FIG. 9E, at step ST224 it is determined whether the car is free or not (i.e. by monitoring the HCR 39 and the CCR 41). If the answer is NO, the program proceeds to step ST223 where the respective RC is erased from the RCR 37. If at step ST224 the answer is YES, the program proceeds to step ST225, where it is determined whether or not Tp>Treq+Tw. Namely, whether the present time Tp is greater then the Treq stored in the respective Tr register +Tw (i.e. 10 sec). If the answer is NO, the program is exited at step ST208. If the answer is NO, the program proceeds to step ST223 where the respective RC is erased from the RCR 37.

It should be noted that at step ST225 the reason the program is exited if the answer is NO rather then returning to step ST222, and repeating these steps until either a corresponding HC is registered or the time Tw has passed is because by doing so the program would have been stuck at those steps for that time and it would not have been possible to monitor for other RCs or operate on RC in the RCR or anything else for that matter. Further, since the actual arrival time Tar is not stored in any register, Tw is determined with respect to Treq. Accordingly, if the car arrives late, it will not wait for the the entire time Tw from the arrival time thereof at the RCF#. However, the reason the car would arrive late is probably due to the car having many calls comming assigned (i.e. during rush time) which would mean that the car would not be free to wait for Tw anyway.

Figure 15:
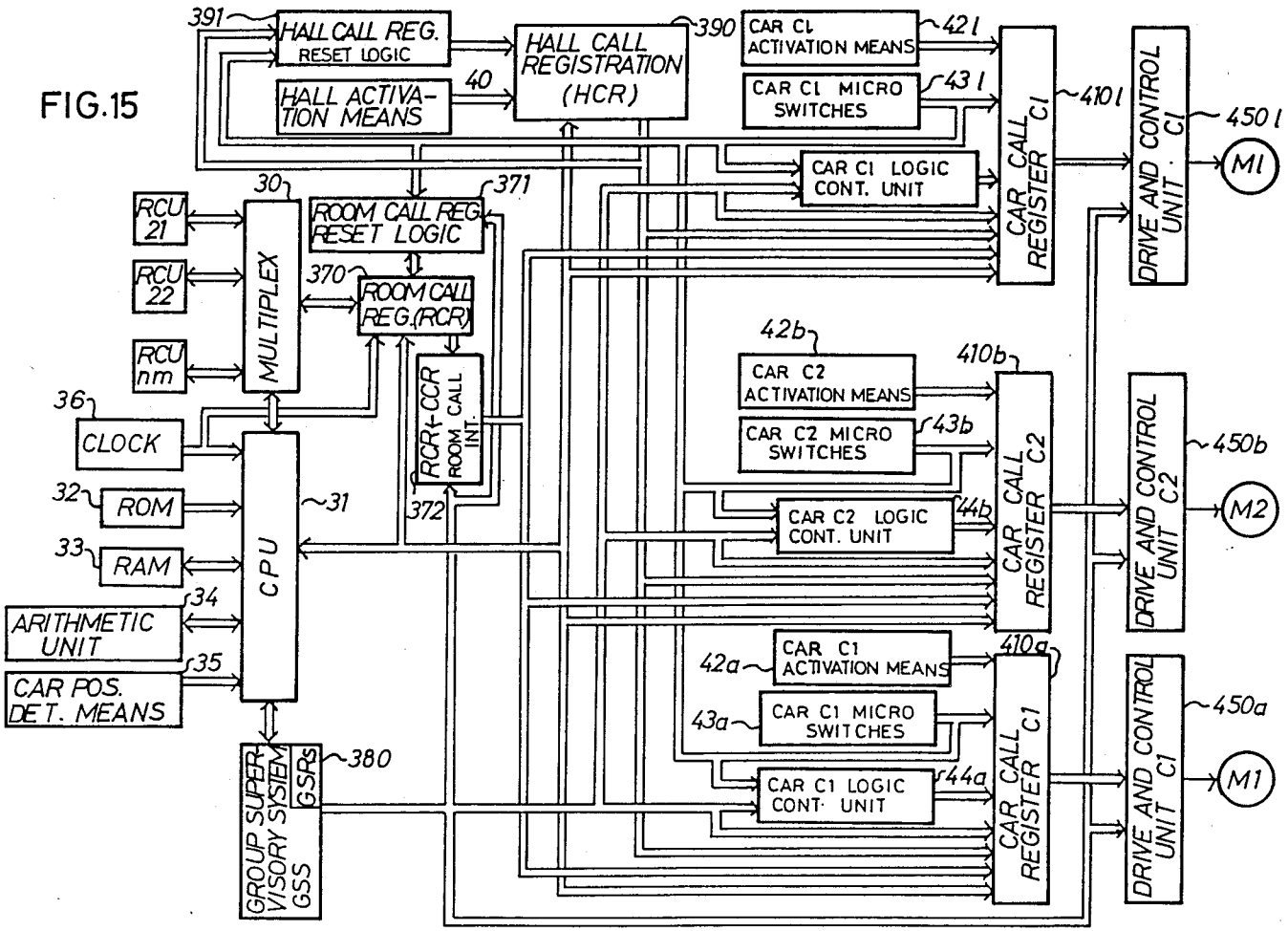
FIG. 15 shows a multiple car elevator control system according to the present invention.

FIG. 15 shows a block diagram of a multiple car elevator control system according to the present invention. In the FIGURE, the same portions as those in the singal car elevator control system are designated by the same reference numerals and the description thereof will not be repeated herebelow.

Referring to FIG. 15, numeral 370 desigates a Multiple Car Room Call Register (hereinafter referred to as RCR 390), numeral 371 designates a Room Call Reset Logic, numeral 372 designates a RCR to CCR Room Call Transfer interface, numeral 390 a Multiple Car Hall Call Register (hereinafter referred to as HCR 390), numeral 391 designates a Hall Call Register Reset Logic, and numeral 380 a Group Supervisory System. Numerals M1-Ml designate elevator car drive motors for driving the cars C1-Cl, respectively, numerals 450*a*-450*l* designate Drive and Control Units for the cars C1-C, numerals 410*a*-410*l* desigante Car Call Registers (hereinafter referred to as CCR 410*a*-410*l*) for the cars C1-Cl, numerals 42*a*-42*l* designate Car Activation Means located inside the cars C1-Cl, respectively, numerals 43*a*-43*l* designate Car position detecting microswitches located in the respective shafts and at the respective floors of the cars C1-Cl, respectively, and numerals 44*a*-44*l* designate Car Logic Control Units for the cars C1-Cl, respectively.

Figure 16:
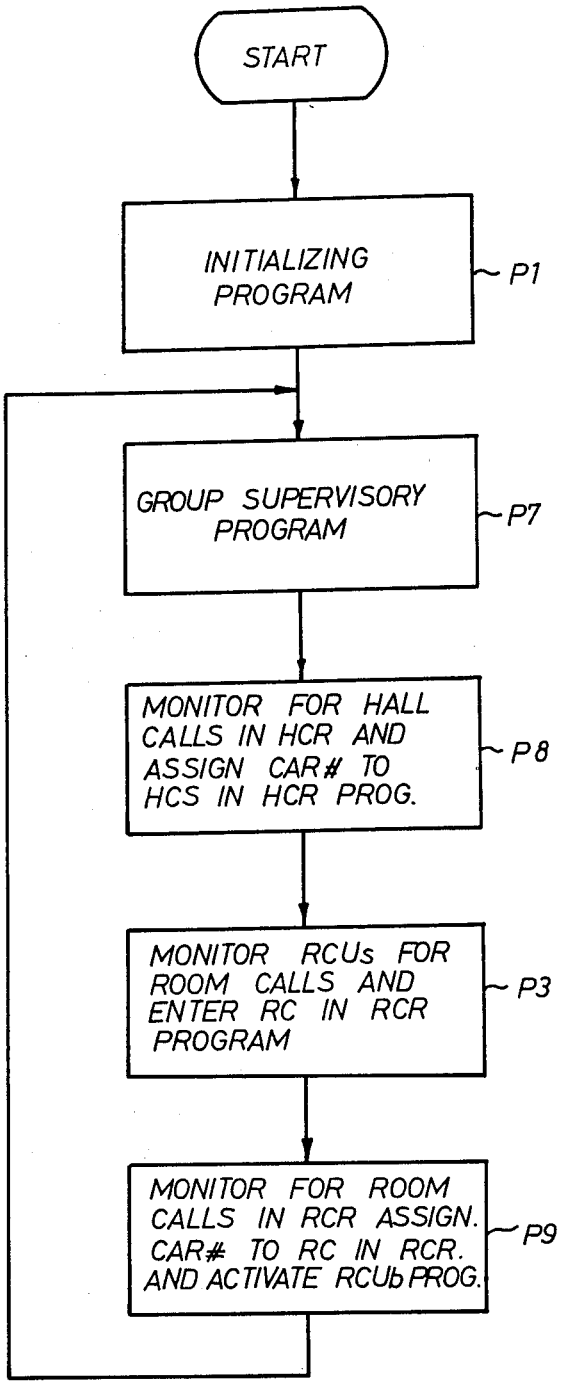
FIG. 16 shows programs for stored in a ROM for controlling the multiple car elevator control system shown in FIG. 15.

FIG. 16 shows the general program stored in the ROM 32 to be executed by the CPU 31. Refering to the FIGURE, numeral P1 designates an Initializing Program, numeral P7 a Group Supervisory Program, numeral P8 a Monitor for HCs in the HCR and Assign CAR# to HCs in HCR Program, numeral P3 designates a Monitor RCUs for RCs and Enter RCs into RCR Program and numeral P9 designates a Monitor for RCs in the RCR, Assign CAR# to RCs in RCR and Activate RCU buzzers Program. The Programs P1 and P3 are the same as those discribed for the Single Car Elevator Control System.

Figure 17A:
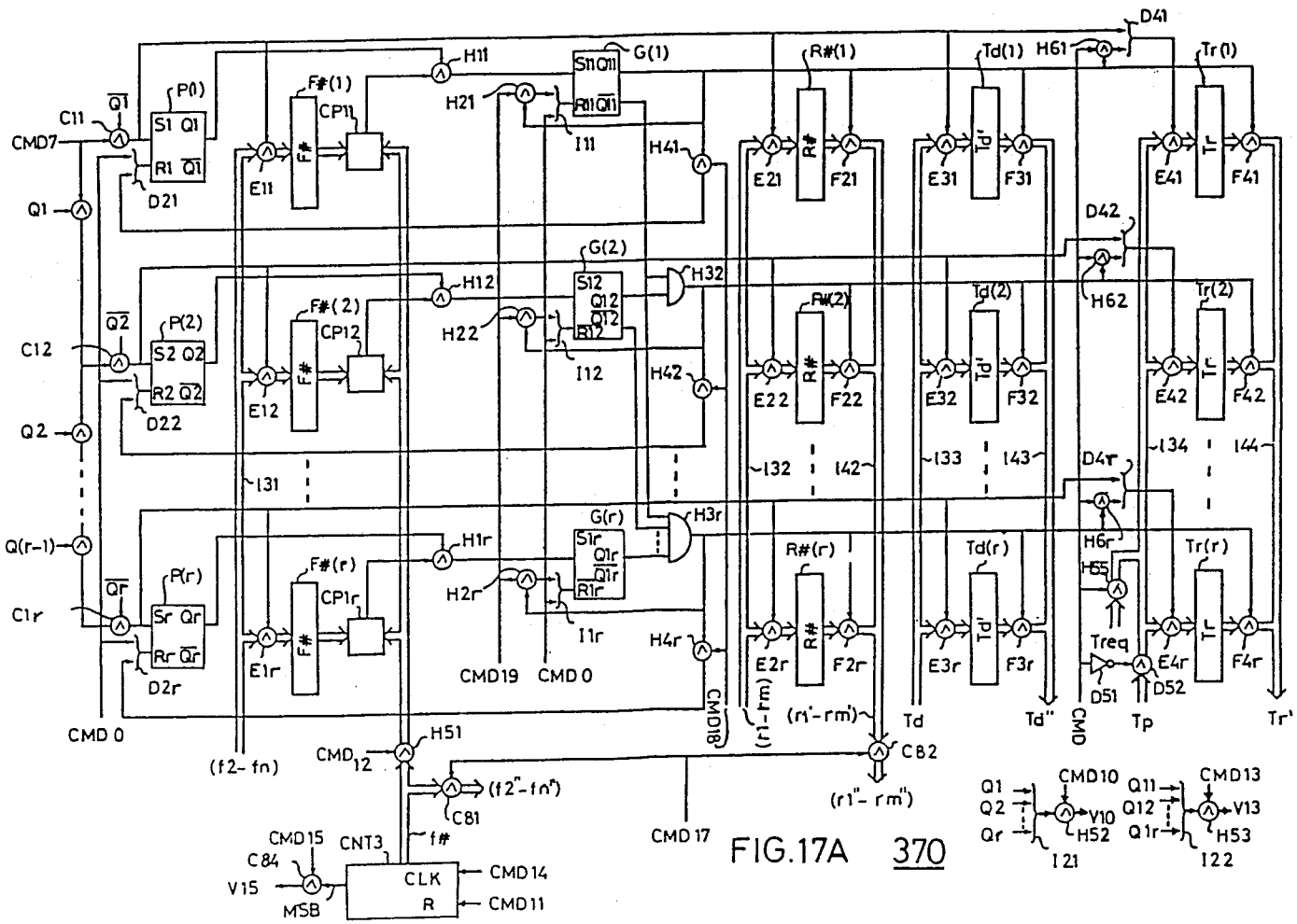
FIGS. 17A,B shows a room call register of the multiple car elevator control system.
Figure 17B:
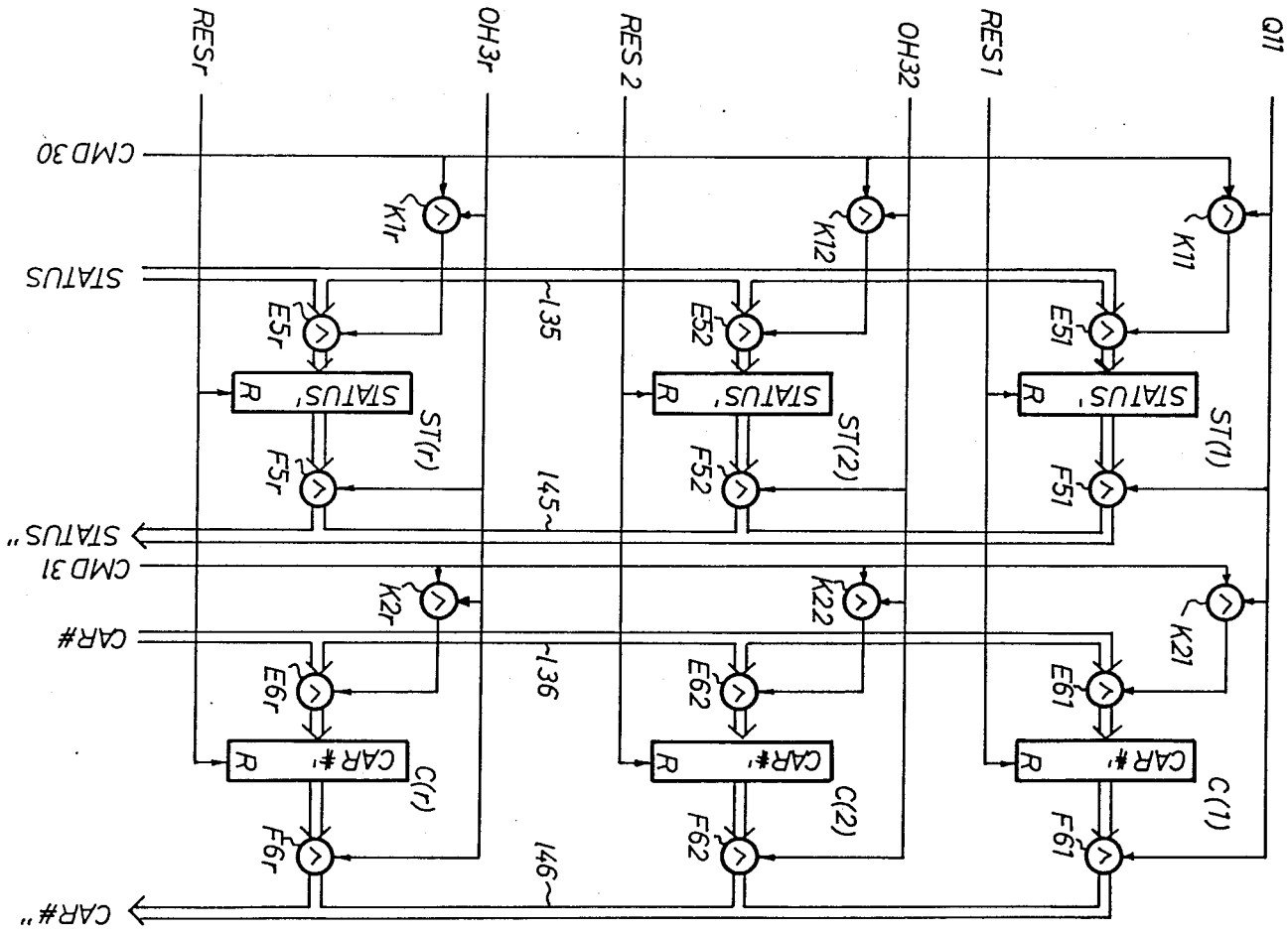

FIGS. 17A and 17B show a schematic diagram of the RCR 370 for the Multiple Car Elevator Control System according to the present invention. In the FIGS., the same portions shown in the RCR 37A-37C described with the Single Car Elevator Control System are represented with the same reference numerals. Also the commands which are used to achieve the same objectives are assigned the same command numbers.

Referring to FIGS. 17A, B, numerals ST(1)-ST(r) designate STATUS registers for indicating the present status of the respective RCs in the respective rows r(1)-r(r), respectively, numerals C(1)-C(r) designate CAR# registers for indicating whether or not a car is assigned to the respective RCs in the respective rows and, if a car is assigned, also serve to indicate which car is assigned (i.e. which of the cars C1-Cl is assigned to service the respective RCs). Numerals K11-K1r and E51-E5r designate AND gates which, when the respective RC is being monitored (i.e. as indicated by the respective outputs Q11 and OH32-OH3r of the flip flop R(1) and the AND gates H32-H3r, respectively, being high), allow a STATUS value on line 135 to be entered into the respective STATUS registers when an assign STATUS command CMD30 is issued by the CPU. Similarly, Numerals K21-K2r and E61-E6r designate AND gates which, when the respective RC is being monitored (i.e. as indicated by the respective outputs Q11 and OH32-OH3r of the flip flop R(1) and the AND gates H32-H3r, respectively, being high), allow a CAR# value on line 136 to be entered into the respective CAR# registers when an assign CAR# command CMD31 is issued by the CPU. Numerals F51-F5r designate AND gates which, when the respective RC is being monitored (i.e. as indicated by the respective outputs Q11 and OH32-OH3r of the flip flop R(1) and the AND gates H32-H3r, respectively, being high), allow a respective STATUS value stored in the STATUS register being monitored to apear on line 145. Numerals F61-F6r designate AND gates which, when the respective RC is being monitored (i.e. as indicated by the respective outputs Q11 and OH32-OH3r of the flip flop R(1) and the AND gates H32-H3r, respectively, being high), allow a respective CAR# value stored in the CAR# register being monitored to apear on line 146. Numerals RES1-RESr designate reset signals provided by the Room Call Reset Logic 371 for reseting the respective STATUS and CAR# registers in the respective rows, as well as the respective presence flip flops P(1)-P(r) (i.e. via respective third inputs to the OR gates D21'-D2r', respectively).

Figure 18:
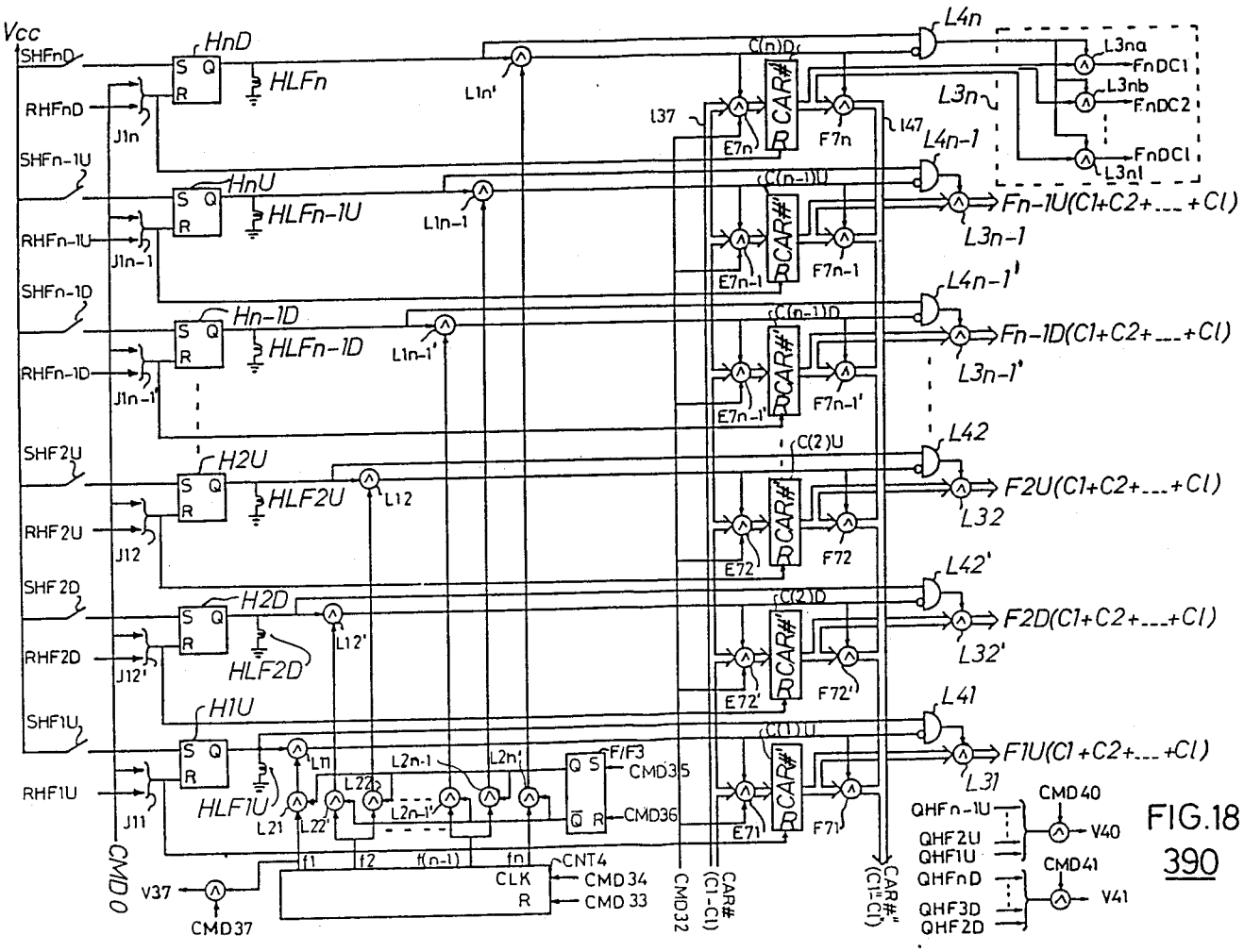
FIG. 18 shows a hall call register HCR of the multiple car elevator control system.

FIG. 18 shows the Multiple Car Hall Call Register 390 according to the present invention. In the FIGURE, the same portions as the portions shown in the Single Elevator Hall Call Register 37 are assigned the same reference numerals. Referring to the FIGURE, numerals H1U-HnD designate S-R flip flops for registering respective up and down HCs entered via the hall buttons switches SHF1U-SHFnD, respectively, numerals C(1)U-C(n)D designate CAR# registers for indicating which car C1-Cl is assigned to each HC. Numerals RHF1U-RHFnD designate reset signals provided by the Multiple Car Hall Call Register Reset Logic 391, numerals J11-J1n designate OR gates, numerals HLF1U-HLFnD designate hall light indicating means for visually indicating that the respective hall are registered, numerals HF1U-HFnD designate the hall buttons located in the respective floors F1-Fn, numerals E71-E7n designate AND gates which, when the respective HC is being monitored (i.e. as indicated by the respective ouputs of AND gates L11-L1n' being high), allow a CAR# value on line 137 to be entered into the respective CAR# registers when an assign CAR# command CMD32 is issued by the CPU. Numerals F71-F7n designate AND gates which, when the respective HC is being monitored (i.e. as indicated by the respective outputs of AND gates L11-L1n' being high), allow a respective CAR# stored in the CAR# register being monitored to appear on line 147. Numerals L41-L4n designate AND gates which in combination with AND gates L31-L3n allow the hall calls presently registered in the HCR 390 (i.e. as indicated by the respective Q outputs of the flip flops H1U-HnD being high) to be assigned to the CCR 410*a*-410*l*, as long as the respective registered HCs are not being monitored by the CPU (i.e. as indicated by the respective outputs of AND gates L11-L1n' being high). Specifically, the output F1U(C1+C2+. . . +Cl), which is equal to F1UC1+F1UC2+. . . +F1UCl, from the AND gate L31 represets the UP direction HC signals from the floor F1, which are connected to the CCR410*a*, CCR41*b* . . . and CCR410*l*, respectively. Similarly, the signals F2D(C1+C2+. . . +Cl), signals F3U(C1+C2+. . . +Cl) (not shown) . . . and signals FnD(C1+C2+. . . +Cl) are connected to the CCR 410*a*, 410*b* . . . and 410*l*, respectively. Specifically, as can be seen from FIG. 19 which shows the CCR 410*a* the signal F1UC1, F2DC1, F2UC1 . . . and FnDC1 from the HCR 390 (i.e. representing one output from the AND gates L31, L32', L32 . . . and L3n, respectively the HCR 390) are connected to respective inputs of AND and OR gates Q11, Q22, Q12 . . . and Q1n, respectively. Numerals L3na-L3nl designate AND gates which show the specific structure of the AND gate L3n. The gates L31-L3n−1 are similarly constructed.

Numeral CNT4 designates a counter (actually a left shift register) having the counting order 000 . . . 001, 000 . . . 010, 000 . . . 100, etc., each time a clock pulse is inputed, namely each time a command CMD34 is issued. Numeral F/F3 designates an S-R flip flop which, in combination with AND gates L21-L2n−1 and L22'-L2n', determine whether the HCR 390 is monitored for HC in the UP direction or DOWN direction, respectively. Numerals J21, J22 and J23 designate AND gates and numerals J24 and J25 designate OR gates.

Figure 25:
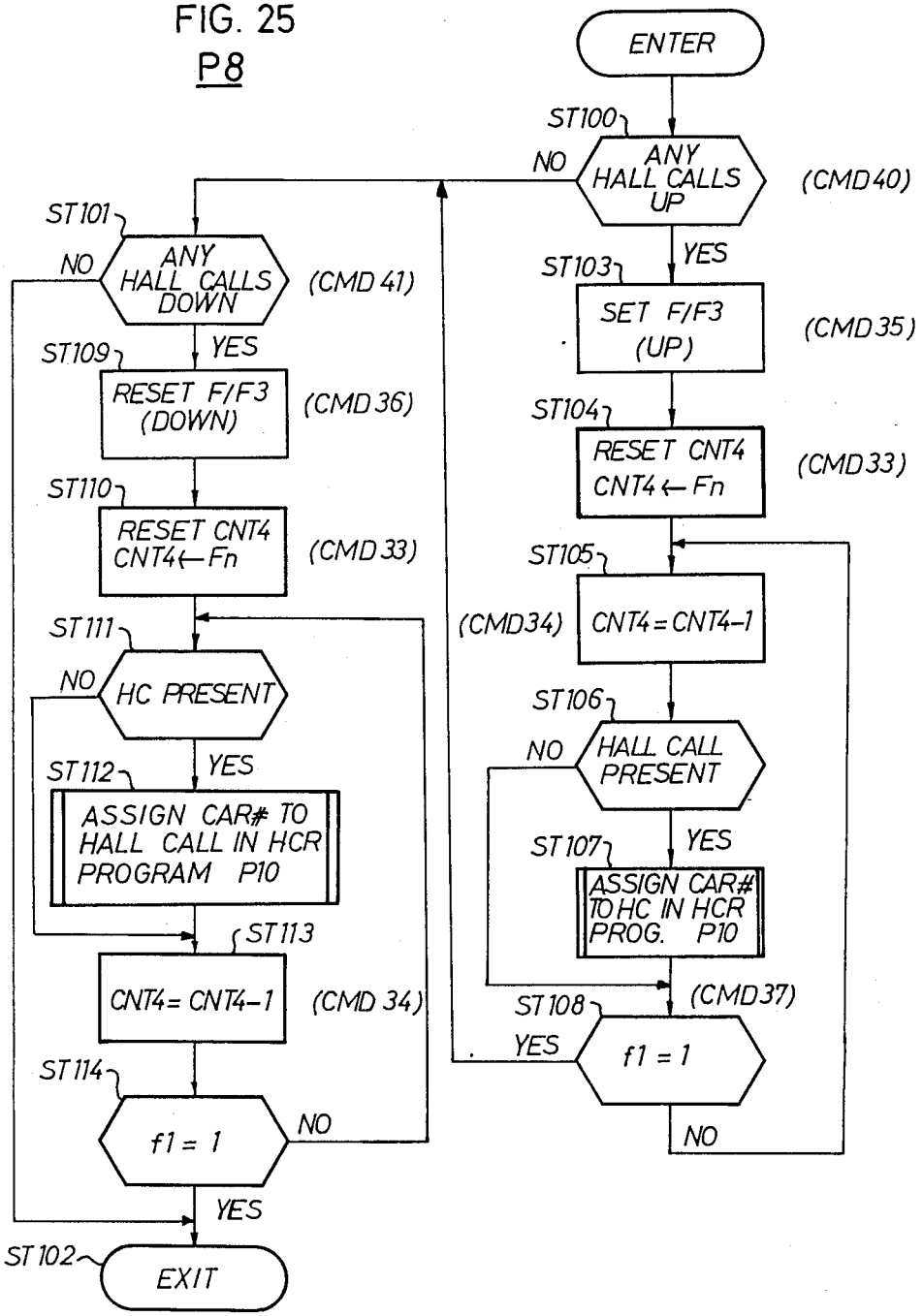
FIG. 25 shows a monitor HCs in HCR and assign CAR# to HCs in GCR program P8 of the multiple car elevator control system.
Figure 26:
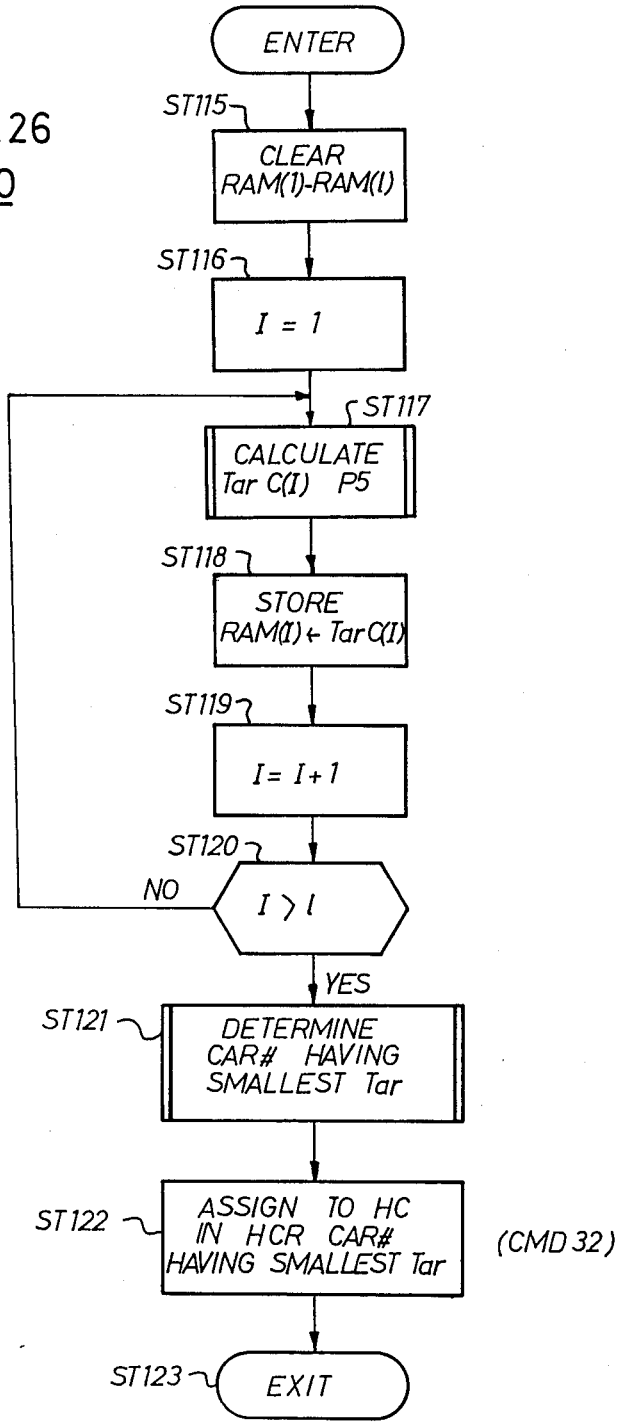
FIG. 26 shows a assign CAR# to HC in HCR program P10 of the multiple car elevator control system.

FIG. 25 shows the Monitor for HCs in the HCR and Assign CAR# to the HCs in the HCR Program P8 which is utilized in combination with the HCR 390 according to the present invention. Refering to the FIGURE, after entering the program at step ST100, a command CMD50 is issued, whereby it is determined whether or not there are any UP direction HCs registered in the HCR 390. Specifically, the command CMD50 is inputted to the enabling input of the AND gate J22, whereby if any UP direction HC, as indicated by the Q of the flip flops H1U-Hn−1U, are present the signal V50 to the CPU will be high. If there are no UP direction HCs, the program proceeds to step ST101 where the CPU issues a command CMD51, whereby it is determined it whether or not there are any DOWN direction HCs in the HCR 390. If it is determined that there are no DOWN direction HCs, the program is exited at step ST102. Namely, since there are no UP or DOWN direction HCs in the HCR 390, no cars need be assigned to any HCs. If at step ST100 the answer is YES, the progrma proceeds to step ST103, where the CPU issues a command CMD35 whereby the F/F3 is set. Next, at step ST104 the CPU issues a CMD33 whereby the counter CNT4 is reset causing the outputs fn thereof to go high. Next, at step ST105 a command CMD34 is issued whereby the the output fn−1 goes high. Next, at step ST106, it is determined whether or not a HC exits for the F# presently being monitored, which in this case is Fn. This is done by monitoring the output Q of the flip flop Hn−1U. If the answer is NO, the program proceeds to step ST108 where it is dererminded whether or not the floor presently being monitored is F1 (i.e f1=1). If the answer is NO, the program returns to step ST105, where the output of the CNT4 is reduced by one (i.e. the next floor down is monitored for UP an HC. If at step ST106 the answer is YES, the program proceeds to step ST107 where the Assign CAR# to HC in HCR Program P10 is executed, whereby a CAR# is assigned to the HC presently being monitored. Accordingly, steps ST105-ST108 are executed till all the UP direction HC presenly registered in the HCR 390 are assigned a CAR# at step ST107, after which the program proceeds to step ST101.

If at step ST101 the answer is YES, implying that there are DOWN direction HCs presently registered in the HCR 390, the program proceeds to step ST109, where a command CMD36, whereby the F/F3 is reset, thereby enabling to monitor the HCR 390 for DOWN direction HCs and to assign CAR# thereto. Next, at step ST110 the counter CNT4 is reset whereby output fn=1. Next, at step ST111, it is determined whether or not there is a DOWN direction HC from the floor Fn, namely, if the output Q of the flip flop HnD is high. If the unwer is NO, the program proceeds to step ST113 where the output of the CNT4 is reduced by one. Next, at step ST114, similar to step ST108, it is determined whether or not the output f1=1, by monitoring the output of cleared. Next, at step ST116 a counter I (not shown) is set to 1. Next, at step ST117, the arrival time program P5 is executed whereby the arrival time Tar of car C(I) is determined. Next, at step ST118, the calculated Tar for car C(I) is stored in memory space RAM(I). Next, at step ST119, the value of I is increased by one. Next, at step ST120 it is determined whether or not the present value of I is greater than 1, where 1 represents the number of cars C1-Cl. If the answer is NO, the program returns to step ST117 where the arrival time program P5 is executed for the car C(I). Steps ST117-ST120 are repeated till all the cars' arrival time TarC(1)-TarC(l) are determined and stored in memory spaces RAM(1)-RAM(l), respectively. Next, at step ST121 a Determine CAR# having smallest Tar Program (not shown) is executed. This program determines which of the memory spaces has the smallest Tar value and is well known in the art. Next, at step ST122, a command CMD32 is issued whereby the CAR# having the smallest Tar value (i.e can arrive fastest at the F# of the HC being considered) is assigned to the respective CAR# register, after which the program is exited at step ST123. The command CMD32 causes first enabling inputs to AND gates E71–E7n' to go high, respective second enabling inputs of which are connected to the outputs of the AND gates L11–L1n'. Each of the gates E71–E7n' is further connected via line 137 to the CAR# C1-Cl from the CPU and the outputs thereof are inputted to the CAR# registers C(1)U–C(n)D, respectively. According, only when both enabling inputs to each of the AND gates E71–E7n are high, implying that the HC in the respective row is being monitored and that the command CMD32 is being issued, can the CPU assign a car number to the CAR# registers C(1)U–C(n) D. The flip flops H1U–HnD and the CAR# registers C(1)U-C(n) are automatically reset when the assigned car arrives at the respective F# in the respective direction as defined by the respective HCs by the signals RHF1U–RHFnD supplied by the Hall Call Register Reset Logic 391 which will be described herebelow.

Figure 22:
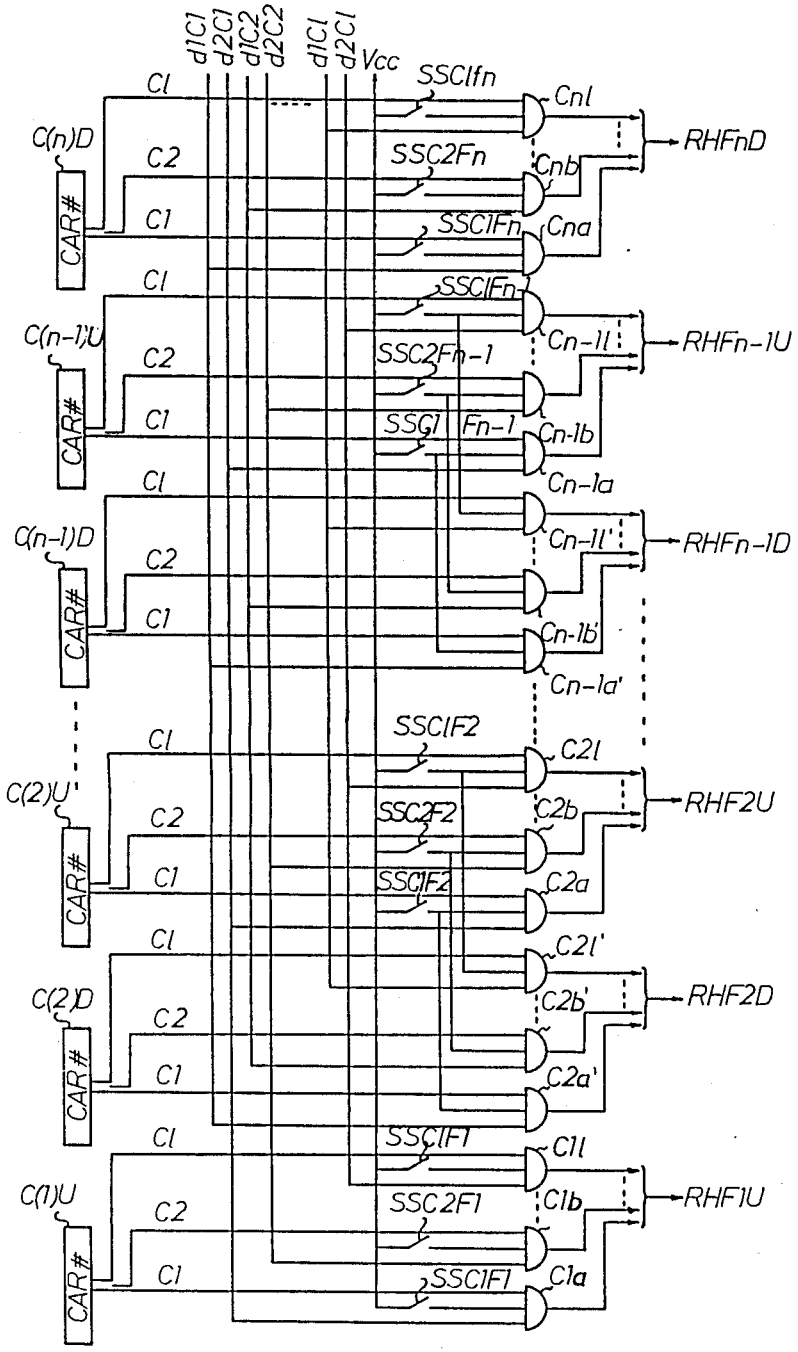
FIG. 22 shows a hall call register reset logic of the multiple car elevator control system.

FIG. 22 shows the Hall Call Reset Logic 391 according to the present invention. Referring to the Fig., numerals C(1)U–C(n)D designate the CAR# registers of the HCR 390. The respective outputs c1, c2 . . . and cl of each of the CAR# registers designates the output line representative of the car numbers C1, C2 . . . and Cl, respectively. Accordingly, if the output c2 of the register C(2)U is high, it implies that the car number C2 is assigned to the second floor F2 UP direction HC. Numerals d1C1, d2C1–d1Cl,d2Cl designate the direction signals for cars C1-Cl, respectively, provided by the Group Supervisory Register 380A (not shown but similar in structure to the Supervisory Register 38A). Numerals SSC1F1-SSClF1, SSC1F2-SSClF2, . . . and SSC1Fn-SSClFn designate the micro-switches located in the elevator shafts of the elevators C1, C2, . . . and Cl at the floors F1-Fn, respectively, for detecting the arrival of the elevator cars C1, C2, . . . and C1 at the respective floors F1-Fn, respectively. Numerals C1a-Cnl designate AND gates and numerals C1al-Cnal designate OR gates, the outputs RHF1U–RHFnD of which represent the HCR 390 reset signals which are utilized to reset the HCs registered in the HCR 390.

For example, assuming that a HC exists for the DOWN direction from the second floor (i.e. the output Q of the flip flop H2D is high), and that the car C1 is assigned to that HC (i.e. the output C1 of the CAR# register C(2)D is high), when the car C1 is instructed to travel in the down direction (i.e. signal direction d2C1=0) and when the car C1 arrives at the second floor F2 (implying that switch SSC1F2 closes), all the inputs to AND gate C2a' are high, causing the output thereof to go high, which causes a respective input to OR gate C2al' to go high which causes the output thereof, namely, the reset signal RHF2D to go high, which causes the flip flop H2D in the HCR 390 to reset.

Figure 19:
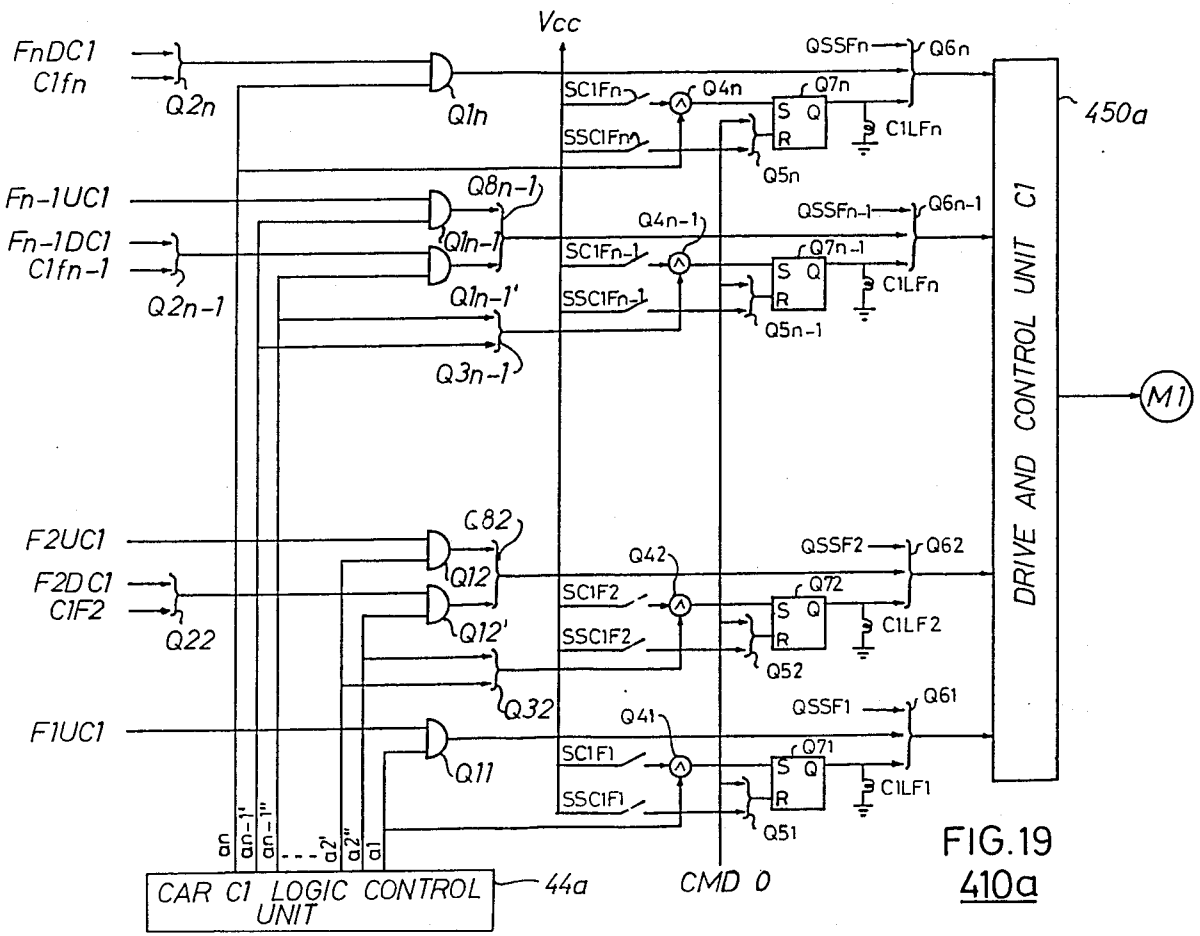
FIG. 19 shows one car call register CCR of the multiple car elevator control system.

FIG. 19 shows the Multiple Car Car Call Register 410*a* according to the present invention. The CCR 410*b*, *410c* . . . and 410*l* are similarly constructed, with the only difference being that the input signals are the respective input signals. Referring to the Fig., numeral Q71–Q7n designate S-R flip flops which are set in response to the car activation means SC1F1–SC1Fn which are representative of CCs for the floors F1–Fn, respectively. Numerals C1LF1–C1LFn designate lamps located inside the car C1 for visually indicating CCs registered in the car C1 for the floor numbers F1–Fn, respectivelly. Numerals SSC1F1–SSC1Fn designate micro-switches located in the shaft of the elevator car C1 for detecting the arrival of the car at the floors F1–Fn, respectively. Numeral 450*a* designates a Drive and Control Unit 450 for the car C1 which is used to control the motor M1 of the car C1. Numeral 44*a* designates a Logic Control Unit 44*a*, which is identicall in structure (as well as 44*b*–44*l*) to the control unit 44 with the direction signals inputed thereto being the direction signals for car C1 (and car C2-Cl for the units 44*b*–44*l*, respectively). Numerals Q41–Q4n desigante AND gates which allow CCs to be registered in the respective flip flops Q71–Q7n only when respective signals a1–an from the Logic Control Unit 44*a* are high (as was previously explained with respect to the Single Car Elevator Control System).

Numerals F1UC1, F2DC1, F2UC1–Fn−1UC1 and FnDC1 designate up and down HCs for the floors F1,F2–Fn−1 and Fn, respectively, provided by the HCR 390. Numerals C1f2,C1fn−1 and C1fn designate transfered RCs for the floors F1,Fn−1 and Fn, respectively, provided by the RCR 370 and the Room Call Interface 372 (which will be explained later). Numerals Q22–Q2n designate OR gates for combining the transferred RCs and down direction HCs C1f2, F2DC1-C1fn,FnDC1 from the Room Call Interface 372 (as will be explained later) and the HCR 390, respectively. Numerals Q11–Q1n designate AND gates for controlling the transfer of the RCs and HCs therethrough as a function of the outputs a1–an from the Logic Control Unit 44*a* which are representative of the car's present position and direction of travel, so that only calls above and below the car's present position are transferred through said gates when the direction of the car is UP and DOWN, respectively. Numerals Q82–Q8n−1 designate OR gates for combining the up and down direction calls for the floors F2–Fn−1, respectively. Numrals QSSF1–QSSFn designate calls supplied by a Group Supervisory Register 380A (similar in structure to the Supervisory register 38A), said calls being representative of HFCP or LFCP, or simply at F# at which the elevator car is to wait at (such as floor F1) when no calls are present in the RCR 370, HCR 390 and CCR 410*a*. Numerals Q32–Q3n−1 designate OR gates and numerals Q41–Q4n designate AND gates for controlling the entry of CCs therethrough as a function of the activation of the car call switches SC1F1–SC1Fn and the outputs a1–an from the Logic Control Unit 44*a*, which are representative of the car's present position and direction of travel, so that only CCs above and below the car's present position are transfered through said AND gates when the direction of the car is UP and DOWN, respectively. Numerals Q51–Q5n designate OR gates which allow the position switches SSC1F1–SSC1Fn reset the flip flops (i.e. CCs) Q71–Q7n, respectively, when the car arrives at the floors F1–Fn, respectively. The direction signals are not utilized for controlling the reseting of the CCs (i.e. flip flops Q71–Q7n) because the car's position and direction has already been considered for the case of allowing CCs to be registered in the CCR 410*a* (as exlained hereabove) and, accordingly, the direction of the car need not be considered again as to the reseting operation. Numerals Q61–Q6n designate OR gates for combining the RCS HCs, CCs and supervisory register calls provided by the Group Supervisory System Register 380A, and inputs the same to the Drive and Control Unit 450*a*.

For example, if a transfered RC exists specifying the floor F2 (i.e. the output f2''' from the RCR 370 is high) and specifying the car C1 (i.e. the output of the respective C# register specifies the car C1), the Room Call Transfer Interface causes the input C1f2 to be high.

Accordingly, the output of the gate Q22 is high, which causes one input to the AND gate Q12' to be high. If the car's assigned direction is down and the the car's present position is above the floor F2, the signal a2" from the Logic Control Unit 44*a* is high, allowing the other input to the AND gate Q12' to also be high which causes the output thereof to be high. Accordingly, one input to the OR gate Q82 is high which causes the output thereof to be high, which intern causes an respective input to the OR gate Q62 to be high. Accordingly, the output of the OR gate Q62 is high, thereby indicating to the Control Unit 410*a* that a call is assigned thereto from the second floor. Similarly for a down direction HC from the floor F2 (i.e. for the signal F2DC1)

Figure 20A:
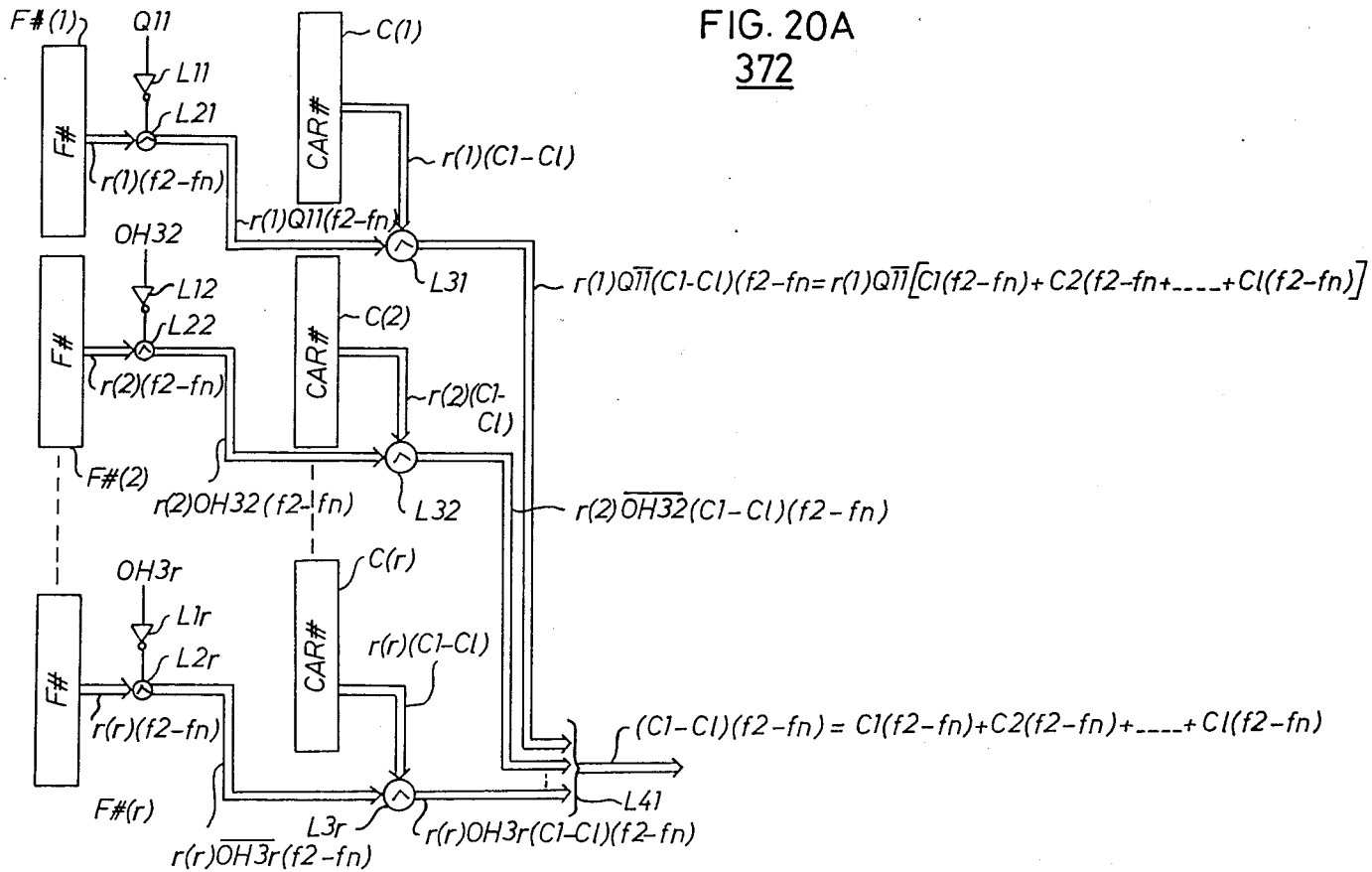
FIGS. 20A,B shows room call to car call interface of the multiple car elevator control system.

FIG. 20A shows a block diagram of the RCR-CCR Room Call Interface 372 according to the present invention. Generally, this interface is utilized for:

1. distributing the RCF#s stored in the respective F# registers F#(1)-F#(r) to the allocated cars via the respective CCRs as defined by the CAR# values stored in the respective CAR# registers C(1)-C(l); and 2. Preventing the RCF# of the RC presently being monitored from being transferred to the allocated CCR.

Referring to the Fig., numerals F#(1)-F#(r) and C(1)-C(r) designate the F# registers and CAR# registers in the rows r(1)-r(r) in the RCR 370, respectively, numerals Q11 and OH32-OH3r designate the outputs Q11 of the flip flop G(1) and the outputs of the AND gates H32-H3r, respectively. Numerals L11-L1r designate invertors and numerals L21-L2r designate AND gates for preventing the RC presently being monitored (i.e. as designated by the one output from the outputs Q11, OH32-OH3r being high) from appearing (i.e. being transfered) to the a respective CCR 410*a*-410*l* as defined by the information in the CAR# registers (C(1)-C(r), respectively. Numerals L31-L3r designate AND gates for ANDing together the respective F# signals and CAR# signals stored in the F# registers F#(1)-F#(r) and C(1)-C(r), respectively. Numeral L41 designates OR gates for combining respective signals which are representative of the same F# and same CAR# generated from the information stored in the F# and CAR# registers in the rows r(1)-r(r). For example, if the information in the F# and CAR# of the first and second rows specifies the F# F1 and the car C1, respectively, this information can be ORed together (i.e. by OR gates L41). The signal on the output of the OR gate L41 is designated as C1(f2-fn)+C2(f2-fn)+ . . . +Cl(f2-fn), where C1(f2-fn)=Clf2+Clf3+ . . . +Clfn. Similarly for the other C2−Cl expresions. Accordingly, the C1(f2-fn) expression represents the RC signals which are inputted to the CCR 410*a* (i.e. the RCR of the first car C1), the C2(f2-fn) expression represents the RC signals which are inputted to the CCR410*b*, and so on for the remaining expressions.

It should be noted that the Q11, OH32-OH3r signals where not included in the output of the OR gate L41 for the reason of simplifying the expression. Accordingly, this expression is only correct if none of the RCs in the RCR 370 is being monitored. If a RC is being monitored, it would only mean that corresponding signal for that RC would not appear at the output of the OR gate L41 and accordingly, would not be transferred to a corresponding CCR 340*a*, 340*b* . . . , or 410*l* (as defined by the information in the corresponding CAR# register of the same row as that RC). Further, that although the output signals from the F# registers F#(1)-F#(r) are r(1)(f2-fn)-r(r)(f2-fn), where r(1)-r(r) designate the respective rows in which the F# registers F#(1)-F#(1) are located, these expressions should preferably read r(1)(f2'-fn')-r(r)(f2'-fn'). The reason the ' symbols were omitted from the expressions is simply because this would have resulted in many ' expressions which would have be combersome and painstaking.

Figure 20B:
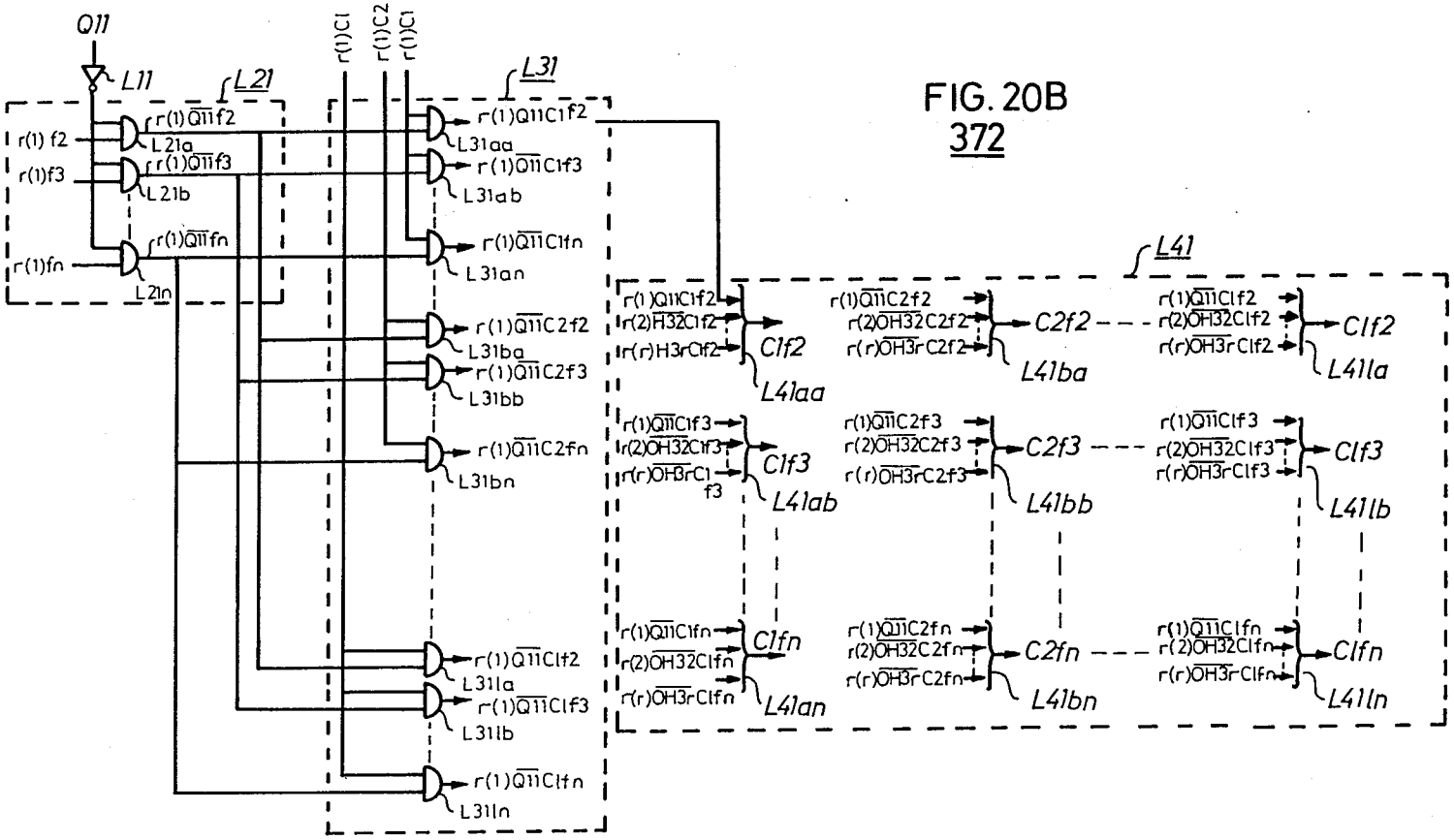

FIG. 20B shows the actual structures of the AND gate L21, AND gate L31 and OR gate L41. The AND gates L22-L2r are similarly constructed. Referring to the FIG., numerals L21*a*-L21*n* designate AND gates of the AND gate L21, the respective inputs of which are connected to the output of the invertor L11 and the outputs r(1)f2-r(r)fn of the F# register F#(1). Numerals L31*aa*-L31*an*, L31*ba*-L31*bn*, . . . and L31*la*-L31*ln* designate AND gates of the AND gate L31, the respective inputs of which are connected to the respective outputs L21*a*-L21*n* and to the outputs r(1)C1-r(r)Cl of the CAR# register C(1).

The OR gate L41 comprises OR gates L41*aa*, L41*ab*, . . . L41*an*, L41*ba*, L41*bb*, . . . L41*bn*, . . . and L41*la*, L41*lb*, . . . L41*ln*, the first respective inputs of which are connected to the outputs of the AND gate L31, namely, the outputs of the AND gates L31*aa*, L31*ab*, . . . and 131*an*, L31*ba*, L31*bb*, . . . and 131*bn*, . . . and L31*la*, L31*lb*, . . . and 131*ln*, respectively, the second respective inputs of which are connected to the outputs of the AND gate L32, . . . and the last respective inputs of which are connected to the outputs of the AND gate L3r, respectively. The output signals C1f2-C1fn of the respective OR gates L41*aa*-L41*an* are inputted to the CCR 410*a* of the car C1, the output signals C2f2-C2fn of the respective OR gates L41*ba*-L41*bn* are inputted to the CCR 410*b* of the car C2, . . . and the output signals Clf2-Clfn of the respective OR gates L41*la*-L41*ln* are inputted to the CCR 4101 of the car Cl, respectively. Here again, the signals on the outputs of the OR gates in the OR gate L41 do not consider the case where a RC is being monitored in the RCR 370 and it should a RC be monitored in the RCR 370, it would only imply the that RC would not appear at the input of the CCR defined by the information therein during that time.

Accordingly, if the information in the F# and CAR# registers in the second row r(2) of the RCR 370 designate the floor f3 and the car C2, respectively, it would imply that the second input to the OR gate L41*bb* is high and, accordingly, that the outputs C2f3 thereof is high (assuming that this RC is not being monitored). Since this output is connected to the CCR 410*b*, it implies that the second car C2 would be assigned to service a transfered RC for the third floor F3.

Figure 21A:
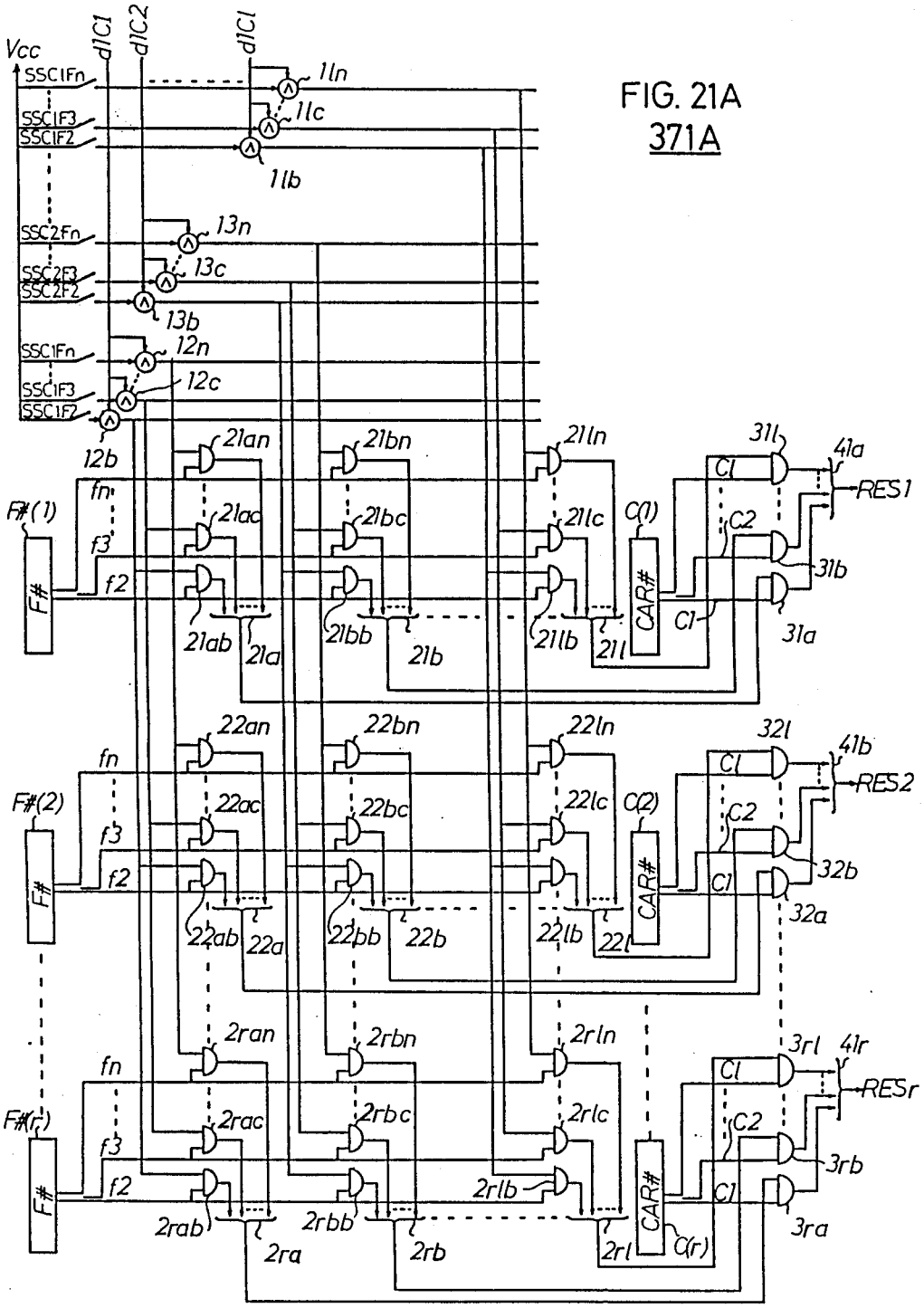
FIG. 21A,B show respective embodiments of a room call register reset logic of the multiple car elevator control system.

FIG. 21A shows a first embodiment 371A of the Room Call Reset Logic 371 according to the present invention, which is utilized for:

1. determining whether or not any of the cars C1-Cl has, while travelling in the down direction, arrived at at a F# presently specified in one or more of the F# registers F#(1)-F#(r);

2. determining whether or not the car satisfying the above condition 1, is the same car as the CAR# stored in the respective CAR# register (i.e. the CAR# register in the same row as the F# register for which the above condition 1 was satisfied; and 3. when the conditions 1 and 2 above are satisfied, generate a reset signal for reseting the RC in the row which satisfied those conditions.

Referring to the Fig., numerals F#(1)-F#(r), C(1)-C(r) designate the F# and CAR# registers in the rows r(1)–r(r), respectively, of the RCR 370. Numerals SSC1F2, SSC1F3, . . . SSC1Fn, SSC2F2, SSC2F3, . . . SSC2Fn, . . . and SSClF2, SSClF3, . . . SSClFn designate the car position detecting switches located at the respective floors F1, F2, . . . and Fn in the shafts of the elevator cars C1, C2, . . . and Cl, respectively. Numerals d1C1, d1C2, . . . and d1Cl designate the DOWN direction signals d1 (d1=1) of the cars C1, C2, . . . and Cl, respectively, from the Group Supervisory System Register 380A. Numerals 12*b*, 12*b*, . . . 12*n*, 13*b*, 13*c*, . . . 13*n*, . . . and 1*lb*, 1*lc*, . . . 1*ln* designate AND gates for allowing the signals generated by the closure of the switches SSC1F2, SSC1F3, . . . SSC1Fn, SSC2F2, SSC2F3, . . . SSC2Fn, . . . and SSC1F2, SSC1F3, . . . SSC1Fn when the cars C1, C2, . . . and Cl arrive at the respective floors F1, F2, . . . and Fn while travelling in the down direction to pass through said gates. Numerals 21*ab*, 21*ac*, . . . 21*an*, 21*bb*, 21*bc*, . . . 21*bn*, . . . and 21*lb*, 21*lc*, . . . 21*ln* designate AND gates for allowing the signals generated by the closure of the switches SSC1F2, SSC1F3, . . . SSC1Fn, SSC2F2, SSC2F3, . . . SSC2Fn, . . . and SSClF2, SSClF3, . . . SSClFn when the cars C1, C2, . . . and Cl arrive at the respective floors F2, F3, . . . and Fn while travelling in the down direction to be compared with the F# value stored in the F# register F#(1), so as to determine whether or not any of the cars C1-Cl is presently at, or just arrived at, the F# stored in the F# register F#(1). Similarly, numerals 22*ab*, 22*ac*, . . . 22*an*, 22*bb*, 22*bc*, . . . 22*bn*, . . . and 22*lb*, 122*lc*, . . . 22*ln* designate AND gates for allowing the signals generated by the closure of the switches SSC1F2, SSC1F3, . . . SSC1Fn, SSC2F2, SSC2F3, SSC2Fn, . . . and SSClF2, SSClF3, . . . SSClFn when the cars C1, C2, . . . and Cl arrive at the respective floors F1, F2, . . . Fn while travelling in the down direction to be comapared with the F# value stored in the F# register F#(2), so as to determine whether or not any of the cars C1-Cl is presently at, or just arrived at, the F# stored in the F# register F#(2). Similarly, Numerals 2*rab*, 2*rac*, . . . 2*ran*, 2*rbb*, 2*rbc*, . . . 2*rbn*, . . . and 2*rlb*, 2*rlc*, . . . 2*rln* designate AND gates for allowing the signals generated by the closure of the switches SSC1F2, SSC1F3, . . . SSC1Fn, SSC2F2, SSC2F3, . . . SSC2Fn, . . . and SSClF2, SSClF3, . . . SSClFn where the cars C1, C2, . . . and Cl arrive at the respective floors F1, F2, . . . and Fn while travelling in the down direction to be compared with the F# value sored in the F· register F#(r), so as to determine whether or not any of the cars C1-Cl is presently at, or just arrived at, the F# stored in the F# register F#(r).

Numerals 21*a*–21*l*, 22*a*–22*l*, . . . and 2*ra*–2*rl* designate OR gates for grouping the output of the AND gates 21*ab*, 21*ac*, . . . 21*an*, 21*bb*, 21*bc*, . . . 21*bn*, . . . and 21*lb*, 21*lc*, . . . 21*ln*, 22*ab*, 22*ac*, . . . 22*an*, 22*bc*, . . . 22*bn*, . . . and 22*lb*, 22*lc*, . . . 22*ln*, . . . and 2*rab*, 2*rac*, . . . 2*ran*, 2*rbb*, 2*rbc*, . . . 2*rbn*, . . . and 2*rlb*, 2*rlc*, . . . 2*rln*, respectively. Accordingly, if the F# stored in the F# register F#(1) is the same as the F# which the car C1 has just arrived at while traveling in the down direction, the output of the gate 21*a* goes high, if the F# stored in the F# register F#(1) is the same as the F# which the car C2 has just arrived at while travelling in the down direction, the output of the gate 21*b* goes high, . . . and if the F# stored in the F# register F#(1) is the same as the F# which the car Cl has just arrived at while travelling in the down direction, the output of the gate 21*l* goes high. The same applies to the second third and so on rows.

The outputs of the OR gates 21*a*–21*l* connect to first inputs of AND gates 31*a*–31*l*, the second inputs of which are connected to respective outputs C1-Cl of the CAR· register C(1), the outputs of the OR gates 22*a*–22*l* content to first inputs of AND gates 32*a*–32*l*, the second inputs of which are connected to respective outputs C1-Cl of the CAR# register C(2), . . . and the outputs of the OR gates 2*ra*–2*rl* connect to first inputs of AND gates 3*ra*–3*rl*, the second inputs of which are connected to respective outputs C1-Cl of the CAR# register C(r). The outputs of the AND gates 31*a*–31*l*, 32*a*–32*l*, . . . and 3*ra*–3*rl* are grouped together by OR gates 41*a*, 41*b*, . . . and 41*r*.

Accordingly, the output RES1 of OR gate 41*a* only goes high when the car C1-Cl as specified by the information in CAR# register C(1) arrives at the F# as specified in the F# register F#(1) while travelling in the down direction, the output RES2 of OR gate 41*b* only goes high when the car C1-Cl as specified by the information in CAR# register C(2) arrives at the F# as specified in the F# register F·(2) while traveling in the down direction, . . . and the output RESr of OR gate 41*r* only goes high when the car C1-Cl as specified by the information in CAR# register C(r) arrives at the F# as specified in the F# register F#(r) while travelling in the down direction, respectively. The outptputs RES-1–RESr of the RCR 370 Reset Logic are connected to the reset terminals R1–Rr of the presence flip flops P(1)–P(r) via the OR gates D21–D2r, respectively, as wel as the the reset inputs of the CAR# and STATUS registers C(1)–C(r) and ST(1)–ST(r), respectively.

It should be noted that when the value stored in a CAR# register is 000 . . . 0000, (i.e. all zeros), implying that none of the cars is assigned to that RC, the respective, the corresponding RC can not be reset from the RCR 370 regardless of the position of direction of travel of any of the cars C(1)-C(l). Further, in the RCR-CCR Room Call Transfer Interface 372, similar to the above explanation, if no car is assigned to the CAR# registers C(1)–C(r), the F# stored in the corresponding F# register F#(1)–F#(r) can not be transfered to the CCR 410*a*–410*l*. Accordingly, only when a car is assigned to the CAR# registers C(1)–C(r) will the respective F# stored in the respective F# register F#(1)–F#(r) be assigned (transfered) to the CCR 410*a*–410*l* and will the respective RCs in the rows r(1)–r(r) be automatically reset.

Figure 21B:
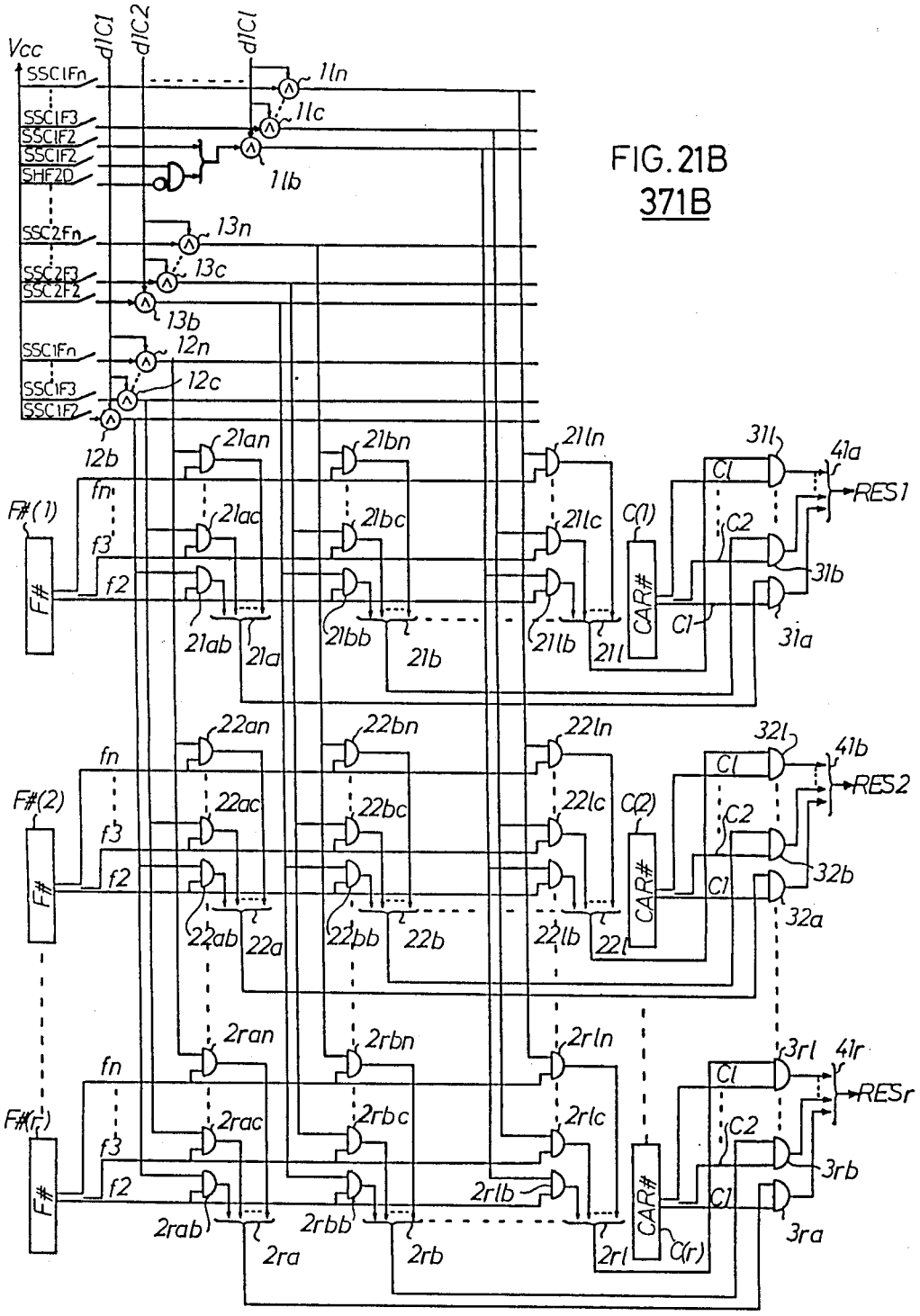

FIG. 21B shows a second embodiment 371B of the RCR Reset Logic 371. The only difference between the two embodiments is that, with this embodiment it is also possible to, by using hardware instead of software, determine whether or not a HC corresponding to a respective RC is present just before the arrival of an allocated elevator car at the respectively assigned RCF#, and if it is determined that no corresponding HC exists, cause that RC to be reset from the RCR 370. In this way, if an operator activates his RCU and fails to show up in the elevator hall way and activate the down direction hall button before the expected arrival of the elevator car at that floor, the RC is automatically reset from the RCR 370 and, accordingly, the elevator car does not service that floor, if that car has no other call assigned thereto from that F#, whereby the passengers in the car are not unnecessarily delayed. In the Fig., this modification is only illustrated for the second floor F2. Referring to the Fig., numeral SSClF2' desingates a car position detecting switch located in the shaft of the elevator car Cl just above the second floor F2 switch SSClF2, numeral GG1 designates an AND gate, one input of which is connected to the switch SSClF2 and the other inverted input of which is connected to the output Q of the hall call flip flop H2D of the HCR 390, and numeral GG2 designates an OR gate one input of which is connected to the switch SSClF2 and the other input of which is connected to the output of the AND gate GG1. Accordingly, at the time the switch SSClF2 is activated by the car Cl while travelling in the down direction, if no DOWN direction HC exists from the floor F2, the corresponding RC in the RCR 370. Specifically, since the switch SSClF2' is physcally located above the switch SSClF2, when the car Cl arrives at a point in the elevator shaft just above the second floor, if the output Q of the flip flop H2D is not set, implying that there is no DOWN direction HC from the second floor, both inputs to the AND gate G11 are high causing the output thereof to go high which, similar to the previous explanation, causes the respective RC in the RCR 370 to be reset, resulting in the car not stopping to service the floor F2.

FIG. 23 shows the Monitor for RCs in the RCR 370, Assign CAR# to RCs in the RCR and activate the RCUb Program P9 according to the present invention. The program P9 is very similar to the program P4B with the only difference being that the steps ST251 and ST256 are replaced by the step ST125. Accordingly, the description of the similar portions will not be repeated herebelow. Referring to the Fig., at step ST124 an Assign CAR# to RC in RCR and Ativate RCUb Program is executed P11.

FIG. 23 shows the Monitor for RCs in the RCR, Assign a CAR# to respective RCs in the RCR and Activate RCUb Program P9 according to the present invention. It can be seen from the Figs. that the programs P4B and P9 for the single and multiple CCRs 37B and 370, respectively, are very similar and, accordingly, the similar steps have been designated by the same reference numerals. The only difference between the two programs is that the steps ST25 and ST29 have been replaced by the step ST125. At step ST125, an Assign CAR# to RCs in the RCR and Activate RCUb Program P11 is executed.

It should be noted that, similar to the use of the program P4B with the Single Car RCR 37B, the steps ST21-ST29 are utilized for scanning the Multiple Car RCR 370 for RCs from the top floor Fn to the second floor F2. Once a RC is detected to be from the floor number presently being considered, the program P11 is executed for that RC.

Specifically, the program P11 is utilized for:

1. determining whether or not the value stored in that RC's STATUS register is 0 or 1;

2. If the value stored in that RC's STATUS register is 0:

3a. determining whether or not any of the cars can arrive before the desired time Td;

3b. determining whether or not any of the cars can arrive at the desired time Td;

3c. storing the arrival times Tar of the cars which cannot arrive before or by the desired time Td;

4. If at 3 it is determined that a car can arrive before the desired time Td:

4a. not assigning any of the cars to the CAR# register of that RC, since the fact that at least one of the cars can arrive at that RCF# before the desired time Td implies that there is still time to do so (with respect to that car and the desired time Td), since, if no other calls are assigned to that car in the meantime, that car will be able to arrive at that RCF# even if that RCF# is assigned to that car at some later time, whereby, the cars are assigned to the RCs at the last possible second, i.e., not before it is absolutely necessary to do so, without conciously delaying the service to that RC with respect to the desired time Td, whereby the system has more time to decide which car becomes most appropriate as new calls come in and the cars are not prematurely moved to a less advantageous position with respect to the new calls, thereby, generally reducing the number of runs each car makes and, accordingly, reducing the wear thereof as well as the electrical cost to operate the cars.

4b. activating that RCUb so as to inform the operator thereof that a car will be available at his floor at the desired time Td from the time the buzzer sounds;

4c. changing the information stored in the Tr register of that RC from information representative of the desired time Td to the required time Treq, where Treq'Tb+Td, where:

Tb represents the time that the RCUb was activated and Td the desired time in the corresponding Td register;

4d. changing the status of the RC to 1, thereby indicating to the system the next time this RC is being considered that the information stored in the Tr register is representative of the required time Treq and that the RCUb has been previously activated.

5. if at 3 it is determined that none of the cars can arrive before the desired time Td, but that a car can arrive at the desired time Td:

5a. allocating that car to the CAR# register, thereby allowing the RCF# to be assigned to one of the CCR 410*a*, 410*b*, . . . or 410*c*, depending on which CAR# was assigned, as well as allowing the system to reset that RC from the RCR 370 when the assigned car arrives at RCF# while travelling in the down direction;

5b. same as 4b;

5c. same as 4c;

5d. same as 4d;

6. if at 3 it is determined that none of the cars can arrive before or by the desired time Td;

6a. assigning to the CAR# register of that RC the car having the smallest arrival time Tar, so that the nearest car to that RCF# may start to proceed toward that RCF#;

7. If during a subsequent time that this program is executed, a RC being considered still has a 0 status value:

7a. re-calculating the arrival times of the cars and repeating the above mentioned operations 1-6, whereby, even though a car was previously assigned to that RC (i.e. the RC presently being considered), the CAR# register may be reset if it is determined that presently a car can reach before the desired time Td.

8. If the value stored in that RC's STATUS register is 1:

9a. same as 3a but with respect to Treq;

9b. same as 3b but with respect to Treq;

9c. same as 3c but with respect to Treq;

10. If at 9 it is determined that a car can arrive before the required time Treq:

10a. same as 4a but with respect to Treq, even if a car was previously assigned;

11. if at 9 it is determined that none of the cars can arrive before the required time Treq, but that a car can arrive at the required time Treq:

11a. same as 5a.

12. if at 9 it is determined that none of the cars can arrive before or by the desired time Td:

12a. same as 6a but with respect to Treq.

13. If during a subsequent time that this program is executed, a RC being considered has a 1 status value:

14a. same as 7a but with respect to steps 8–12;

14b. same as 8–11, and with respect to Treq.

Generally, the program P11 is utilized for:

1. determining whether or not any of the cars can service that RC before the desired time Td or required time Treq specified therein (i.e. in the RC presently being considered);

2. determining whether or not any of the cars can service that RC at the desired time Td or required time Treq specified therein;

3. storing the arrival times Tar of all the cars that cannot arrive before the time Td;

4. if it is determined at 1 that a car can arrive before the desired time Td or required time Treq;

4a. not assigning any car to the CAR# register of that RC (CAR#=0), thereby preventing that RCF# from being transfered to the CCR 410*a*–410*l* as well as not allowing that RC to be automatically reset when any of the cars pass by that RCF#;

4b. activating that RCUb to inform the operator thereof that the car will be available at his floor by the time Td from the activation thereof;

5. if it is determined at 1 that none of the cars can arrive before the desired time Td or required time Treq and it is determined at 2 that a car can arrive at the desired time Td or the reqired time Treq:

5a. assigning that car to the CAR# register of that RC which has an arrival time Tar=Td or Tar=Treq, thereby assigning that RCF# to on of the CCR 410*a*, 410*b*, . . . or 410*l*, as well as allowing the allocated car to automatically rset that RC when it services that RCF# on its way down;

5b. same as 4b;

6. if the conditions specified in 1 and 2 above cannot be satisfied, namely, if none of the cars can service that RC by the desired time Td or required time Treq:

6a. assigning the car to the CAR# register of that RC which has the smallest arrival time Tar (i.e. the car which can provide the quickest service), whereby that RCF# is assigned to one of the CCR 410*a*, 410*b*, . . . or 410*l*, thereby instructing the assigned car to approach that RCF# so that when it gets nearer, the conditions 2 should arrise.

More generally, the most appropriate CAR# is determined according to the following hyrarchial order (criteria):

1. if any of the cars can service that RC (i.e. the RC presently being considered) before the desired time Td or the required time Treq specified therin (i.e. in the respective Td of that RC), and if it is further determined that any of those cars can still service that RC before the desired time Td or required time Treq specified therein on a second run, or after servicing the last call assigned thereto on a first run, then none of the cars is assigned to that RCF#;

2. if none of the cars can satisfy the condition 1 above, and if any of the cars can reach that RCF# at the desired time Td or the required time Treq, then one of those cars is assigned to that RCF#;

3. if none of the cars can satisfy the conditions 1 and 2 specified above (i.e. if none of the cars can reach that RCF# before or by the desired time Td or reqired time Treq), then the car which can arrive at that RCF# the fastest is assigned to that RC.

4. during subsequent executions of this program, (a) cancelling, (b) assigning, (c) re-assigning a previously assigned car, or (d) not changing the previously assigned car the presently most appropriate CAR# to that RC according to the above defined hyarchical order, namely;

(a) cancelling a previously assigned CAR# (i.e. not assigning any of the cars) if it is determined that presently one of the cars can arrive before the desired time Td or the required time Treq (b) assigning or re-assinging the CAR# which was previously assigned if it is determined that another car is more appropriate for that RC (i.e. if it is determined that one of the cars now can arrive at the desired time whereas none of the cars was determined to be able to before, or that another car can arrive quicker then the previously allocated car but not before the desired or required time Td or Treq, respectively).

The reasons why it is so vigorously checked whether or not one of the cars can reach the RCF# before the desired time Td on a first or second run are:

1. To ensure that the car which is determined to be presently able to reach the RCF# before the desired time Td, will actually not be too far to reach that RCF# soon thereafter, namely, soon after this decision is made (i.e. by soon after is meant before the time Td with respect to the time that this decision was made), because it is on its way down to service RCs HCs or CCs further down then the RCF# and even though it will soon arrive at that RCF#, as soon as it passess that RCF#, it will not be able to arrive at that RCF# on a second run by the desired Td;

2. to save electricity. Namely, if any of the cars is determined to be capable of reaching the RCF# on a first run, or after servicing the last call assigned thereto on a first or second run, there is no need to assign that RCF# to any of the cars now, since there is time to do so later without unnecessarily delaying the service provided to the operator of that RCU.

It should be noted that the RCR 37C, 370 and 3700 (which will be discussed later) all show hardware which, in combination with the respecitive software, change the information stored in the Tr registers Tr(1)–Tr(r) from information representative of the registered time Treq to information representative of the time Treq. However, since in the embodiments utilizing these RCRs the registered time Treg is not utilized in any of the calculations shown in the corresponding software, the Tr registers Tr(1)–Tr(r) can be eliminated completely by storing the required time Treq in the Td registers Td(1)–Td(r), since the information representative of the desired time Td is exchanged for the time Treq. Namely, once the time Treq is calculated and stored in the RCR, the information representative of Td is never utilized again for any given RC. However, since other software programs may consider both the registered time Treg, the desired time Td and/or the required time Treq in any number of ways for determining which of the cars is the most appropriate car, the Tr registers are included in the Figs. One such modification would be to not only consider the time Treq when assigning a car, but also to consider the times Treg and Td, whereby if a RC was registered before a given time with respect to the present time that that RC is being considered, that RC is given priority over other RCs when determining the car to be allocated thereto.

Figure 24A:
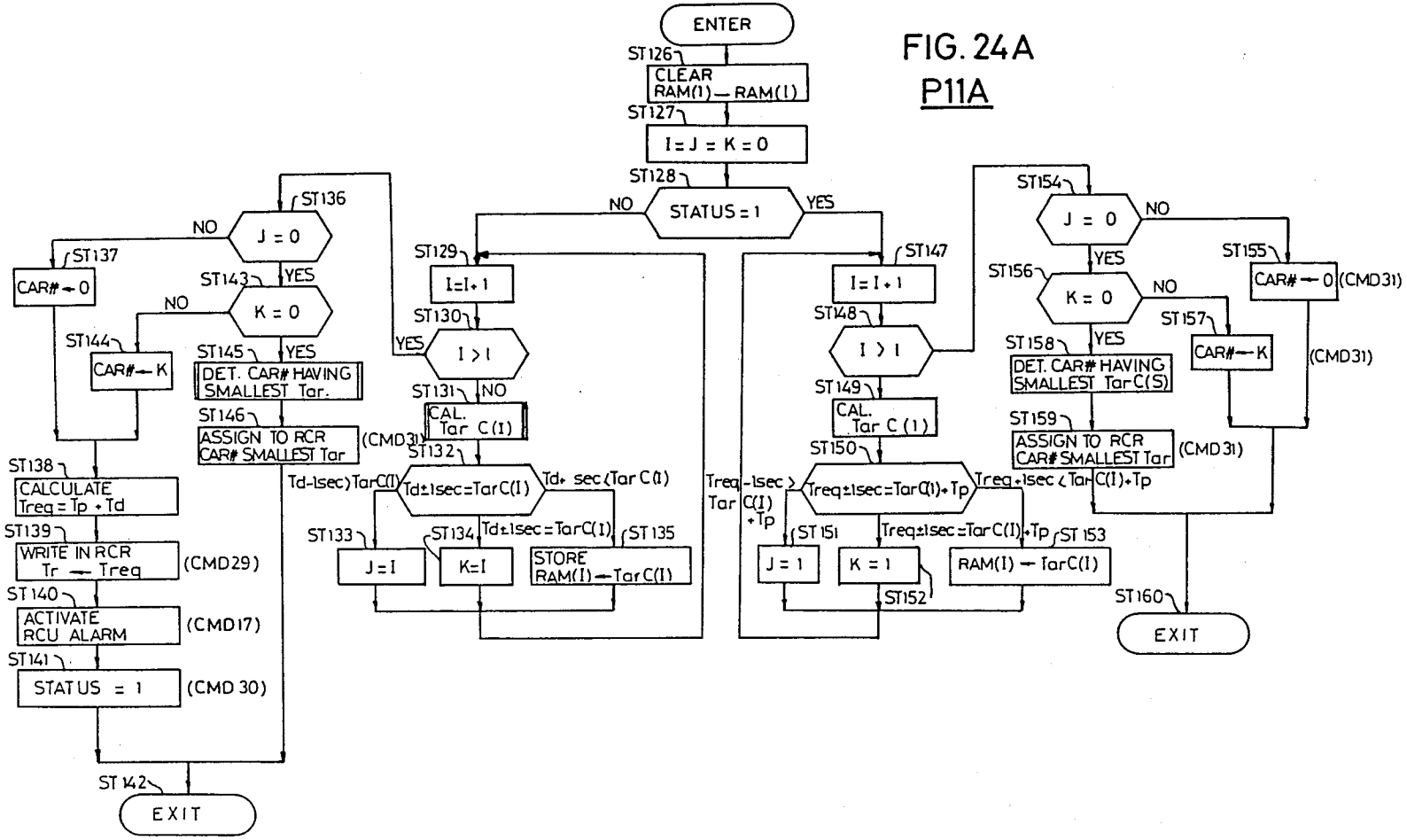
FIG. 24A,B,C,D,E,F shows respective embodiments of an assign CAR# to RCs in RCR and activate RCUb program P11 of the multiple car elevator control system.

FIG. 24A shows a first embodiment P11A of the program P11 according to the present invention. Refering to the Fig., after entering the program, at step ST126, Tar registers RAM(1)-RAM(l) in the RAM 33 are reset. Next, at step ST127 registers I,J and K in the RAM 33 are reset. Next, at step ST128, it is determined whether or not the STATUS value of the STATUS register presently being read out of the RCR 370 is 0 or 1. Here, the STATUS value of the STATUS register of the RC entry presently being considered is utilized for indicating whether or not:

1. the respective RCU's buzzer (RCUb) was activated; and 2. the value stored in the respective Tr register Tr(1)-Tr(r) represents a respective registered time Treg (i.e. the time the RC was registered in the RCR) or a required time Treq (i.e. the time the elevator is required to serve the respective RC in the RCR).

Since, once the STATUS value is changed from 0 to 1, the information representative of the time Td and Treg is not required any longer, the information representative of Treq can be stored either in the respective Td registers Td(1)-Td(r) or the Tr registers Tr(1)-Tr(r). In other words, once the information representative of Treq is stored in the Tr registers Tr(1)-Tr(r) and the STATUS value is changed to 1, the information representative of the desired time Td in the Td registers Td(1)-Td(r) becomes redundant.

Since, as explained with respect to program P4B for the single RCR 37B, only the information pertaining to one RC entry, namely, the R#, F#, Td" and Tr' is read out from the registers R#(1)-R#(r), Td(1)-Td(r) and Tr(1)-Tr(r) via lines 141, 142, 143 and 144, similarly, only one respective STATUS value STATUS" and one CAR# value CAR#" is read out from the registers ST(1)-ST(r) and C(1)-C(r) via lines 145 and 146, respectively, in the Multiple Car Car Call Register.

If at step ST128 the answer is NO (i.e. STATUS=0), the program proceeds to step ST129 where the value of I is increased by one (At this stage I=1). Next, at step ST130, it is determined whether or not the value of I>1 (i.e. the number of cars). If at step ST130 the answer is NO (i.e. I<1), the program proceeds to step ST131 where the Tar Calculation Program P5 is executed for car number C(I).

It should be noted that in executing the program Tar Calculation Program P5 for the car C(I), only the calls in the respective CCR 410(I) (where I is and integer from 1-l) need be considered, since the RCs and HCs are automatically transfered to the assigned CCR 410*a*-410*l*. For example, if I=1, only the HC signals F1UC1-FnDC1, RC signals C1f2-C1fn and CCs, as indicated the states of the outputs Q of the flip flops Q71-Q7n in the CCR 410*a*, need be considered.

Next at step ST132 it is determined whether or not Td±1 sec=TarC(I). Specifically, it is determined whether or not the desired time Td" of the RC presently being read out of the RCR 370 is whithin one second of the arrival time Tar of the car C(I) calculated in step ST131. If it is determined that the car C(I) can arrive at the floor number of the RC presently being considered in less time than the desired time Td set on the respective RCU (i.e. Td−1 sec>TarC(I)), the program proceeds to step ST133 where J is set to the present value of I. If at step ST132 it is determined that Td±1 sec=TarC(I), the program proceeds to step ST134 where the K register is set to the present value of I. If at step ST132 it is determined that Td±1 sec<-TarC(I) (i.e. that the car C(I) can not arrive by the desired time Td), the program proceeds to step ST135 where the value of TarC(I) is stored in the RAM 33 in space RAM(I). After step ST133, ST134, or ST135 the program returns to step ST129 where the value of I is increased by one. Steps ST129-ST135 are repeated until at step ST130 it is determined that the value of I>1 at which time the program proceeds to step ST136. At step ST136 it is determined whether or not the value of J=0. If the value of J is not equal to 0 (i.e. answer NO) indicating that at least one of the cars C1-Cl can arrive at the floor of the RC presently being considered (RCF#) by the time Td specified therein, the program proceeds to step ST137 where the respective CAR# register of that RC in the RCR 370 is reset (i.e. by issuing a CMD31 and inputing via line 136 a 000 . . . 00 value, where the number of zeros is representative of the number of cars). The reason no car is assigned to the RC presently being read out of the RCR 370 is because, since J is not equal to 0, at least one car can arrive whithin the desired time Td, and, accordingly, there is no need to prematurely assign a car now, since it can be assigned at some later time when the condition Td±1 sec=TarC(J) arrises for that and any other car, when no other cars can arrive before then, without conciously delaying the service provided to that RC (i.e. that car, or some other car, should be able to provide service at the desired time Td). In other words, only when it is determined that none of the cars can arrive before the desired time Td, i.e. TarC(1)−TarC(1)>Td−1 sec, is a CAR# assigned to that RC. Next, at step ST138, the value Treq=Tp+Td is determined where:

Tp=the present time (i.e. the time that this step ST138 is executed) as outputed by the clock 36; and Td=the desired time Td" read out via line 143 of the RCR 370.

Next, at step ST139, the value Treq calculated in step ST138 is writen into the respective Tr register in the row of the RC presently being read out by issuing a command CMD29. Next, at step ST140, a command CMD17 is issued which causes the respective RCUb defined by the information in the R# and F# registers of the RC presently being read out to be activated. Next, at step ST141, a command 30 is issued, whereby the STATUS value in the STATUS register in the row of the RC presently being read out is changed from 0 to 1, after which the program is exited at step ST142. Accordingly, if it is determined that the STATUS value is 0 and that there is at least one car which can arrive at the floor of the RC presently being examined in the RCR 370 at a time less than the desired time (i.e. Tar<Td−1 sec), then the program proceeds through steps ST136-ST142, wherby the respective RCUb defined by the information in the RC presently being considered is activated, the information in the respective Tr register is changed from Treg to Treq and the STATUS value is changed from 0 to 1. However, no CAR# is assigned to the RC because there is still time before the car must be allocated, since at least one car can arrive before the desired time, thereby saving electricity, since all sorts of calls may be entered in the meantime, whereby the cars C1-Cl can be allocated appropriately at the last second.

If at step ST136 the answer is YES, implying that none of the cars can arrive at the floor number of the RC presently being read out of the RCR 370 before the desired time Td, the program proceeds to step ST143. At step ST143, it is determined whether or not K=0, namely, whether on not any of the cars C1–Cl can reach the floor number of the RC presetly being read out of the RCR 370 at the time desired (i.e. Td±1 sec=Tar). If at step ST143 the answer is NO, implying that at least one of the cars C1–Cl can reach the floor number of the RC presently being considered at the desired time (Td±1 sec=Tar), the program proceeds to step ST144 where a command CMD31 is issued and the car C(K) is assigned to the CAR# register of the RC presently being considered, after which the program proceeds through steps ST138–ST142. Accordingly, the RCF# is assigned to one of the CCR 410*a*–410*l* which corresponds to the CAR# value presently stored in the CAR# register.

However, if both the contents of the registers K and J are 0, the program proceeds from step ST130 through steps ST136, ST143 to step ST145, where the car having the smallest arrival time Tar is determined. This program of determining the car number having the smallest arrival time is well known in the art and is therefore not disclosed herein. The fact that J=K=0 implies that the step ST135 was executed for all the cars C1–Cl and, accordingly, the respective arrival times Tar of the cars C1–Cl are stored in the RAM 33 in spaces RAM(1)–RAM(l), respectively. Next, at step ST146, a command CMD31 is issued which enables the car having the smallest arrival time Tar to be assigned to the CAR# register in the same row as the RC presently being considered, after which the program is exited through step ST142. In this last described case, the respective RCUb oefined by the R§ presently being considered is not activated and the STATUS value thereof not changed to 1 because all the cars are too far to reach the floor number defined by the RC and/or have already been assigned many calls which will not allow the cars to reach the RCF# by the desired time Td defined by the respective RCU. However, since a car is assigned to the RC, even though the assigned car may be altered each time this program is executed due to the program determining, due to continually changing conditions (i.e. delayed service new calls, etc), that another car is nearer than the previously assigned car, a car should finally reach a point where the arrival time thereof Tar is determined to be equall to the desired time Td, whereby the program would be executed via steps ST143, ST144, ST138–ST142 instead of steps ST143–ST146.

Next, the case where the STATUS=1 will be considered. The STATUS=1 implies that:

1. this program has been executed at least once;
2. the corresponding RCUb has been previously activated;
3 that the value stored in the corresponding Tr register is representative of a value Treq; and
4. the corresponding CAR# register may or may not have a CAR# assigned therein.

Again, after entering the program, at step ST126, the Tar registers RAM(1)–RAM(l) registers in the RAM 33 are cleared. Next, at step ST127, the registers I,J and K in the RAM 33 are cleared (i.e. I=J=K=0). Next, at step ST128, it is determined that the STATUS value of the RC presently being considered is 1. Accordingly, the program proceeds from step ST128 to step ST147 where the value of the I register is increased by 1. Next, at step ST148 it is determined whether or not the value of I>1. If the answer is NO, implying that the last car C(l) has not been considered as yet, the program proceeds to step ST149 where the arrival time of car C(I) is caculated by the Tar Calculation Program P5. Next, at step ST150, it is determined whether or not $$Treq \pm 1\ sec = TarC(I) + Tp$$

where:

Treq is the value stored in the Tr register of the RC presently being read out (i.e. presently being considered);

TarC(I) is the arrival time of the car C(I) which was just calculated in step ST149; and Tp is the present time being read out of the clock 36 that this step ST150 is being executed.

Figure 24B:
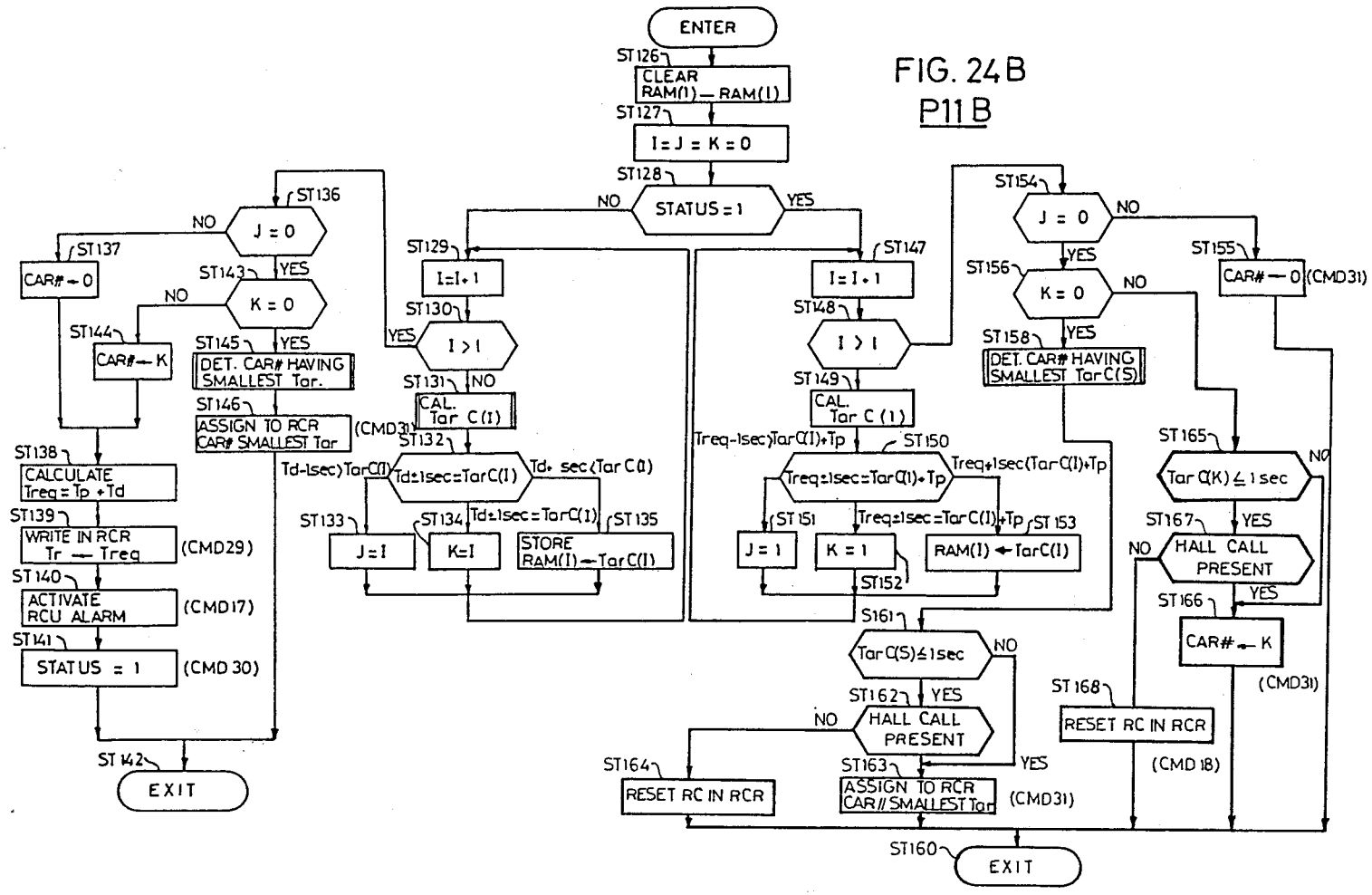

If at step ST150 it is determined that Treq−1 sec>TarC(I)+Tp (i.e. that the car C(I) can arrive at the RCF#, as specified in the RC presently being considered, before the required time Treq), the program proceeds to step ST151 where the value in the register J is changed to I (i.e. J=I). If it is determined that Treq±1 sec=TarC(I)+Tp, the program proceeds to step ST152, where the value in register K is changed to I. If it is determined that Treq+1 sec<TarC(I)+Tp (i.e. that the car C(I) can only arrive at the RCF#, as specified by the RC presently being considered, at a time which is later than the required time Treq, as specified in the corresponding Tr register of the RC presently being considered), the program proceeds to step ST153 where the arrival time of the car C(I) TarC(I) is stored in the register RAM(I) of the RAM 33. After executing steps ST151, ST152 or ST153 the program returns to step ST147 where the value of I is increased by 1 so that the next car may be considered. When at step ST148 is determined that I>1, namely that all the cars have been considered, the program proceeds to step ST154 where it is determined whether or not the value in the register J=0. If the answer is NO, implying that at least the car C(J) can arrive before the required time Treq, as specified in the corresponding Tr register, at the RCF#, as specified in the F# register of the RC presently being considered, the program proceeds to step ST155 where the command CMD31 is issued and the contents of the CAR# register of the RC presently being considered is reset to 0 (i.e. no car assigned). It should be noted that it is quite possible that a car was previously assigned but due to service being faster than originally estimated, it may be subsequently determined that a car or cars can arrive at the RCF# faster than the required time Treq and, accordingly, the car which was previously assigned may be reset at step ST155. If at step ST154 the answer is YES, implying that none of the cars can arrive at the RCF# before the required time Treq, the program proceeds to step ST156 where it is determined whether or not K=0. If at step ST156 the answer is NO, implying that at least the car C(K) can arrive at the RCF# at the required time Treq, the program proceeds to step ST157 where the command CMD31 is issued and the car C(K) is assigned to RC presently being considered by applying a signal e program P11A, the only difference being that the program P11B further allows the system to automatically reset the RC presently being considered in the RCR 370 if it is determined that no corrresponding HC (i.e. a HC from the same F# as the RCF#) is present at a given time Tres before the arrival of an allocated car, as specified in the information in the CAR# register of the RC presently being considered, at the RCF#. Accordingly, if a car is allocated to service a RC, as that car approaches the RCF#, only if a HC from the same F# as that RCF# is registered in the HCR 390 before the arrival thereof at that F# is the car allowed to service that F#. Accordingly, not only is the operator required to activate his RCU but he is also required to press the respective hall botton (before a time Tres with respect to Tarrival i.e. 1 sec) in order to be serviced, thereby ensuring that he actually will use the car and not unecessarily inconvinience other people using the car. Accordingly, the command CMD18 is utilized in this program. Command CMD18 was not required for the program P11A. As can be seen from FIG. 24B, the only difference between FIG. 24A and 24B are additional steps ST161–ST168. Specifically, in program P11B, after step ST158, the program proceeds to step ST161 where it is determined whether or not TarC(s)<1 sec. If at step ST161 the answer is NO, the program proceeds to step ST163 where, similar to step ST159, the car having the smallest Tar is assigned to the RC in the RCR. However, if at step ST161 the answer is YES, the program proceeds to step ST162 where it is determined whether or not a HC is present from the F# of the RC presently being considered. If at step ST162 the answer is YES, implying that the person who generated the RC presently being considered has also activated the respective hall push botton (i.e. generated a HC from the same F# as the RC), the program proceeds to step ST163 where the car having the smallest arrival time Tar(s) is assigned to service that RC, after which the program is exited at step ST160. However, if at step ST162 the answer is NO, implying that the person who generated the RC presently being considered either changed his mind and is not going to utilize the elevator car or that he is not going to arrive in time for utilizing the elevator car, the program proceeds to step ST164 where a command CMD18 is issued, whereby the RC presently being considered is reset from the RCR 370, after which the program is exited at step ST160. Similarly, at step ST156 it is determined whether or not K=0. If at step ST156 the answer is NO, the program proceeds to step ST165. At step ST165, similar to step ST162, it is determined whether or not TarC(K)<1 sec. If at step ST165 the unswer is NO, the program proceeds to step ST166 where the car number C(K) is assigned to the CAR# register of the RC presently being considered in the RCR 370, after which the program is exited. If at step ST165 the unswer is YES, the program proceeds to step ST167. At step ST167, similar to step ST162, it is determined whether or not a corresponding HC is presently registered in the HCR 390 from the F# that the RC presently being considered originated from. If at step ST167 the unswer is NO, the program proceeds to step ST168 where the RC entry presently being considered is reset. If at step ST167 the unswer is YES, the program proceeds to step ST166 where the car number C(K) is assigned to the RC entry presently being considered, after which the program is exited at step ST160. If at step ST167 the unswer is NO, the program proceeds to step ST168, where the RC presently being considered is reset.

Figure 24C:
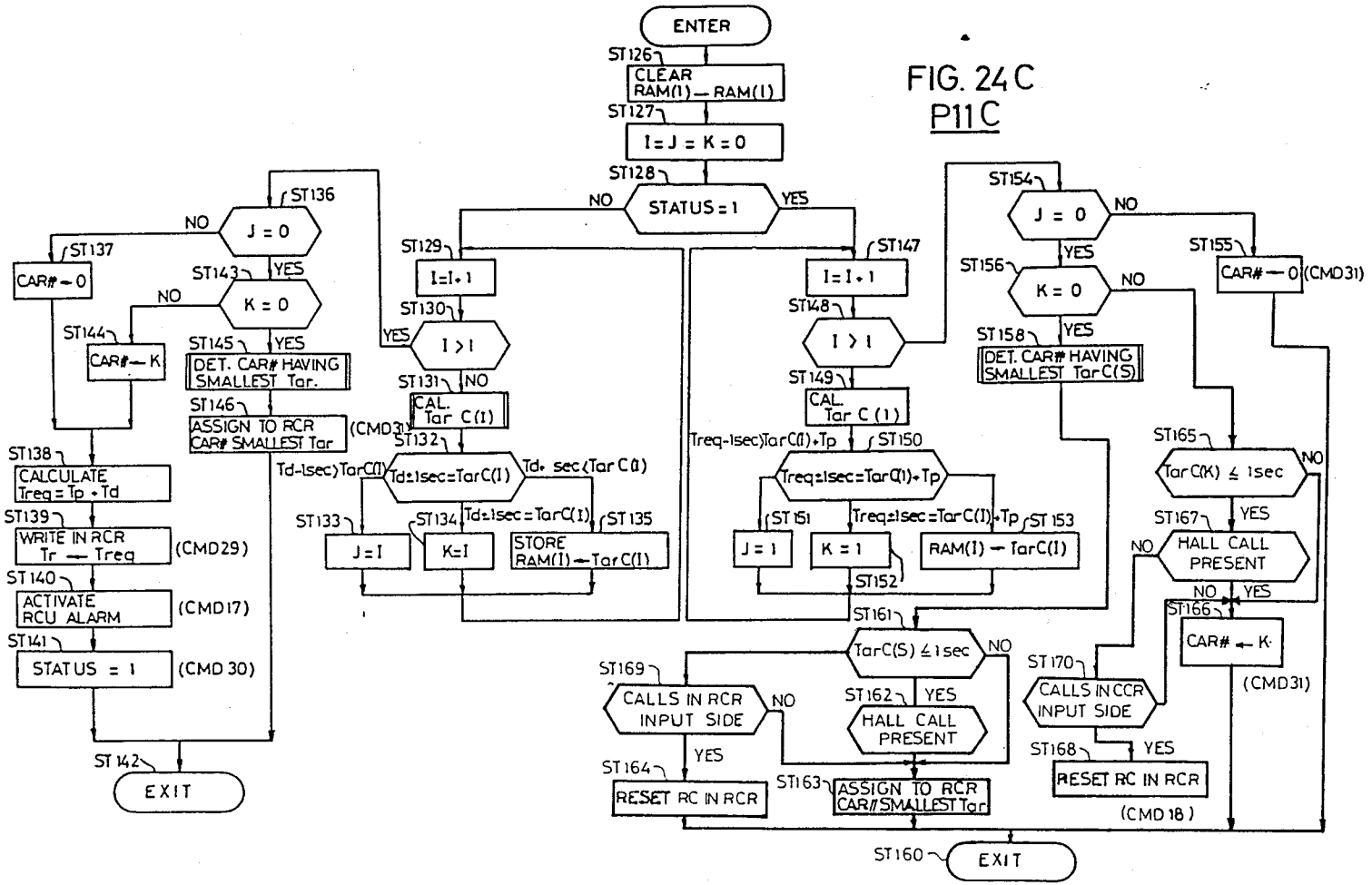

FIG. 24C shows a third program P11C of the program P11 similar to the programs P11A and P11B. The program P11C further comprises steps ST169 and step ST170, which are utilized to determine whether or not there are any other calls besides the RC presently being considered in the corresponding RCR 410*a*–410*l* specified by the information presently stored in the CAR# register of that RC. This is made possible since when a RC is being considered, the respective output Q11, OH32–OH3r are high which, as can be seen in FIG. 20A prevents the RC being considered from being transfered to the designated RCR 410*a*, 410*b*, . . . or 410*l*, as specified by the information stored in the corresponding CAR# register. Accordingly, since the RC entry is negated at the time it is considered, if there are any other calls in the designated CCR 410*a*, 410*b*, . . . or 410*l*, the corresponding car C1, C2, . . . or Cl is not free.

Referring to FIG. 24C, if at step ST162 it is determined that there is no corresponding HC presently registered in the HCR 390 (i.e. unswer NO), the program proceeds to step ST169, where it is determined whether or not there are any calls assigned to the corresponding CCR. If there are no calls assigned to the CCR being considered, implying that there are no RCs, HCs and CCs for that car other than the RC presently being considered (i.e. that car is free), the program proceeds to step ST163 which was explained previously. If the unswer at step ST169 is YES, the program proceeds to step ST164 where the RC presently being considered is erased. In other words, if there are no calls in the RCR, the RC being considered is not erased from the RCR even though no respective HC existed 1 sec before the arrival of the allocated car, thereby giving the person who activated that RC extra time to activate the respective HC and to be provided with prompt service, since the allocated car is waiting at his floor, when no other person wants to use it. Similarly, step ST170 performs the same function as step ST169. Specifically, if at step ST167 the unswer is NO, the program proceeds to step ST170. If at step ST170 the unswer is NO (i.e., it is determined that there is no corresponding HC registered 1 sec before the arrival of the allocated car), the program proceeds to step ST166 where car C(K) is assigned to the RCR being considered. If at step ST170 the unswer is YES, the program proceeds to step ST168 where the RC is erased from the RCR (i.e. a command CMD18 is issued).

It should be noted that in the above programs P11B and P11C the fact that the respective RCs are reset if no corresponding HCs are registered 1 sec before the arrival of an allocated car to each RC is also usefull for the case where, if the operator registers a HC prematurely early (i.e. with respect to the time he set his RC's timer) he may be serviced by another car (since the system has no way of identifying who the persons registering HCs are, and accordingly, has no way of determining whether or not the presently registered HC has been registered by the same person who registered a RC from the same F#), and accordingly, when the allocated car does arrive at that RCF#, since the operator of the corresponding RCU has already utilized another car, no corresponding HC will be registered and, by using the programs P11B or P11C, no redundant service arrises (i.e. the RC's allocated car will not unnecessarily provide service to someone who has already been serviced). It should be further noted that if the Room Call Reset Logic 371B shown in FIG. 21B is utilized, the steps for determining whether or not a corresponding HC is registered before the arrival of an allocated car is not required since this is carried out automatically by the hardware disclosed in the FIG. 21B. Further, that if the program P11C is utilized, where it is not only determined whether or not a corresponding HC exists for the RC presently being considered, but also whether or not the elevator is free (i.e. has no calls allocated to it) and if it is free, allow the elevator to wait at that floor as long as no other calls are assigned to it, the Room Call Register Reset Logic 371 must be modified to include this condition, or the RCs would be automatically reset upon the arrival of the allocated car at the RCF#. This modification to the Reset Logic can comprise the additional hardware of r groups of n−1 AND gates, the first inputs of which are conneted to the outputs f2–fn of the F# registesters F#(1), F#(2), . . . and F#(l), and the second inputs of which are connected to the outputs Q of the H2D, H3D, . . . and HnD registers, respectively, in the HCR 390, and the respective outputs of which are connected to where the outputs of the F# registers F#(1)–F#(r) are presently connected in the Reset Logic 371A. In this way the additional requirement that a corresponding HC be present for the reset signals RES1–RESr to go high is provided.

FIG. 24D shows a further embodiment P11D of the program P11 which can be applied to any of the programs P11A–P11C according to the present invention. The steps ST126*a*–ST126*d* are inserted between the step ST126 and the step ST127 in the programs P11A–P11C. By utilizing these steps the RCR Reset Logic 371 can be done away with altogether, thereby minimizing the hardware required. Specifically, after entering the program P11D, at step ST126*a* it is determined whether or not a CAR# is assigned to the RC presently being considered in the RCR 370 (i.e. by monitoring the value on the output line 146). If the unswer at step is NO (i.e. there is no CAR# assigned), the program proceeds to the step ST127 shown in the FIGS. 23A–24C. If the unswer is YES, the program proceeds to step ST126*b*, where it is determined whether or not the allocated car, as specified by the value stored in the CAR# register of the RC presently being considered, has arrived at the RCF#. This is accomplished by monitoring the ON/OFF output state of the respective arrival detecting switches 43*a*–43*l*. For example, if the assigned car is C1 and the RCF# is F2, whether or not the switch SSC1F2 is closed is determined, whereby if it is closed it implies that the Car C1 is at the floor F2. Next, at step ST126*c* it is determined whether or not the assigned direction of the allocated car is down (i.e. by monitoring the respective output of Group Supervisory Register 380A. If the unswer is NO, the program goes to step ST127. If the unswer is YES, the program proceeds to step ST126*d*, where a command CMD18 is issued, whereby the RC presently being considered in the RCR 370 is erased therefrom. In this way, it can be determined whether or not the allocated car has reached the RCF# presently being considered, and if it has, reset that RC from the RCR 370.

FIG. 24E shows another embodiment P11E of the program P11 which can be utilized with any of the embodiments P11A–P11D. This program further considers (as disclosed for the single car elevator system) the case where, when it is determined that a car can arrive before the desired or required time Td or Treq, it is further determined whether or not the car will be within the desired time Td or the required ftime Treq after passing by the RCF# on the way to service more calls assigned thereto, or after servicing the last call assigned thereto. Referring to the Figure, the steps ST132*a*–ST133*h* are to be instead of the step ST133 and instead of the step ST151, respectively. These steps will be described as being inserted instead of the step ST133, but it is to be understood that these steps are similarly inserted in the programs P11A, P11B and/or P11C instead of the step ST151 with the difference that they are with respect to the required time Treq.

Referring to the FIG. 24E, at step ST132*a* it is determined whether or not the car presently being considered (i.e. C(I)) has any calls assigned thereto (i.e. if the car is free). If the unswer is NO, implying that the car is free and that it can reach the RCF# by the desired time Td, the program proceeds to step ST132*f*, where, similar to step ST133, the value of J is set to the present value of I (J=I). If the unswer is YES, the program proceeds to step ST132*b* where the calculation Trem=Td−Tar is carried out in the arithmetic unit, where Trem represents the time remaining, after the car arrives at the RCF# a first time, for the car to arrive at that RCF#, a second time or a first time after having serviced the last call assigned thereto, to be considered to have arrived at that RCF# by the desired time Td. Next, at step ST132*c*, the car's present position (CPP) is set at the RCF#. Next, at step ST132*d* the Tar program P5 is executed with the CPP set at the RFT# and all the calls serviced on its way to the RCF# on a first run considered to have been serviced already (i.e. only the calls which were not serviced by the car on its way from its actual present position to the RCF# need be considered when calculating the arrival time Tar2). Next, at step ST132*e*, it is determined whether or not Tar2=Trem±1 sec. If Trem−1 sec>Tar2, implying that the car can arrive at the RCF# on a second run (i.e. a second time) or on a first run after servicing the last call before the desired time Td, the program proceeds to step ST132*f* where J is set to the present value of I (J=I). If at step ST132*e* it is determined that Tar2=Trem±1 sec, implying that the car can arrive at the RCF# on a first or second run at the time Td, the program proceeds to step ST132*g*, where K is set to the present value of I. If at step ST132 it is determined that Trem+1 sec<Tar2, implying that the car cannot arrive at the RFC# a second time before the desired time Td, the program proceeds to step ST132*h*, where the Tar2 value is stored in the memory space RAM(I). After the execution of steps ST132*f*, ST132*g* or ST132*h*, the program proceeds to the step ST133. Accordingly, the program 11E serves to further determine the arrival time Tar2 of the cars which are determined to be able to arrive at the RCF# before the desired time Td or the required time Treq on a first run or after having serviced the last respective calls assigned thereto, so as to determine whether or not the car will still be able to arrive at the RCF# when it is actually required to do so.

Another embodiment P11F (not shown) of the program P11 may have the program go directly from steps ST133 and ST151 to the steps ST137 and ST155, respectively, in any of the programs P11A–P11E, whereby as soon as it is determined that a car can reach the RCF# before the desired time Td or the required time Treq, respectively, the program stops calculating the arrival time of the cars for which this has not been done for yet. This provides a much faster execution of this program.

FIG. 24G shows a further embodiment of the programs P11A–P11F, where at step ST169*a*, it is determined whether or not Treq+Tw>Tp, where Tw is a waiting time, i.e. 5 sec.

Figure 27:
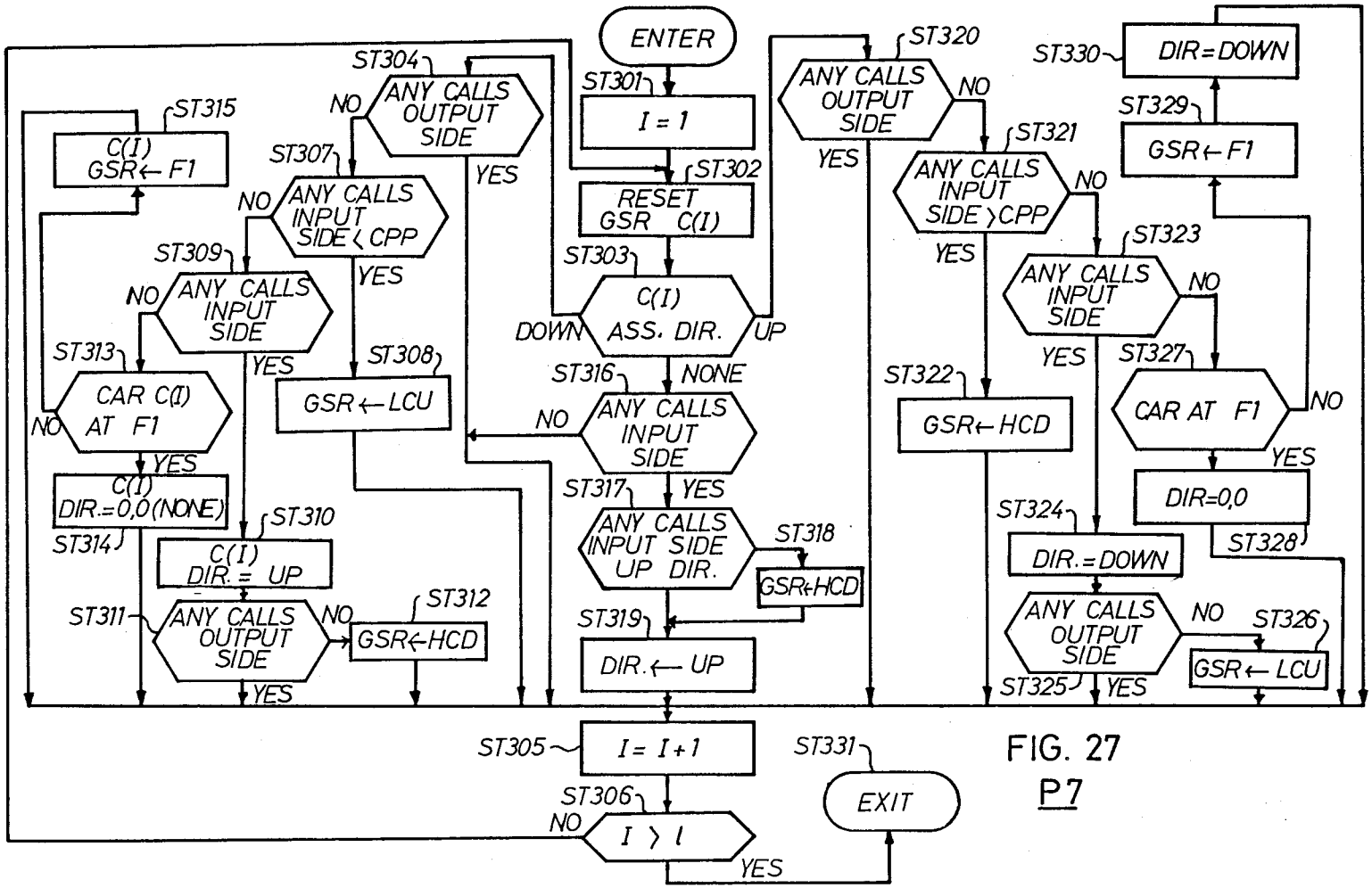
FIG. 27 shows a group supervisory program P7 of the multiple car elevator control system.

FIG. 27 shows the Group Supervisory Program P7 according to the present invention. Referring to the Fig., after entering the program, at step ST301 the value in a register I=1. Next, at step ST302, the Group Supervisory Register (not shown, but similar to the register 38A) for CAR# C(I) is reset (i.e. flip flops similar to the flip flops SSF1–SSFn in the register 38A are reset). Next, at step ST303, the car's C(I) presently assigned direction is determined (i.e. by monitoring the output of flip flops similar to the flip flops SSd1 and SSd2 in the register 38A). If the presently assigned direction is determined to be down, the program proceeds to step ST304, where it is determined whether or not any calls presently registered in the CCR 410(I) are present on the output side thereof, By output side it is implied the output of the OR gates Q61–Q6*n* of the CCR 410*a* which are applied to the Drive and Control Unit for the case of the car C1 (similarly for the other cars). If at step ST304 the unswer is YES, implying that there are still down direction calls (RCs, HCs and/or CCs) below the CPP if the car's presently assigned direction is down or that there are still up direction calls (i.e. HCs and/or CCs) above the CPP if the car's presently assigned direction is up and, accordingly, that the car must service more calls in its presently assigned direction, the program proceeds to step ST305. If at step ST304 the unswer is NO, the program proceeds to step ST307, where it is determined whether or not there are any calls being inputted to the CCR 410(I) which are below the CPP. By input side is meant, for the car C1, the HC signals F1UC1–FnDC1 and RC signals C1f2–C1fn which are inputted to the CCR 410*a* (similarly for the other CCR 410*b*–CCR 410*l*). The reason it is checked whether there are any calls below the CPP is because the cars presently assigned direction is down, and if there where calls at the input side of the CCR(I) for the UP direction and below the CPP, they would not appear at the output side due to the Car C(I) Logic Control Unit. If the unswer at step ST307 the unswer is YES, the program proceeds to step ST308 where the flip flop in the Group Supervisory Register 380A corresponding to the lowest call for the up direction (hereinafter referred to as LCU direction) presently appearing at the input side of the CCR 410(I) is set, thereby instructing the car to proceed in its presently assigned direction (i.e. down) towards the LCU, since the output of the flip flip is inputted to the respective CCR 410(I) and will be assigned to the Drive and Control Logic C(I). If the unswer at step ST307 is NO, the program proceeds to step ST309 where it is determined whether or not there are any calls present at the input side of the CCR 410(I). If the unswer is YES, the program proceeds to step ST310 where the direction of the car C(I) is changed to UP. Next, at step ST311, whether or not there are any calls at the output side of the CCR 410(I) is determined. If at step ST311 the unswer is YES, implying that at least one of the calls on the input side is for the UP direction and that that call is above the CPP, the program proceeds to step ST305. If the unswer is NO, implying that none of the calls on the input side are for the UP direction and that all the down direction calls are from a floor higher then the CPP, the program proceeds to step ST312 where a flip flop in the GSR 380*a* corresponding to the highest call (i.e. call from the highest F#) for the down direction is set. If the unswer at step ST309 is NO, the program proceeds to step ST313, where it is determined whether the car's C(I) present position CPP is at F1 or not. If the unswer is YES, the program proceeds to step ST314 where the car's C(I) direction is set to NONE (i.e. C(I)d1,-C(I)d2=1,1), which informs the respective Drive and Control Unit C(I) to leave the car C(I) at the floor F1 as well as preventing any calls may be assigned to this car from the present time (i.e. the time this step is executed) to the next time this program is executed, from appearing at the output side of the CCR 410(I). If a step ST313 the unswer is NO, implying that the car C(I) is not at the floor F1, the program proceeds to step ST315 where the flip flop in the GSR 380(I) corresponding to the F# F1 is set, thereby instructing the car C(I) to proceed to the floor F1. Since the direction is already for DOWN, there is no need to change it. After step ST308, ST312, ST314 or ST315, the program to step ST305, where the value of I is increased by 1. Next at step ST306 it is determined whether or not the last cage C(1) has been considered. If at step ST305 the unswer is NO the program returns to step ST302, where the GSR for car C(I) is reset, and the program P7 is executed again for the car C(I). If at step ST306 the unswer is YES, the program is exited at step ST331.

If at step ST303 the direction of the car C(I) is determined to be NONE (i.e. C(I)d1,C(I)d2=1,1), implying that the CPP is F1, the program proceeds to step ST316 where it is determined whether or not there are any calls at the input side of the CCR 410(I). If the unwer is NO, the program proceeds to step ST305. If the unswer is YES, the program proceeds to step ST317 where it is determined whether or not any of the calls at the input side are for the UP direction. If the unswer is YES, the program proceeds to step ST319 where the car C(I) is assigned the UP direction, after which the program proceeds to step ST305. If at step ST317 the unswer is NO, the program proceeds to step ST318 where a flip flop in the GSR 380(I) corresponding to the highest call for the down direction (HCD) presently appearing at the input side of the CCR 410(I) is set, after which the program proceeds to the step ST319.

If at step ST303 it is determined that the car's presently assigned direction is UP, the program proceeds to step ST320, where, similar to the step ST304, it is determined whether or not there are any calls on the output side .to the CCR 410(I). The steps ST320, ST321, ST322, ST322, ST323, ST324, ST325, ST326, ST327, ST328, and ST329 are symetrical to the steps ST304, ST307, ST308, ST309, ST310, ST311, ST312, ST313, ST314 and ST315, respectively, with the only difference being the directions considered, and accordingly the description for the UP direction will be omitted. The only difference between the UP and DOWN directions being the step ST330, where the GSR 380(I) direction for the car C(I) is set for DOWN.

Figure 29:
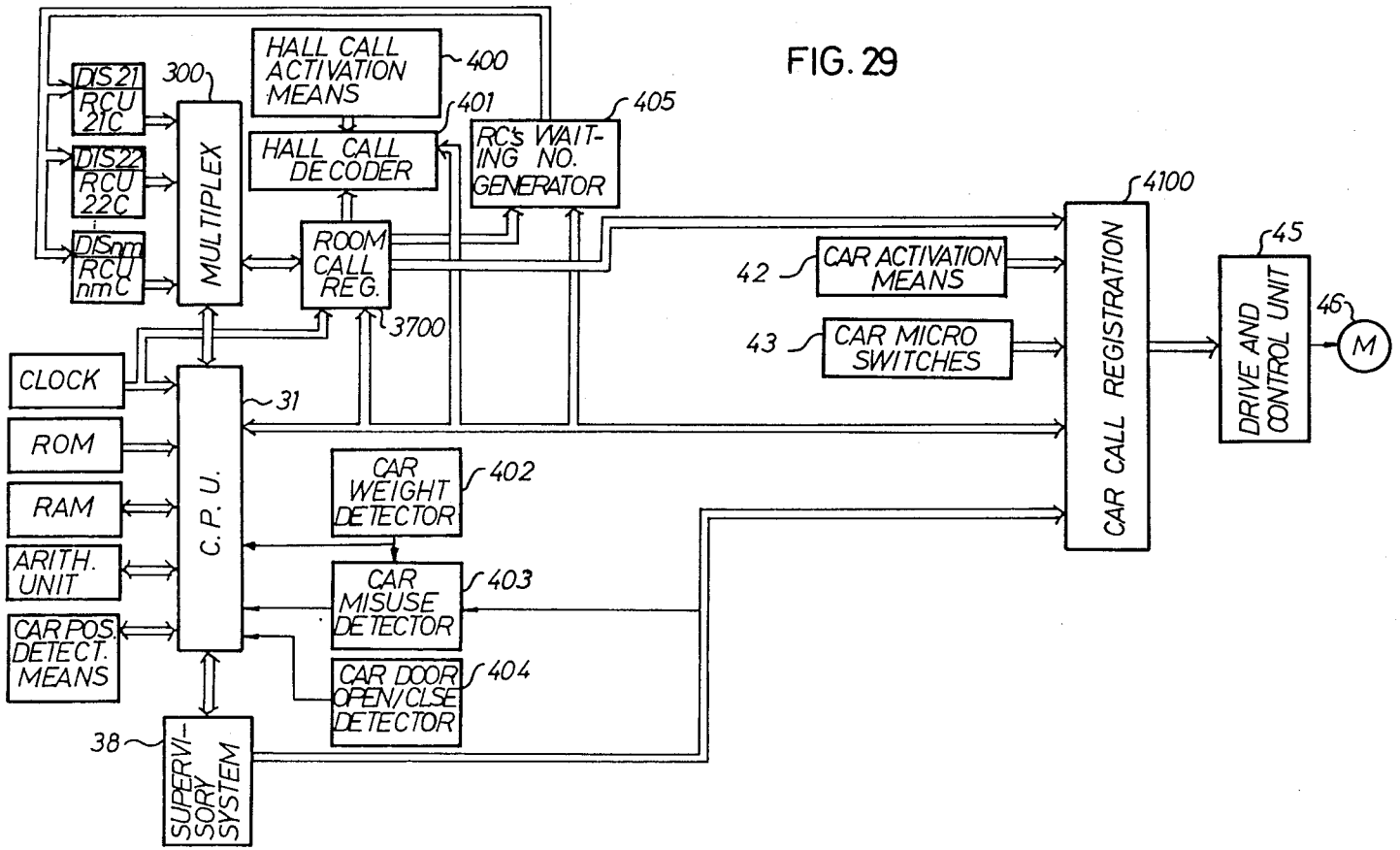
FIG. 29 shows a block diagram of a private elevator control system according to the present invention.

FIG. 29 shows a Private Elevator Car Control System according to the present invention. This system is private in the sense only one operator is provide service at any given time. Many people living in appartment buildings would like not only to minimize the time they wait for the elevator car in halls, but would also like to know what they alone or with their companions will be provided service. This system not only provides for private service of the car, but also:

1. ensures that no one is in the elevator car at the time the assigned operator is provided service;

2. ensures that no one else will be able to use the car during the time the car is allocated to service a given operator;

3. provides service to the presently designated operator even though the operator arrives somewhat early or late;

4. visually indicates to the operator his turn in a wames up), numeral 405 designates a RC's Waiting No.

Generator for genrating the waiting numbers to be displayed on the respective displays DIS21–DISnm, numeral 400 designates Hall Call Activation Means which, when manipulated correctly, informs the elevator system that the operator the car is presently allocated to service is waiting in the hall, whereby the car door is instructed to open. In this way, the operator is guaranteed of being serviced, since no other person waiting in the hall (i.e. for other cars which run on a regular service basis or the same as this private basis) is aware of the fact that the private car is at that F# (i.e. since no visuall means are provided in the hall) and even if they attempt to use the private elevator there chances of suceeding is very small, as will be explained more fully later. Numeral 401 designates a Hall Call Decoder for determining whether the bottom pressed (i.e. the CODE# inputted) on the respective pannel is the correct CODE# is not, numeral 3700 designates a Room Call Register 3700 (hereinafter referred to as a RCR 3700), numeral 4100 designates a Car Call Register (hereinafter referred to as a CCR 4100), numeral 402 designates a Car Weight Detector for detecting the presence or abscence of passengers in the car, numeral 403 designates a Car Misuse Detector for detecting the misuse of the car by the same person or persons (i.e. by the fact that even though the car's assigned direction has changed a number of times, the person or persons in the car have not gone out therefrom) and upon the detection of a misuse condition not providing any service until the persons misusing the car have gone out therefrom, thereby ensuring that other people wating to be serviced will not be overly delayed due to the misuse thereof. Numeral 404 designates a Car Door OPEN/-CLOSE Detector for detecting whether the door is open or closed. The remaining portions are the same as those disclosed in the previous embodiments.

Figure 30:
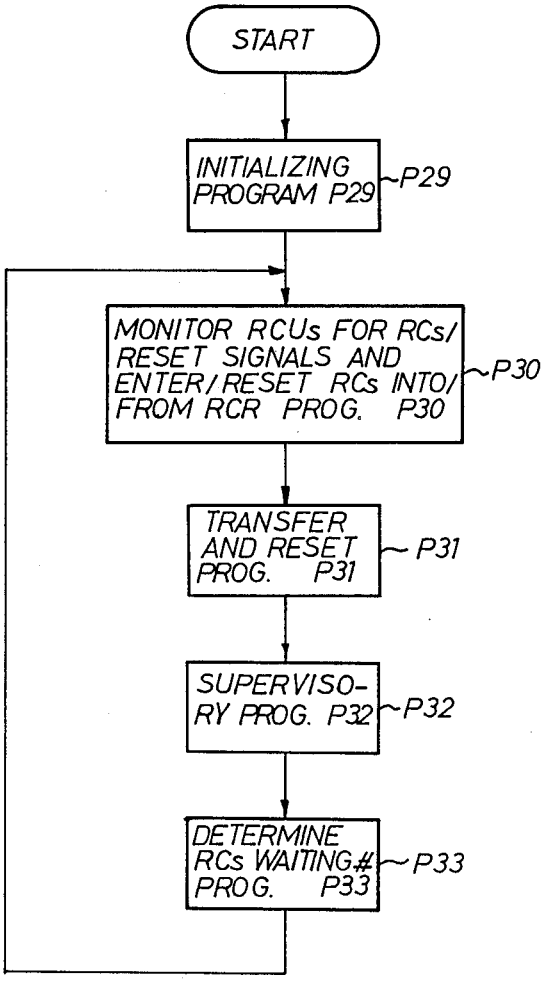
FIG. 30 shows programs stored in a ROM of the private elevator control system according to the present invention.

FIG. 30 shows a general flow chart of programs stored in the ROM 32 which are executed intern by the CPU 31. Referring to the Fig. numeral P29 designates an Initializing program which is similar to the Initializing Program of the Single Car Elevator System, numeral P30 shows a Monitor RCUs for RCs/Reset Signals and Enter/Reset RCs into/from the RCR Program P30 which is similar to the program P3 utilized for the Single Car Elevator System and for the Multiple Car Elevator System but having the added function of being able to reset RC's from the RC 3700, numeral P31 designates a Transfer and Reset Program, numeral P32 a Group Supervisory Program, and numeral P33 a Determine RC's Waiting No. Program.

FIG. 31 shows a control panel 400F2 installed in the elevator hall of the second flow F2 corresponding to the Hall Call Activation Means 400. Referring to the Fig., the control panel 400F2 comprises push bottons 21', 22', . . . and 2m', which are representative of the respective suites RM21, RM22, . . . RM2n of the second floor, as well as a RESET push botton SR21. This control pannel must be activated properly in order for the user to be serviced by the elevator system. More specifically, in order to be service by the car after the activation of a RCU by an operator, the operator of that RCU, once receiving the green light (i.e. once his RCUb is activated), before being service by the car, must activate one of the bottons of the hall control panel, which corresponds to his R#. For example, if an operator leaves on the second floow in RM22, the operator, once activating his RCU22 must also press the botton 22', marked RM22 for his easy interpretation, in order to be serviced. If the operator presses the wrong botton or other people try to utilize the elevator by pressing a botton, the elevator car doors won't open unless the right botton is pressed. Further, should more then one botton be pressed on the control panel 400F2, the car doors will not open either. If the operator presses the wrong botton on the control pannel 400F2, he can always press the RESET botton SR2', thereby erasing the mistake, and again press the correct botton corresponding to his suite.

Figure 33:
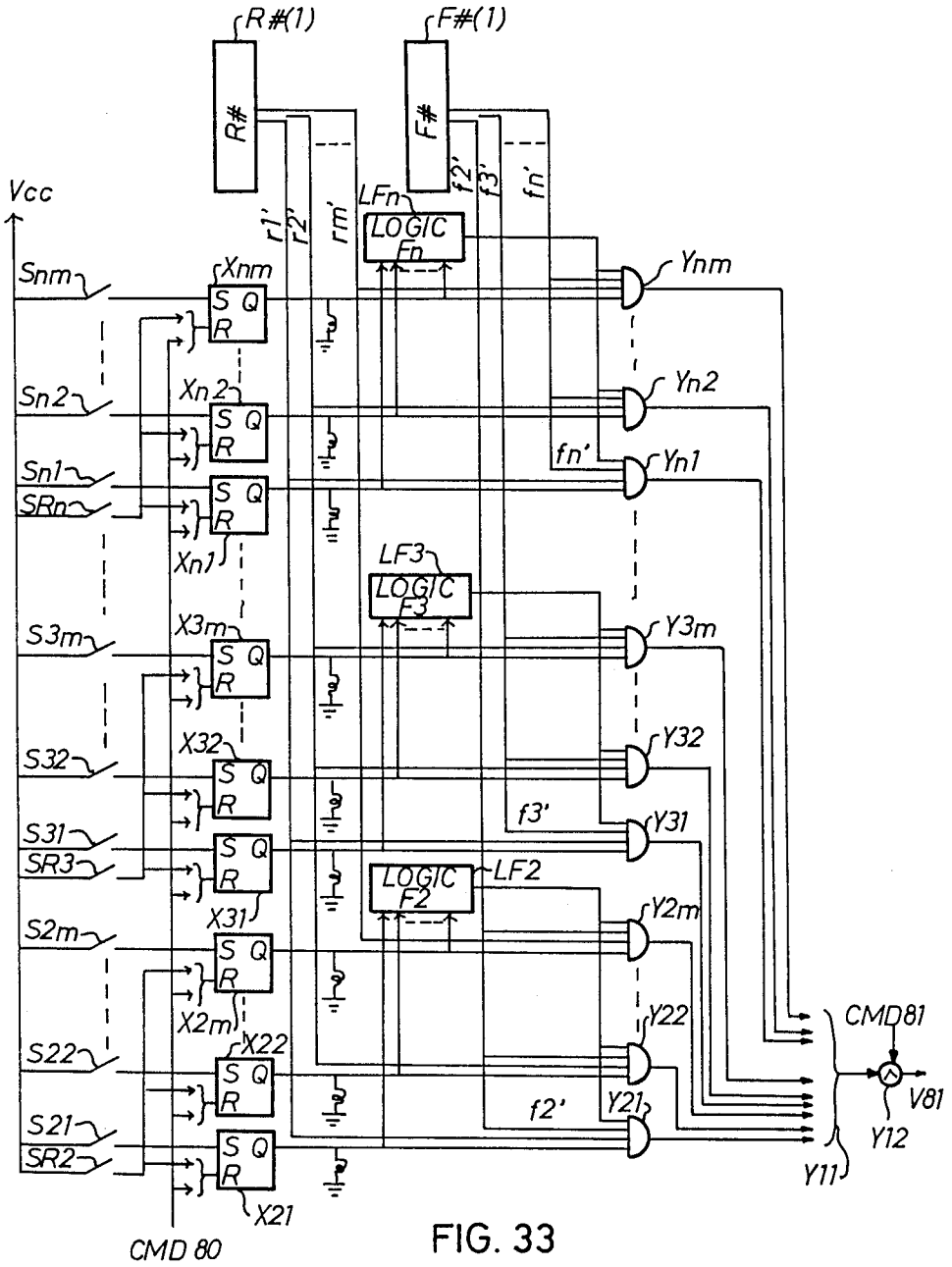
FIG. 33 shows a schematic diagram of a hall code decoder of the private elevator control system according to the present invention.

FIG. 33 shows a schematic block diagram of the Hall Call Decoder 401. Referring to the Fig., numerals S21–S2*m*, S31–S3*m*, . . . Sn1–Snm designate Hall call switches of the Control Panels 400F2, 400F3, . . . 400F*n* of the Hall Call Activation Means 400, located in the elevator halls F2, F3, . . . Fn, respectively, where switches S21–S2*m* correspond to the bottons 21'–2*m'* *and SR2 corresponds to the botton SR2', respectively. Numerals SR2, SR3, . . . SRn designate reset switches which are utilized for resetting coded hall calls signals (hereinafter referred as CODE#) entered via the Hall Call switches S21–S2m,* S31–S3*m*, . . . and Sn1–Snm, respectively. Numerals R#(1) and F#(1) designate the R# and F# registers in the row r(1) of the RCR 3700. Numerals X21–Xnm designate S-R flip flops for registering the respective HCs entered through the activation means S21–Snm, respectively, each having a light bulb connected to its output for indicating the respective activated states thereof. Numerals LF2, LF3, . . . and LFn represent logic circuits F2, F3, . . . Fn, which are utilized to determine whether or not only one of the hall call activation means from the respective floors F2, F3, . . . and Fn is activated. Specifically, only if one of the respective Q output of the flip flops X21–X2*m*, X31–X3*m*, . . . or Xn1–Xnm is high, is the respective output of the logic circuits LF2,LF3, . . . or LFn high. For example, the logic circuit LF2 comprises gates which realize the boolean expression:

LF2=QX21%QX22BAR, . . .
%QX2nBAR+QX21BAR%QX22%, . . .
%QX2nBAR+ where: QX21 is output Q of X21, etc.

Accordingly, the output of the logic circuit LF2 is high only when one of the inputs thereto is high. Similarly for the other logic circuits.

AND gates Y21–Y2*m* have respective first inputs connected to the Q outputs of the flip flops X21–X2*m*, respective second inputs connected to the outputs r1'–rm' of the R# register R#(1), respective third inputs connected to the output f2'–fn' of the F# register F#(1) and respective fourth inputs connected to output of the Logic Circuit LF2–LFn. Accordingly, the output of the AND gate Y22 goes high only if:

1. the RC originated from the RCU22 (i.e. the RCU in the RM22 on the second floor F2); and 2. only the botton 22', corresponding to RM22, on the control panel 400F2 is pressed.

The outputs of the AND gates Y21–Ynm are connected to the inputs of an OR gate Y11, the output of which is connected to the input of AND gate Y12, so that the CPU can determine whether or not the correct push botton from the correct floor corresponding to the RC presently being considered has been activated when a command CMD81 is issued.

Accordingly, when the car arrives at a floor to service a RC, only if the correct Hall Call botton corresponding to that RC is pressed, is the system introduced to provide service for the person waiting in the hall (i.e. is the car door opened)

In using this system, the operator:

1. sets the timer to the desired time Td and activates his RCU;

2. waits for this RCUb to be activated, thereby informing him that the car will certainly be available at his F# at the desired time Td from the time the RCUb sounds;

3. proceeds to the elevator car and activates a push botton corresponding to his R# in the control pannel on his floor; and 4. when the car doors open, enter the car and enters a CC to the floor he wants to go to.

If at step 3 the operator pushed the wrong botton on the control pannel, he may correct his mistake by:

5. pressing the RESET botton on the control pannel; and 6. press the correct botton corresponding to his R#.

It should be noted that the operator once activating his RCU may enter the correct CODE# before the RCUb is activated, and no later than time Td+ALPHA from the time the RCUb is activated, where ALPHA represents additional time provided by the system, as will be explained more fully later, for the operator to utilize the system. In other words, although the operator plans to utilize the car at time Td from the activation of his RCUb even if he is a little early or late, the car will wait for him before proceeding to service the next chronologically registered RC in the RCR 3700.

It should be noted that, since no visual means are provided for indicating the arrival of the car at the respective F#, persons waiting in the hall way to use regular elevators have no way of knowing that the private car has arrived.

Further, should a person waiting for one of the regular elevator cars attempt to utilize the private elevator car, firstly assuming that an operator from that F# activated his RCU, secondly that that person's turn has come up and thirdly that the private car has arrived and is waiting for that person, he would still be required to press the reset botton each time he entered a wrong CODE#. Accordingly, such trouble makers would soon realize the odds against them and be discouraged from even trying. On the other hand, users are provided with a simple and easy to use elevator control system, while at the same time being provided with a private car (i.e. no other person can get into the car while the operator whose turn it is to use the car is provided with service). Further, the person is gauranteed of the exact time of the arrival of the car so that the least amount of time need be spent in the halls of the building.

It should be noted that although only one type of hall encoder is shown, other encoders may be utilized without departing from the invention.

FIG. 32 shows the Car Misuse Detector according to the present invention. Referring to the Fig., numeral 402 designate a Car Weight Detector for detecting whether or not there are any people inside the car. The output of the detector 402 is low whenever the car is empty and is high whenever someone is in the car. Numeral 35*a* designates a Car Door Open/Close Detector, the ouput of which is high when the car's door is closed. Numeral 35*b* designates an invertor, numeral 35*d* designates an AND gate, numeral 35*e* designates a pulse generator and numeral 35*d* designates a counter the CLK input of which is connected to the output of the pulse generator 35*e* and the reset input R of which is connected to the output of the AND gate 35*c*. Input d1C1 designates one of the direction signal of the car supplied by a Supervisory Register 3800A (not shown but similar to register 38A). The output of the counter 35*d* goes high after the pulse generator generates three pulses, indicating that the car's direction has changed three times, and is reset when the output of the Weight Detectors 402 and Car Door detector 35*a* are low and high, respectively, namely, when the car's doors are closed while the car is empty.

Specifically, every time the direction of the car is changed, i.e. during the execution of the Supervisory Program P32, the d1C1 direction signal either goes from a high to a low or from a low to a high signal. Accordingly, for every change of direction is indicated by the direction signal d1C1, the pulse geneator 35*c* generates a pulse. Further, as long as a person is in the car the output of the weight detector 402 is high which means that the reset input R of the counter 35*d* is low (i.e. since the respective input to the AND gate 35*c* is low), thereby allowing the counter to count the pulses generated by the pulse generator 403 as a function of the number of times the car's direction is changed while the persons riding therein do not go out therefrom. Accordingly, since when a car proceeds to service a newly assigned RC, there should be no one in the car and accordingly, the output of the weight detector should be low and the reset input of the counter 35*d* high, implying that the counter 35*d* is reset. Upon arrival of the car at the RCF#, the car is instructed to wait at the RCF# till either a given waiting time passes and no correct CODE# is registered or till the right CODE# is registered in the respective code panel, at which time the car's doors are instructed to open, thereby allowing the person or persons in the hall to enter upon which the output of the weight detector goes high and the reset input of the counter 35*c* goes low allowing the counter to start counting. Depending on the F# the operator wants to go to, regardless of whether it is above or below the RFC#, as indicated by the CC he registers once entering the car, and the RCF# presently being serviced, the Supervisory Program P32 will assign an UP or DOWN direction to the car, in response to which the pulse generator will produce a first pulse. After arriving at the F# or F#s in one direction (i.e. to see off friends living on other floors or to see off a wife, husband, girlfriend, etc., at the first floor, or, in the case where the operator after arriving at the first floor suddenly remembers that he fogot something in his room and wants to go back, to pick it up before going to work, etc.) the operator may want to return to his F#, at which time the direction of the car will be changed from up to down or from down to up and, since the car's door were never allowed to close while the operator was out of the car, the counter will count another pulse generated by the pulse generator 35*e*, whereby the operator may return to his F#, since only two pulse was generated so far. However, after returning to his floor number, if the operator attempts to use the car again in the down direction without getting out, the counter will have counted to three, at which time the output MIS1 of the counter 35*d* goes high, whereby the Supervisory System prevents the car from accepting the call (i.e. the car does not go anywhere and the doors remain open).

It should be noted that it is not intended to limit the counter 35*d* to 3 pulses and any number of pulses may be used without departing from the spirit of the invention.

Figure 34:
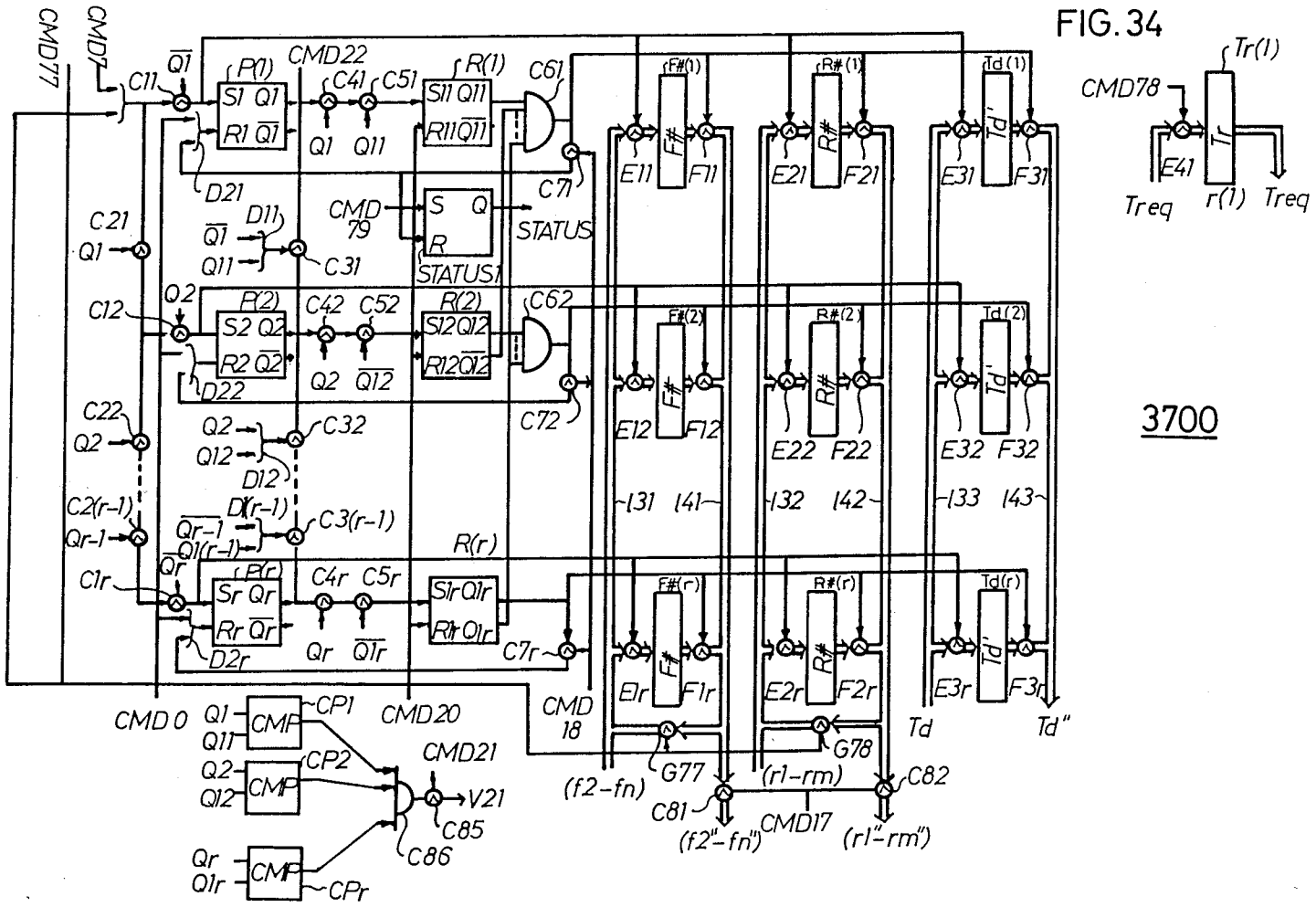
FIG. 34 shows a schematic diagram of a room call register of the private elevator control system according to the present invention.

FIG. 34 shows the RCR 3700 according to the present invention. In the Fig., the same or corresponding portions as those in the RCR 37 are desiganted by the same reference numerals. Referring to the Fig., numeral G79 represents an OR gate and G77, G78 designate AND gates which, in combination, allow the RC (i.e. F# and R#) of the last set read flip flop R(1)–R(r) to be copied into the first empty row (i.e. the first row in which the presence flip flop P(1)–P(r) is reset) when a copy command CMD77 is issued by the CPU. For example, if R(1)=R(2)=1 and P(1)=0, P(2)=1, when a command CMD77 is issued, the R# and F# stored in the registers R#(2) and F#(2) will be copied into the R# and F# registers of the first row (i.e. R#(1) and F#(1)), as well as causing the presence flip flop P(1) to set. Numeral STATUS1 designates a S-R flip flop for indicating the STATUS of the RC in the first row and Tr(1) designates a register for storing the required time Treq of the RC in the first row r(1), namely, the time that the car is expected to service the RC in row r(1). Although the arrival time of the car will not be delayed, since only one RC is assigned to the car at any given time, Treq is utilized for determining a waiting time for giving the user extra time to arrive at the hall and enter his CODE# in case he is a little late. Numeral F111 designates an AND gate connected to output of the F# register F#(1), so that when the output of the first presence flip flop P(1) is high, indicating that there is a RC present in the first row r(1), the F#r(1)(f2'–fn') present stored in the F# register F#(1) is passed through the AND gate F111 and is applied to the CCR 4100.

It should be noted that the reason only one Tr register and STATUS flip flop are utilized is because of the fact that, in this embodiment, only one RC is assigned to the car at any given time, namely, the RC in the first row.

Figure 35:
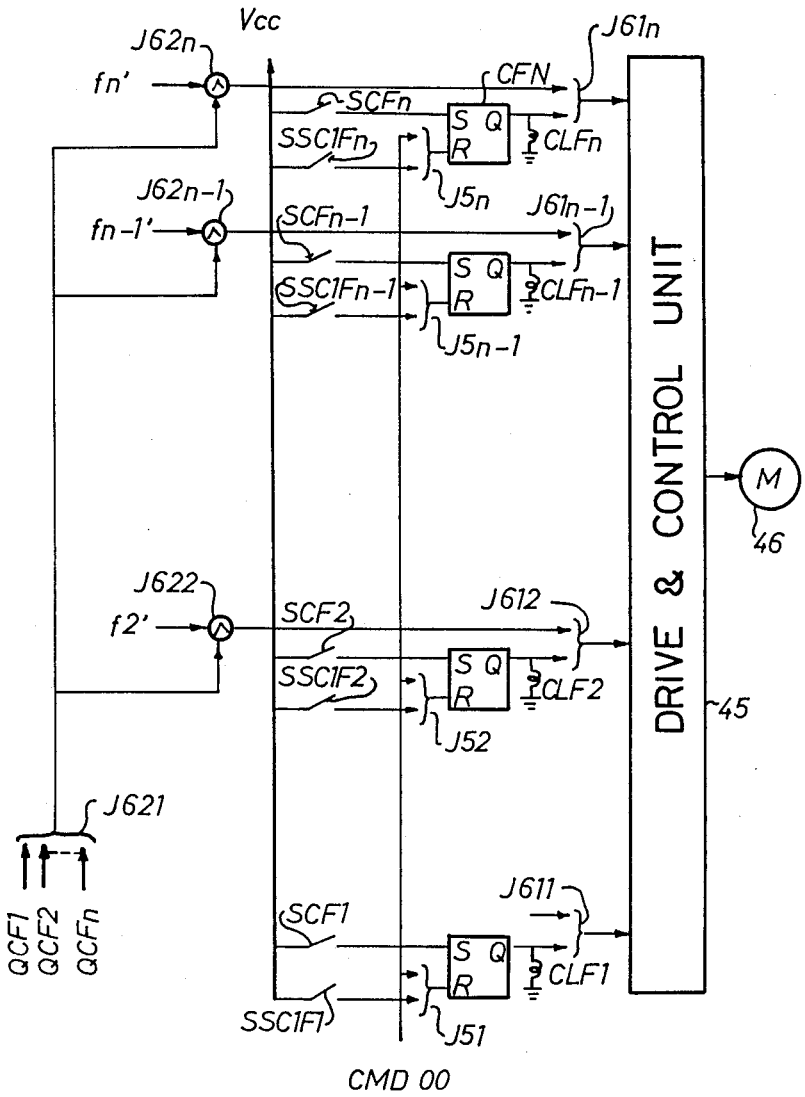
FIG. 35 shows a schematic diagram of car call register of the private elevator control system according to the present invention.

FIG. 35 shows the Car Call Register 4100 according to the present invention. Referring to the FIG., numeral SCF1–SCFn designate switches located inside the car, utilized for entering CCs for the floors F1–Fn and which correspond to the Car Call activation means 42, numeral SSC1F1–SSC1Fn designate car arrival detecting switches for detecting the arrival of the car at the floors F1–Fn and which correspond to the Car Micro Switches 43, numerals CF1–CFn designate S-R flip flops for registering CCs in response to the activation of the switches SCF1–SCFn, numerals J51-J5n and J611–J61n designate oR gates, numeral 45 designates the Drive and Control Unit and numeral 46 the Motor for driving the car. Numeral J621 designates an OR gate and J622–J62n AND gates which, in combination, prevent the RC in row r(1) of the RCR 3700 (i.e. as indicated by one of the inputs r(1)(f2'–fn')) from being assigned to the CCR 4100 while a CC is present in the CCR 4100 (i.e. as indicated by an output QCF1–QCFn of the flip flops CF1–CFn being high).

Figure 36A:
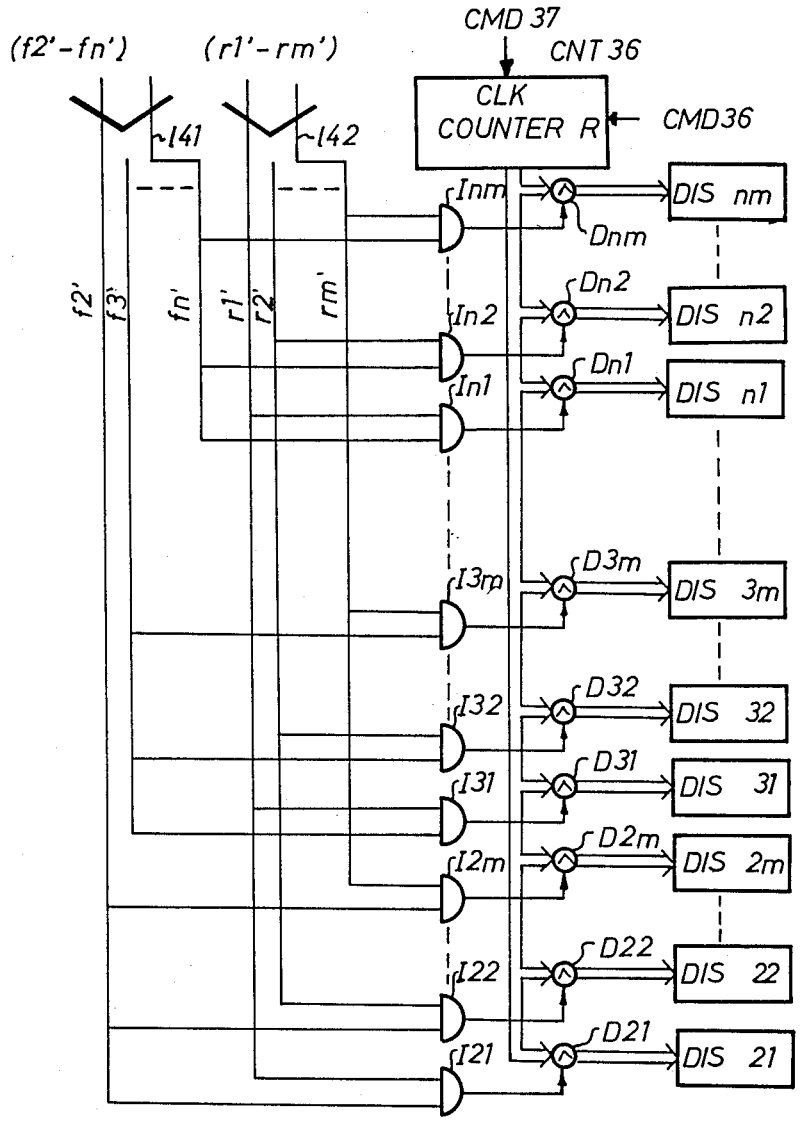
FIG. 36A shows a schematic block diagram of a waiting turn number generator of the private elevator control system according to the present invention.

FIG. 36A shows the RCs Waiting No. Generator according to the present invention. Referring to the FIG., numerals DIS21–DISnm designate LCDs mounted in the RCU21–RCUnm, respectively, for indicating the waiting number of each RC, numeral CNT36 designates a counter, numerals (f2'–fn') and (r1 '–rm') designate the F# and R# signals appearing on line 141 and 142 of the RCR 3700, respectively, and numerals D21–Dnm and I21–Inm designate AND gates.

FIG. 36B shows the Determine RCs Waiting No. Program P33 which in combination with the RC's Waiting No Generator 405 is utilized to generate the waiting number for each RC in the RCR 3700. Referring to the FIG., after entering the program, at step ST360 a command CMD20 is issued, whereby the read flip flops R(1)–R(r) in the RCR 3700 are reset (since the CMD20 is inputted to the reset inputs thereof). Next, at step ST361 a command CMD36 is issued, whereby the counter CNT36 is reset (since CMD36 is inputted to the reset input of the counter CNT36). Next, at step ST362 a command CMD21 is issued, whereby it is determined whether or not any RCs are registered in the RCR 3700. If the unswer is NO, the program is exited at step ST365. If the unswer is YES, the program proceeds to step ST363, where a command CMD22 is issued, whereby the first non-set read flip flop in the RCR 3700 is set, causing the first none read RC in the RCR 3700 to be read out therefrom (i.e. the F# and R# thereof appear on lines 141 and 142). Next, at step ST364, a command CMD37 is issued, whereby a pulse is applied to the CLK input of the counter CNT36 causing the output thereof to increase by one, i..e CNT=CNT+1, after which the program returns to step ST362. Accordingly, steps ST362–ST364 are repeated until all the read flip flops R(1)–R(r) in the rows in which RCs are registered are set, implying that a waiting number has been assigned to all the presently activated RCUs. This is made possible due to the fact that the order in which the RCs are stored in the RCR 3700 is the chronological order in which they were registered (i.e. the RC in row r(1) was registered before the RC in row r(2), and so on for the following rows). For example, if a RC in the second row r(2) originated from a RCU22 (i.e. RM22 on F2), after the program F33 is executed a first time, the read flip flop R(1) in row r(1) is set, the value in the counter CNT36=1 and this value is asssigned to the first RC in row r(1). The next time this program is executed, the read flip flop R(2) in row r(2) is set, the value in the counter CNT36=2 and this value is assigned to the second RC in row r(2). Specifically, since the RC in row r(2) is from the RM22 on F2, when the read flip flop R(2) is set, the signals f2' and r2' on output lines 141 and 142 go high. Accordingly, both inputs to AND gate I22 are high causing the output thereof to be high, enabling the AND gate D22 which allows the present value of the counter CNT36 to be applied to the display DIS22. Accordingly, the display DIS22 displays the No. 2.

It should be noted that the displays DIS21–DISnm each include a memory unit (such as S-R flip flops) to remember the assigned waiting Nos., and that these memory units may be eliminated if the program P33 is continuously executed so that the LCD displays receive quick repetition (high duty cycle) display commands or if the computer is quick enough, may also be eliminated.

Figure 37A:
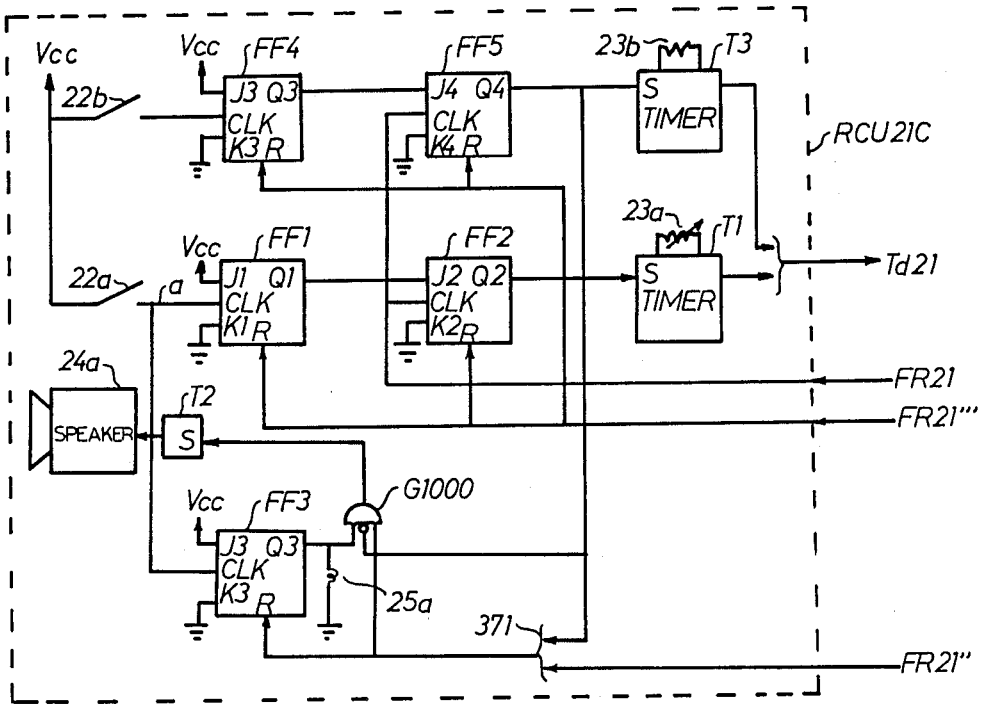
FIG. 37A,B show a third embodiment of the room call unit control further providing a reset botton for reseting a previously registered room call according to the present invention.
Figure 37B:
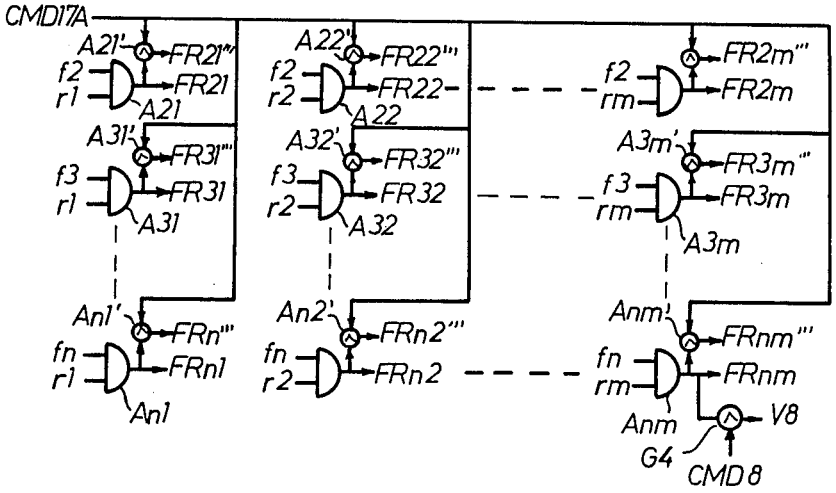

FIG. 37 shows a room call unit RCU21C, which is similar to the RCU21 but providing the added function of being able to be reset immediately after the activation thereof, or at any time thereafter, by the operator. In the FIG., the same portions as those in the RCU21 are designated by the same reference numerals, and the description thereof will not be repeated. Referring to the FIG., numeral **22*b* desigantes a reset bottom for reseting a previously enetered RC, numerals FF4 and FF5 designate J-K flip flops, numeral T3 desigantes a timer, numeral 23*b* designates a resistor and numeral 370 and 371 OR gates. Signals FR21, FR21'' and FR21''' are saplied by the multiplexer 300 and the signal Td21 is received thereby. Specifically, the signal FR21 is the RCUs monitoring signal for monitoring whether or not the RC botton 22a has been activated, and, if the RC botton 22a has been activated, monitor that RCU for the time that the output of the timer T1 is high as disclosed with respect to the RCU21, as well as for monitoring whether or not the reset botton 22b has been activated (i.e. if the reset botton 22b has been activated, that RCU's signal Td21 stays high longer then when the botton 22A is pressed, whereby during the execution of the program P30 it is determined that not a RC is being entered but that a reset signal for erasing a previously entered RC is being entered. The signal FR21'' is a RCUb signal provided multiplexer 300 when a command CMD17 is issued. The signal FR21''' is a reset RCU signal provided by the multiplexer 300 immediately after the detection of the RCU's reset signal when a command CMD17A is issued. AND gate G1000 is for preventing the buzer 24a from being activated when a cancel RC from RCU signal is entered (i.e. activation of switch 22b**).

It should be noted that if the reset botton 22b is accidently pressed, even though no corresponding RC exists in the RCR 3700, a Reset RC from the RCR Program P34 (which will be described later) will simply determine the same and no problems will arrise.

The operation of the reset botton 22b, flip flops FF5, FF6 and the timer T3 is identical to the operation of RC botton 22a, the flip flops FF1, FF2 and the timer T1, and accordingly the operation thereof will not be repeated. The only difference between the two is that the first mentioned has a fixed resitor 23b instead of the variable resistor 23a, where the value of the resistor 23b is chosen so that the time that the output of the time T3 goes high for is slightly longer then the time that the RCU21C is monitored for. This condition in the flow chart of the program P3 would have caused the program to proceed from step ST5 directly to step ST8, whereby the RCU presently being monitored would have been considered to be defective, and the RC corresponding thereto would not have been registered in the RCR 37. However, in this embodiment, this condition is further utilized to indicate a RC reset signal, whereby the additional required hardware and software is minimally increased (i.e. no extra wires are required for interconnecting the respective RCUs RCU21C–RCUnmC and the multiplexer 300). Accordingly, after entering a RC by the activation of the bottom 22a, if the operator changes his mind and decides not to use the elevator, due to, for example, realizing that he forgot to do something or due to the visual indicator indicating that a lot of other people are before him, as indicated by the waiting No. displayed, the operator can press the R reset botton 22b, whereby the system is instructed to cancel that RC from th RCR 3700.

Figure 38A:
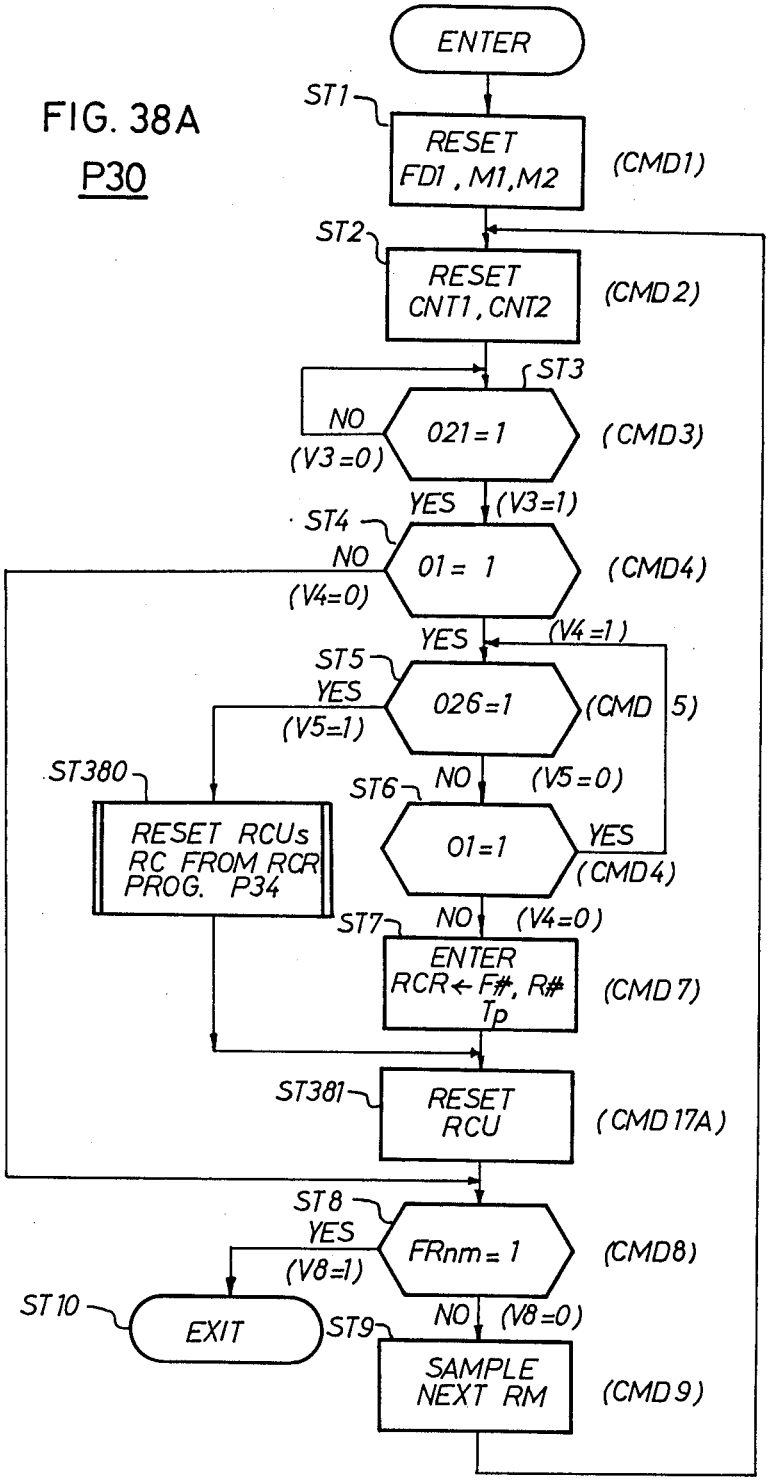
FIG. 38A shows a monitor RCUs for RCs/reset signals and enter/reset RCs into/from the RCR program P30 of the private elevator control system according to the present invention.

FIG. 38A shows the Monitor RCUs for RCs/Reset Signals and Enter/Reset RCs into/from the RCR program P30 according to the present invention. The program P30 is similar to the program P3 and only the different portions thereof will be described herebelow.

Refereing to FIG. 38A, it can be seen that the only differences between the program P3 and P30 is the inclusion of step ST381 between steps ST7 and ST8 and the inclusion of step ST380 between step ST5 and ST381 in the latter. At step ST380 a Reset RC from RCR Program P34 is executed. The program P34 is used for:

1. scanning the RCs stored in the RCR 3700;
2. determining whether or not the RC presently being scaned in the RCR originated from the RCU presently being monitored;
3. when the RC entry corresponding to the RCU presently being monitored is found in the RCR, erasing that RC from the RCR; and
4. moving all the RCs registered in succeeding rows to the erased RC up one row.

Specifically, after determining at step ST5 that output O26 of the counter CNT1 is high, indicating that the RCU presently being monitored is either defective or that the reset botton 22b therein has been activated, the program proceeds to step ST380 where the RC corresponding to the RCU presently being monitored is reset. Next, at step ST381 a command CMD17A is issued, whereby the RCU presently being monitored is reset, after which the program proceeds to step ST8 where it is determined whether or not the last RCUnm has been monitored, as was previously explained. Similarly, after entering the F#, R# and Tp corresponding to the RCU presently being monitored into the RCR at step ST7, the program proceeds to step ST381, where, as explained above, the RCU presently being monitored is reset. Accordingly, as soon as the information pertaining to a RC presently being monitored is entered into the RCR 3700, a command CMD17A is issued whereby that RCU is reset. Accordingly, the operator may, immediately after activating his RCU:

1. cancel his RC by pressing the reset botton on his RCU;
2. change the setting of his timer and enter a new RC (this would however require additional software not disclosed herein, but which should be obvious to those skilled in the art when considered in combination with the subject matter disclosed in the present invention, i.e. a comparing program which compares each RC registered in the RCR with the other RCs and when it is detected that two RCs originated from the same RCU erases the earlier registered RC)

The remaining portions are the same as in the program P3.

Figure 38B:
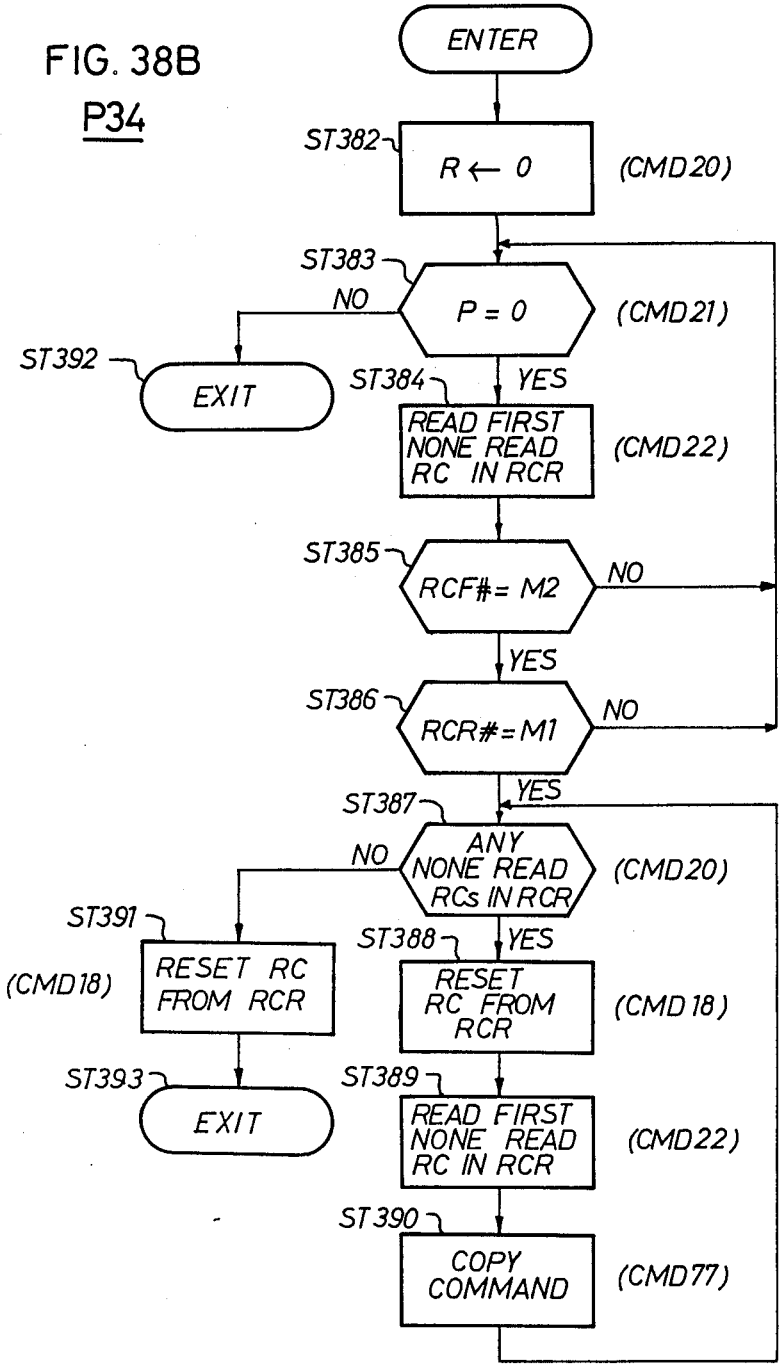
FIG. 38B shows a reset RCU's RC from RCR program P34 of the private elevator control system according to the present invention.

FIG. 38B shows the Reset RC from the RCR Program P34 according to the present invention. Referring to the FIG., after entering the program, at step ST382 a command CND20 is issued whereby the read flip flops R(1)–R(r) in the RCR 3700 are reset. Next, at step ST383 a command CMD21 is issued, whereby it is determined whether or not there are any RCs registered in the RCR 3700. If at step ST383 the unswer is NO, the program is exited at step 392. If the unswer is YES, the program proceeds to step ST384 where a command CMD22 is issued, whereby the first non-read RC in the RCR is read (i.e. the first read flip flop which is not set of the same row the presence flip flop of which is set), thereby causing the R# (hereinafter referred to as RCR#) and F# (hereinafter referred to as RCF#) of that RC to appear on lines 142 and 141, respectively. Next, at step ST385 it is determined whether or not the RCF#=M2, namely, whether or not the signal (f2'–fn') on line 141 is equall to the output signal f2–fn of the counter M2. This comparison is done in a comparator not shown in the drawings. If the unswer is NO, the program returns to step ST383. If the unswer is YES, the program proceeds to step ST386 where it is determined whether or not the RCR#=M1, namely, whether or not the signal (r1'–rm') on line 142 is equall to thsued, whereby it is determined whether or not there are non read RCs in the RCR. If at step ST387 the unswer is NO, the program proceeds to step ST391 where a command CMD18 is issued, whereby the presence flip flop in the row of the RC presenly being considered is reset, thereby erasing that RC from the RCR 3700, after which the program is exited at step ST393. Accordingly, steps ST382-385 are utilized for finding the RC corresponding to the RCU presently being monitored, step ST387 is utilized for determining whether or not there are any RCs registered in subsequent rows to that RC in the RCR, and if subsequent RCs are present, steps ST388-390 are utilized for moving up those subsequent RCs up one row so that the empty row is filled with the subseqent RCs, so that the next time the program is executed, a subsequently monitoried RC (i.e. due to an activated RCU) will not be entered ahead of said subsequent RC in the RCR. Specifically, if at step ST387 the unswer is YES, implying that subsequent RCs are registered in the RCR 3700, the program proceeds to step ST388 where, similar to step ST391, a CMD18 is issued, whereby the presence flip flop in the row of the RC presenly being considered is reset (i.e. the RC corresponding to the RCU presently being monitored by the multiplexer 300 is reset from the RCR). Next, at step ST389 a command CMD22 is issued, whereby the first non-read RC in the RCR is read (i.e. the first read flip flop which is not set of the same row the presence flip flop of which is set), causing the F# and R# of that RC to appear on lines 141 and 142. Next, at step ST390 a copy command CMD77 is issued, whereby the presence flip flop of the above reset RC is set and the F# and R# appearing on the output lines 141 and 142 are allowed to pass through AND gates G77 and G78 to appear on the input lines 131 and 132 and to be inputed into the preceeding F# and R# registers, i.e. the just erased RC, due to the set input of presence flip flop of that row momentarily going high during the time that CMD77 is issued. Accordingly, the first succeeding RC to the erased RC is copied into the row of the erased RC. After step ST390, the program returns to step ST387, where again it is determined whether or not there are any sucessive RCs in the RCR. If the unswer is NO, the program proceeds to step ST391 where the last RC appearing in the RCR is erased, after which the program is exited. This is necessary because, since the last RC was copied into the preceeding row, there now exist two RCs for the same RCU and accordingly it is necessary to erase the last one. If at step ST387 the unser is YES, implying that there are still more sucessive RCs in the RCR, steps ST388-ST390 are successively repeated till all the successive RCs have sequencially been moved up one row. In this case, step ST388 is similar to step ST391 in that both steps serve to erase the last appearing R for which a copy was made in the row thereabove.

FIG. 38A shows the Transfer and Reset Program P31 for the private car elevator system according to the present invention. Referring to the FIG., after entering the program, at step ST600, it is determined whether or not there are any CCs in the CR 4100 (i.e. by monitoring the outputs Q of the flip flops CF1-CFn). If there are CCs in the CCR 4100 (unswer YES), the program is exited at step ST620. If the unswer is NO, the program proceeds to step ST601 where it is determined whether or not the car's doors are closed. Accordingly, the steps ST600 and ST601 in combination are utilized for determining whether or not the car is free (i.e. whether or not there is any person in the car) as well as ensuring that no one can get into the car once the doors are closed. If the unswer is NO (i.e. the doors are not closed), the program proceeds to step ST602, where it is determined whether or not there are any RCs in the RCR 3700 (i.e. by monitoring the Q outputs of the presence flip flops P(1)-P(r)). If the unswer is NO, the program is exited. If the unswer is YES, the program proceeds to step ST603, where it is determined whether the the first row in the RCR is empty or not. If the unswer is YES (i.e. first row in RCR is empty), the program proceeds to step ST618 where a Transfer RCs in RCR one row UP Program P35 is executed, after which the program proceeds to step ST605. The program P35 moves all the RCs in the RCR 3700 up one row, as will be explained later. If at step ST603 the unswer is NO (i.e. first row is not empty), the program proceeds to step ST604, where it is determined whether the STATUS of the RC presently being considered is 0 or 1 (i.e. by monitoring the Q output of the flip flop STATUS1 in the RCR 3700). If at step ST604, the unswer is NO (i.e. STATUS=0), the program proceeds to step ST605, where the Tar program P5 is executed for the RC in the first row of the RCR 3700. The Tar program can be the same as the program P5 of the Single and Multiple Elevator Car Control Systems. However, since only one RC is assigned to the CCR 4100 at any given time, when executing the program P5 the program will proceed through steps ST31, ST32 and ST37, where the arrival time is determined to be Tar=A/V, where A is the distance between the CPP and the RCF# and V is the car's velocity. Accordingly, the Tar program P5 can be simplified to only include the above mentioned steps.

After calculating the arrival time Tar at step ST605, the program proceeds to step ST606, where it is determined whether or not Tar<Td for the RC in row r(1) of the RCR 3700. If the unwer is NO, implying that the car is not sufficiently close to the RCF# with respect to the desired time Td, the program is exited. If the unswer is YES, implying that the car can reach the RCF# before or by the desired time Td, as specified in the Td(1) register, the program proceeds to step ST607 where a command CMD17 is issued, whereby the RCUb corresponding to the RC in the first row r(1) is activated. Next, at step ST608 a reset CODE# command CMD80 is issued, whereby all CODE#s registered in the hall panels are reset (i.e. the flip flops X21-Xnm of the Hall Call Decoder 401 are reset). Accordingly, if any prank CODE#s were registered up till now, these prank CODE#s are erased at step ST608. Next, the program proceeds to step ST609, where the value Treq is determined (Treq=TP+Td). Next, at step ST610, the CPU issues a command CMD78, whereby the value Treq is stored in the Tr register Tr(1). Next, at step ST611, the CPU issues a command CMD79, whereby the status of the STATUS flip flop STATUS1 is changed to 1, after which the program is exited.

If at step ST603 the status value in the STATUS flip flop STATUS1 is determined to be 1, the program proceeds to step ST612, where it is determined whether or not the car has arrived at the RCF# of the RC presently in the first row of the RCR 3700 (i.e. by monitoring the corresponding arrival detecting means). If the car has not arrived yet (i.e. unswer NO at step ST612, the program is exited. If the car has arrived, the program proceeds to step ST613, where the CPU issues a command CMD81, whereby it is determined whether or not the CODE# presently entered (if one is entered) in the control panel of the RCF# corresponds to the RC presently being considered (i.e. the RC in the first row of the RCR 3100). If at step St613 the unswer is NO, implying that either:

1. the car has arrived before the desired time Td;
2. the person responsible for the RC presently in row r(1) did not enter a CODE#; and/or
3. that the wrong CODE# was entered, the program proceeds to step ST615, where it is determined whether or not Tar+5sec>Tp, where the 5 sec represents an extra operator waiting time, whereby the elevator car is allowed to wait an extra 5 sec before proceeding to service the next RC in the RCR. If the unswer is NO, implying that the operator should still be given a chance to enter the correct CODE#, the program is exited (i.e. his RC is not erased). If the unswer is YES, the program proceeds to step ST619, where it is determined whether or not there are any other RCs registered in the RCR 3700 (i.e. by monitoring the Q output of the presence flip flop P(2) in the RCR 3700). If at step ST619 the answer is NO, implying that there are no other RCs presently registered in the RCR 3700, the program is exited, whereby the operator is given even more time to show up and enter his CODEù. If at step ST619 the unswer is YES, the program proceeds to step ST616, where the CPU issues a command CMD80, whereby the flip flops in the control panels of the hall call decoder 401 are reset.

If at step ST613 the answer is YES, implying that the correct CODEù has been entered into the corresponding control panel, the program proceeds to step ST614, where the Drive and Control Unit 45 instructs the car doors to be opened, so that the person waiting in the hall way may enter the same. Next, at step ST616, the CPU issues a command CMD80, whereby, as described above, the CODEù entered into the corresponding control panel is reset. Next, at step ST617, the CPU issues a command CMD180, whereby the presence flip flop P(1) in the first row of the RCR 3700 (i.e. the first RC) is reset, since the command CMD180 is inputted through OR gate D21' directly to the reset terminal of the flip flop P(1), after which the program is exited.

It should be noted that the fact that once it is determined that the elevator car has arrived at the RCFù of the RC presently assigned to the CCR 4100, it is immediately determined whether or not there is a corresponding CODEù registered in the corresponding control panel, and if the correct CODEù is registered, the car doors are instructed to open and provide service. Accordingly, since the elevator car is instructed to proceed to the RCFù immediately upon being free to do so regardless of the time it takes to get there, even though as operator sets his timer for i.e. 20 sec., if the car only takes i.e. 10 sec. to arrive at the RCFù from its last position after having completed serving a previous call, (which implies that the RCUb of the presently being considered RC was activated immediately after having completed serving the previous call), if the operator arrives early i.e. in 8 sec. after his RCUb was activated and enters the proper CODEù into the control panel, as soon as the elevator car arrives at his floor, namely, 10 sec, the doors will be instructed to open and he will be serviced. Further, should the opposite case occur, namely, the operator arrives too late with respect to the desired time Td as set on his RCUb, since the car is instructed to wait, i.e. 5 sec extra (as in step ST615), a little before giving up on the operator and proceeding to the next RC, the operator will still be serviced even when arriving a little late. Further if no other RCs are registered in the RCR 3700, the RC presently being considered is not erased, and the car is instructed to wait for the CODEù to be registered indefinitely, until either the CODEù is registered or until it is determined that another RC has been registered in the CR 3700. In this way the operators are provided with the maximum flexibility.

Figure 39A:
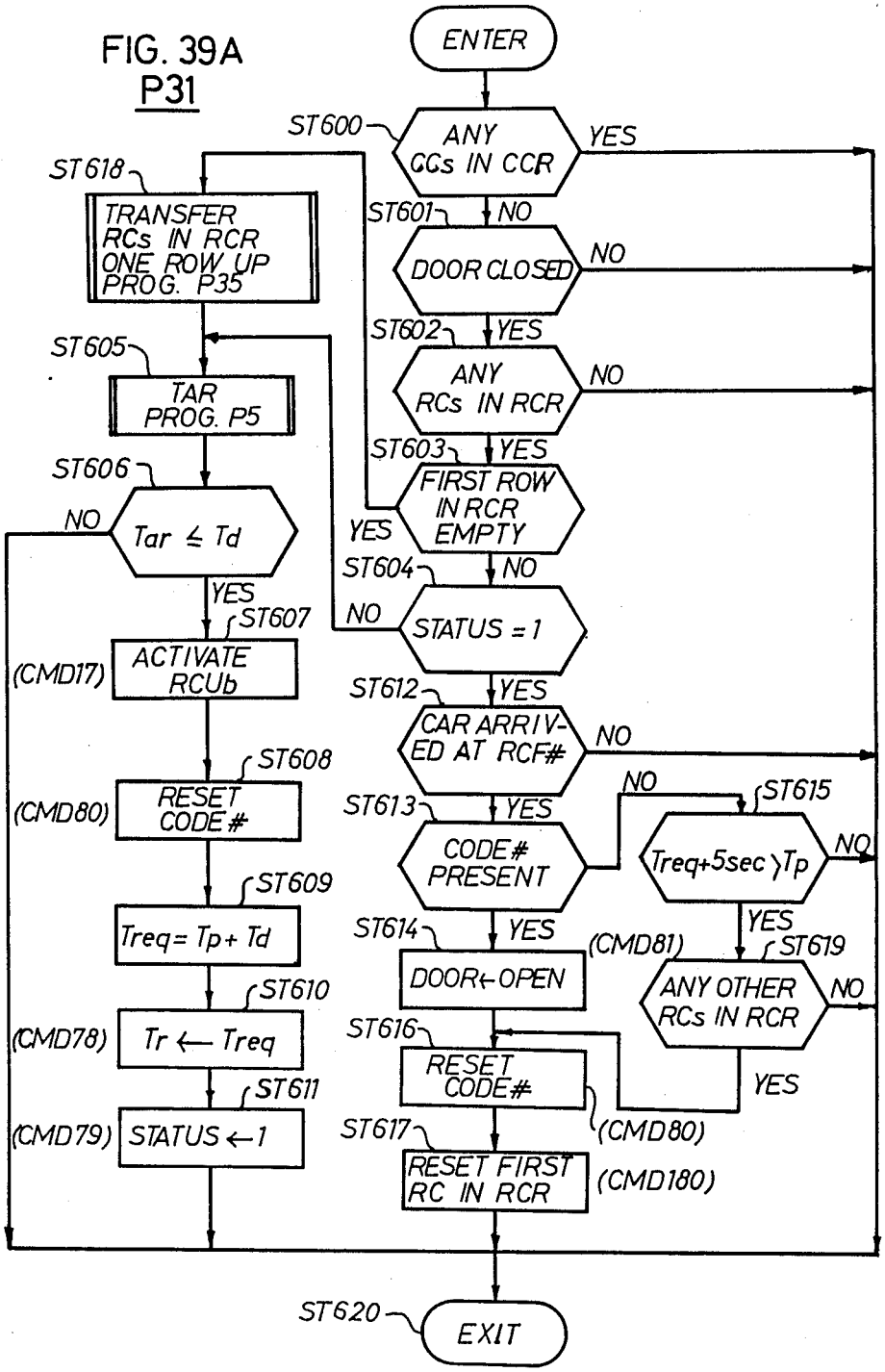
FIG. 39A shows a transfer and reset program P31 of the private elevator control system according to the present invention.

FIG. 39B shows the Transfer RCs in RCR one row Up Program P35 according to the present invention, which is utilized for transferring data from the second row of registers r(2) to the first row of registers r(1), from the third row of registers r(3) to the second row of registers r(2), and so on, in the RCR 3700, once the data stored in the first row of registers r(1) has been erased.

Referring to the program, after entering, at step ST621 all the read registers R(1)–R(r) are set to 0 (i.e. a CMD20 is issued). At step ST622, a command CMD21 is issued, whereby it is determined whether or not there are any RCs in the RCR 3700. If no RCs are present (answer NO), the program is exited at step ST631. If the answer at step ST622 is YES, it implies that at least the second presence register P(2) is set, i.e. Q2=1, and the program proceeds to step ST623. At step ST623 a read command CMD22 is issued, whereby the second read register is set, i.e. R(2)=1, since there is no RC in row r(1), i.e. P(1)=0, and accordingly, when a read command CMD22 is issued, not the first read flip flop R(1) is set, but the second read flip flop R(2) is set. Next, at step ST624, a copy command CMD77 is issued, whereby the Fù and Rù data stored in the second row r(2) registers F(2) and R(2), which presently appears on the respective output lines 141 and 142 (i.e. as signals f2'–fn' and r1'–rm', respectively), due to read flip flop R(2) being set, is copied into the first row r(1) registers Fù(1) and Rù(1), respectively. This is because of the fact that R(2) is high, causing the output of AND gate C62 to be high, which in turn enables AND gates F12 and F22 which allows the data stored in the second row r(2) registers Fù(2) and Rù(2) to appear on the respective output lines 141 and 142. Further, since P(1) is low, when the copy command CMD77 is issued, which enables the AND gates G77 and G78, allowing the data on the output lines 141 and 142 to appear on input lines 131 and 132 as well as setting the presence flip flop P(1), the data in the Fù(1) and Rù(2) registers is copied into the Fù(1) and Rù(1) registers, respectively. Accordingly, since these output lines 141 and 142 are connected through the AND gates G77 and G78 to the respective input lines 31 and 132 when the copy command CMD77 is issued, information present in one row can be copied into any other row or rows, regardless of the row the copying is done from and regardless of the row or rows the information is being copied into.

Next, at step ST625, a second read command CMD22 is issued, which sets the first read flip flop R(1)=1. The reason the R(1) was not set the first time a read command was issued at step ST623 is due to the fact that P(1)=0 at that time. Accordingly, steps ST621–ST625 serve to copy the information stored in the second row r(2) to the first row r(1). At step ST626, it is determined whether or not there are any more RCs in the RCR to be transferred. If at step ST626 the answer is YES, since at this time the condition P(1)=P(2)=R(1)=R(2)=1 has been established, it implies that at least P(3)=1, which means that there is at least one more RC to be transferred up one row, and the program proceeds to step ST627. If at step ST626 the answer is NO, the program proceeds to step ST630. At step ST630, an erase command CMD18 is issued which causes the presence register P(2) to reset, thereby symbolically erasing the RC in the second row r(2), after which tthe program is exited at step ST632. This is necessary since the RC in the second row has already been copied into the first row. By symbolically erased, it is meant that, although the information in the registers of the second row is not actually erased, the fact that the respective second row presence register P(2) is reset, for all purposes the machine assumes that no information is present in that row. Steps ST626–ST629 are utilized to sequentially transfer all subsequent RC stores in the RCR up one row. For facilitating the understanding of these steps, one loop for transferring information from the third row r(3) to the second row r(2) will be described herebelow.

At step ST627, an erase command CMD18 is issued, which for the same reasons as in step ST630, causes the second presence register P(2) to be reset (since at this time, R(1)=R(2)=1 and R(3)−R(r)=0, causing the output of AND gate C62 to be high, which allows P(2) to be reset when the command CMD18 is issued). Next, at step ST628 a read command CMD22 is issued which causes the third read register R(3) to set (since R(1)=R(2)=1 at this time). Next, at step ST629, a copy command CMD77 is issued which causes the information stored in row r(3) to be copied into the second row r(2) for similar reasons as were explained for step ST624. After step ST629 the program returns to step St626 where it is again determined whether or not all the RCs in the RCR have been transferred up one row. This process is repeated till it is determined that all the RCs have been transferred up one row, at which time the program proceeds to step ST630, where the last set presence register is reset, after which the program is exited at step ST632.

FIG. 40 shows the Supervisory Program P32 according to the present invention. Referring to the FIG., after entering the program, at step ST640 it is determined whether or not the car is misued (i.e. by monitoring the output of the Car Misuse Detector 402. If the answer is YES, the program proceeds to step ST641, where it is determined whether or not the car is empty (i.e. whether or not there are any passengers in the car, by monitoring the output of the Car Weight Detector 402). If at step ST641 it is determined that the car is not empty (i.e. answer NO), the program proceeds to step ST642 where the CPU instructs the Drive and Control Unit 45 to open the door or to keep it open if its already open. Next, at step ST643, the car is instructed not to go anywhere, i.e., DIR=NONE, and at step ST644, a reset command CMDOO is issued whereby any CCs in the CCR 4100 are reset, after which the program is exited. If at step ST641 the answer is YES (i.e. the car is empty), the program proceeds to step ST645, where the CPU instructs the Control unit 45 to close the car's doors, after which the program proceeds to step ST643. Accordingly, should it be determined that a person or persons are misusing the elevator car (at step ST640) and that that person is still in the car (at step ST641), the car door is opened and is instructed to stay open until the person misusing the car gets out, at which time the car's doors are instructed to close (at step ST645). Only when the person or persons misusing the car gets out of the car and the car's doors are allowed to completely close, implying that the person misusing the car has no chance of getting back into the car, is the misuse condition of the misuse detector 403 reset (as explained above). Accordingly, the next time that program is executed, at step ST640, it will be determined that the car is not misused (answer NO) and the program will proceed to step ST646 where it is determined whether or not the car is empty. If the answer is NO, the program proceeds to step ST647 where it is determined whether or not there are any CCs presently registered in the CCR 4100. If there are no CCs presently registered in the CCR (i.e. answer NO), the program proceeds to step ST648, where the car's doors are instructed to stay open and next, at step ST649, the car's direction is set as NONE (i.e. don't go anywhere), after which the program is exited. Accordingly, if a operator gets into the car after entering the correct CODEù, unless he enters a CC inside the car, the car's doors are instructed to stay open and the car doesn't go anywhere. Accordingly, the doors are instructed to stay open and the car instructed not to go anywhere whenever:

1. a person is in the car and a misuse condition exists; or 2. a person is in the car and no RC is registered in the RCR.

It should be noted that a door-open-over-time condition can be included, whereby once it is detected that the doors stay open for more than i.e. 5 sec., a buzzer is activated, thereby preventing users from keeping the car at any given Fù for more then a given time, so that other users may be serviced.

If at step ST646 it is determined that the car is empty (answer YES), the program proceeds to step ST650, where it is determined whether or not the car's doors are closed. If the answer is NO, the program proceeds to step ST651 where the car's doors are instructed to close, after which the program is exited. Accordingly, if a person, after being service, just got out of the car, the program proceeds to steps St646, St650 and St651, whereby the car's doors are closed, so that the car may be instructed to service the next RC, if such a RC is registered in the RCR. If at step ST650 the answer is YES, the program proceeds to step ST652 where a command CMDOO is issued, whereby any CCs presently registered in the CCR 4100 are reset. Namely, since the car is empty, there should be no CCs registered in the CCR and if there are CCs registered, it implies that the last operator to use the elevator car is just trying to make trouble, and, accordingly, these CCs are reset. Next, at step ST653, it is determined whether or not any RCs are presently registered in the RCR 4100. If the answer is NO, the program proceeds to step ST654 where the car's direction is set to NONE, after which the program is exited. Specifically, since there are presently no CCs in the CCR (step ST652) and no RCs in the RCR (step ST653), there is no demand for the car, and, accordingly, the car is instructed to stay where it is (at the Fù that the last operator to utilize the car out at) with the doors thereof being closed, so that no people in the hall can indiscriminately utilize the car.

If at step ST653 the answer is YES,, the program proceeds to step ST655 where it is determined whether or not the first row in the RCR is empty (i.e. by monitoring the output Q of flip flop P(1)). If at step ST655 the answer is YES (i.e. P(1)=0), the program proceeds to step ST656 where the Transfer RCs in the RCR One Row UP Prog. P35 is executed, after which the program proceeds to step ST657. If at step ST655 the answer is NO, the program proceeds to step ST657. At step ST657 it is determined whether or not the RCFù of the RC in row r(1) is higher then the CPP (i.e. car's present position). If the answer is YES, the program proceeds to step ST658 where the car's direction in the Supervisory System Register is assigned the UP direction. If it is determined that the RCFù=CPP (i.e. the car is presently at the RCFù), the program proceeds to step ST659 where the car is assign a NONE direction (i.e. the car is instructed not to go anywhere). If the answer is NO, the program proceeds to step ST660 where the car is assigned a DOWN direction. After steps ST658–St660 the program is exited at step ST667.

If at step ST647 the answer is YES, (implying that the car is not misused, the car is not empty and that there are CCs presently registered in the CCR), the program proceeds to step ST661, where the CPP is determined. Next, at step ST662 the car's presently assigned direction is determined (i.e. by monitoring the output of the Supervisory System Register. If it is determined that the car's presently assigned direction is NONE or UP, the program proceeds to step ST663, where it is determined whether or not any of the CCs presently registered in the CCR 4100 are from floor higher than the CPP (any CCscCPP, by monitoring the Q outputs of the flip flops CF1–CFn which are above the CPP). If the answer is YES, the program proceeds to step St665, where the car is assigned an UP direction. If the answer is NO, the program proceeds to step ST664, where the car is assigned a DOWN direction. Accordingly, if the car's presently assigned direction is UP, if it is determined that there are still RCs above the CPP, the direction is not changed and the car is instructed to continue to provide service in the up direction. Further, if it is determined that there are no RCs above the CPP, the direction is changed from UP to DOWN, and the car is instructed to provide service in the DOWN direction. Further, if the car is presently not assigned any direction (i.e. DIR=NONE), if it is determined that there are CCs present above the CPP, the car is assigned an up direction and if not, the car is assigned a DOWN direction. If at step ST662 the car's presently assigned direction is determined to be DOWN, the program proceeds to step St666, where it is determined whether or not there are and CCs presently registered in the CCR from floors lower than the CPP. If the answer is NO, the program proceeds to step ST665, where the cars assigned direction is changed to DOWN. If at step ST666 the answer is YES, the program is exited at step ST667 (i.e. the assigned DOWN direction is not changed).

Figure 28A:
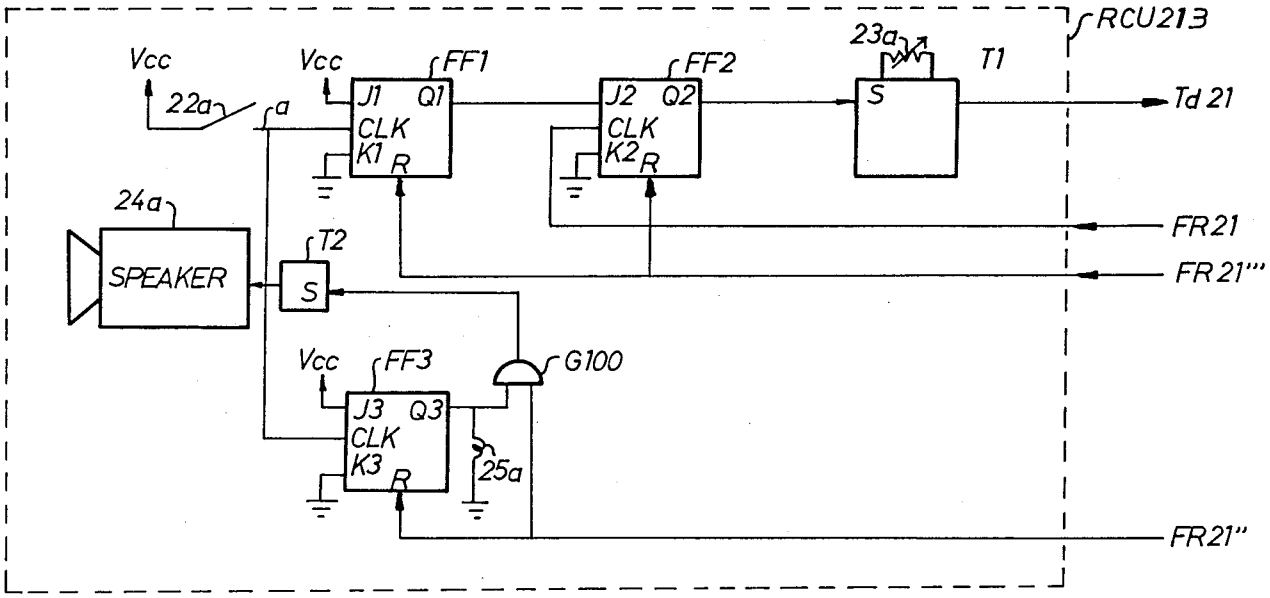
FIG. 28A shows a second embodiment of the room call unit which enables the elevator control system to reset the unit immediately after the unit is monitored according to the present invention.
Figure 28B:
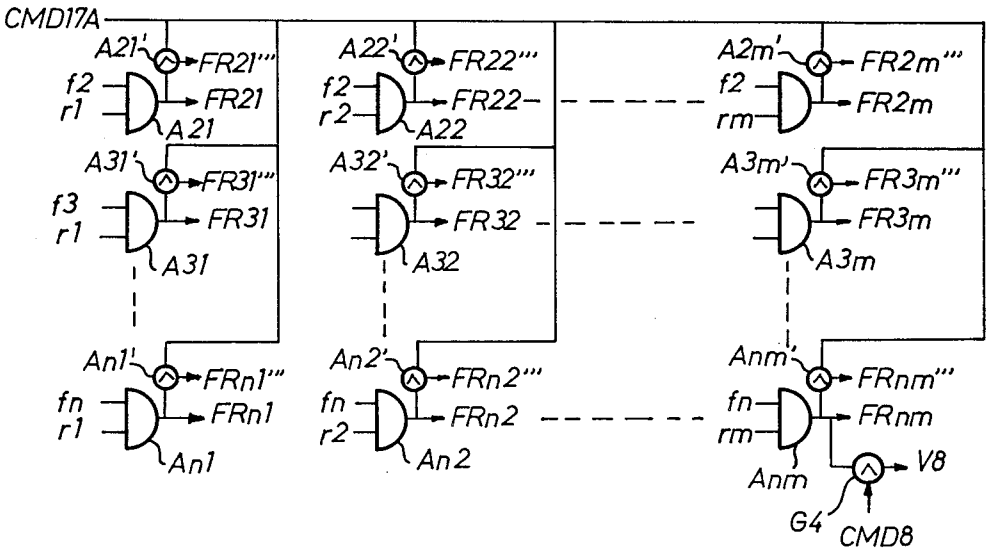
FIG. 28B shows the modification to a part of a multiplexer 30 necessary for incorporating the RCU shown in FIG. 28A and 37A.

FIG. 28 shows a second embodiment RCU21B of the room call unit RCU21 according to the present invention, which further enables the elevator control system to reset the RCU soon after the monitoring thereof and to activate the RCU's buzzer when the conditions specified by the setting of the RCU't timer can be satisfied. FIG. 28B shows the modification required to the multiplexer 30 for generating the RCU's reset signals FR21'''-FRnm''' when a command CMD17A is issued. Accordingly, with this second embodiment of the RCUs, the signal FR21''-FRnm'' are only utilized for activating the respective RCU's buzzers, as well as for turning of respective light indicating means 25*a* off. Accordingly, the light activating means 25*a* not only serve to indicate to the respective operators thereof that they have a RC entered which is presently being considered by the control system, but also that a car will provide service at the desired time setting on there respective RCUs from the time that the respective light indication means are reset. Accordingly, both visual and audio indicators are provided. Refering to the FIGS., numeral FF3 designates a flip flop, numeral 25*a* light bulb, numeral G100 and AND gate, numeral FR21''' a RCU's reset signal and numeral FR21'' a RCU's buzzer activation and light reset signal (hereinafter referred to as RCUb signal). The flip flop FF3 is set upon the closure of the switch 22*a* causing the light 25*a* to light, and is reset upon the RCUb signal FR21'' going high. The AND gate G100 allows the speaker 24*a* to be activated only when the FF3 is set and the signal FR21'' goes high and is useful for the case where no STATUS value is utilized by the control system. In FIG. 28B, numerals A21'-Anm' designate AND gates for providing the signals FR21'''-FRnm'''. These signals are provides just after the multiplexer 30 and associated software determine the desired time setting of each activated RCU (as set by the respective timers therein) when a command CMD17A is issued by the CPU. Accordingly, the monitor signal FR21–FRnm which is presently high, indicating the RCU RCU21B–RCUnmB being monitored, allows the respective reset signal FR21'''-FRnm''' to go high when the command CMD17A is issued, causing the just monitored RCU to be reset.

Figures 3A, 3B:
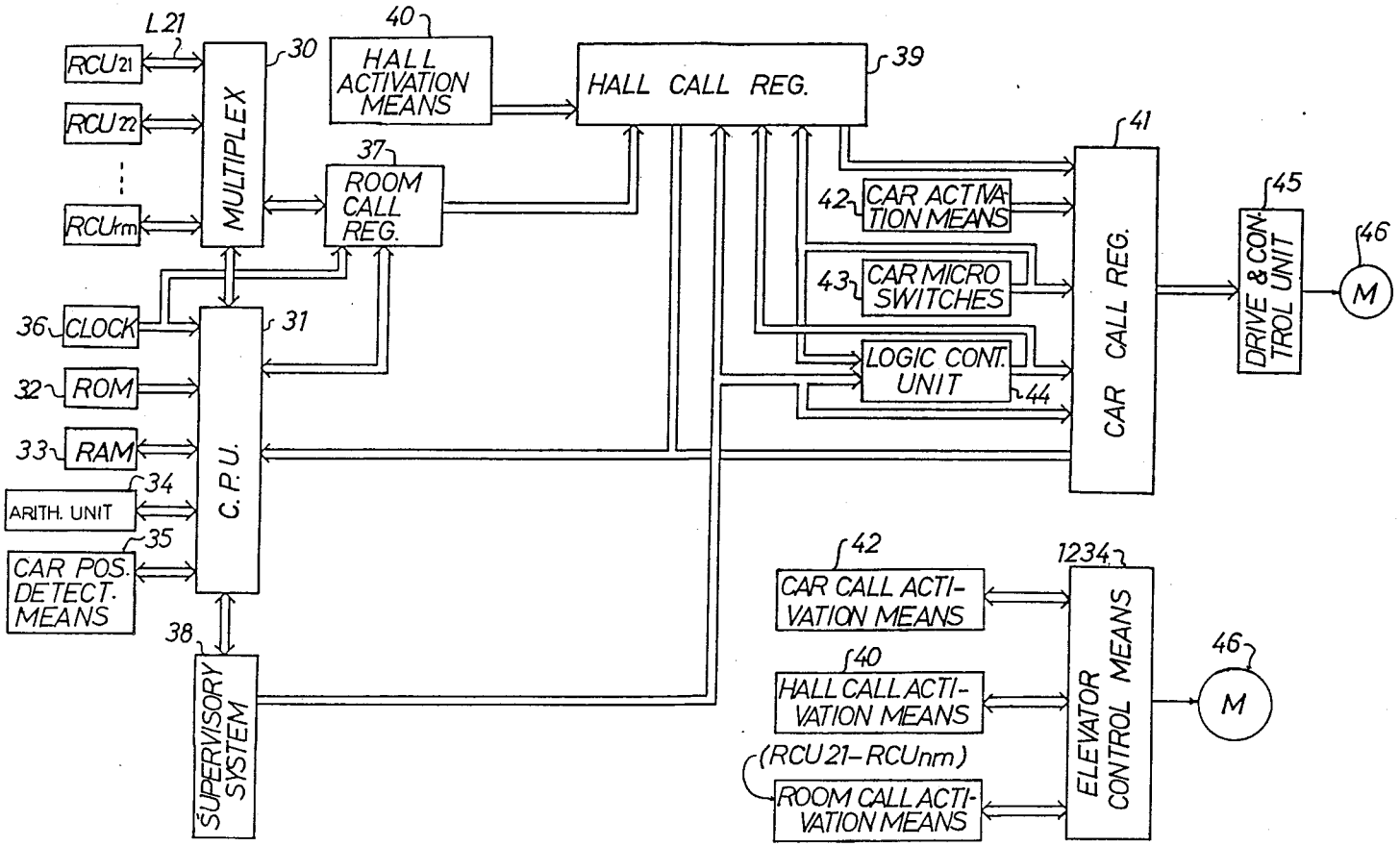
FIGS. 3A and 3B show block diagrams of a Single Car Elevator Control System, which utilize the room call units shown in FIG. 1, according to the present.

FIG. 3A shows a general block diagram of the elevator control system according to the present invention. Refering to the FIG., numeral 42 designates a car call registering means for entering car calls from within a car, numeral 40 desiganates a hall call registering means for entering hall calls from the respective elevator halls of a building, numeral RCU21–RCUnm designates a room call registering means for entering room calls from within a the respective room of the building, numeral 1234 designates an elevator control means for controling an elevator car 46 in response to the activated states of said activation means. FIG. 3B shows a block diagram which shows in greater detail the elevator control system shown in FIG. 3A.

What is claimed is:

1. An elevator control system which comprises:

an elevator car (46) for transporting people up and down in a building;

car call registering means (42) located inside the car for registering car calls from within the car; of the building for registering hall calls from the halls of the building;

room call registering means (RCU21–RCUnm) located in respective rooms of the building for registering respective room calls from the respective rooms of the building, the registered room calls indicating to the elevator control system that the person registering the room call would like to utilize the elevator car from the floor number that the room call originated from at a desired time from the time that a room call registering means is activated; and elevator control means (1234) for controlling said car in response to the registered calls entered through said activation means;

2. An elevator control system as recited in claim 1, wherein said room call activation means comprises a plurality of room control units, each of which is placed in a respective room of a building, said room control units comprising:

activation means for registering a room call;

desired time setting means for selectively setting a desired time that the elevator car is desired to be utilized from the time that said activation means was activated;

audio signal generating means for allowing the elevator control system to indicate to the operator of the room control unit that the elevator car will be available at the hall of the floor that the respective room call unit is located on at the desired time set on the desired time setting means from the time that the audio signal generating means is activated by the elevator control system; and room call unit reset means for reseting the activated state of the respective room call units when respective room call unit reset signals are provided by said control means.

3. An elevator control system as recited in claim 2, wherein each of said room call units further comprises:

manual reseting means for allowing the operator thereof to reset a previously entered room call.

4. An elevator control system as recited in claim 2, wherein each of said room call units further comprises:

visual indication means for allowing the operator thereof to visually note the activated state of the room call unit.

5. An elevator control system as recited in claim 2, wherein each of said room call units further comprises:

visual displaying means for visually indicating the waiting turn that an activated room call unit has been assigned by the elevator control system.

6. An elevator control system as recited in claim 2, wherein said control means compises:

means for monitoring whether or not the respective room call units RCUs are activated;

room call storing means for storing information representative of the room number Rù and floor number Fù from which each registered room call originated from, and information representative of the desired time that the respective desired time setting means was set at the time each room call was registered of the room call units which are determined to be activated;

car position detecting means for detecting the present position of the car;

car arrival time determining means for determining the time required for the car to go from its present position to the floor number of each registered room call (RCFù);

means for determining whether or not the car can arrive at the room call's floor number (RCFù) before the desired time Td;

means for determining whether or not the car can arrive at the room call's floor number at the desired time Td;

means for determining that the car can not arrive at the room call's floor number by the desired time Td;

means for activating the respective audio signal generation means of the respective room call units as defined by the floor number Fù and room number Rù information stored in said storing means represetative of respective registered room calls;

means for generating reset signals for reseting the respective activated room call units; and means for assigning the respective floor numbers Fùs of the respective registered room calls to the car.

7. A car elevator control system as recited in claim 6 wherein, when it is determined that the car can arrive at the floor number of a registered room call before the desired time Td:

activating the respective audio signal generating means of the room call unit corresponding to that room call.

8. A car elevator control system as recited in claim 6 wherein, when it is determined that the car can arrive at the floor number of a room call at the desired time Td:

activating the respective audio signal generating means of the room call unit corresponding to that room call; and allocating the car to that room call's floor number.

9. A car elevator control system as recited in claim 6 wherein, when it is determined that the car can not arrive at the room call's floor number of a registered room call by the desired time Td:

assigning the floor number of that room call to the car, so that the car may start to advance towards the floor number specified by that room call when it is available to do so.

10. An elevator control system according to claim 1, wherein said hall call registering means comprises:

hall call activation means for entering CODEù representative of the room numbers from which the room calls are genterated from; and a hall code decoding means for decoding the CODEù entered through said hall code activation means, so that when the right CODEù is entered said elevator control system provides service.

11. An elevator control system according to claim 1, wherein said control means comprises:

a misuse detecting means for determining whether or not the car is being misued.

12. An elevator control system according to claim 1, wherein said control means further comprises:

room call assigning means for assigning only one room call entered through said room call actiavation means to said car, so that the car services only one call at any given time.

13. An elevator control system as recited in claim 1, wherein said elevator control means comprises:

a drive and control unit driving said motor;

a car call register for storing registered car calls entered through said call call activation means;

a hall call register for storing registered hall calls entered through said hall call activation means;

a room call register for storing registered room calls entered through said room call activation means;

a central processing unit CPU;

a random access memory for storing information;

a read only memory for storing programs to be executed by said CPU;

a clock for generating the present time;

an arithmetic unit;

car position detecting means for detecting the present position of the car; and car arrival detecting means for detecting the arrival of the car at the floors of the building.

14. An elevator control system as recited in claim 1, wherein said elevator control means further comprises:

a multiplexer for generating monitor signals for sequencially monitoring said room call activation means for room calls and for entering into said room call register any registered room calls.

15. An elevator control system as recited in claim 2, wherein:

when a room call is registered, said elevator control means instructs said car to proceed to the floor number from which said registered room call originated from.

16. An elevator control system as recited in claim 2, wherein:

said control means comprises a multiplexer, said multiplexer generating monitoring signals for sequencially monitoring the room control units, said multiplexer monitoring each room call unit for a first short period of time if it is determined that the room call unit being monitored is not activated, and monitoring each room call unit for the duration that a signal from the monitored room call unit is high, said signal from said room call unit being high indicating to said multiplexer that the room call unit being monitored has been activated and the duration that said signal from said room call unit is high being representative of the desired time setting to which the desired time setting means of the room call unit being monitored is set to.

17. A multiple car elevator control system comprising:

an plurality of elevator cars for transporting people up and down in a building;

car call registering means located inside the respective cars for registering car calls from within the cars;

hall call registering means (40) located in the hallways of the building for registering hall calls from the halls of the building;

room call registering means (RCU21–RCUnm) located in respective rooms of the building for registering respective room calls from the respective rooms of the building, the registered room calls indicating to the elevator control system that the person registering the room call would like to utilize an elevator car from the floor number that the room call originated from at a desired time from the time that a room call registering means is activated; and elevator control means for controlling said cars in response to the registered calls entered through said activation means.

18. An elevator control system as recited in claim 17, wherein said room call activation means comprises a plurality of room control units, each of which is placed in a respective room of the building said room control units comprising:

activation means for registering a room call;

desired time setting means for selectively setting a desired time that the elevator car is desired to be utilized from the time that said activation means is activated;

audio signal generating means for allowing the elevator control system to indicate to the operator of the room control unit that the elevator car will be available at the hall that the respective room call unit is located on at the desired time set on the desired time setting means from the time that the audio signal generating means is activated by the elevator control system; and room call unit reset means for reseting the activated state of the respective room call units when respective room call unit reset signals are provided by said control means.

19. An elevator control system as recited in claim 17, wherein each of said room call units further comprises:

visual indication means for allowing the operator thereof to visually note the activated state thereof.

20. An elevator control system as recited in claim 17, wherein each of said room call units further comprises:

visual displaying means for visually indicating the waiting turn that an activated room call unit has been assigned by the elevator control system.

21. An elevator control system as recited in claim 18, wherein said control means comprises:

means for monitoring whether or not the respective room call units RCUs are activated;

room call storing means for storing information representative of the room number Rù and floor number Fù from which each registered room call originated from, and information representative of the desired time that the respective desired time setting means was set to at the time each room call was registered of the room call units which are determined to be activated;

car position detecting means for detecting the present position of the cars;

car arrival time determining means for determining the time required for each car in said cars to go from its present position to the floor number of each registered room call (RCFù);

means for determining whether or not any of the cars can arrive at the room call's floor number (RCFù) before the desired time Td;

means for determining whether or not the any of cars can arrive at the room call's floor number at the desired time Td;

means for determining which cars in said cars can not arrive at the room call's floor number by the desired time Td;

means for storing the arrival times of the cars which are determined not to be able to arrive at the room call's floor number by the desired time Td;

means for activating the respective audio signal generation means of the respective room call units as defined by the floor number Fù and room number Rù information stored in said storing means represetative of respective registered room calls;

means for generating reset signals for reseting the respective activated room call units; and means for assigning the respective floor numbers Fùs of the respective registered room calls to the respective cars.

22. A multiple car elevator control system as recited in claim 21 wherein, when it is determined that at least one of the cars can arrive at the room call's floor number of a registered room call before the desired time Td:

activating the respective audio signal generating means of the room call unit corresponding to that room call.

23. A multiple car elevator control system as recited in claim 21 wherein, when it is determined that none of the cars can arrive at the room call's floor number of a registered room call before the desired time Td and that at least one of the cars can arrive at the room's calls floor number at the desired time Td:

activating the respective audio signal generating means of the room call unit corresponding to that room call; and allocating one of the cars which is determined to be able to arrive at that room call's floor number at the desired time to that room call.

24. A multiple car elevator control system as recited in claim 21 wherein, when it is determined that none of the cars can arrive at the room call's floor number of a registered room call by the desired time Td:

allocating the car in said cars which is determined to be able to arrive at that room call's floor number the fastest.

25. An elevator control system as recited in claim 17, wherein said elevator control means comprises:

a drive and control unit driving unit motor;

a car call register for storing registered car calls entered through said call call activation means;

a hall call register for storing registered hall calls entered through said hall call activation means;

a room call register for storing registered room calls entered through said room call activation means;

a central processing unit CPU;

a random access memory for storing information;

a read only memory for storing programs to be executed by said CPU;

a clock for generating the present time;

an arithmetic unit;

car position detecting means for detecting the present position of the car; and car arrival detecting means for detecting the arrival of the car at the floor of the building.

26. An elevator control system as recited in claim 1, wherein said room call registering means only registers room calls for the down direction.

27. An elevator control system as recited in claim 17, wherein said room call registering means only registers room calls for the down direction.

* * * * *